US009534756B2

(12) United States Patent
Takahira et al.

(10) Patent No.: US 9,534,756 B2
(45) Date of Patent: Jan. 3, 2017

(54) LIGHT-EMITTING DEVICE, FLOODLIGHT, AND VEHICLE HEADLIGHT

(71) Applicant: SHARP KABUSHIKI KAISHA, Osaka-shi (JP)

(72) Inventors: Yoshiyuki Takahira, Osaka (JP); Koji Takahashi, Osaka (JP); Yosuke Maemura, Osaka (JP); Hiroshi Kijima, Osaka (JP); Tomohiro Sakaue, Osaka (JP)

(73) Assignee: SHARP KABUSHIKI KAISHA, Osaka-shi (JP)

( * ) Notice: Subject to any disclaimer, the term of this patent is extended or adjusted under 35 U.S.C. 154(b) by 737 days.

(21) Appl. No.: 13/853,785

(22) Filed: Mar. 29, 2013

(65) Prior Publication Data

US 2013/0258689 A1 Oct. 3, 2013

(30) Foreign Application Priority Data

| | | |
|---|---|---|
| Apr. 3, 2012 | (JP) | 2012-084983 |
| May 9, 2012 | (JP) | 2012-107960 |
| Jul. 6, 2012 | (JP) | 2012-153098 |
| Jul. 6, 2012 | (JP) | 2012-153103 |

(51) Int. Cl.
*F21S 8/10* (2006.01)
*F21V 14/00* (2006.01)
(Continued)

(52) U.S. Cl.
CPC ..... *F21S 48/115* (2013.01); *F21S 48/1145* (2013.01); *F21S 48/17* (2013.01);
(Continued)

(58) Field of Classification Search
CPC .... F21S 48/17; F21S 48/1145; F21S 48/1721; F21S 48/1757; F21S 48/115; F21V 9/16; F21V 7/06; F21V 14/06; F21V 14/00; F21V 29/74; F21V 2200/13; F21V 29/006; F21V 5/008; F21V 7/0033; F21Y 2105/001; F21Y 2101/025; F21Y 2115/10; F21Y 2105/10; F21Y 2115/30; F21Y 2101/00
See application file for complete search history.

(56) References Cited

U.S. PATENT DOCUMENTS

| | | | |
|---|---|---|---|
| 5,642,373 | A | 6/1997 | Kamizato et al. |
| 7,510,300 | B2 | 3/2009 | Iwauchi et al. |

(Continued)

FOREIGN PATENT DOCUMENTS

| | | |
|---|---|---|
| JP | 57-97502 | 6/1982 |
| JP | 8-139412 | 5/1996 |

(Continued)

OTHER PUBLICATIONS

Takahira et al. U.S. Office Action mailed Oct. 24, 2014, directed to U.S. Appl. No. 13/855,483; 15 pages.

(Continued)

*Primary Examiner* — Stephen F Husar
*Assistant Examiner* — Danielle Allen
(74) *Attorney, Agent, or Firm* — Morrison & Foerster LLP

(57) ABSTRACT

A light-emitting device includes a light-emitting section, a lens, and a movement control section, the movement control section changing an illumination position and a spot size of a laser beam in the light-emitting section by changing a relative position of the lens with respect to the light-emitting section.

17 Claims, 63 Drawing Sheets

(51) Int. Cl.

| | |
|---|---|
| ***F21V 7/06*** | (2006.01) |
| ***F21V 9/16*** | (2006.01) |
| ***F21V 14/06*** | (2006.01) |
| *F21V 29/00* | (2015.01) |
| *F21V 5/00* | (2015.01) |
| *F21V 7/00* | (2006.01) |
| *F21V 29/74* | (2015.01) |
| *F21Y 101/00* | (2016.01) |

(52) U.S. Cl.
CPC ..... *F21S 48/1721* (2013.01); *F21S 48/1757* (2013.01); *F21V 7/06* (2013.01); *F21V 9/16* (2013.01); *F21V 14/00* (2013.01); *F21V 14/06* (2013.01); *F21V 5/008* (2013.01); *F21V 7/0033* (2013.01); *F21V 29/006* (2013.01); *F21V 29/74* (2015.01); *F21V 2200/13* (2015.01); *F21Y 2101/00* (2013.01); *F21Y 2105/10* (2016.08); *F21Y 2115/10* (2016.08); *F21Y 2115/30* (2016.08)

(56) References Cited

U.S. PATENT DOCUMENTS

| | | | |
|---|---|---|---|
| 7,576,845 | B2 | 8/2009 | Asakura et al. |
| 8,743,158 | B2 | 6/2014 | Kang |
| 2002/0196639 | A1 | 12/2002 | Weidel |
| 2004/0041997 | A1 | 3/2004 | Uomori et al. |
| 2004/0189447 | A1 | 9/2004 | Okubo et al. |
| 2004/0218401 | A1 | 11/2004 | Okubo et al. |
| 2006/0239024 | A1 | 10/2006 | Valcamp et al. |
| 2007/0002283 | A1 | 1/2007 | Shimada |
| 2007/0189352 | A1 | 8/2007 | Nagahama et al. |
| 2007/0201241 | A1 | 8/2007 | Komatsu |
| 2008/0062709 | A1 | 3/2008 | Mochizuki et al. |
| 2008/0084905 | A1 | 4/2008 | Doerfel et al. |
| 2008/0094619 | A1 | 4/2008 | Nakaji |
| 2008/0316759 | A1 | 12/2008 | Valcamp et al. |
| 2011/0032717 | A1 | 2/2011 | Kamitani et al. |
| 2011/0122638 | A1 | 5/2011 | Konishi |
| 2011/0148280 | A1 | 6/2011 | Kishimoto et al. |
| 2011/0235356 | A1 | 9/2011 | Sato et al. |
| 2011/0249460 | A1* | 10/2011 | Kushimoto ..... 362/510 |
| 2011/0280039 | A1 | 11/2011 | Kishimoto |
| 2012/0057364 | A1 | 3/2012 | Kishimoto et al. |
| 2012/0069593 | A1 | 3/2012 | Kishimoto et al. |
| 2012/0106183 | A1 | 5/2012 | Takahashi |
| 2012/0106189 | A1 | 5/2012 | Takahashi et al. |
| 2012/0299476 | A1 | 11/2012 | Roberts et al. |
| 2013/0027962 | A1 | 1/2013 | Takahashi et al. |
| 2013/0265561 | A1 | 10/2013 | Takahira et al. |

FOREIGN PATENT DOCUMENTS

| | | |
|---|---|---|
| JP | 2003-45210 | 2/2003 |
| JP | 2004-210130 | 7/2004 |
| JP | 2005-283290 | 10/2005 |
| JP | 2007-140109 | 6/2007 |
| JP | 2007-227228 | 9/2007 |
| JP | 2008-71555 | 3/2008 |
| JP | 2008-143505 | 6/2008 |
| JP | 2008-537315 | 9/2008 |
| JP | 2009-184463 | 8/2009 |
| JP | 2009-204459 | 9/2009 |
| JP | 2010-45274 | 2/2010 |
| JP | 2010-95205 | 4/2010 |
| JP | 2011-37337 | 2/2011 |
| JP | 2011-37343 | 2/2011 |
| JP | 2011-113668 | 6/2011 |
| JP | 2011-124088 | 6/2011 |
| JP | 2011-134619 | 7/2011 |
| JP | 2011-157022 | 8/2011 |
| JP | 2011-157023 | 8/2011 |
| JP | 2011-198720 | 10/2011 |
| JP | 2011-222238 | 11/2011 |
| JP | 2011-222260 | 11/2011 |
| JP | 2012-9355 | 1/2012 |

OTHER PUBLICATIONS

Takahira et al., U.S. Office Action mailed Jul. 2, 2015, directed to U.S. Appl. No. 14/721,802; 14 pages.

* cited by examiner

LIGHT-EMITTING DEVICE, FLOODLIGHT, AND VEHICLE HEADLIGHT

This Nonprovisional application claims priority under 35 U.S.C. §119 on (i) Patent Application No. 2012-084983 filed in Japan on Apr. 3, 2012, (ii) Patent Application No. 2012-153103 filed in Japan on Jul. 6, 2012, (iii) Patent Application No. 2012-107960 filed in Japan on May 9, 2012, and (iv) Patent Application No. 2012-153098 filed in Japan on Jul. 6, 2012, the entire contents of which are hereby incorporated by reference.

TECHNICAL FIELD

The present invention relates to a light-emitting device, a floodlight, and a vehicle headlight each being capable of emitting light in response to an excitation light beam. The present invention also relates to a lighting device and a vehicle headlight each being capable of using, as a part of illuminating light, fluorescence that is generated by emission of an excitation light beam to a fluorescent body.

BACKGROUND ART

In recent years, researches have been actively made into a light-emitting device which uses, as illuminating light, fluorescence that a light-emitting section containing a fluorescent body generates in response to an excitation light beam emitted from a semiconductor light emitting element such as a light emitting diode (LED) or a semiconductor laser (LD: Laser Diode).

A technique related to such a light-emitting device is exemplified by light-emitting devices disclosed in Patent Literatures 1 through 4.

Patent Literature 1 allows a vehicle headlamp having variable lighting characteristics to be mechanically simply structured and improves obstacle resistance and response speed. Patent Literature 2 discloses a headlight which, while restraining an enlargement, is capable of (i) reducing electric power consumption and (ii) forming desired density in a light-distribution pattern. Patent Literature 3 discloses a vehicle lamp capable of electrically switching between a horizontally wide light-distribution pattern and a light-distribution pattern suitable for AFS (Adaptive Front-lighting System) casting light beams leftward and rightward. Patent Literature 4 discloses a light source device which prevents a device from getting large-sized, increasing in weight, and getting high in manufacturing cost even in the light source device equipped with a function of varying light distribution.

In other words, the techniques of Patent Literatures 1 through 4 can also be as described below.

The vehicle headlamp of Patent Literature 1 includes a plurality of laser elements, a light collecting lens which collects light emitted from the respective plurality of laser elements, and a drive electronic circuit which causes the plurality of laser elements to selectively emit light. This allows lighting characteristics of the vehicle headlamp to comply with a running drive condition and an ambient condition.

The headlight of Patent Literature 2 includes an emission unit which emits, by performing scanning, light from a respective plurality of laser elements in accordance with a determined light-distribution pattern. This allows formation of a desired light-distribution pattern. Further, since this headlight includes an output adjusting section which adjusts respective outputs of the plurality of laser elements, density can be formed in a light-distribution pattern.

Note that Patent Literatures 1 and 2 disclose that the plurality of laser elements may be replaced with a plurality of LEDs.

According to the vehicle lamp of Patent Literature 3, a projection lens and a horizontally long surface light source including a plurality of LEDs are disposed so that respective optical axes thereof are inclined by a given angle with respect to an axis extending in a front-to-rear direction of a vehicle. According to this, in a case where an LED on the outer side than a focal point of the projection lens is on, the horizontally wide light-distribution pattern is realized. Meanwhile, in a case where an LED on the inner side than the focal point of the projection lens is on, the light-distribution pattern suitable for AFS (Adaptive Front-lighting System) casting light beams leftward and rightward can be realized. Namely, it is possible to switch between the foregoing two light-distribution patterns.

The light source device of Patent Literature 4 includes light control means for changing an emission range and/or a light intensity distribution of an excitation light beam emitted from a solid light source to a fluorescent body. This allows a light distribution to be variable by a simple method.

CITATION LIST

Patent Literature 1

Japanese Patent Application Publication, Tokukai, No. 2003-45210 (Publication Date: Feb. 14, 2003)

Patent Literature 2

Japanese Patent Application Publication, Tokukai, No. 2011-157022 A (Publication Date: Aug. 18, 2011)

Patent Literature 3

Japanese Patent Application Publication, Tokukai, No. 2011-113668 A (Publication Date: Jun. 9, 2011)

Patent Literature 4

Japanese Patent Application Publication, Tokukai, No. 2011-134619 A (Publication Date: Jul. 7, 2011)

SUMMARY OF INVENTION

Technical Problem

However, the techniques described in Patent Literatures 1 through 4 have the following problems.

Namely, since for example, the vehicle headlamp of Patent Literature 1 includes no light-emitting section that emits light in response to a laser beam, the vehicle headlamp has no color rendering property that is sufficient for use in a vehicle headlamp, and it is difficult for, for example, the vehicle headlamp of Patent Literature 1 to vary a light-distribution pattern.

The techniques of Patent Literatures 1 through 4 also have the following problems.

According to the techniques of Patent Literatures 1 through 4, it is disclosed that a laser element, an LED, or the like is used as a light source, whereas it is not disclosed that a plurality of kinds of light sources are used for one device.

Namely, according to the techniques of Patent Literatures 1 through 4, no lamp is disclosed that is provided with both a laser element and an LED.

Therefore, none of the techniques of Patent Literatures 1 through 4 make it possible to control respective light-distribution characteristics of light sources which differ in principle of light emission.

The present invention has been made in view of the problems, and an object of the present invention is to provide a light-emitting device, a floodlight, and a vehicle headlight each of which (i) has a color rendering property that is sufficient for use in a vehicle headlamp and (ii) allows a light-distribution pattern to be variable.

Further, the present invention has been made in view of the problems, and an object of the present invention is to provide a lighting device and a vehicle headlight each of which is capable of controlling light-distribution characteristics and a light intensity distribution by emission of illuminating light in a range of floodlighting having a desired area by use of a laser light source and a light source other than the laser light source.

Solution to Problem

In order to attain the object, (1) a light-emitting device in accordance with an embodiment of the present invention includes: a light-emitting section which emits light in response to a laser beam emitted from a laser light source; a light control section which controls the laser beam to be guided from the laser light source to the light-emitting section; and a movement control section which causes the light control section to move, the movement control section changing an illumination position and a spot size of the laser beam in the light-emitting section by changing a relative position of the light control section with respect to the light-emitting section.

In order to attain the object, (2) a light-emitting device in accordance with an embodiment of the present invention includes: a light-emitting section which emits light in response to laser beams emitted from a plurality of laser light sources, the plurality of laser light sources having respective outputs which are controlled so that the laser beams emitted from the plurality of laser light sources are shone in respective different regions on the light-emitting section.

In order to attain the object, (3) a vehicle headlight in accordance with an embodiment of the present invention includes: a light-emitting section which emits light in response to a laser beam emitted from a laser light source; a light control section which controls the laser beam to be guided from the laser light source to the light-emitting section; and a movement control section which causes the light control section to move, the movement control section changing an illumination position and a spot size of the laser beam in the light-emitting section by changing a relative position of the light control section with respect to the light-emitting section.

Advantageous Effects of Invention

Each of the above configurations (1) through (3) make it possible to provide a light-emitting device, a floodlight, and a vehicle headlight each of which (i) has a high color rendering property and (ii) achieves any light-distribution pattern. Further, each of the above configurations (1) through (3) yields an effect of controlling light-distribution characteristics and a light intensity distribution of illuminating light.

BRIEF DESCRIPTION OF DRAWINGS

FIG. 33 is a set of diagrams (*a*) and (*b*) showing an example of the light-distribution characteristics of the headlamp as exhibited when the headlamp is used in an urban district, (*a*) being a diagram showing the light-distribution characteristics as exhibited when only the LED is on, (*b*) being a diagram showing the light-distribution characteristics as exhibited when both the laser light source unit and the LED are on.

FIG. 38 is a set of diagrams (*a*) through (*c*), (*a*) being a schematic view showing another example of ranges of floodlighting formed by the process that is carried out by the headlamp, (*b*) being a schematic view showing an example of an illuminated region formed on the light-emitting section, (*c*) being a diagram showing an example of a light-distribution pattern as formed when only the LED is on.

DESCRIPTION OF EMBODIMENTS

[Embodiment 1]

A light-emitting device 1 and the like in accordance with the present embodiment are described below with reference to drawings. The following description gives identical parts and components respective identical reference signs. The identical parts and components are also identical in names and functions. Therefore, a specific description of those parts and components is not repeated.

[Outline of Operation of Light-Emitting Device 1]

First, an outline of operation of the light-emitting device 1 is described with reference to, for example, FIG. 2. Then, a specific configuration of the light-emitting device 1 is specifically described.

Figure 2:
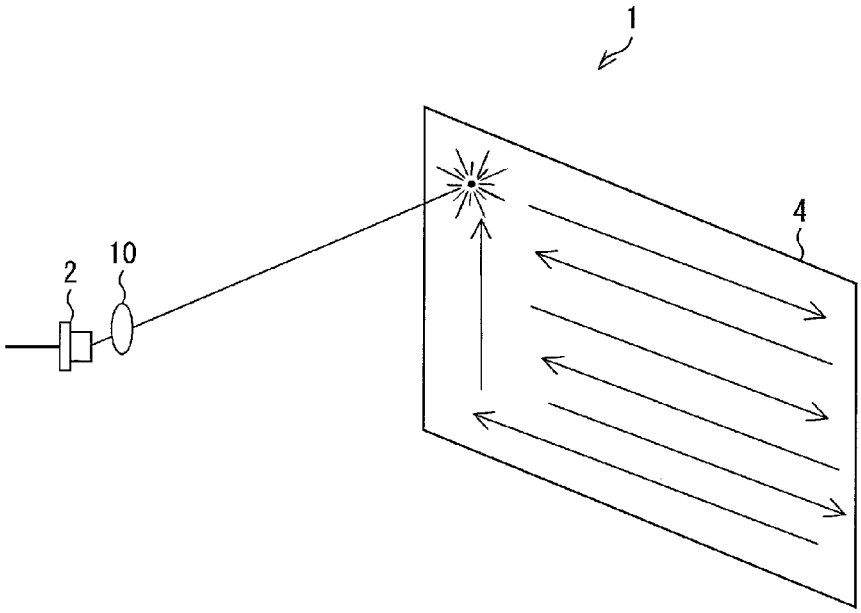
FIG. 2 is a schematic view for explaining how a floodlight according to the present invention operates.

FIG. 2 is a schematic view for explaining how the light-emitting device 1 operates. The light-emitting device 1 includes a laser (laser light source) element 2, a light-emitting section 4, a lens (light control section) 10, and a movement control section 11 (not illustrated) (see FIG. 2).

According to the light-emitting device 1, the laser element 2 emits a laser beam, and the light-emitting section 4 emits light in response to the laser beam. The lens 10 controls the laser beam to be guided from the laser element 2 to the light-emitting section 4. The movement control section 11 controls the lens 10 to move. The movement control section 11 changes an illumination position and a spot size of the laser beam in the light-emitting section 4 by changing a relative position of the lens 10 with respect to the laser element 2.

FIG. 2 explains the foregoing operation. The lens 10 moves in response to the control by the movement control section 11. According to this, scanning with the laser beam is performed on any region of an illuminated surface of the light-emitting section 4 to which surface the laser beam is emitted. Further, the movement control section 11 can also change the spot size of the laser beam in the light-emitting section 4 to any size by causing the lens 10 to move.

Figure 3:
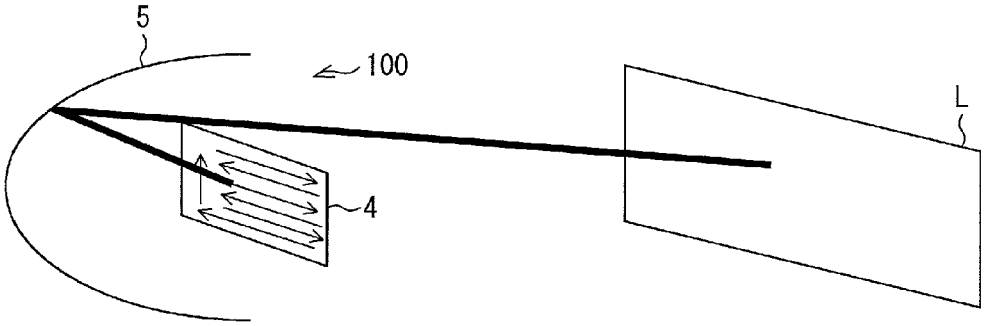
FIG. 3 is a diagram for explaining how a floodlight including a light-emitting device according to the present embodiment casts light.

FIG. 3 is a diagram for explaining how a floodlight 100 casts light. The floodlight 100 includes the light-emitting device 1 and a parabolic mirror 5. The light-emitting section 4 is provided substantially at a focal point of the parabolic mirror 5. The parabolic mirror 5 reflects (casts), to the outside, light emitted by the light-emitting section 4.

According to the floodlight 100, the movement control section 11 changes an illumination position and a spot size of a laser beam in the light-emitting section 4 by changing a relative position of the lens 10 with respect to the light-emitting section 4. According to this, a region which is floodlit with the light reflected by the parabolic mirror 5 is cast changes in accordance with the illumination position of the laser beam in the light-emitting section 4, and a floodlit region L illustrated in FIG. 3 is formed. In this case, an amount of scanning with the laser beam can also be controlled by increasing the spot size of the laser beam in the light-emitting section 4. Same applies to examples of FIG. 4 etc. described later.

Figure 4:
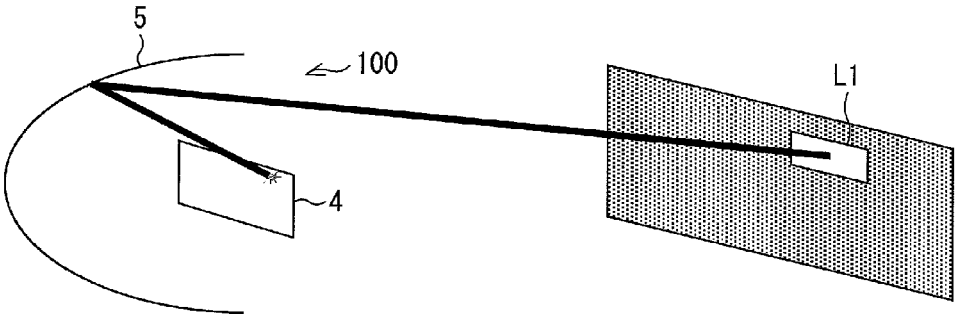
FIG. 4 is a diagram for explaining an example of floodlighting by a floodlight according to the present embodiment.

FIG. 4 is a diagram for explaining an example of floodlighting by the floodlight 100. According to this example, a laser beam is emitted to only a part of a region of the light-emitting section 4 by causing the movement control section 11 to operate, so that a floodlit region is limited to a region L1.

Figure 5:
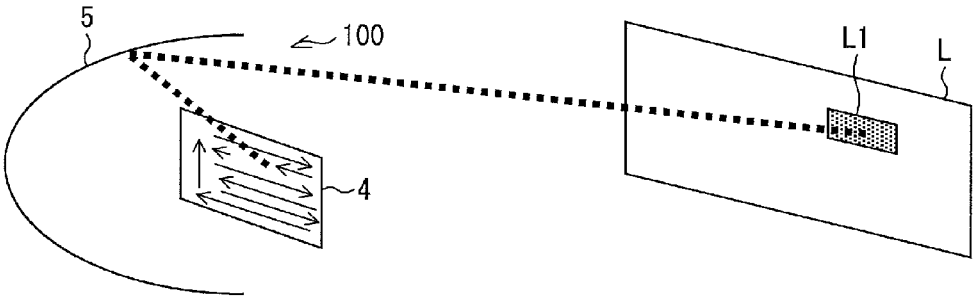
FIG. 5 is a diagram for explaining an example of floodlighting by a floodlight according to the present embodiment.

FIG. 5 is a diagram for explaining another example of floodlighting by the floodlight 100. According to this example, the floodlight 100 performs floodlighting on the floodlit region L except the region 1 by causing the movement control section 11 to operate. This can be achieved by turning off the laser element 2 at a point of time when the region 1 is illuminated during illumination of the floodlit region L (see FIG. 2).

Thus, the light-emitting device 1 can freely change an illumination position and a spot size of a laser beam in the light-emitting section 4. This makes it possible to freely change a light-distribution pattern. In addition, since the light-emitting device 1 uses the laser element 2 to secure a sufficient luminance and includes the light-emitting section 4 which emits light in response to a laser beam, it is possible to improve a color rendering property and a contrast of light having a wavelength other than a wavelength of a laser beam.

Further, the floodlight 100 can also achieve the following effect. That is, a conventional floodlight has a problem with response speed since the conventional floodlight needs to change a light-distribution pattern by causing the whole floodlight unit to move. In addition, it is difficult to introduce the conventional floodlight into, for example, an electric automobile since a driving device of the conventional floodlight consumes much electric power. Moreover, the conventional floodlight also has a problem such that a direction in which the conventional floodlight is controlled is limited due to an increase in size of the driving device. In contrast, the floodlight 100, which can freely change an illumination position and a spot size of a laser beam in the light-emitting section 4 by operation of the movement control section 11, is high in response speed and can be greatly reduced in electric power consumption.

The following description discusses respective configurations of members of the light-emitting device 1 and the floodlight 100.

(Laser Element 2)

The laser element 2 is a light-emitting element which functions as a laser light source that emits a laser beam. The laser element 2 may have one light-emitting point for each chip or have a plurality of light-emitting points for each chip. A laser beam that is emitted by the laser element 2 has a wavelength of, for example, 395 nm (blue violet). It is also possible to select a laser having a wavelength ranging from 380 nm to 415 nm in a blue-violet region (The present invention defines a wavelength range from 380 nm to 415 nm as "blue violet"). Alternatively, a wavelength of a laser beam that is emitted by the laser element 2 may be appropriately selected in accordance with a kind of a fluorescent body to be contained in the light-emitting section 4. Accordingly, the laser beam that is emitted by the laser element 2 may have a wavelength different from that of a blue-violet laser beam. For example, a blue laser that is generated at 470 nm is considered as a candidate for the laser beam that is emitted by the laser element 2 (The present embodiment defines a wavelength range from 420 nm to 490 nm as "blue").

(Lens 10)

The lens 10 adjusts (e.g., expand or reduce) a range of emission of a laser beam from the laser element 2 so that the laser beam is appropriately emitted to the light-emitting section 4. The lens 10 is provided in a vicinity of a laser emitting section of the laser element 2. The movement control section 11 controls the lens 10 to move. The movement control section 11 changes an illumination position and a spot size of the laser beam in the light-emitting section 4 by changing a relative position of the lens 10 with respect to the laser element 2.

Note that a convex lens, a parabolic mirror, a concave mirror, or the like can be used as the lens 10. Use of a convex lens, a parabolic mirror, or a concave mirror makes it easy to control a laser beam to be guided from the laser element 2 to the light-emitting section 4. Further, a convex lens, a parabolic mirror, and a concave mirror have an advantage of being easily available.

(Light-Emitting Section 4)

The light-emitting section 4 emits fluorescence in response to a laser beam emitted from the laser element 2 and contains a fluorescent body which emits light in response to a laser beam. Specifically, the light-emitting section 4 is a fluorescent body-containing light-emitting body such as (i) a sealed-type light-emitting body in which a fluorescent body is dispersed into a sealing material, (ii) a light-emitting body obtained by hardening a fluorescent body, (iii) a thin-film type light-emitting body obtained by applying (depositing) fluorescent body particles to (on) a substrate made of a highly thermally conductive material, or (iv) the like. The light-emitting section 4, which converts a laser beam into fluorescence, can be said to be a wavelength converting element.

The light-emitting section 4 is provided substantially at the focal point of the parabolic mirror 5. Therefore, fluorescence emitted from the light-emitting section 4 is reflected by a reflection curved surface of the parabolic mirror 5, so that an optical path of the fluorescence is controlled.

(Fluorescent Material)

The present embodiment uses BAM ($BaMgAl_{10}O_{17}$: Eu), BSON ($Ba_3Si_6O_{12}N_2$: Eu), or Eu-α (Ca-α-SiAlON: Eu) as the fluorescent body of the light-emitting section 4 so that the fluorescent body emits white fluorescence in response to a laser beam which has been generated by the laser element 2 and has a wavelength of 395 nm. However, a fluorescent material is not limited to these fluorescent bodies, but may be appropriately selected so that the floodlight 100 casts white light. For example, it is possible to use another oxynitride fluorescent body (e.g., a sialon fluorescent body such as JEM ($LaAl(SiAl)_6N_9O$: Ce) or β-SiAlON), a nitride fluorescent body (e.g., a CASN ($CaAlSiN_3$: Eu) fluorescent body), a SCASN ((Sr, Ca)$AlSiN_3$: Eu) fluorescent body, an Apataite ($(Ca,Sr)_5(PO_4)_3Cl$: Eu) fluorescent body, or a III-V-group compound semiconductor nanoparticle fluorescent body (e.g., indium phosphide: InP).

(Sealed Type)

A sealing material which the light-emitting section 4 of a sealed type is made is of, for example, a resin material such as a glass material (e.g., inorganic glass or organic/inorganic hybrid glass) or a silicone resin. Low-melting glass may also be used as the glass material. The sealing material is preferably highly transparent, and is preferably highly heat-resistant in a case where a laser beam is high in output. The light-emitting section 4 may be sealed with silicon oxide or titanium oxide by a sol-gel process.

The light-emitting section 4 may have, on a top surface thereof, an anti-reflection structure which prevents reflection of a laser beam. In the case of a sealed-type light-emitting body, since it is easy to control a shape of a top surface of a light-emitting section, it is particularly desirable to form an anti-reflection film.

(Thin-Film Type)

In a case where the light-emitting section 4 is a thin-film type light-emitting body, Al, Cu, AlN ceramic, SiC ceramic, aluminum oxide, Si, or the like is used as a substrate. Fluorescent body particles are applied to or deposited on the substrate, and then the substrate is divided into substrates each having a desired size. Thereafter, the substrates are fixed to a light-emitting body supporting section by use of a highly thermally conductive adhesive.

In a case where Al or Cu is used as the substrate, it is desirable that a side of the substrate on which side no fluorescent body particles are deposited (a side of the substrate which side faces the light-emitting body supporting section) be coated with TiN, Ti, TaN, Ta, or the like as a barrier metal. Further, the barrier metal may be coated with Pt or Au, for example.

It is desirable to use, as a highly thermally conductive adhesive, eutectic solder of SnAgCu, AuSn, or the like. However, the highly thermally conductive adhesive is not particularly limited to those.

(In case of Blue LD)

In order to obtain white light by causing a semiconductor laser or the like to excite a fluorescent body, it is assumed that various excitation wavelengths and various fluorescent body materials are combined. However, white light can also be obtained as below. That is, a fluorescent body is excited by use of a blue laser beam, and fluorescence from the fluorescent body is used as an optical component of illuminating light. Then, a blue light component which has not contributed to the excitation of the fluorescent body is also utilized as an optical component of illuminating light by being scattered, and scattered blue light and the fluorescence from the fluorescent body are mixed, so that white light is obtained. Use of the white light thus obtained as white illuminating light makes it possible to achieve white illumination with high efficiency.

For example, white light can also be obtained by causing the light-emitting section 4 to contain a yellow florescent body (or a green and red florescent body) and emitting a laser beam in a vicinity of 450 nm (blue) (a wavelength range from 420 nm to 490 nm in the present invention).

(Transmission Type)

Note that it is possible to use the floodlight 100 in which the light-emitting section 4 emits light on a side thereof opposite from a side thereof on which a laser beam is incident. Same applies to a floodlight 200 etc. described later.

Note that, in a case where the floodlight 100 is a transmission-type floodlight, i.e., in a case where the light-emitting section 4 has such light-distribution characteristics as to emit light more intensely on a side thereof opposite from a side thereof on which a laser beam is incident than on the side thereof on which the laser beam is incident, a spot size of the laser beam in the light-emitting section 4 is preferably substantially equal to or larger than a light-emitting area of the light-emitting section 4.

In a case where the light-emitting area is larger than the spot size, it is necessary to increase an excitation density of the laser beam so as to obtain a luminance of the light that is emitted by the light-emitting section 4. This causes a problem such that the light-emitting section 4 deteriorates (changes in color and/or shape) due to heat of the laser beam and becomes shorter-lived. In view of this, a transmission-type floodlight allows the light-emitting section 4 to be longer-lived while preventing a deterioration of the light-emitting section 4.

(Parabolic Mirror 5)

The parabolic mirror 5 reflects fluorescence generated by the light-emitting section 4 and casts light toward a light-distribution area. The parabolic mirror 5 forms a bundle of rays (illuminating light) which travels in a given solid angle. The parabolic mirror 5 may be a member having a surface on which a metal thin film is formed or may be a member made of metal.

Figure 6:
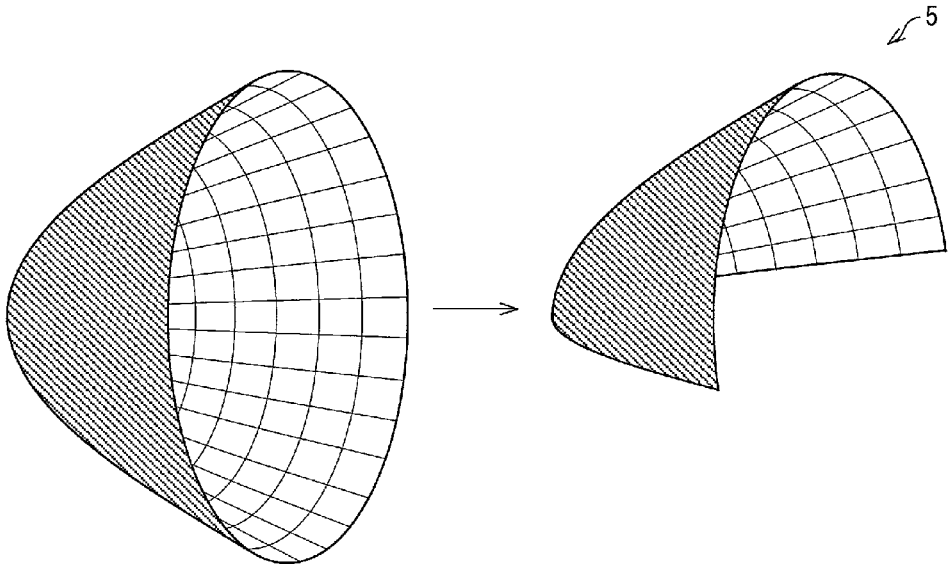
FIG. 6 is a conceptual diagram showing the paraboloid of revolution of a parabolic mirror.

The parabolic mirror 5 includes, in a reflection plane thereof, at least a part of a partial curved surface that is obtained by cutting, along a plane containing a rotation axis which is a symmetry axis of a parabola, a curved surface (parabolic curved surface) formed by causing the parabola to rotate around the rotation axis (see FIG. 6).

A part of the parabolic mirror 5 thus shaped is provided so as to face a top surface of the light-emitting section 4, the top surface being larger in area than a side surface of the light-emitting section 4. Namely, the parabolic mirror 5 is provided so as to cover the top surface of the light-emitting section 4 (so as to face an illuminated (light-receiving) surface that is a surface of the light-emitting section 4 to which surface a laser beam is emitted). From another viewpoint, at least a part of the parabolic mirror 5 is provided at a radiation angle at which light that is emitted from the light-emitting section 4 has the highest luminous intensity when seen from the light-emitting section 4.

In a case where the light-emitting section 4 and the parabolic mirror 5 are provided in a positional relationship as described above, it is possible to efficiently cast fluorescence of the light-emitting section 4 in a given solid angle. This allows fluorescence to be used with higher efficiency.

(Half Parabolic Mirror)

A parabolic mirror may be a half parabolic mirror or the like (described below) provided that the parabolic mirror has a parabolic shape. The parabolic mirror may also be an off-axis parabolic mirror or a multi-facet type parabolic mirror.

Figure 7:
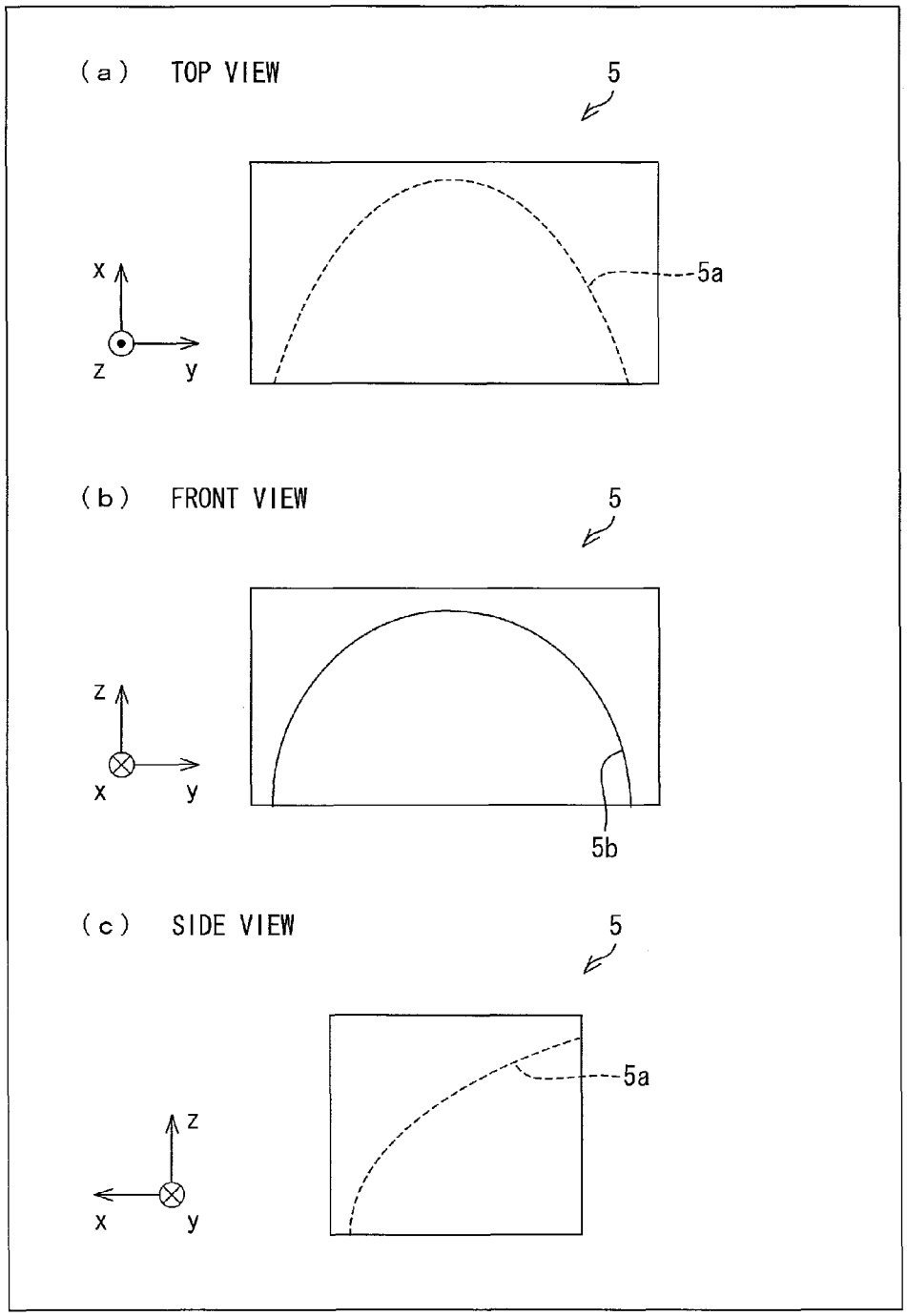
FIG. 7 is a set of diagrams (*a*) through (*c*), (*a*) being a top view of a parabolic mirror, (*b*) being an elevational view of the parabolic mirror, (*c*) being a side view of the parabolic mirror.

FIG. 6 is a conceptual diagram showing the paraboloid of revolution of the parabolic mirror 5. (*a*) of FIG. 7 is a top view of the parabolic mirror 5, (*b*) of FIG. 7 is an elevational view of the parabolic mirror 5, and (*c*) of FIG. 7 is a side view of the parabolic mirror 5. FIG. 7 (*a*) through FIG. 7 (*c*) show examples in each of which for simple illustration of an explanatory view, the parabolic mirror 5 has been formed by hollowing a member which is a rectangular parallelepiped.

In each of (*a*) of FIG. 7 and (*c*) of FIG. 7, a curved line indicated by a sign 5*a* shows a parabolic curved surface. Meanwhile, in a case where the parabolic mirror 5 is seen from the front, an opening (illuminating light exit) 5*b* thereof is semicircular (see (*b*) of FIG. 7).

(Another Configuration)

Note that a mirror does not need to be a parabolic mirror and may be appropriately selected in accordance with an intended use of a floodlight. For example, a mirror may be an ellipse mirror. Alternatively, a mirror can be a multi-facet mirror which enables any light distribution or a free-form surface mirror.

Note that the parabolic mirror 5 may have a non-parabolic part. Further, a reflecting mirror of a floodlight of the present invention may include a parabolic mirror having a closed circular opening or a part of the parabolic mirror. In addition, the reflecting mirror is not limited to a parabolic mirror provided that the reflecting mirror may be an optical element or an optical element group (a combination of optical elements, e.g., a combination of an ellipse mirror and a convex lens) which converts, into substantially parallel light, light emitted from the light-emitting section 4.

(Substantially Parallel Light)

Substantially parallel light does not need to be completely parallel and may have an angle of floodlighting (a vertex angle at which a luminous intensity is halved) of 20° or less. The present embodiment sets angles of floodlighting for respective elements constituting the laser element 2. From the viewpoint of light-distribution control, the elements constituting the laser element 2 are set to have respective angles of floodlighting each falling within a range of 0.5° to 20°, and an average of the respective angles of floodlighting of the elements constituting the laser element 2 is 3° or less.

[Light-Emitting Device 1, Configuration of Floodlight 200]

Figure 1:
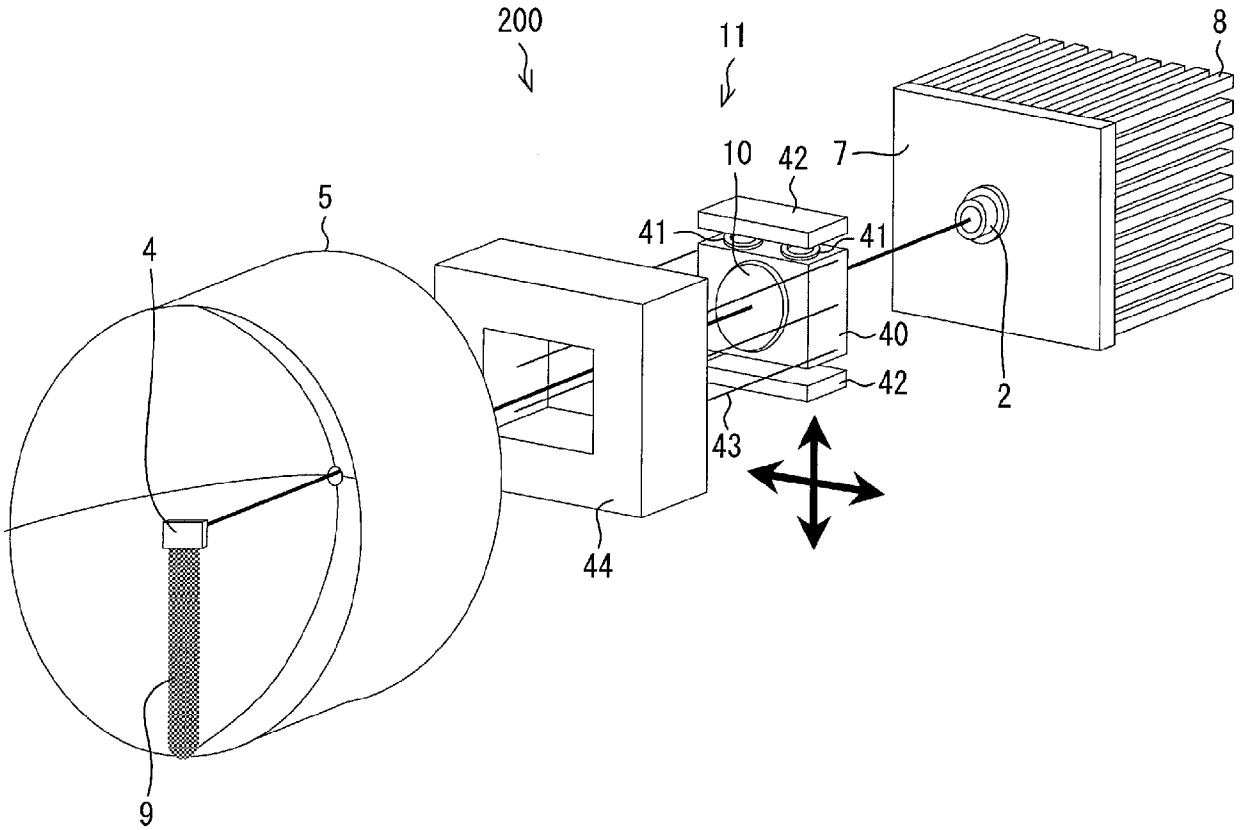
FIG. 1 is a schematic view of a floodlight according to the present embodiment.

The following description more specifically discusses, for example, configurations of a light-emitting device and a floodlight with reference to, for example, FIG. 1.

FIG. 1 is a schematic view of a floodlight 200 according to the present embodiment. The floodlight 200 includes the laser element 2, the lens 10, the light-emitting section 4, the parabolic mirror 5, a heat radiating base 7, a fin 8, and a light-emitting body supporting section 9 (see FIG. 1). The floodlight 200 further includes a movement control section 11 which functions as an actuator.

(Heat Radiating Base 7)

The heat radiating base 7, which is a supporting member for supporting the laser element 2, is made of metal (e.g., aluminum or copper). Therefore, the heat radiating base 7 is highly thermally conductive and can efficiently radiate heat generated in the laser element 2 provided thereon.

Note that a member supporting the laser element 2 may be a member containing a highly thermally conductive substance (e.g., silicon carbide or aluminum nitride) other than metal. However, it is more preferable that the member supporting the laser element 2 be made of, for example, highly thermally conductive metal.

(Fin 8)

The fin 8, which is provided for the heat radiating base 7, functions as a cooling section (heat radiating mechanism) which cools heat transferred from the laser element 2 to the heat radiating base 7. The fin 8, which has a plurality of heat radiating plates, enhances heat radiation efficiency by increasing an area of a contact part with atmosphere. Note that the fin 8 does not necessarily need to abut on the heat radiating base 7 and that a heat pipe, a water-cooled pipe, a Peltier device, or the like may be provided between the radiating base 7 and the fin 8.

It is only necessary that the cooling section which cools the radiating base 7 have a cooling function (radiating function). The cooling section which cools the radiating base 7 in a water-cooling mode may perform cooling by use of a radiator. Alternatively, the cooling section may perform forced cooling by use of, for example, a fan.

(Light-Emitting Body Supporting Section 9)

The light-emitting body supporting section 9 made of highly thermally conductive metal or the like supports the light-emitting section 4 at one end thereof and causes the light-emitting section 4 to be provided substantially at a focal point of the parabolic mirror 5. The light-emitting body supporting section 9 has the other end that is connected, via the parabolic mirror 5, to a radiating member (not illustrated) which is highly thermally conductive. Therefore, heat of the light-emitting section 4 which heat is generated by a laser beam is transmitted to each of the light-emitting body supporting section 9 and the radiating member, so that efficient heat radiation is achieved.

(Movement Control Section 11)

The movement control section 11 which functions as an actuator includes a lens frame body 40, a coil(s) 41, a magnet(s) 42, a suspension wire 43, and a wire supporting housing 44.

The lens 10 is fitted in the lens frame body 40. The lens frame body 40 is in a shape of a rectangular parallelepiped and has side surfaces which face each other and on each of which two coils 41 are provided (on which four coils 41 in total are provided). According to FIG. 1, two coils 41 are provided on each of two surfaces of the lens frame body 40 which face each other in a vertical direction of the floodlight 200 shown in FIG. 1 (the two coils 41 provided on the lower side surface are not illustrated).

Note that the lens frame body 40 does not need to be in the shape of a rectangular parallelepiped and may be variously shaped. Further, the coil(s) 41 is(are) not particularly limited in kind and may be a pattern coil(s), for example. In addition, the number of the coil(s) 41 is not limited to four and may be one, or one or more other than four.

The magnet(s) 42 is(are) provided in a vicinity of the coil(s) 41 so as to face the coil(s) 41. A multipolar magnetic neodymium magnet (Nd magnet) is used for the magnet(s) 42. However, the magnet(s) 42 is(are) not limited in kind and can be appropriately selected in accordance with a kind of an actuator. Further, the magnet(s) 42, which is(are) in the shape of a rectangular parallelepiped in FIG. 1, is not particularly limited in shape.

The wire supporting housing 44 supports the lens frame body 40 by being connected to the lens frame body 40 via the suspension wire 43. The wire supporting housing 44 is not particularly limited in material and shape. However, the wire supporting housing 44 is formed in a shape which does not hinder emission, to the light-emitting section 4, of a laser beam emitted from the laser element 2.

According to the foregoing configuration, a magnetic field is generated by sending an electric current through the coil(s) 41, and the magnetic field thus generated exerts rotary power (rotary torque) on the magnet(s) 42. Therefore, the rotary torque can be freely changed by changing a level of the electric current. This makes it possible to control movement of the lens frame body 40, i.e., the lens 10. Further, in a case where a direction in which the electric current is sent through the coil(s) is changed, it is possible to change, to an opposite direction, a direction of the rotary power that is exerted on the magnet(s) 42.

According to this, the lens 10 can freely move in arrow directions in FIG. 1. Therefore, a relative position of the lens 10 with respect to the light-emitting section 4 is changed, so that an illumination position of a laser beam in the light-emitting section 4 can be changed. In this case, a spot size of the laser beam in the light-emitting section 4 needs to be larger than an NFP (Near Field Pattern) size of the laser element 2.

An excitation density of the laser beam in the light-emitting section 4 needs to be reduced by causing the spot size of the laser beam in the light-emitting section 4 to be larger than the NFP size. This is because a problem occurs such that the light-emitting section 4, which is heated by the laser beam, deteriorates (changes in color and/or shape) due to heat of the laser beam and becomes shorter-lived.

Note that the movement control section 11 which functions as an actuator does not need to be a biaxial-type actuator. The number of axes of the actuator may be one, or one or more other than two.

Further, the actuator may be an actuator in another mode provided that the actuator includes a mechanism which causes the lens to move in the arrow directions in FIG. 1. The another mode of the actuator is exemplified by "a rack-and-pinion mode", a helicoid mode, and a solenoid mode.

[Floodlight 300]

Figure 8:
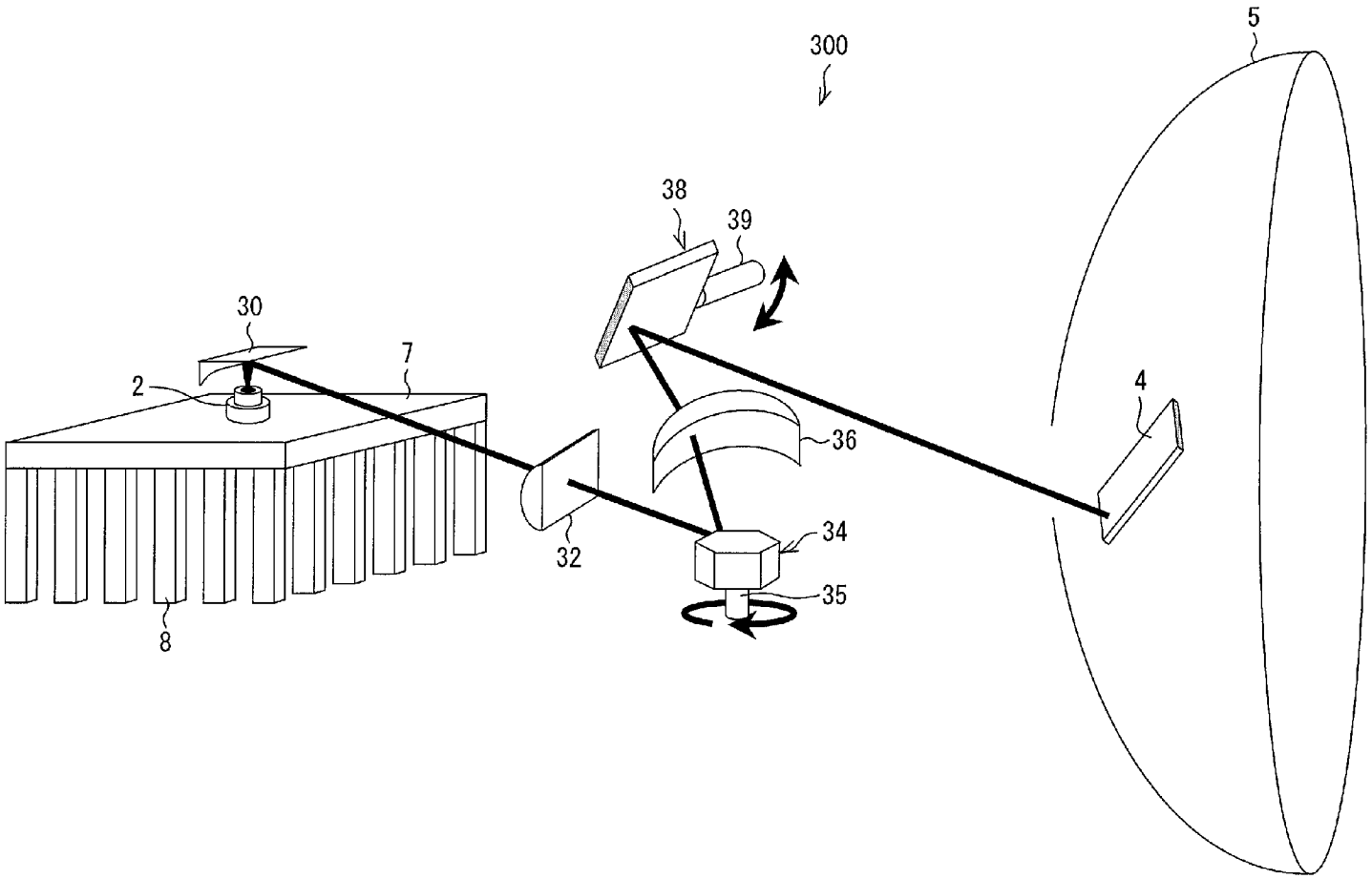
FIG. 8 is a schematic view of a floodlight according to the present embodiment.

The description below deals with a still another floodlight 300 of the present embodiment with reference to FIG. 8. FIG. 8 is a view schematically illustrating the floodlight 300. As illustrated in FIG. 8, the floodlight 300 includes a laser element 2, a light-emitting section 4, a parabolic mirror 5, a heat radiating base 7, a fin 8, and a light-emitting body supporting section 9 (not illustrated). The floodlight 300 further includes an initial mirror (light control section) 30, a cylindrical lens 32, a polygon mirror (light control section) 34, a polygon mirror driving section (movement control section) 35, a scanning lens 36, a galvanometer mirror (light control section) 38, and a galvanometer mirror driving section (movement control section) 39.

The initial mirror 30 collimates a laser beam emitted from a laser beam emission end of the laser element 2, and redirects that collimated light toward the cylindrical lens 32 by reflection.

The movement of the initial mirror 30 may be controlled by an actuator or the like (not illustrated).

The cylindrical lens 32 changes, in only a single direction, magnification of a laser beam reflected by the initial mirror 30, and directs that laser beam toward the polygon mirror 34.

The polygon mirror 34 is such a polygon mirror as is mounted in, for example, a high-accuracy digital copying machine or laser printer. The polygon mirror 34 is rotated at a high speed of several tens of thousand times per minute as driven by the polygon mirror driving section 35 connected to the polygon mirror 34. The polygon mirror 34 reflects a laser beam while rotating at such a high speed to redirect that laser beam toward the scanning lens 36.

The scanning lens 36 is a lens for use in scanning with a laser beam. The scanning lens 36, upon receipt of a laser beam at an angle $\theta$, forms an image having a size ($Y=f\cdot\theta$) calculated by multiplying the focal length f of the scanning lens 36 by the angle $\theta$. The scanning lens 36 has a function of scanning an image forming surface at a uniform speed with use of a laser beam adjusted by the polygon mirror 34 for equiangular scanning. Then, the scanning lens 36 directs a laser beam toward the galvanometer mirror 38.

The galvanometer mirror 38 is rotated, as driven by the galvanometer mirror driving section 39, by an amount corresponding to the level of a received driving voltage, and thus changes its angle of reflection. The galvanometer mirror 38 reflects a laser beam to redirect it toward the light-emitting section 4. With this configuration, the galvanometer mirror 38 can cause a laser beam to fall upon the light-emitting section 4 at any angle.

As described above, the floodlight 300 uses the polygon mirror driving section 35 and the galvanometer mirror driving section 39 to move the polygon mirror 34 and the galvanometer mirror 38, respectively, to change in any manner an illumination position and a spot size of a laser beam in the light-emitting section 4.

The initial mirror 30, the polygon mirror 34, and the galvanometer mirror 38 are each provided with an HR coating made from a dielectric multilayer film. Further, the cylindrical lens 32 and the scanning lens 36 are each provided with an AR (anti-reflective) coating made from a dielectric multilayer film. The AR coating and HR coating are each tuned to the wavelength of light that is emitted by the laser element 2.

Providing the AR coating and HR coating can reduce optical loss. Since the present embodiment uses a high-power laser, providing neither of the AR coating and HR coating will problematically cause optical loss to change into heat, which will distort an optical element. Further, while a vehicle floodlight can change the illumination position and spot size of a laser beam in any manner, the light distribution (time-averaged light distribution) of a laser beam formed in the light-emitting section 4 is, in accordance with a floodlighting pattern for a headlamp which pattern is stipulated in the laws and regulations, frequently an identical light distribution for forming a pattern that conforms to the laws and regulations. This indicates that individual optical elements are each not uniformly exposed to a laser beam, but only a particular region of the optical element is constantly exposed to a high laser output. Thus, providing neither of the AR coating and HR coating will problematically cause such a particular region to deteriorate.

[Floodlight 400]

Figure 9:
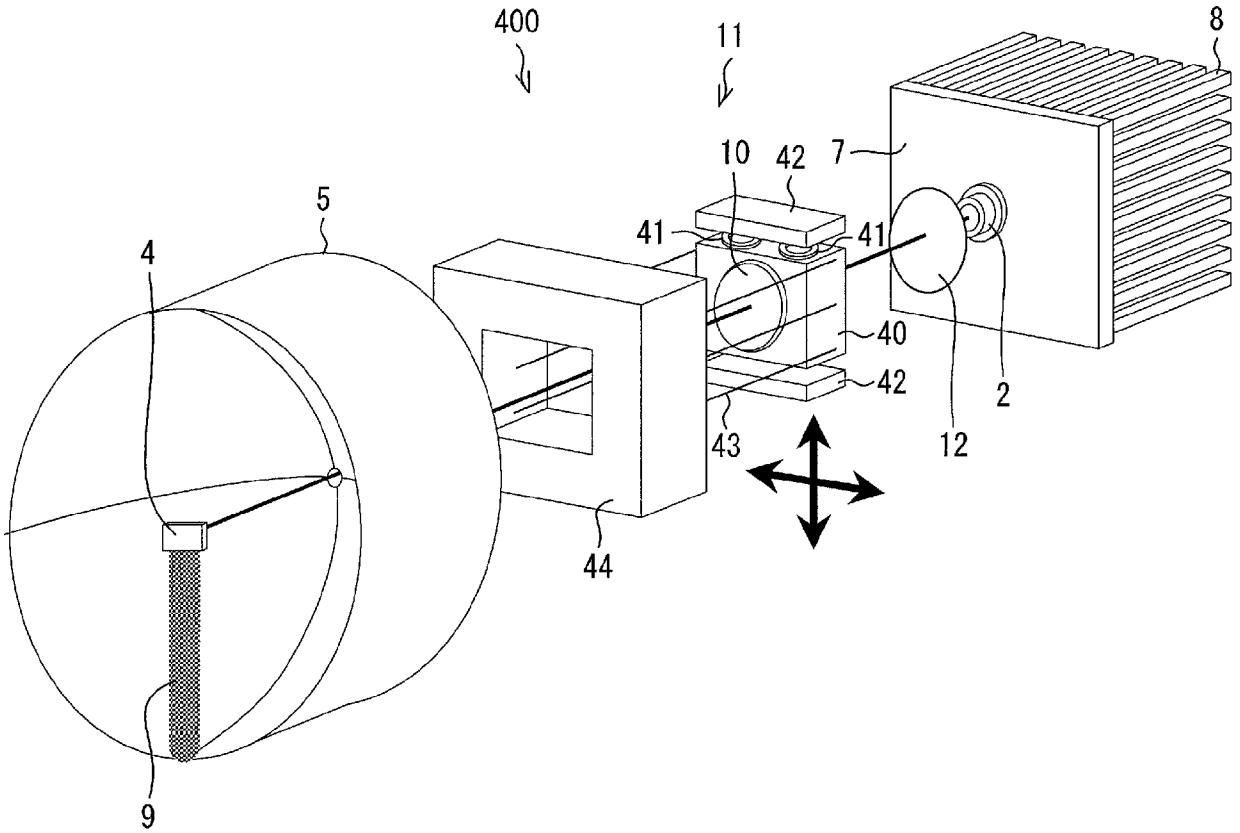
FIG. 9 is a schematic view of another floodlight according to the present embodiment.

The description below deals with a still another floodlight 400 of the present embodiment with reference to FIG. 9. FIG. 9 is a view schematically illustrating the floodlight 400.

The floodlight 400 differs from the floodlight 200 in that it includes a lens 12 between the laser element 2 and the lens frame body 40.

The lens 12 is a collimating lens of which aberration has been corrected so that a laser beam received from the laser element 2 is changed into parallel light. The lens 10 is an objective lens for forming an image with use of a laser beam.

The floodlight 400 of the present embodiment may alternatively include a collimating lens and an objective lens separately as described above.

The floodlight 200 includes an actuator that drives the lens along the arrow directions, and is thus incapable of changing the spot size of a laser beam of the light-emitting section 4 at a desired position. In other words, the spot size, which changes in accordance with coma aberration, cannot be changed intentionally. The floodlight 400 is, in contrast, capable of forming a spot of any size at any position by moving the collimating lens 12.

[Floodlight 500]

Figure 10:
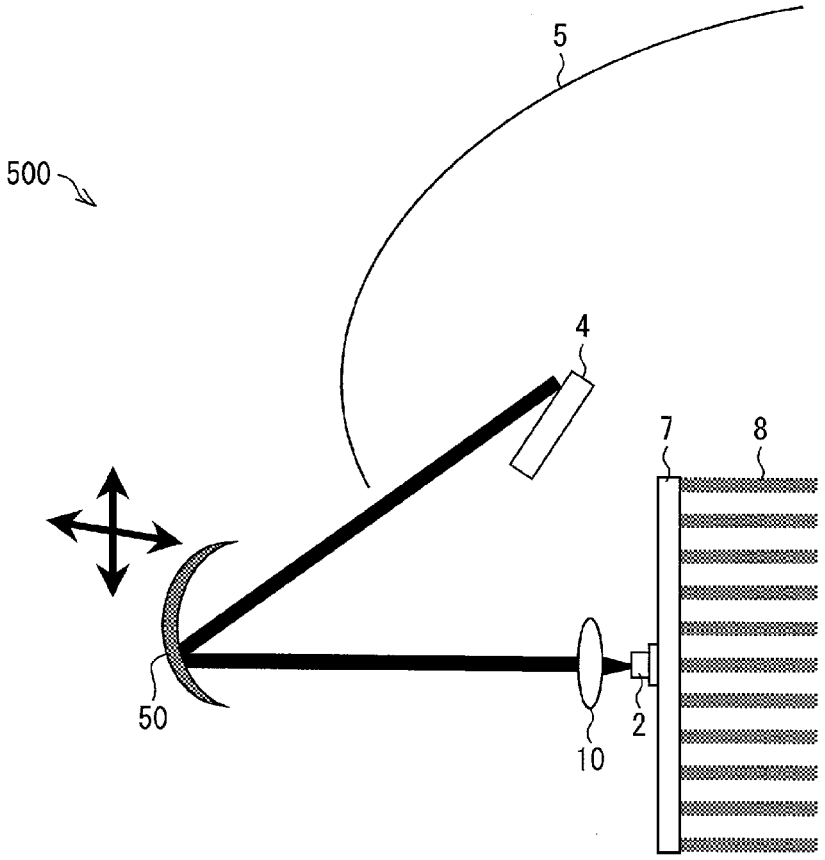
FIG. 10 is a schematic view of another floodlight according to the present embodiment.

The description below deals with a still another floodlight 500 of the present embodiment with reference to FIG. 10. FIG. 10 is a view schematically illustrating the floodlight 500.

The floodlight 500 includes a laser element 2, a light-emitting section 4, a parabolic mirror 5, a heat radiating base 7, a fin 8, a light-emitting body supporting section 9, and a lens 10. The floodlight 500 further includes an actuator (movement control section 11; not illustrated) and a concave mirror 50 that is driven by the actuator.

The floodlight 500 is configured to operate as follows: The laser element 2 emits a laser beam, which travels through the lens 10 to fall upon the concave mirror 50. The concave mirror 50 then reflects the laser beam, which has fallen thereon, toward the light-emitting section 4. The concave mirror 50 is moved as such under control of the movement control section 11. In other words, the movement control section 11 changes an illumination position and a spot size of the laser beam by changing a relative position of the concave mirror 50 with respect to the light-emitting section 4.

The floodlight 500 of the present embodiment may alternatively differ in configuration from the floodlight 300 and the like as described above.

A vehicle floodlight is frequently provided in front of an engine compartment. Since such an engine compartment contains various pieces of equipment and piping, a floodlight desirably has a small depth. Further, a heat radiating fin 8 is desirably provided not on the engine compartment side, but in the outermost shell of the vehicle for efficient heat radiation. The floodlight 500, which includes the concave mirror 50, attains the above two objects.

Further, the floodlight 500 changes the position of a light-emitting spot of the light-emitting section 4 by using the movement control section 11 to cause the concave mirror 50 to move in a direction parallel to the principal plane of the concave mirror 50.

The concave mirror 50 may, depending on the size of the light-emitting spot of the light-emitting section 4, alternatively be replaced with a convex mirror.

The concave mirror 50 may further alternatively be replaced with a plane mirror. This configuration will, however, not allow functions similar to the above to be performed with mere use of a mechanism for moving the plane mirror in a direction parallel to the mirror plane. In view of this, the floodlight 500 can, in the case where it includes a plane mirror, employ a mechanism that, for instance, (i) sets a rectangular coordinate system defined by a z axis (direction normal to the mirror plane), an x axis (on the mirror plane), and a y axis (perpendicular to the x axis and z axis) and (ii) inclines the mirror plane in the x axis direction and y axis direction. Moving the plane mirror as such can change the position of a light-emitting spot of the light-emitting section 4.

Example 1

Figure 11:
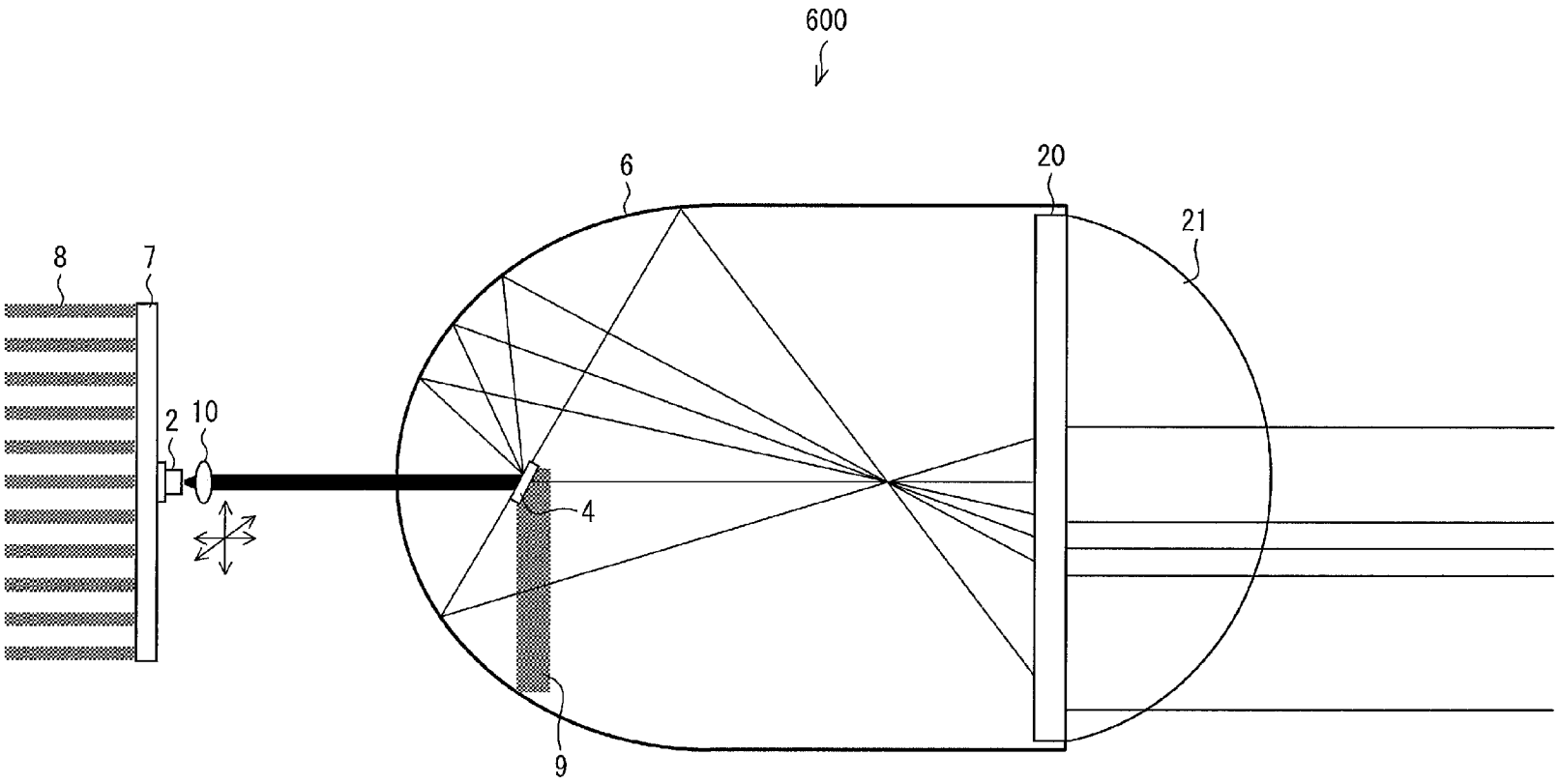
FIG. 11 is a diagram for explaining a lighting device according to the present embodiment.

FIG. 11 is a diagram for explaining a floodlight 600, which is a variation of the floodlight 400.

The floodlight 600 includes a laser element 2, a light-emitting section 4, an ellipse mirror 6, a heat radiating base 7, a fin 8, a light-emitting body supporting section 9, a movement control section 11 (not illustrated) functioning as an actuator, a lens 10 moved under control of the movement control section 11, a wavelength cut coating 20, and a lens 21.

The floodlight 600 includes a single laser element 2 having an excitation spot size ranging from 20 μm Φ to 500 μm Φ. The laser element 2 is provided on the heat radiating base 7. The heat radiating base 7 and the fin 8 are each made of Al, which is highly thermally conductive.

The laser element 2 emits a laser beam to the light-emitting section 4, the laser beam being guided as controlled with use of the lens 10. The lens 10 is moved under control of the movement control section 11.

The floodlight 600 includes an ellipse mirror 6 of Φ 38 mm in place of the parabolic mirror 5. The light-emitting section 4 is provided substantially at a first focal position of the ellipse mirror 6. The light-emitting section 4 is 4 mm×2 mm in size, and is supported by the light-emitting body supporting section 9 in the state in which the light-emitting section 4 is inclined at an angle of 15° to a laser beam.

The wavelength cut coating 20 blocks light within a particular wavelength range. The wavelength cut coating 20 blocks, for example, a laser beam of wavelengths of 400 nm or less to help provide a user with a device that is easy on the human eye. What wavelengths to block may be selected as appropriate by selecting a desired kind of the wavelength cut coating 20. Further, the wavelength cut coating 20 may be replaced with a wavelength cut filter.

The lens 21 causes light that has been reflected by the ellipse mirror 6 and that has passed through the wavelength cut coating 20 to be substantially parallel light, and then causes that substantially parallel light to be emitted to the outside of the floodlight 600. The lens 21 is in contact with the wavelength cut coating 20, and is connected to the ellipse mirror 6.

With the above configuration, the movement control section 11 can, by controlling the movement of the lens 10, (i) move the lens 10 in any direction (indicated by the arrows in FIG. 11) along the three axes (X, Y, and Z), (ii) scan an illumination position of a laser beam in the light-emitting section 4, and (iii) change the spot size of the laser beam in any manner. The laser element 2 of the floodlight 600 has a scan rate set to 60 Hz.

The above conditions for the floodlight 600 are not limited to the values specified above. The light-emitting section 4 may, for example, have a size other than 4 mm×2 mm (for example, 1.2 mm×0.6 mm).

Further, the scan rate may be any rate that is 30 Hz or larger. Setting the scan rate to smaller than 30 Hz will let flickers become easily noticeable. While a higher frequency causes flickers to be less noticeable, a scan rate of 120 Hz is sufficient because it allows the floodlight 600 to, even in the case where the driver is driving a vehicle at a speed of 400 km per hour, switch light distributions before the vehicle moves 1 m.

Example 2

Figure 12:
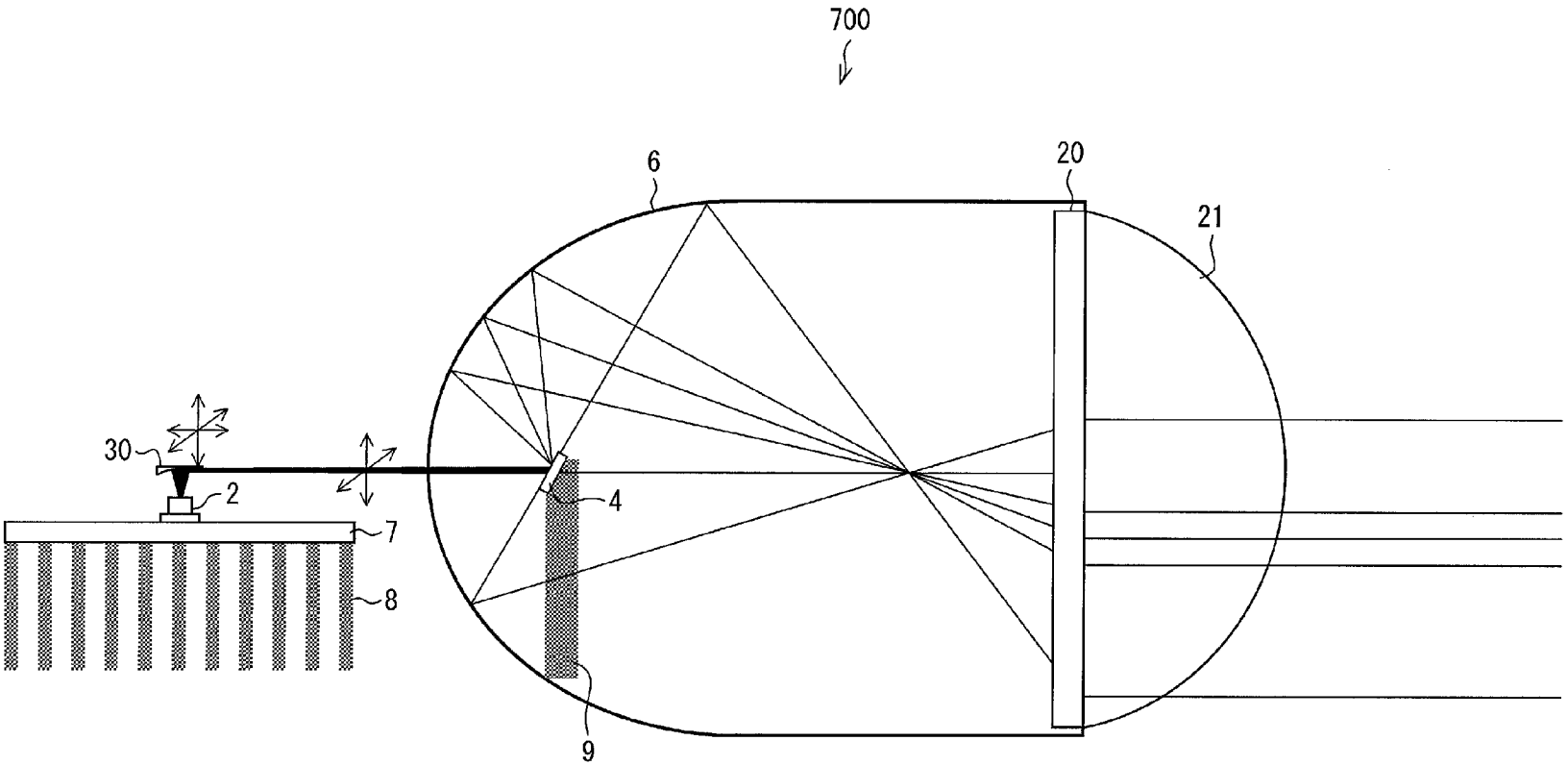
FIG. 12 is a diagram for explaining another lighting device according to the present embodiment.

FIG. 12 is a diagram for explaining a floodlight 700, which is a variation of the floodlight 600.

The floodlight 700 includes a laser element 2, a light-emitting section 4, an ellipse mirror 6, a heat radiating base 7, a fin 8, a light-emitting body supporting section 9, an movement control section 11 (not illustrated) functioning as an actuator, an initial mirror 30 moved under control of the movement control section 11, a wavelength cut coating 20, and a lens 21.

The present Example is identical to Example 1 except that it includes an initial mirror 30 in place of the lens 10 included in the floodlight 600. The present Example collimates light emitted from the laser element 2 and controls its optical path to change in any manner (i) an illumination position and a spot size of a laser beam in the light-emitting section 4.

The present Example includes, as the initial mirror 30, an off-axis parabolic mirror of which a focal position substantially coincides with a light-emitting point of the laser element 2.

Example 3

Figure 13:
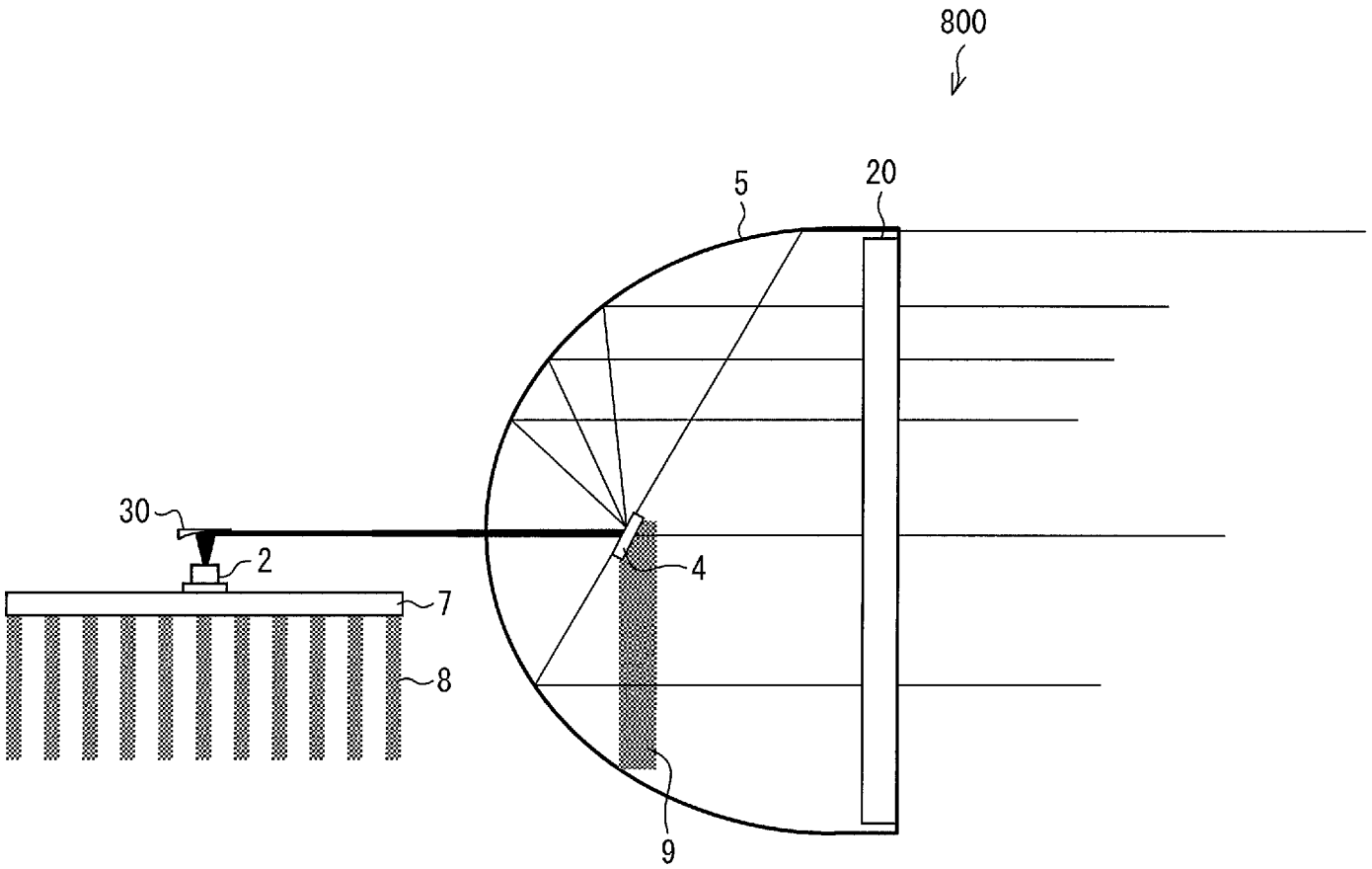
FIG. 13 is a diagram for explaining another lighting device according to the present embodiment.

FIG. 13 is a diagram for explaining a floodlight 800, which is a variation of the floodlight 700.

The floodlight 800 is identical to the floodlight 700 except that it includes a parabolic mirror of Φ 38 mm in place of the ellipse mirror 6 and the convex lens 21. Thus, similarly to the floodlight 700, the floodlight 800 can change in any manner (i) an illumination position and a spot size of a laser beam in the light-emitting section 4.

Example 4

Figure 20:
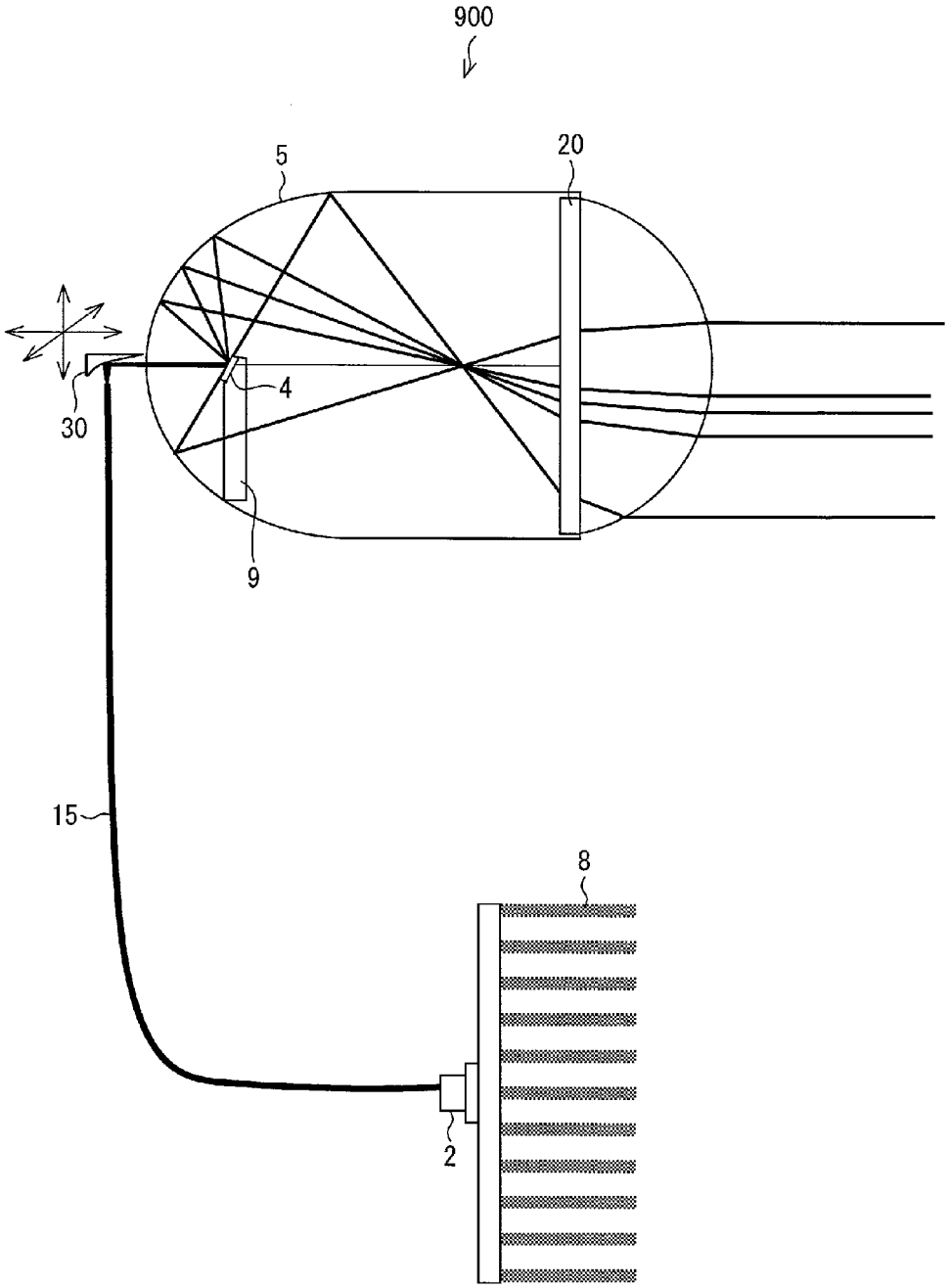
FIG. 20 is a diagram for explaining another lighting device according to the present embodiment.

FIG. 20 is a diagram for explaining a floodlight 900, which is a variation of the floodlight 700.

The floodlight 900 is identical to the floodlight 700 except that it causes a laser beam of the laser element 2 to enter a fiber 15, through which the laser beam is guided to a substantial focal position of the initial mirror 30. Thus, similarly to the floodlight 700, the floodlight 900 can change in any manner an illumination position and a spot size of a laser beam in the light-emitting section 4.

The floodlight 900, which includes the fiber 15, can reduce space necessary behind the floodlight 900.

The floodlight 900, which includes the fiber 15, allows the fin 8 to be provided as appropriate at such a position as to facilitate heat radiation. This configuration improves long-term reliability of the floodlight 900.

The floodlight 900 causes a laser beam to enter the fiber 15 through a butt joint. The present Example is, however, not limited to such a configuration. The floodlight 900 may as appropriate use a lens or a mirror so as to cause a laser beam to enter the fiber 15.

The fiber 15 has a numerical aperture (NA) of 0.18 at both an entry end and an emission end. The NA of the light-emitting section 4 may be different from that of the entry end to maintain efficiency in coupling laser beams and reduce an excitation area of a light source section. In such a case, the NA of the light-emitting section 4 is greater than that of the entry end.

The initial mirror 30 may alternatively be replaced with a lens. This configuration, however, requires the fiber 15 to extend behind the floodlight 900 considerably, and thus occupies space behind the floodlight 900.

[Example of Application of Floodlight]

Figure 14:
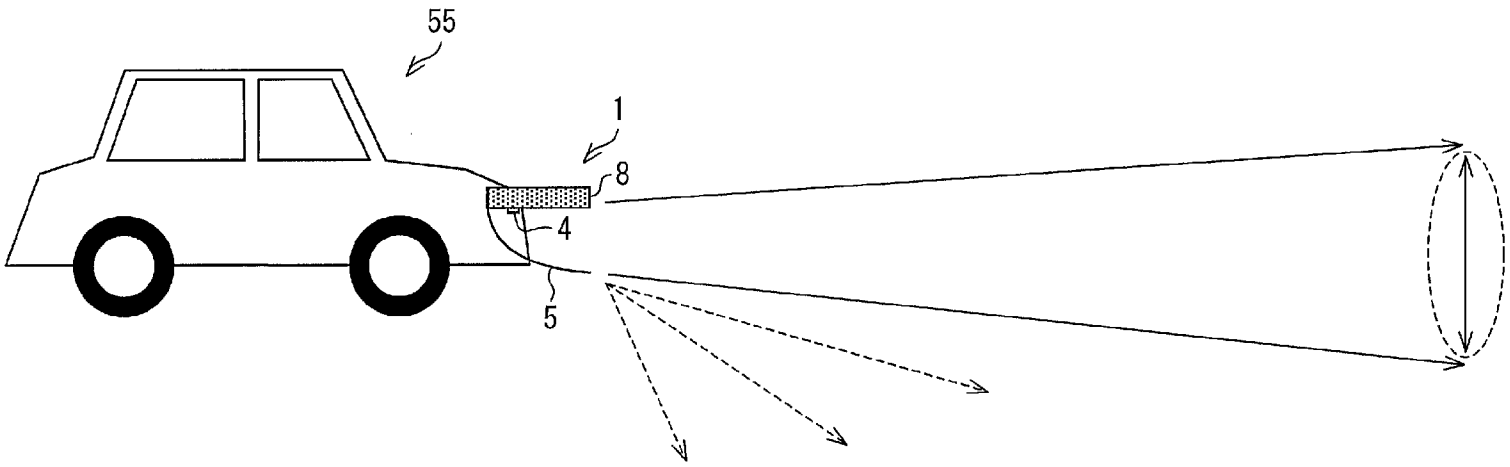
FIG. 14 is a conceptual diagram of a case where a floodlight according to the present embodiment is applied to a vehicle headlight.

FIG. 14 is a conceptual diagram of a case where a floodlight above is applied to a vehicle headlight (headlamp). FIG. 14 illustrates a case of the headlamp so provided at the head of a vehicle 55 that the parabolic mirror 5 is positioned vertically on the under side. The parabolic mirror 5 is, however, provided at a position and in an orientation each of which may be changed as appropriate in accordance with, for example, guidelines on design of a headlamp for a vehicle.

The headlamp may be applied to a driving headlight (high beam) or passing headlight (low beam) for a vehicle. Further, the headlamp can, while a vehicle 55 is being driven, change its light-distribution pattern in accordance with a driving state. This configuration allows light to be cast in any floodlighting pattern while the vehicle 55 is being driven, and can thus increase convenience to the user. This point will be described later in detail.

The above floodlights may each be applied to not only a vehicle headlight but also other lighting devices. Further, the above floodlights may each be used as a headlamp for a moving object other than a vehicle (for example, a human being, a ship, an airplane, a submarine, or a rocket). In particular, a two-wheeled vehicle such as a motorcycle has, as a property, a vehicle body that tilts greatly at a curve. Conventional systems are thus problematic in that the device is large-sized and the operating speed is low. This has made it meaningless to have a variable light distribution. Including the floodlight of the present Example in a motorcycle, in contrast, allows the motorcycle to constantly light an area in its driving direction. The above floodlights may alternatively each be used in a searchlight, a projector, or an indoor lighting apparatus other than a downlight (for example, a standlamp).

[Light Amount Adjusting Section]

With reference to, for example, FIG. 15, the description below deals with a light amount adjusting section included in the floodlight of the present embodiment. The description below applies not only to the floodlight 200 but also to the floodlight 300 and the like. Further, the description below deals with an example case of a light amount adjusting section (or a light amount control section) included in a headlamp serving as a vehicle headlight for a high beam. The light amount adjusting section (light amount control section) may, however, also be included in an object other than a vehicle.

(Light Amount Adjusting Section)

Figure 15:
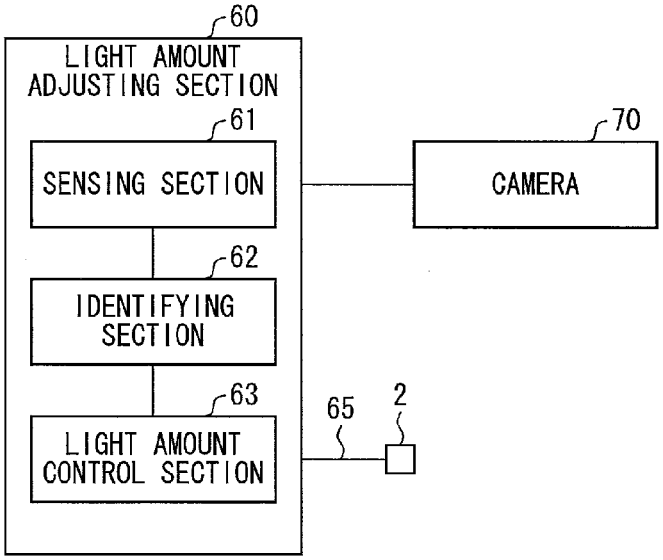
FIG. 15 is a block diagram for schematically explaining a light amount adjusting section according to the present embodiment.

FIG. 15 is a block diagram for schematically explaining a light amount adjusting section 60 included in the floodlight 200. The light amount adjusting section 60 accepts an input from a camera 70 mounted in a vehicle. The light amount adjusting section 60 includes a light amount control section 63 (described below) connected to the laser element 2 through a wire 65.

The camera 70 continuously captures a moving image of an area in front of the vehicle, the moving image including a lit region (floodlit region). The camera 70 is provided, for example, in the vicinity of a rear-view mirror provided in the front of the inside of the vehicle. The camera 70 can be, for example, an image capturing device for capturing a moving image at a television frame rate. In the case where the camera 70 is provided for a moving object that moves at a speed of 400 km per hour, the frame rate is desirably 120 Hz or higher. The frame rate may be selected as appropriate, but at least needs to be equal to or higher than the frame rate of the floodlight.

The camera 70 starts capturing a moving image at the latest when the laser element 2 emits a laser beam, and outputs the captured moving image to the light amount adjusting section 60. The light amount adjusting section 60 controls, in accordance with the kind of object captured by the camera 70, the amount of light that is emitted by the laser element 2. The light amount adjusting section 60 includes a sensing section 61, an identifying section 62, and a light amount control section 63.

The sensing section 61 analyzes a moving image, captured by the camera 70, to detect an object in floodlighting regions. Specifically, the sensing section 61, upon obtaining a moving image from the camera 70, attempts to detect an object separately in individual detection regions, each of which is a region in a moving image, the region corresponding to an individual floodlighting region, and for which coordinate information is set in advance.

The sensing section 61, in the case where it has detected an object within a detection region, outputs to the identifying section 62 a detection signal indicative of the detection region in which the sensing section 61 has detected the object.

The identifying section 62 identifies the kind of the object within the detection region indicated by the detection signal outputted from the sensing section 61. Specifically, the identifying section 62, upon obtaining a detection signal from the sensing section 61, extracts features (for example, moving speed, shape, and position) of the object within the detection region indicated by the detection signal, and thus calculates a feature value, which is a numerical representation of the features.

The identifying section 62 further refers to a reference value table that is stored in a memory (not illustrated) and that manages reference values each of which is a numerical representation of the features of a kind of object, and retrieves from the reference value table a reference value having a difference from the calculated feature value which difference is within a predetermined threshold. The reference value table manages, for example, respective reference values corresponding to an oncoming vehicle, a preceding vehicle, a road sign, an expected obstacle and the like. The identifying section 62, in the case where it has identified a reference value having a difference from the calculated feature value which difference is within the predetermined threshold, determines that the object represented by that reference value is the object detected by the sensing section 61.

The identifying section 62, on the basis of the determination result, outputs to the light amount control section 63 an identification signal indicative of (i) the kind of the object represented by the reference value and (ii) the detection region in which the sensing section 61 has detected the object.

The light amount control section 63, in accordance with the kind of the object represented by the identification signal received from the identifying section 62, controls the amount of light to be cast to a floodlighting region corresponding to the detection region. Specifically, in the case where the identifying section 62 has outputted an identification signal indicative of an oncoming vehicle, a preceding vehicle or the like as the kind of the object, the light amount control section 63 causes an output of the laser element 2 to a region of the light-emitting section 4 which region forms floodlighting for the detection region (in which the sensing section 61 has detected the oncoming vehicle, the preceding vehicle or the like) to decrease to a level at which the driver of the oncoming vehicle, the preceding vehicle, or the like sees no glare.

In the case where the identifying section 62 has outputted an identification signal indicative of a road sign, an obstacle or the like as the kind of the object, the light amount control section 63 causes an output (floodlighting) of the laser element 2 to a floodlighting region corresponding to the detection region (in which the sensing section 61 has detected the road sign, the obstacle or the like) to increase. This operation can attract attention of the driver to the road sign, the obstacle or the like.

(Process for Adjusting Amount of Light)

Figure 16:
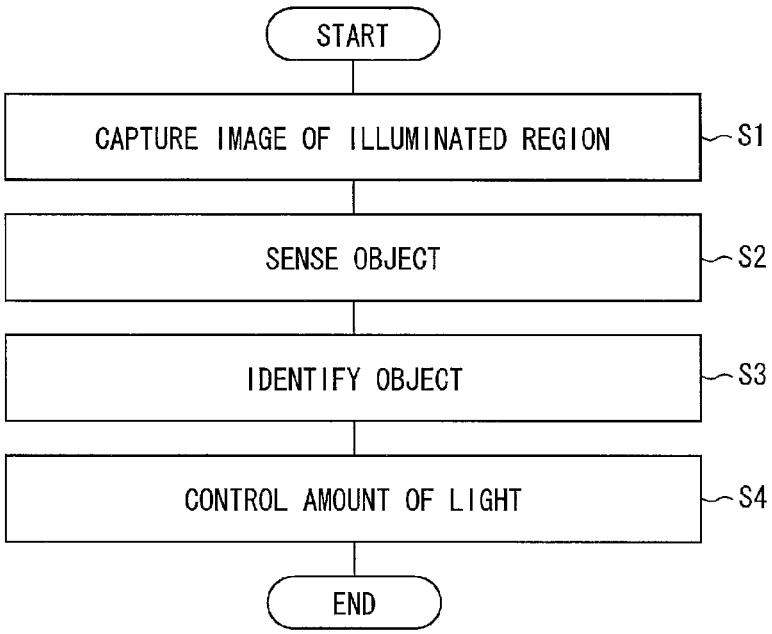
FIG. 16 is a flow chart showing an operation of adjusting the amount of light that is emitted by a laser element.

With reference to FIG. 16, the description below deals with a process for adjusting the amount of light that is emitted by the laser element 2. FIG. 16 is a flow chart showing an operation of adjusting the amount of light emitted by the laser element 2.

As illustrated in FIG. 16, the camera 70 starts capturing a moving image at the latest when the laser element 2 is turned on (S1). The camera 70, during this step, captures a moving image of an area in front of the vehicle at such an angle of view that the camera 70 can capture a moving image of the entire lit region to which the laser element 2 casts light. The camera 70 then outputs the captured moving image to the light amount adjusting section 60.

Next, the sensing section 61 analyzes the moving image, captured by the camera 70, to detect an object in floodlighting regions (S2). Specifically, the sensing section 61, upon obtaining a moving image from the camera 70, attempts to detect an object separately in individual detection regions, each of which corresponds to an individual floodlighting region. The sensing section 61, in the case where it has detected an object within a detection region, outputs to the identifying section 62 a detection signal indicative of the detection region in which the sensing section 61 has detected the object.

Then, the identifying section 62 identifies the kind of the object within the detection region indicated by the detection signal outputted from the sensing section 61 (S3). Specifically, the identifying section 62, upon obtaining a detection signal from the sensing section 61, (i) extracts features (for example, moving speed, shape, and position) of the object within the detection region indicated by the detection signal, and (ii) calculates a feature value, which is a numerical representation of the features.

Next, the identifying section 62 refers to a reference value table to retrieve a reference value having a difference from the calculated feature value which difference is within a predetermined threshold. The identifying section 62, in the case where it has identified a reference value having a difference from the calculated feature value which difference is within the predetermined threshold, determines that the object represented by that reference value is the object detected by the sensing section 61.

The identifying section 62, on the basis of the determination result, outputs to the light amount control section 63 an identification signal indicative of (i) the kind of the object represented by the reference value and (ii) the detection region in which the sensing section 61 has detected the object. The identifying section 62, in the case where, for instance, it has determined that the kind of the object is an oncoming vehicle, outputs to the light amount control section 63 a detection signal indicative of a detection region corresponding to the floodlighting region in which the sensing section 61 has detected the oncoming vehicle.

Then, the light amount control section 63, in accordance with the kind of the object represented by the identification signal received from the identifying section 62, controls the amount of light to be cast to an individual floodlighting region corresponding to the detection region (S4). Specifically, in the case where the identifying section 62 has outputted an identification signal indicative of an oncoming vehicle, a preceding vehicle or the like as the kind of the object, the light amount control section 63 decreases an output (floodlighting) of the laser element 2 to a floodlighting region corresponding to the detection region (in which the sensing section 61 has detected the oncoming vehicle, the preceding vehicle or the like). This configuration can reduce unpleasant glare and dazzle that, for example, the driver of an oncoming vehicle, a preceding vehicle or the like experiences. The above configuration can thus create a safe and comfortable traffic environment.

In the case where the identifying section 62 has outputted an identification signal indicative of a road sign, an obstacle or the like as the kind of the object, the light amount control section 63 increases an output (floodlighting) of the laser element 2 to a floodlighting region corresponding to the detection region (in which the sensing section 61 has detected the road sign, the obstacle or the like). This configuration, which brightly lights the road sign, the obstacle or the like, allows the driver to, for example, visually read a road sign correctly and recognize an obstacle or the like correctly. The above configuration can thus create a safe traffic environment.

The technique for identifying the kind of an object in a moving image is not limited to the above, and may be a publicly known technique.

The reference value table may manage not only reference values corresponding to an oncoming vehicle, a preceding vehicle, a road sign, an obstacle and the like, but also reference values corresponding to a pedestrian, a bicycle and the like. This configuration allows the amount of light to be optimally controlled in accordance with the kind of an object identified by the identifying section 62.

The reference value table referred to by the identifying section 62 may be set by the user as appropriate, and is particularly effective for a searchlight or a ship, for example.

In the case where, for instance, any floodlight above is applied to a searchlight, the above configuration allows the user to register in the reference value table (i) an advertisement on an advertising balloon and (ii) a portion of the advertisement which portion needs emphasizing. This allows the searchlight to (i) follow the advertising balloon if it has been moved by the wind and also to (ii) particularly brightly light only the portion of the advertisement which portion needs emphasizing.

The camera 70 may be a camera for visible light, a camera for infrared light, or a camera for both visible light and infrared light. Including a camera for infrared light facilitates sensing homothermal animals including a human being.

The technique for identifying the kind of an object in a moving image captured by the camera 70 is not limited to the above, and may be a publicly known technique.

The camera 70 may be replaced with an infrared radiation radar that radiates an infrared ray to an object present in a light-distribution area and senses a reflected wave from that object. Alternatively, the camera 70 may be used in combination with such an infrared radiation radar. The case involving an infrared radiation radar can, similarly to the case involving the camera 70, also use a widely usable technique to sense an object present in a light-distribution area.

[Another Configuration of Light Amount Adjusting Section 60]

The light amount adjusting section 60 may be unconnected with the camera 70 and simply include only the light amount control section 63. The floodlight, in this case, allows the driver or fellow passenger to set the intensity of a laser beam and input the setting value to the light amount control section 63. This configuration allows the light amount control section 63 to, even if unconnected with the camera 70, control the amount of light that is emitted by the laser element 2.

[Effects Brought about by Light Amount Adjusting Section 60]

With reference to, for example, FIG. 17, the description below deals with effects brought about by the light amount adjusting section 60.

Figure 17:
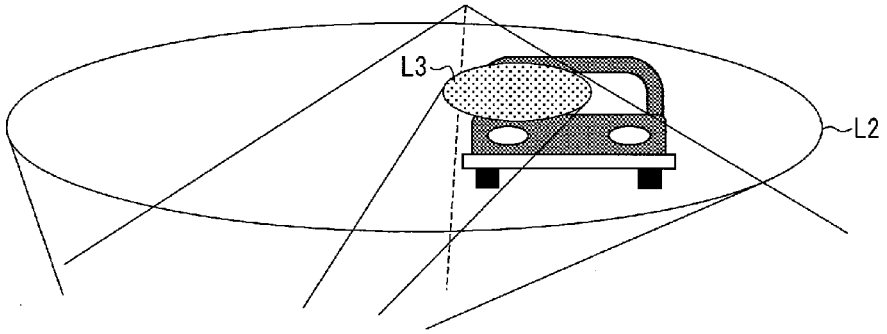
FIG. 17 is a diagram for explaining an effect that is brought about by the light amount adjusting section.

FIG. 17 is a diagram for explaining an effect that is brought about by the light amount adjusting section 60. FIG. 17 illustrates (i) an elliptic region L2 indicative of a range of floodlighting which range is lit by a vehicle equipped with a floodlight including the light amount adjusting section 60 and (ii) a vehicle as an oncoming vehicle. The method described above with reference to, for example, FIG. 15 makes it possible to, while using a high beam, control a floodlighting region so that the vehicle casts no light to a region (region L3) within the region L2 which region L3 corresponds to the driver of the oncoming vehicle such that if the vehicle casts light to the region L3, the driver of the oncoming vehicle would be subjected to the floodlighting. Further, the above method makes it possible to control a floodlighting region for not only an oncoming vehicle but also a preceding vehicle. This configuration can reduce unpleasant glare and dazzle that, for example, the driver of an oncoming vehicle, a preceding vehicle or the like experiences. The above configuration can thus create a safe and comfortable traffic environment.

Figure 18:
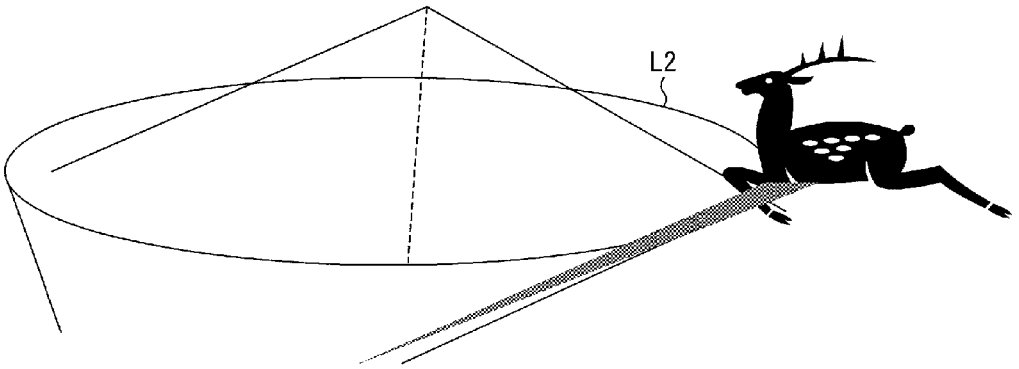
FIG. 18 is a diagram for explaining an effect that is brought about by the light amount adjusting section.

FIG. 18 is a diagram for explaining an effect that is brought about by the light amount adjusting section 60. FIG. 18 illustrates (i) an elliptic region L2 indicative of a range of floodlighting which range is lit by a vehicle equipped with a floodlight including the light amount adjusting section 60 and (ii) a deer as an example accident factor. The method described above with reference to, for example, FIG. 15 makes it possible to increase an output (floodlighting) of the laser element 2 to a floodlighting region corresponding to the detection region in which the sensing section 61 has detected the deer. This configuration brightly lights the deer so as to allow the driver to visually recognize the deer correctly and thus to create a safe traffic environment.

FIG. 18 illustrates a deer to explain an effect of the light amount adjusting section 60. This effect is, however, also brought about in the case of a road sign, an obstacle or the like instead of a deer.

Figure 19:
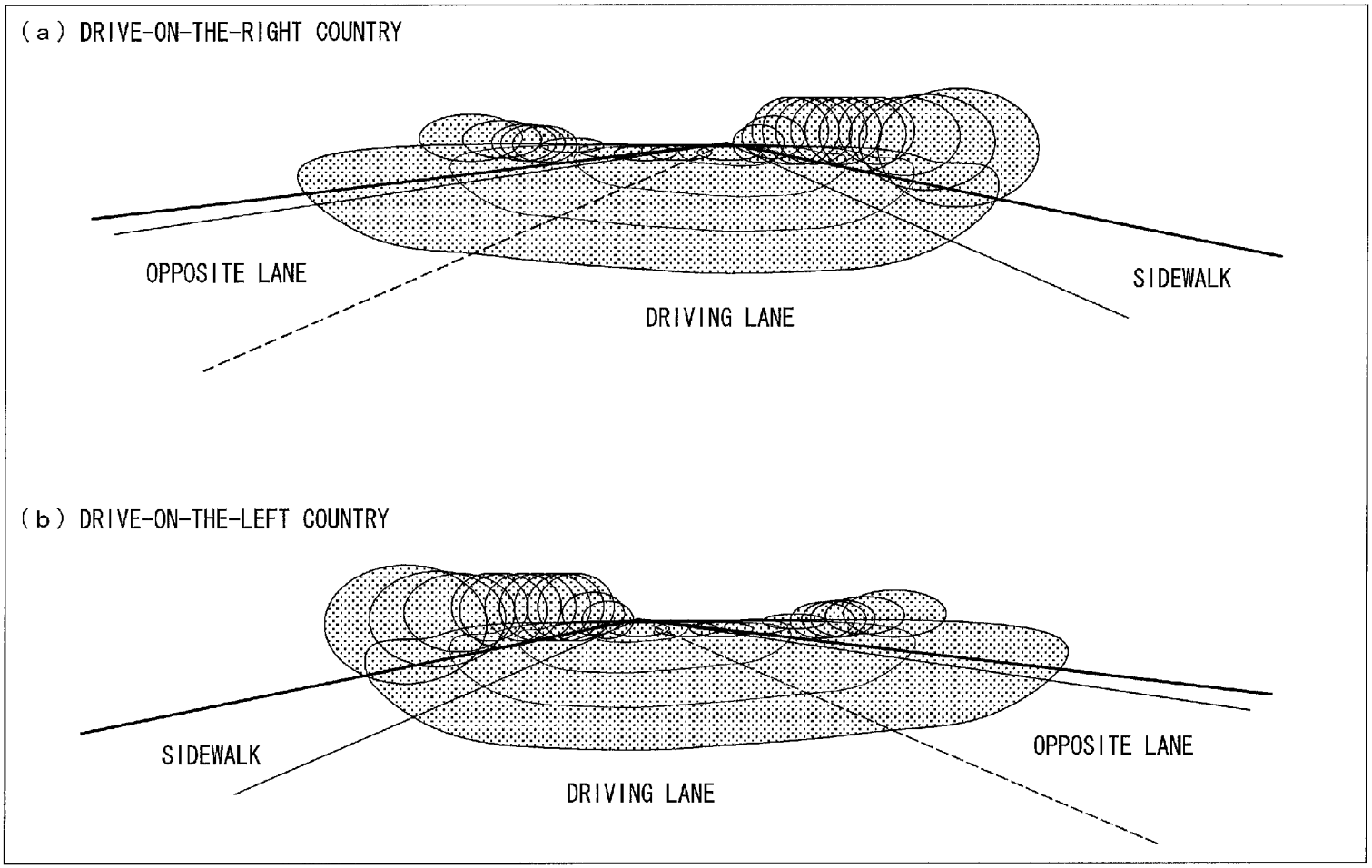
FIG. 19 is a diagram for explaining an effect that is brought about by the light amount adjusting section.

FIG. 19 is a diagram for explaining an effect that is brought about by the light amount adjusting section 60. The light-distribution pattern needs changing between, for example, (i) France, which is a drive-on-the-right country, and (ii) the United Kingdom, which is a drive-on-the-left country. In view of this, the light amount adjusting section 60 changes the light-distribution pattern in accordance with the laws and regulations of the country in which a vehicle is driven. FIG. 19 illustrates how the light-distribution pattern is changed, the upper half of FIG. 19 illustrating a light-distribution pattern for a drive-on-the-right country and the lower half of FIG. 19 illustrating a light-distribution pattern for a drive-on-the-left country. In the case where, for instance, the vehicle travels from the United Kingdom to France or vice versa, the light amount adjusting section 60 can, by for example connecting to a global positioning system (GPS), automatically change the light-distribution pattern as illustrated in FIG. 19. This configuration can provide the driver with a safe driving environment.

The light amount adjusting section 60 can bring about various effects as described above. The light amount adjusting section 60 can additionally carry out the operation below (not illustrated in the drawings).

Specifically, the movement control section 11, when the identifying section 62 has identified an ascending slope, receives from the identifying section 62 a signal indicating that the identifying section 62 has recognized an ascending slope. The movement control section 11 then changes the laser beam illumination position by changing a relative position of the lens 10 with respect to the light-emitting section 4, thereby changing, from a forward direction to a ground direction, a range in which illuminating light is emitted from a vehicle.

Further, the movement control section 11, when the identifying section 62 has identified a descending slope, receives from the identifying section 62 a signal indicating that the identifying section 62 has recognized a descending slope. The movement control section 11 then changes the laser beam illumination position by changing the relative position of the lens 10 with respect to the light-emitting section 4, thereby changing, from the forward direction to a direction opposite from the ground direction, the range in which the illuminating light is emitted from the vehicle.

With the above configuration, in the case where the identifying section 62 has identified an ascending slope or descending slope, the movement control section 11 changes the laser beam illumination position by changing the relative position of the lens 10 with respect to the light-emitting section 4. The movement control section 11 thus changes, from the forward direction to the ground direction or direction opposite from the ground direction, the range in which illuminating light is emitted from the vehicle.

The above configuration allows the vehicle 55 to appropriately light a road even if an ascending slope or descending slope appears in the forward direction, and can thus provide the driver with a safe driving environment.

The light amount adjusting section 60 can also carry out the operation below in cooperation with the movement control section 11.

Specifically, the movement control section 11, in the case where the sensing section 61 has sensed an object such as a road sign or an obstacle, receives from the sensing section 61 a signal indicating that the sensing section 61 has sensed an object. The movement control section 11 then moves the lens 10 to change the relative position of the lens 10 with respect to the light-emitting section 4.

In the case where the identifying section 62 has identified, by image recognition, the kind of the object sensed by the sensing section 61, the movement control section 11 receives from the identifying section 62 a signal indicative of the identified kind of the object. The movement control section 11 then moves the lens 10 in accordance with the kind of the object identified by the identifying section 62, thereby changing the relative position of the lens 10 with respect to the light-emitting section 4.

The light amount control section 63, in the case where the sensing section 61 has detected an object such as a road sign or an obstacle, receives a signal indicative of that object from the sensing section 61. The light amount control section 63 then controls the amount of light that is emitted by the laser element 2 that performs floodlighting on the floodlit region in which the object has been sensed.

The light amount control section 63 controls the amount of light, emitted by the laser element 2, so that either one of an illuminating light-distribution pattern (or illuminance) stipulated in a drive-on-the-right country and an illuminating light-distribution pattern (or illuminance) stipulated in a drive-on-the-left country is satisfied.

[Floodlight 1000]

Figure 21:
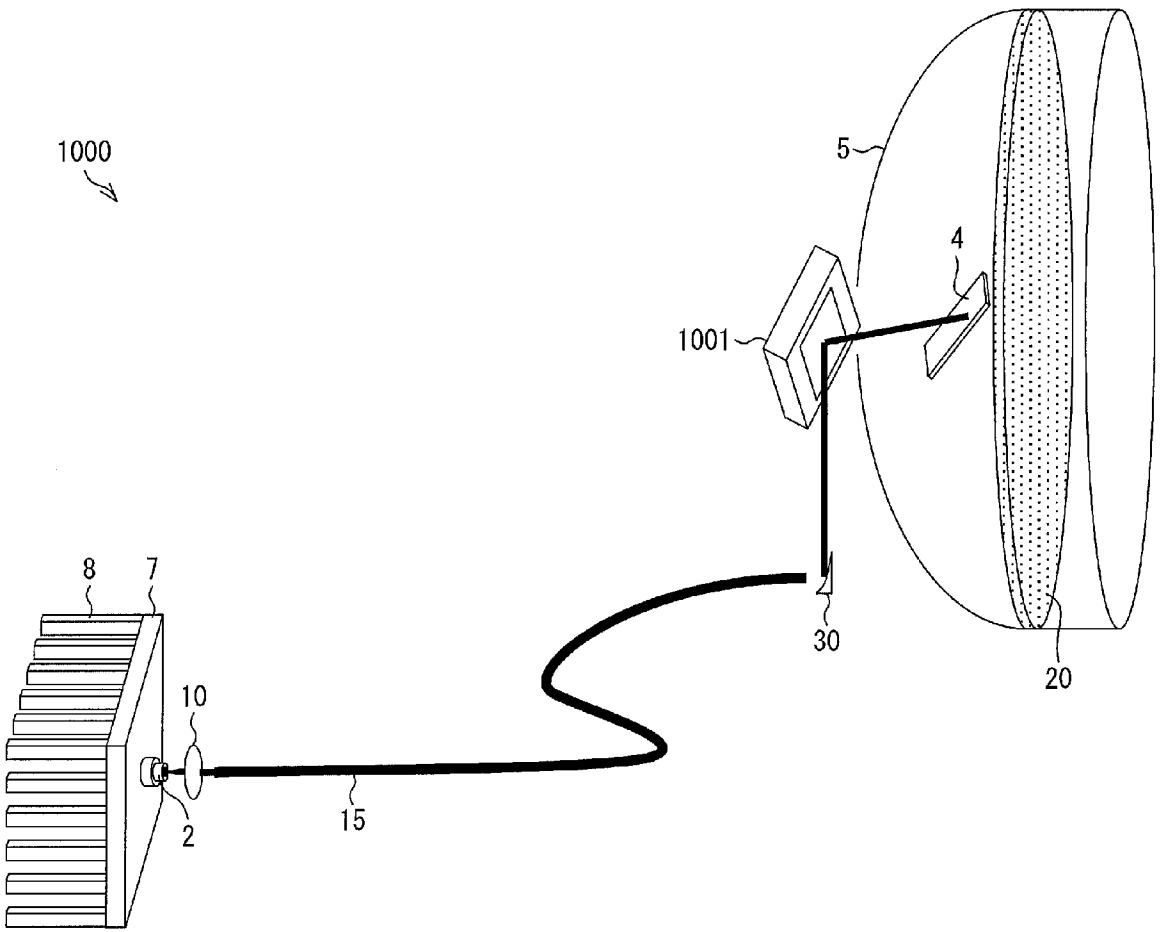
FIG. 21 is a schematic view of another floodlight according to the present embodiment.

The description below deals with another floodlight 1000 of the present embodiment with reference to FIG. 21. FIG. 21 is a schematic view of the floodlight 1000. As illustrated in FIG. 21, the floodlight 1000 includes a laser element 2, a light-emitting section 4, a parabolic mirror 5 provided with a wavelength cut coating 20, a heat radiating base 7, a fin 8, and a lens 10. The floodlight 1000 further includes a fiber 15, an initial mirror 30, and a MEMS (micro electro mechanical system) mirror 1001.

Note that the following description gives identical parts and components respective identical reference signs. The identical parts and components are also identical in names and functions. Therefore, a specific description of those parts and components is not repeated. This applies also to descriptions below of a floodlight 1010 and the like.

The fiber 15 may be (i) a single-mode fiber or (ii) a multimode fiber, of which the core for transmitting light is thick. The fiber 15 may be made of not only quartz but also plastic. The fiber 15, in such a case, is inexpensive and high in bend strength. The fiber 15 may be connected to the lens 10 by a butt joint.

Figure 22:
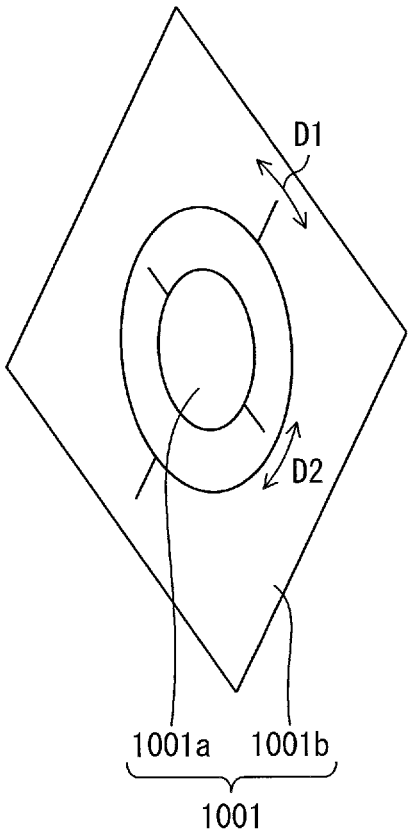
FIG. 22 is a schematic view explaining a MEMS mirror.

The laser element 2 emits a laser beam, which travels through the lens 10 and the fiber 15 and is reflected by the initial mirror 30 to fall upon the MEMS mirror 1001. The MEMS mirror 1001 is a minute electron mirror including fine parts formed by integrating machine parts with electron circuits. The MEMS mirror 1001 is provided between (i) the laser element 2 and (ii) a region outside the parabolic mirror 5 which region is located on the side opposite from the opening of the parabolic mirror 5. The description below deals with the MEMS mirror 1001 with reference to FIG. 22. FIG. 22 is a schematic view explaining the MEMS mirror 1001.

The MEMS mirror 1001 includes a mirror section 1001*a* and a mirror driving section 1001*b*. The mirror section 1001*a* is provided as surrounded by the mirror driving section 1001*b*. The mirror section 1001*a* is exemplified by, but is not limited to, a circular biaxial mirror having a diameter of 1 mm Φ. The mirror section 1001*a* may have a mirror plane provided with a coating such as an Al coating.

The mirror driving section 1001*b* is, for example, configured as follows, but is not limited to such a configuration: The mirror driving section 1001*b* is substantially square with a side of 5 mm, and surrounds the mirror section 1001*a*. The mirror driving section 1001*b* changes its angle in response to a voltage change along a direction D1 (that is, an X axis direction perpendicular to the gravitational direction) and/or a direction D2 (that is, a Y axis direction defined as the gravitational direction). The mirror driving section 1001*b*, by means of the angle change, moves the mirror section 1001*a* provided on the mirror driving section 1001*b*. Moving the mirror section 1001*a* as such consequently changes the illumination position and spot size of a laser beam that is emitted by the light-emitting section 4 after being reflected by the mirror section 1001*a*. This configuration allows the floodlight 1000 to emit light to any position and change the light-distribution pattern.

The MEMS mirror 1001 is preferably set to have a drive range along the Y axis direction which range is longer than a drive range along the X axis direction. This configuration is particularly effective in the case where the floodlight 1000 has a horizontally long range of floodlighting. The drive ranges of the MEMS mirror 1001 may, however, be changed as appropriate in accordance with its range of floodlighting. For example, in the case where the floodlight 1000 has a longitudinally long range of floodlighting, the MEMS mirror 1001 is set to have a drive range along the X axis direction which range is longer than a drive range along the Y axis direction.

In the case where the floodlight 1000 forms a floodlighting pattern by continuously performing scanning with use of a laser beam and synchronizing the intensity of the laser beam with the scanning rate (scanning speed), the MEMS mirror 1001 is desirably a resonance-type MEMS mirror, which can increase its scanning rate.

The MEMS mirror 1001 is desirably of a resonance type in the case where, for instance, the floodlight 1000 performs scanning at a vertical scanning rate of 60 Hz and synchronizes the intensity of a laser beam with the scanning rate to form, in the light-emitting section 4, a light-emitting pattern that can serve as a floodlighting pattern for a passing lamp.

In the case where the present system is used to change the floodlighting position of spot light or continuously light a target object (for example, a deer as a risk factor), the MEMS mirror 1001 is desirably a MEMS of a non-resonance type because continuously lighting a target object increases illuminance for such a target object (at a given laser output).

[Floodlight 1010]

Figure 23:
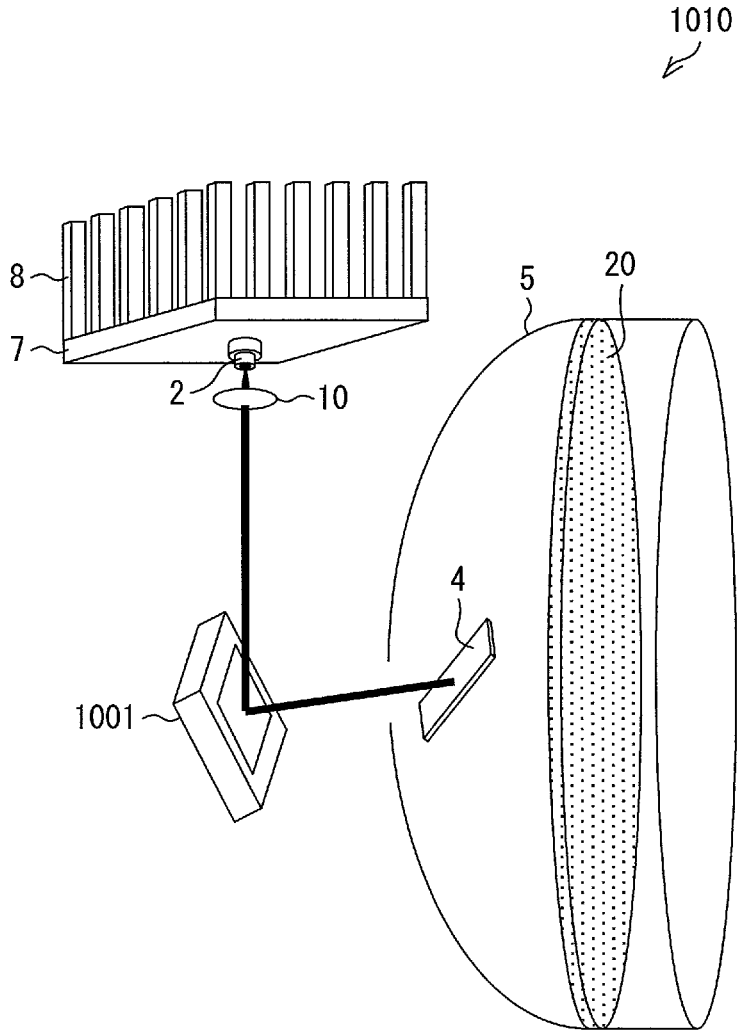
FIG. 23 is a schematic view of another floodlight according to the present embodiment.

With reference to FIG. 23, the description below deals with a floodlight 1010, which is a variation of the floodlight 1000. FIG. 23 is a schematic view of the floodlight 1010. As illustrated in FIG. 23, the floodlight 1010 includes a laser element 2, a light-emitting section 4, a parabolic mirror 5 provided with a wavelength cut coating 20, a heat radiating base 7, a fin 8, a lens 10, and a MEMS mirror 1001.

The floodlight 1010 differs from the floodlight 1000 of FIG. 21 in that it includes neither of the fiber 15 and the initial mirror 30 both included in the floodlight 1000. With this configuration, the laser element 2 emits a laser beam, which travels through the lens 10, falls upon the MEMS mirror 1001 to be reflected thereby, and then arrives at the light-emitting section 4. The floodlight 1010, during this operation, moves the above-described MEMS mirror 1001 to emit light to any position and change the light-distribution pattern.

As described above, the floodlight 1010 can, without using the fiber 15 or the initial mirror 30, bring about effects similar to those brought about by the floodlight 1000. The floodlight 1010 includes fewer parts than the floodlight 1000, which in turn increases the degree of freedom in designing the layout inside the floodlight 1010.

[Floodlight 1020]

Figure 24:
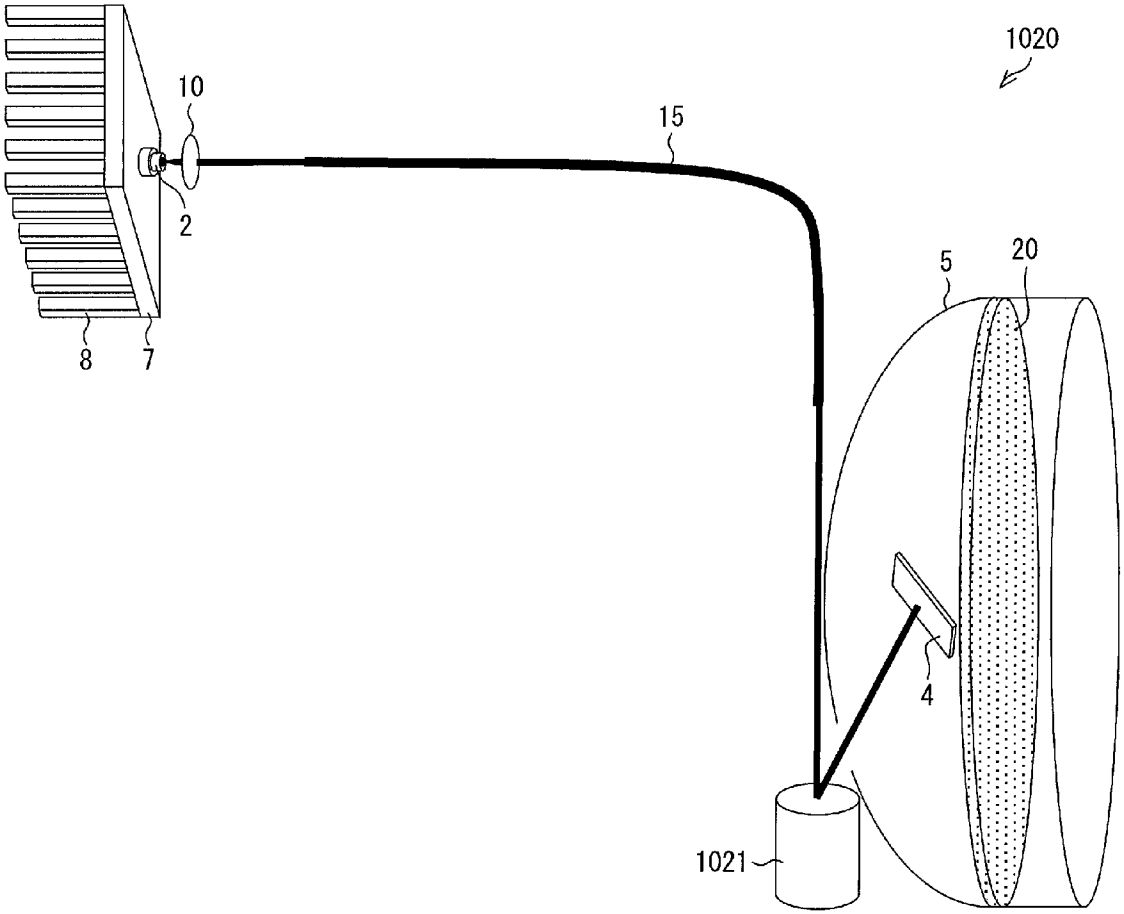
FIG. 24 is a schematic view of another floodlight according to the present embodiment.

With reference to FIG. 24, the description below deals with another floodlight 1020 of the present embodiment. FIG. 24 is a schematic view of the floodlight 1020. As illustrated in FIG. 24, the floodlight 1020 includes a laser element 2, a light-emitting section 4, a parabolic mirror 5 provided with a wavelength cut coating 20, a heat radiating base 7, a fin 8, and a lens 10. The floodlight 1020 further includes a fiber 15 and a piezo mirror element 1021.

The floodlight 1020 is configured as follows: The laser element 2 emits a laser beam, which travels through the lens 10 and the fiber 15 to fall upon the piezo mirror element 1021. The laser beam is then reflected by the piezo mirror element 1021 to arrive at the light-emitting section 4.

Figure 27:
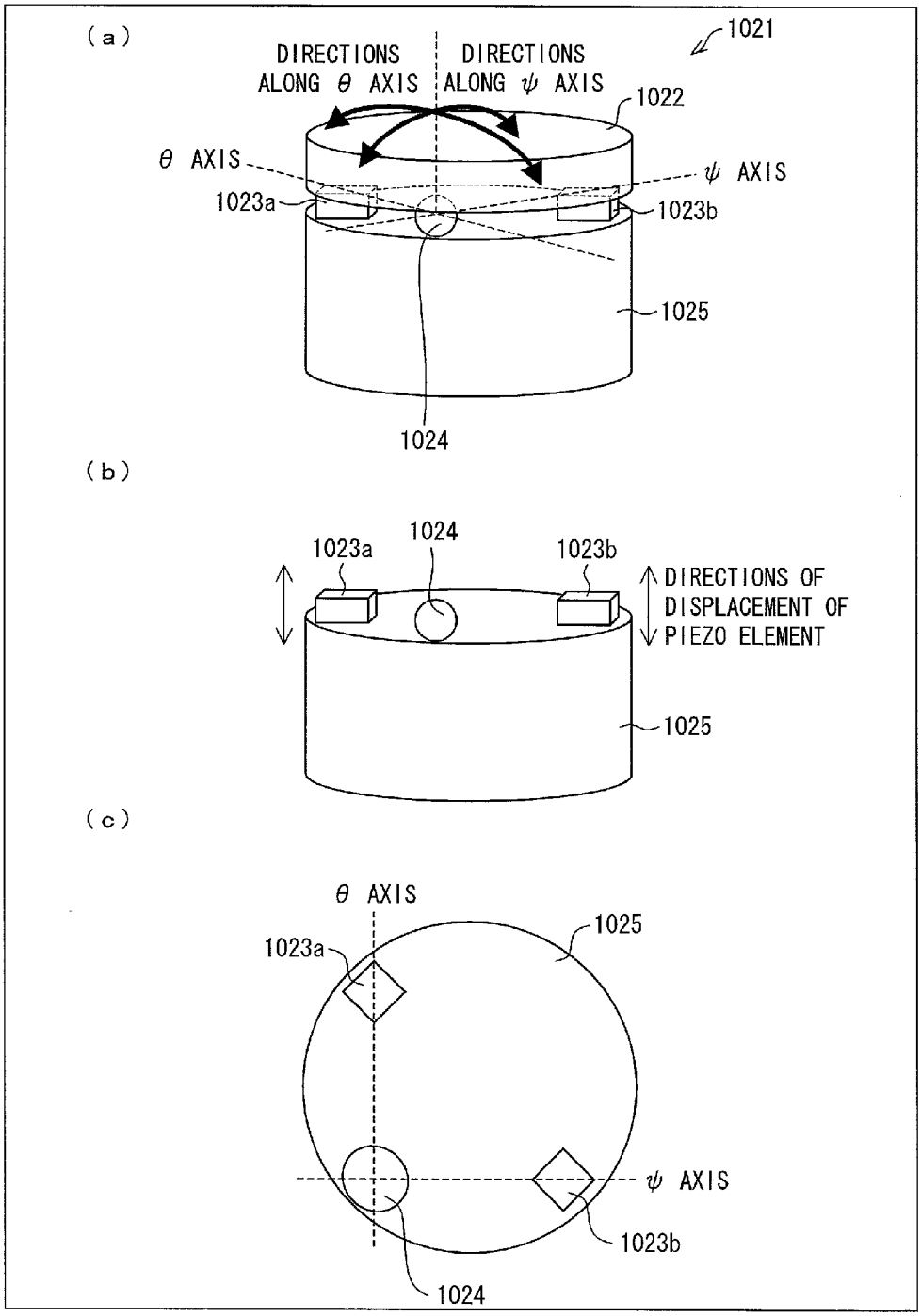
FIG. 27 is a set of schematic views explaining a piezo mirror element.

The piezo mirror element 1021 is an element that includes a piezo element and a mirror and that is movable along two-dimensional directions (biaxial directions) on the mirror plane of the mirror. The piezo element can move the mirror to change the optical path of a reflected laser beam in the biaxial directions. The description below deals with a specific configuration of the piezo mirror element 1021 with reference to FIG. 27. FIG. 27 is a set of schematic views explaining the piezo mirror element 1021, where (*a*) is a perspective view schematically illustrating an overall configuration of the piezo mirror element 1021, (*b*) is a perspective view schematically illustrating a configuration of the portion other than the mirror 1022, and (*c*) is a top view of the portion illustrated in (*b*), the top view illustrating an example positional arrangement of piezo elements 1023*a* and 1023*b* and a fulcrum member 1024.

As illustrated in (*a*) and (*b*) of FIG. 27, the piezo mirror element 1021 is configured to include, on a foundation 1025, (i) a piezo element 1023*a* for θ axis direction driving, (ii) a piezo element 1023*b* for Ψ axis direction driving, (iii) a fulcrum member 1024, and (iv) a mirror 1022 on top of the above members.

The piezo elements 1023*a* and 1023*b* are each made of a piezoelectric ceramic, and are each a piezoelectric device that, in response to voltage application, causes displacement in the direction perpendicular to the θ axis and Ψ axis (that is, the direction perpendicular to a top surface of the foundation 1025) due to a piezoelectric effect. The piezo elements 1023*a* and 1023*b* are, for example, each a laminated piezoelectric actuator produced by NEC Tokin Corporation.

The piezo elements 1023*a* and 1023*b* and the fulcrum member 1024 are, for example, arranged on the foundation 1025 as illustrated in (*c*) of FIG. 27. Specifically, (i) the piezo element 1023*a* and the fulcrum member 1024 are provided on the θ axis and in the vicinity of respective opposite ends on the foundation 1025, and (ii) the piezo element 1023*b* is provided on the Ψ axis and in the vicinity of an end on the foundation 1025. The mirror 1022 is provided on top of the piezo elements 1023*a* and 1023*b*, which are provided on the respective two axes (namely, the θ axis and Ψ axis). In other words, the mirror 1022 in FIG. 27 is so provided as to cover the piezo elements 1023*a* and 1023*b* and the fulcrum member 1024, which are provided on the two axes as described above.

Applying a voltage to the piezo elements 1023*a* and 1023*b* of the piezo mirror element 1021, which includes its individual members as described above, causes the piezo elements 1023*a* and 1023*b* to be each so displaced in the direction perpendicular to the top surface of the foundation 1025 as to move the mirror plane of the mirror 1022 along the perpendicular direction. The mirror 1022 is in actuality moved with the fulcrum member 1024 as a fulcrum. Thus, the displacement of the piezo elements 1023*a* and 1023*b* can change the inclination of the mirror 1022 along the biaxial directions.

The floodlight 1020 changes the inclination of the mirror 1022 of the piezo mirror element 1021 to control the optical path of a laser beam emitted from the fiber 15, and controls the illumination position in the light-emitting section 4 to controlled floodlighting. The piezo elements 1023*a* and 1023*b* are each controlled by a piezo mirror driving section (movement control section; not illustrated).

The piezo mirror element 1021 configured as above is capable of highly precise angle adjustment, and is thus suitable for the case in which, for example, the optical path is long or a laser beam is reflected a plurality of times. The piezo mirror element 1021 is, for example, 20 mm in height and 40 mm Φ in diameter, but is not limited to such a size.

As described above, the floodlight 1020 can, with use of the piezo mirror element 1021 as well, emit light to any position and change the light-distribution pattern freely.

The positional arrangement of the piezo elements 1023*a* and 1023*b* and the fulcrum member 1024 is not limited to that illustrated in (*c*) of FIG. 27. The above members are, for example, not necessarily provided in the vicinity of respective ends on the foundation 1025. The positional arrangement of the above members may be changed as appropriate in accordance with, for example, the range in which the mirror 1022 is inclined.

As described above, the floodlight 1020 can, with use of the piezo mirror element 1021 as well, emit light to any position and change the light-distribution pattern freely.

[Floodlight 1030]

Figure 25:
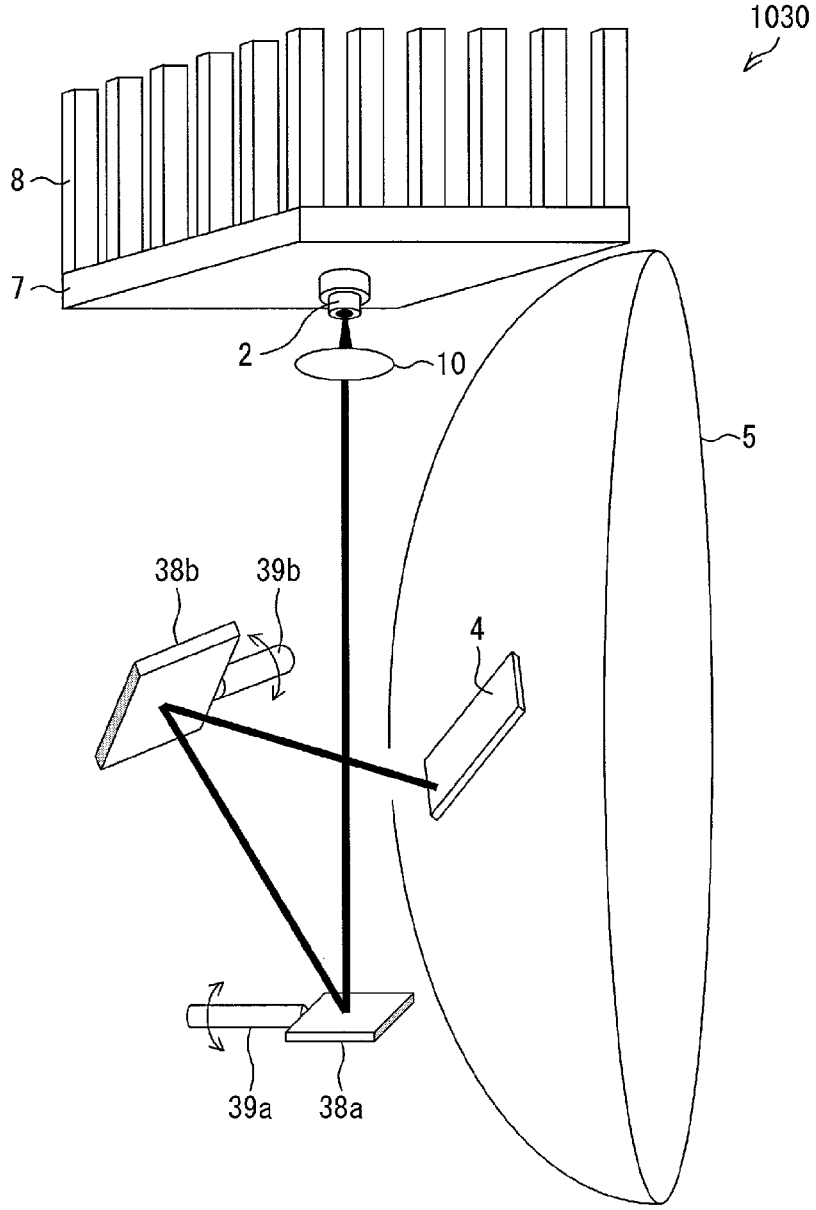
FIG. 25 is a schematic view of another floodlight according to the present embodiment.

With reference to FIG. 25, the description below deals with another floodlight 1030 of the present embodiment. FIG. 25 is a schematic view of the floodlight 1030. As illustrated in FIG. 25, the floodlight 1030 includes a laser element 2, a light-emitting section 4, a parabolic mirror 5, a heat radiating base 7, a fin 8, and a lens 10. The floodlight 1030 further includes a galvanometer mirror 38*a* for an X axis, a galvanometer mirror driving section 39*a*, a galvanometer mirror 38*b* for a Y axis, and a galvanometer mirror driving section 39*b*.

The galvanometer mirror 38*a* is rotated, as driven by the galvanometer mirror driving section 39*a*, by an amount corresponding to the level of a received driving voltage, and thus changes its angle of reflection along an X axis direction (that is, the direction perpendicular to the gravitational direction). The galvanometer mirror 38*a* reflects a laser beam to redirect it toward the light-emitting section 4. With this configuration, the galvanometer mirror 38*a* can cause a laser beam to fall upon the light-emitting section 4 at any angle along the X axis direction.

Similarly, the galvanometer mirror 38*b* is rotated, as driven by the galvanometer mirror driving section 39*b*, by an amount corresponding to the level of a received driving voltage, and thus changes its angle of reflection along a Y axis direction (that is, the gravitational direction). The galvanometer mirror 38*b* reflects a laser beam to redirect it toward the light-emitting section 4. With this configuration, the galvanometer mirror 38*b* can cause a laser beam to fall upon the light-emitting section 4 at any angle along the Y axis direction.

The floodlight 1030 can, with use of the galvanometer mirror 38*a* for the X axis, the galvanometer mirror driving section 39*a*, the galvanometer mirror 38*b* for the Y axis, and the galvanometer mirror driving section 39*b* in cooperation with one another, emit light to any position and change the light-distribution pattern freely.

The galvanometer mirrors 38*a* and 38*b* are each provided with an HR coating made from a dielectric multilayer film. The HR coating is tuned to the wavelength of light that is emitted by the laser element 2.

Providing the HR coating can reduce optical loss. Since the present embodiment uses a high-power laser, providing no HR coating will problematically cause optical loss to change into heat, which will distort an optical element. Further, while a vehicle floodlight can change the illumination position and spot size of a laser beam in any manner, the light distribution (time-averaged light distribution) of a laser beam formed in the light-emitting section 4 is, in accordance with a floodlighting pattern for a headlamp which pattern is stipulated in the laws and regulations, frequently an identical light distribution for forming a pattern that conforms to the laws and regulations. This indicates that individual optical elements are each not uniformly exposed to a laser beam, but only a particular region of the optical element is constantly exposed to a high laser output. Thus, providing no HR coating will problematically cause such a particular region to deteriorate.

[Floodlight 1040]

Figure 26:
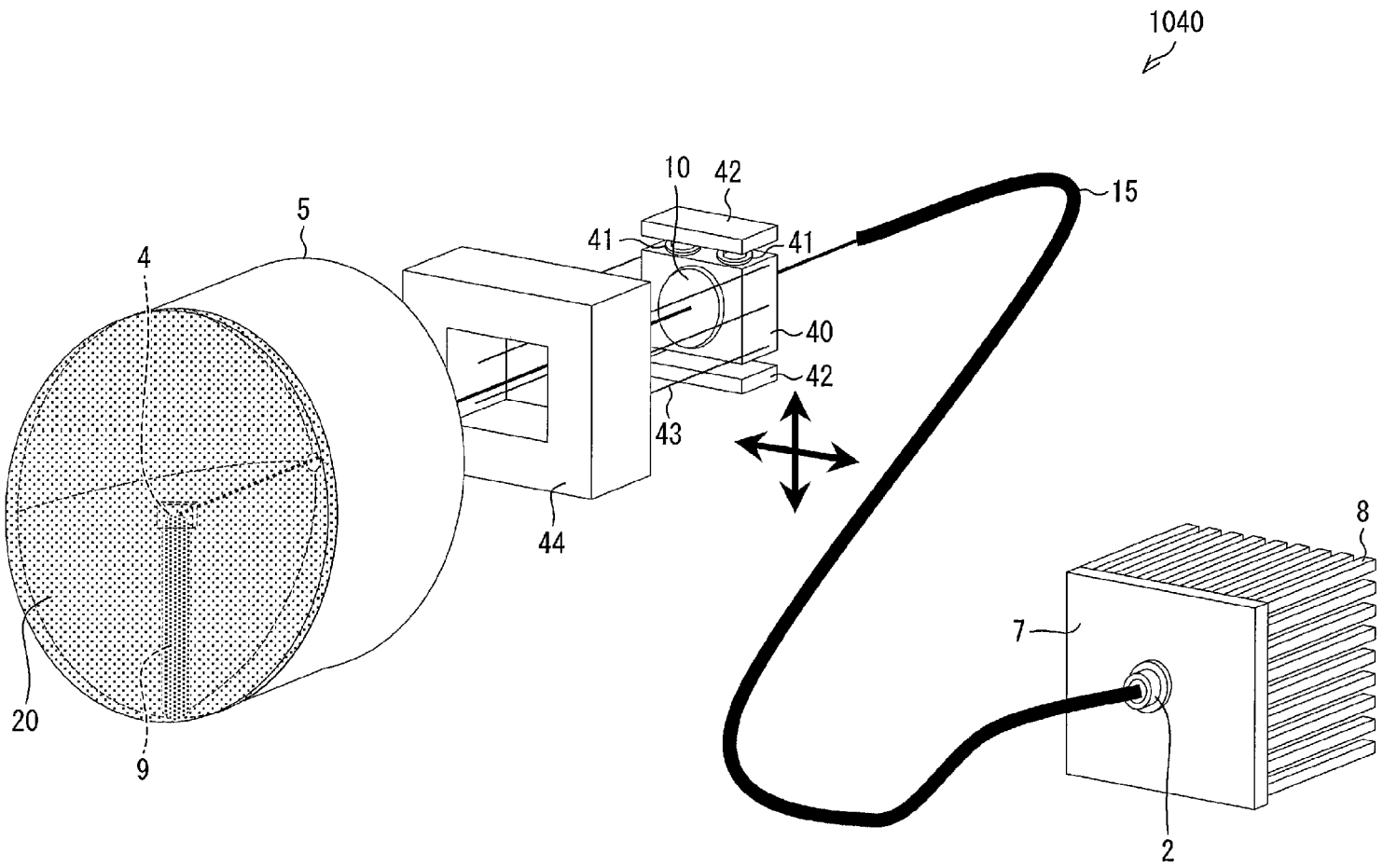
FIG. 26 is a schematic view of another floodlight according to the present embodiment.

With reference to FIG. 26, the description below deals with another floodlight 1040 of the present embodiment. FIG. 26 is a schematic view of the floodlight 1040. The floodlight 1040 is identical in configuration to the floodlight 200 of FIG. 1 except that the laser element 2 of the floodlight 1040 emits a laser beam, which is guided through a fiber 15 to a lens 10 fitted in a lens frame body 40. The fiber 15 may be connected to the laser element 2 by a butt joint. The parabolic mirror 5 of the floodlight 1040 is provided with a wavelength cut coating 20. The floodlight 1040 thus blocks light within a particular wavelength range, and helps provide a user with a device that is easy on the human eye.

The description above has dealt with how the floodlight 1040 differs from the floodlight 200 illustrated in FIG. 1. The floodlight 1040, which has the above configuration, can bring about effects similar to those brought about by the floodlight 200. The floodlight 1040 can thus as appropriate change the route through which light is guided from the laser element 2 to the lens 10. This in turn makes it possible to design the floodlight 1040 while taking its overall layout into consideration. In this respect, the floodlight 1040 brings about an effect different from those brought about by the floodlight 200.

The description above has dealt with various light-emitting devices and floodlights of the present embodiment. The above light-emitting devices and floodlights, however, each merely serve as an example of the present embodiment, and may, needless to say, be combined with one another.

[Problems of Conventional Techniques]

Finally, a light-emitting device in accordance with the present embodiment including the foregoing various features can solve the following problems of the techniques of Patent Literature 1 etc.

The vehicle headlamp of Patent Literature 1 emits a laser beam directly to the outside, and includes no light-emitting section that emits light in response to a laser beam. Therefore, the vehicle headlamp of Patent Literature 1 has a problem of having an extremely low color rendering property of light having a wavelength other than a wavelength of a laser beam.

As in the case of the vehicle headlamp of Patent Literature 1, the headlight of Patent Literature 2 also includes no light-emitting section that emits light in response to a laser beam. Therefore, the headlight of Patent Literature 2 has a problem of having an extremely low color rendering property of light having a wavelength other than a wavelength of a laser beam.

The vehicle lamp of Patent Literature 3 uses an LED as a light source. Since an LED is lower in luminance than a laser light source, it is necessary to increase a light-emitting area so as to obtain a necessary luminous flux. Accordingly, in a case where an LED light source is used in an automobile or a motorcycle which is limited in size of a lamp, there occurs a problem such that the LED light source illuminates a wider region than a laser light source and it is therefore impossible to reduce a size of a lamp such as a running light that is required to cast light at a narrow angle.

Further, according to the vehicle lamp of Patent Literature 3, it is difficult in terms of a vehicle front space to set a lamp which is further required to cast light at a narrow angle than a running light, e.g., which illuminates only an object (e.g., a human) existing at a place to be illuminated (e.g., 40 meters ahead) or does not illuminate only an object (e.g., an opposite lane). It is also difficult to freely change a light-distribution pattern by combining a plurality of narrow-angle floodlights.

In addition, according to the vehicle lamp of Patent Literature 3, there exists a non-light-emitting part between respective LEDs. Therefore, the vehicle lamp needs to be used while being blurred at an illuminated position. This makes it impossible to obtain a contrast (which clarifies a boundary between a bright part and a dark part). Note that, in a case where the vehicle lamp is used without being blurred at an illuminated position, a higher contrast is obtained but a non-light-emitting part between respective LEDs is projected. Therefore, for example, in a case where two LEDs are on, bright-dark-bright floodlighting occurs.

The light source device of Patent Literature 4 is a device which merely emits light, i.e., a device which merely shines light. Patent Literature 4 discloses, as light control means for changing an emission range and/or a light intensity distribution of an excitation light beam, a method for moving a solid light source and a method for moving a mirror.

However, in a case where the light source device of Patent Literature 4 uses a solid light source, even if the light source device uses a semiconductor laser having high directivity, a beam diffusion angle is as wide as 40°. Therefore, though it is possible to change an emission range and/or a light intensity distribution of an excitation light beam, it is impossible to excite only any place in a fluorescent body layer.

Further, the light source device of Patent Literature 4 is not configured to control an illuminated position and an illuminated region (a spot size) in a fluorescent body part for each of beams of light emitted from a plurality of solid light sources. Accordingly, the light source device of Patent Literature 4 is incapable of uniformly illuminate an entire surface of a fluorescent body layer (cause the entire surface of the fluorescent body layer to uniformly emit light). In addition, for a similar reason, the light source device of Patent Literature 4 has a problem of being incapable of exciting the fluorescent body layer in a complicated shape (e.g., preventing a central part of the fluorescent body layer from emitting light and causing a circumference of the fluorescent body layer to emit light).

Patent Literature 4 also discloses (i) a configuration in which fluorescence is cast by providing a fluorescent body layer at a focal point of a lens system and (ii) a configuration in which a light-emitting component that is emitted in a front direction is increased by providing a reflection layer on a side surface of the fluorescent body layer. However, the light source device of Patent Literature 4 exhibits a characteristic of substantially Lambertian-shaped distribution of fluorescence. This prevents all fluorescence from entering an aperture of a lens, so that the light source device becomes an optical system which is extremely great in loss.

Moreover, according to the light source device of Patent Literature 4, it is necessary to increase NA (numerical aperture) (which is determined depending on a lens aperture and a lens focal distance) so as to use fluorescence with higher efficiency. However, according to the light source device of Patent Literature 4, a fluorescent body is excited by causing an excitation light beam to pass between the fluorescent body layer and a lens. Therefore, in a case where a lens having large NA is used, an excitation light beam is rejected by the lens since the excitation light beam is dispersed at a large angle. This prevents effective excitation of the fluorescent body layer. Contrary to this, it is necessary to reduce NA so that an excitation light beam is effectively emitted. This prevents effective casting of fluorescence. Namely, the light source device of Patent Literature 4 is a system which is extremely low in efficiency.

Furthermore, according to the light source device of Patent Literature 4, in order to move the solid light source and to make the light source device to be smaller and lower in weight, the solid light source is not cooled while the fluorescent body layer is cooled. This makes it impossible to obtain a luminance necessary for narrow-angle floodlighting by a vehicle lamp.

Further, Patent Literature 4 discloses a method which uses a digital micromirror device (DMD). This method is excellent in that an excitation range of the fluorescent body layer is controlled (patterned). However, according to the method, the digital micromirror device is entirely illuminated, and only light emitted to a part of the digital micromirror device is used. This causes a problem such that energy as much as unused light is lost and thus the light source device of Patent Literature 4 is low in efficiency, i.e., consumes more electric power.

In addition, the light source device of Patent Literature 4 uses an excitation light beam having a light intensity distribution such that an emission range and/or a light intensity distribution of the excitation light beam is changed by moving an exciting light source. This causes a problem such that the DMD surface also has a light intensity distribution and it is therefore impossible to obtain a sufficient contrast at a place with a weak light intensity even by turning on/off a micromirror.

A light-emitting device and the like in accordance with the present embodiment have been made in view of the above problems, and a light-emitting device and a vehicle headlight each having a high color rendering property and being capable of realizing any light-distribution pattern are provided.

[Summary of Embodiment 1]

A light-emitting device in accordance with a first embodiment the present invention includes: a light-emitting section which emits light in response to a laser beam emitted from a laser light source; a light control section which controls the laser beam to be guided from the laser light source to the light-emitting section; and a movement control section which causes the light control section to move, the movement control section changing an illumination position and a spot size of the laser beam in the light-emitting section by changing a relative position of the light control section with respect to the light-emitting section.

According to the above configuration, the light control section which controls the laser beam to be guided from the laser light source to the light-emitting section is moved under control by the movement control section. According to this, the laser beam that is guided from the laser light source to the light-emitting section is controlled, so that the illumination position and the spot size of the laser beam in the light-emitting section can be changed. As a result, the light-emitting device in accordance with the first embodiment of the present invention can (i) emit light to any place and (ii) freely change a light-distribution pattern.

In this case, since the light-emitting device in accordance with the first embodiment of the present invention uses the laser light source to secure a sufficient luminance and includes the light-emitting section which emits light in response to the laser beam, it is possible to improve a color rendering property and a contrast of light having a wavelength other than a wavelength of a laser beam.

The light-emitting device in accordance with the first embodiment of the present invention may be configured to further include a light amount control section which is capable of controlling an amount of the laser beam that is emitted by the laser light source.

According to the above configuration, in a case where the light amount control section controls an amount of the laser beam that is emitted by the laser light source, an intensity of the laser beam that is shone on the light-emitting section is controlled, and thus an intensity of light that is emitted by the light-emitting section can also be controlled. Therefore, since the light-emitting device in accordance with the first embodiment of the present invention can not only freely change a light-distribution pattern but also freely control an intensity of the light. This makes it possible to achieve a free light-distribution pattern with a change in density.

The light-emitting device in accordance with the first embodiment of the present invention may be configured such that the light-emitting section at least contains a fluorescent body which emits fluorescence in response to the laser beam. The fluorescent body is not particularly limited in kind, and various fluorescent bodies can be used. The fluorescent body may be made up of only a single kind of fluorescent body or a plurality of kinds of fluorescent bodies. According to this, for example, in a case where blue, green, red, and yellow fluorescent bodies are appropriately combined as the light-emitting section, a light-emitting device having a favorable color rendering property can be achieved.

It is also possible to use, as another example of the fluorescent body, a semiconductor nanoparticle fluorescent body which uses a III-V-group compound semiconductor nanometer-sized particle fluorescent body. This allows the device (i) to be highly resistant to a high-powered laser beam whose power can be quickly emitted as fluorescence and (ii) to be longer-lived.

Thus, since the light-emitting section at least contains a fluorescent body which emits fluorescence in response to the laser beam, the light-emitting device in accordance with the first embodiment of the present invention can be more advantageous in terms of, for example, a color rendering property and a life.

The light-emitting device in accordance with the first embodiment of the present invention may be configured such that: in a case where the light-emitting section has such light-distribution characteristics as to emit light more intensely on a side thereof opposite from a side thereof on which the laser beam is incident than on the side thereof on which the laser beam is incident, the spot size of the laser beam in the light-emitting section is substantially equal to or larger than a light-emitting area of the light-emitting section.

In a case where the light-emitting area is larger than the spot size, it is necessary to increase an excitation density of the laser beam so as to obtain a luminance of the light that is emitted by the light-emitting section. This causes a problem such that the light-emitting section deteriorates (changes in color and/or shape) due to heat of the laser beam and becomes shorter-lived.

In view of this, the above configuration allows the light-emitting section to be longer-lived while preventing a deterioration of the light-emitting section.

The light-emitting device in accordance with the first embodiment of the present invention may be configured such that: the light control section is at least one of a polygon mirror and a galvanometer mirror; and the movement control section is an actuator which causes at least one of the polygon mirror and the galvanometer mirror to move.

Use of a polygon mirror and/or a galvanometer mirror as the light control section makes it possible to easily control the laser beam to be guided from the laser light source to the light-emitting section. Further, a polygon mirror and/or a galvanometer mirror, which are/is easily available, can be easily incorporated into the light-emitting device.

Further, the light-emitting device in accordance with the first embodiment of the present invention thus configured can emit light in an extremely wide range. That is, it is easy to increase a solid angle in which floodlighting can be performed. Therefore, even if a solid angle is narrow, floodlighting can be performed on a wide region.

In addition, the light-emitting device in accordance with the first embodiment of the present invention thus configured can perform, with a chromaticity such as white light with no laser, a laser show which is conventionally performed with a laser. In a case where such high-power light is necessary, the above configuration is advantageous for prevention of a deterioration in laser element.

The light-emitting device in accordance with the first embodiment of the present invention may be configured such that: the light control section is a convex lens or a concave mirror; and the control section is an actuator which causes the convex lens or the concave mirror to move.

Use of a convex lens or a concave mirror makes it possible to easily control the laser beam to be guided from the laser light source to the light-emitting section. Further, a convex lens and a concave mirror, which are easily available, can be easily incorporated into the light-emitting device.

Further, since the above configuration requires a small space, the light-emitting device in accordance with the first embodiment of the present invention is more advantageous than another light-emitting device when being incorporated into, for example, a vehicle which requires a strict space design (layout).

The light-emitting device in accordance with the first embodiment of the present invention may be configured to further include: a sensing section which senses an object in a floodlit region on which the light-emitting device performs floodlighting, when the sensing section senses the object, the movement control section causing the light control section to move.

According to the above configuration, a light-distribution pattern with respect to the object can be controlled in a case where the movement control section causes the light control section to move. This allows control of a light-distribution pattern such as emission of light to the whole or a part of the sensed object.

The light-emitting device in accordance with the first embodiment of the present invention may be configured to further include: an identifying section which identifies, by image recognition, a kind of the object which has been sensed by the sensing section, in accordance with the kind of the object which kind has been identified by the identifying section, the movement control section causing the light control section to move.

The light-emitting device thus configured further includes an identifying section which identifies, by image recognition, a kind of the object which has been sensed by the sensing section. Accordingly, in accordance with the kind of the object which kind has been identified by the identifying section, the movement control section causes the light control section to move, so that a light-distribution pattern with respect to the object can be controlled. This allows control of a light-distribution pattern such as emission of light to the whole or a part of the sensed object.

The light-emitting device in accordance with the first embodiment of the present invention may be configured to further include: a sensing section which senses an object in a floodlit region on which the light-emitting device performs floodlighting, when the sensing section senses the object, the light amount control section controlling the amount of the laser beam that is emitted by the laser light source that performs floodlighting on the floodlit region in which the object has been sensed.

According to the above configuration, in a case where the light amount control section controls the amount of the laser beam that is emitted by the laser light source that performs floodlighting on the floodlit region in which the object has been sensed, a light-distribution pattern can be freely changed, and an intensity of the light can also be controlled. This makes it possible to achieve various light-distribution patterns.

The light-emitting device in accordance with the first embodiment of the present invention may be configured to further include: an identifying section which identifies, by image recognition, a kind of the object which has been sensed by the sensing section, in accordance with the kind of the object which kind has been identified by the identifying section, the light control section controlling the amount of the laser beam that is emitted by the laser light source that performs floodlighting on the floodlit region in which the object has been sensed.

The light-emitting device thus configured further includes an identifying section which identifies, by image recognition, a kind of the object which has been sensed by the sensing section. Accordingly, in accordance with the kind of the object which kind has been identified by the identifying section, the light control section can control the amount of the laser beam that is emitted by the laser light source that performs floodlighting on the floodlit region in which the object has been sensed. According to this, a light-distribution pattern can be freely changed, and an intensity of the light can also be controlled. This makes it possible to achieve various light-distribution patterns.

A floodlight in accordance with the first embodiment of the present invention may be configured to include: any one of the light-emitting devices mentioned above; and a floodlighting section which performs floodlighting with light emitted from the light-emitting section, the floodlighting section changing a range of floodlighting by movement of the light control section by the movement control section.

According to the above configuration, the light control section, which is moved under control by the movement control section, can change an illumination position and a spot size of the laser beam in the light-emitting section by changing a relative position of the light control section with respect to the light-emitting section As a result, the floodlight in accordance with the first embodiment of the present invention can (i) emit light to any place and (ii) achieve various light-distribution patterns.

In this case, since the floodlight in accordance with the first embodiment of the present invention uses the laser light source to secure a sufficient luminance and includes the light-emitting section which emits light in response to the laser beam, it is possible to improve a color rendering property and a contrast of light having a wavelength other than a wavelength of a laser beam.

The floodlight in accordance with the first embodiment of the present invention may be configured such that: in a case where the light-emitting section has such light-distribution characteristics as to intensely emit light on a side thereof on which the laser beam is incident, the floodlight includes the floodlighting section on the side of the light-emitting section on which side the laser beam is incident.

According to the above configuration, the floodlight in accordance with the first embodiment of the present invention is suitably applied also to a light-emitting device which is configured such that the light-emitting section emits light on a side thereof on which the laser beam is incident. That is, since a light-emitting device to which the floodlight in accordance with the first embodiment of the present invention is applied is not limited to a light-emitting device which is configured such that the light-emitting section emits light on a side thereof opposite from a side thereof on which the laser beam is incident. This achieves a higher degree of freedom of a layout and a design of floodlight.

As compared with a floodlight which is configured such that the light-emitting section emits light on a side thereof opposite from a side thereof on which the laser beam is incident, the floodlight in accordance with the first embodiment of the present invention can be provided with a heat radiating mechanism on a side thereof opposite from a side thereof on which light is incident (that is, a side thereof on which light is emitted), and more efficient heat radiation from the light-emitting section can be achieved.

Further, it is difficult, for a floodlight which is configured such that the light-emitting section emits light on a side thereof opposite from a side thereof on which the laser beam is incident, to control a bundle of rays which is emitted to a side of the light-emitting section, whereas it is easy for the floodlight in accordance with the first embodiment of the present invention to control a light distribution in the light-emitting section to be performed in a solid angle of $2\pi$ or less steradians. Accordingly, the floodlight in accordance with the first embodiment of the present invention can more effectively use a bundle of rays. This enables lower electric power consumption.

A vehicle headlight in accordance with the first embodiment of the present invention includes any one of the light-emitting devices mentioned above.

According to the above configuration, the vehicle headlight in accordance with the first embodiment of the present invention can emit light to any place, and thus a light-distribution pattern can be freely changed.

A vehicle headlight in accordance with the first embodiment of the present invention may be configured such that, when the identifying section identifies the object as an oncoming vehicle or a preceding vehicle, the light amount control section reduces the amount of the laser beam that is emitted by the laser light source that performs floodlighting on the floodlit region in which the oncoming vehicle or the preceding vehicle has been sensed.

According to the above configuration, the light amount control section reduces the amount of the laser beam that is emitted by the laser light source that performs floodlighting on the floodlit region in which the oncoming vehicle or the preceding vehicle has been sensed. This makes it possible to reduce an extent that a driver of the oncoming vehicle or the preceding vehicle feels dazzled. In particular, since light from an oncoming vehicle makes it difficult for a driver to see a front view, the above configuration yields an effect of preventing occurrence of an accident.

The vehicle headlight in accordance with the first embodiment of the present invention may be configured such that, when the identifying section identifies the object as a road sign or an obstacle, the light amount control section increases the amount of the laser beam that is emitted by the laser light source that performs floodlighting on the floodlit region in which the road sign or the obstacle has been sensed.

According to the above configuration, the light amount control section increases the amount of the laser beam that is emitted by the laser light source that performs floodlighting on the floodlit region in which the road sign or the obstacle has been sensed. Therefore, a driver can easily visually confirm the road sign or the obstacle. This allows the vehicle headlight in accordance with the first embodiment of the present invention to prevent occurrence of an accident.

The vehicle headlight in accordance with the first embodiment of the present invention may be configured such that the movement control section changes the illumination position with respect to the light-emitting section so that either one of an illuminating light-distribution pattern stipulated in a drive-on-the-right country and an illuminating light-distribution pattern stipulated in a drive-on-the-left country is satisfied.

The illuminating light-distribution pattern stipulated in a drive-on-the-right country and the illuminating light-distribution pattern stipulated in a drive-on-the-left country differ from each other. As for this point, according to the vehicle headlight in accordance with the first embodiment of the present invention, in a case where the movement control section changes the illumination position with respect to the light-emitting section, the illuminating light-distribution pattern stipulated in a drive-on-the-right country or the illuminating light-distribution pattern stipulated in a drive-on-the-left country can be satisfied. Therefore, the vehicle headlight in accordance with the first embodiment of the present invention is suitably used in either one of a drive-on-the-right country and a drive-on-the-left country.

The vehicle headlight in accordance with the first embodiment of the present invention may be configured such that the light amount control section controls the amount of the laser beam that is emitted by the laser light source so that either one of an illuminating light-distribution pattern stipulated in a drive-on-the-right country and an illuminating light-illuminance stipulated in a drive-on-the-left country is satisfied.

According to the vehicle headlight in accordance with the first embodiment of the present invention, in a case where the light amount control section controls the amount of the laser beam that is emitted by the laser light source, the illuminating light-distribution pattern stipulated in a drive-on-the-right country or the illuminating light-illuminance stipulated in a drive-on-the-left country can be satisfied. Therefore, the vehicle headlight in accordance with the first embodiment of the present invention can be suitably used in either one of a drive-on-the-right country and a drive-on-the-left country.

The vehicle headlight in accordance with the first embodiment of the present invention may be configured such that: the movement control section changes the illumination position in the light-emitting section by changing the relative position of the light control section with respect to the light-emitting section when the identifying section identifies an ascending slope, thereby changing, from a forward direction to a ground direction, a range in which illuminating light is emitted from a vehicle, and the movement control section changes the illumination position in the light-emitting section by changing the relative position of the light control section with respect to the light-emitting section when the identifying section identifies a descending slope, thereby changing, from the forward direction to the direction opposite from the ground direction, the range in which the illuminating light is emitted from the vehicle.

According to the above configuration, the movement control section changes the illumination position in the light-emitting section by changing the relative position of the light control section with respect to the light-emitting section when the identifying section identifies an ascending slope or a descending slope, thereby changing, from a forward direction to a ground direction or a direction opposite from the ground direction, the range in which the illuminating light is emitted from the vehicle.

According to this, the vehicle headlight in accordance with the first embodiment of the present invention can suitably light a road even in a case where an ascending slope and a descending slope appear in a front view. This makes it possible to provide a driver with a safety driving environment.

[Embodiment 2]

The description below deals with a lighting device of the present embodiment with reference to FIGS. 28 through 50. The present embodiment describes an example case of using a lighting device of the present invention as an automobile headlamp. The lighting device of the present invention may, however, be used as (i) a headlight for a vehicle other than an automobile or (ii) another lighting device.

[Schematic Structure of Headlamp 110]

Figure 29:
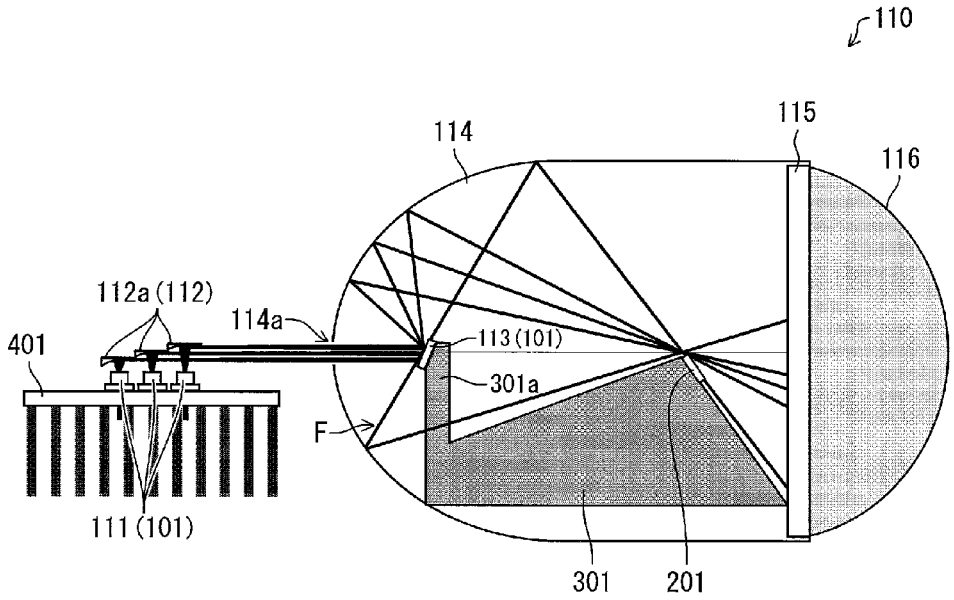
FIG. 29 is a plan view schematically showing an example configuration of the headlamp.

The description below first deals with an example schematic structure of a headlamp 110 (lighting device; vehicle headlight) of the present embodiment with reference to FIG. 29. FIG. 29 is a plan view schematically showing an example configuration of the headlamp 110 of the present embodiment.

As illustrated in FIG. 29, the headlamp 110 includes a laser light source unit 101 (first light source), an LED 201 (second light source; light-emitting diode), a heat radiating base 301, a fin 401, a reflection mirror 112*a* (light control section), a reflector 114 (floodlighting section), a wavelength cut coating 115, and a convex lens 116.

The headlamp 110 can not only use, as illuminating light, light emitted from the laser light source unit 101 and the LED 201, but also control light-distribution characteristics and light intensity distribution of the illuminating light. It should be noted that in general, a comparison between the laser light source unit 101 and the LED 201 under the same conditions of electric power consumption shows that whereas the laser light source unit 101 emits illuminating light at high luminance with low luminous flux, the LED 201 emits illuminating light at a low luminance with high luminous flux.

Further, in actuality, these headlamps 110 are provided one at each anterior end of an automobile on which they are mounted. However, for convenience of explanation, the following description assumes that light is shone by a single headlamp 110.

<Laser Light Source Unit 101>

As shown in FIG. 29, the laser light source unit 101 includes laser elements 111 (laser light sources) and a light-emitting section 113 for emitting light in response to laser beams emitted from the laser elements 111.

(Laser Element 111)

The laser elements 111 are each a light-emitting element which functions as an excitation light source that emits an excitation light beam. The laser elements 111 may each have one light-emitting point for each chip or have a plurality of light-emitting points for each chip.

The use of a laser beam as an excitation light beam allows a fluorescent body included in the light-emitting section 113 described below to be excited efficiently to emit light having a luminance higher than that of light emitted by a conventional light source, and can also reduce the diameter of the light-emitting section 113 itself. In the present embodiment, each laser element 111 emits a laser beam, which is reflected by a reflection mirror 112*a* to form, on the light-emitting section 113, an illuminated region (that is, the spot size of an excitation light beam) having a diameter ranging from 20 μm to 1000 μm. The laser light source unit 101 illustrated in FIG. 29 includes a plurality of laser elements 111, each of which generates a laser beam as an excitation light beam. The laser elements 111 each being a high-luminance light source make it possible to efficiently narrow the illuminated region formed on a light-receiving surface of the light-emitting section 113, and consequently to perform floodlighting at a narrow light-distribution angle.

The present embodiment includes 24 laser elements 111. This indicates that laser beams emitted from the respective laser elements 111 form 24 illuminated regions on the light-receiving surface, which is a surface of the light-emitting section 113 on which surface it receives laser beams. The laser elements 111 are so provided above the fin 401 that the above 24 illuminated regions are formed on the light-receiving surface evenly (in a matrix). The laser elements 111 are, for example, arranged on the light-receiving surface in a matrix of four columns and six rows. This arrangement allows a plurality of laser elements 111 to emit respective laser beams to excite the fluorescent body of the light-emitting section 113 in a matrix. The number of the laser elements 111 is not limited to 24, and may be any number that allows laser beams to be emitted to the entire light-receiving surface of the light-emitting section 113.

The laser elements 111 each emit a laser beam having a wavelength of, for example, 395 nm (blue violet) or 450 nm (blue). The wavelength is, however, not limited to those, and may be selected as appropriate in accordance with the kind of a fluorescent body to be included in the light-emitting section 113.

The laser elements 111 are mounted in a metal package having a diameter of 5.6 mm, and each generate a laser beam having a wavelength of 395 nm (blue violet, 380 to 415 nm) and an output power of 2 W. The laser elements 111 are each connected to a wire, through which the laser element 111 is supplied with electric power and the like.

The wavelength is not limited to 395 nm, and may be selected as appropriate in accordance with the fluorescent body included in the light-emitting section 113.

(Light-Emitting Section 113)

The light-emitting section 113 emits fluorescence upon receiving laser beams generated from the laser elements 111. That is, the laser-emitting section 113 emits light upon receiving a laser beam emitted from at least one of the plurality of laser elements 111.

Further, the light-emitting section 113 contains a fluorescent body (fluorescent substance) that absorbs a laser beam and emits fluorescence.

For example, the light-emitting section 113 is a light-emitting body containing a fluorescent body, such as a light-emitting body having particles of a fluorescent body dispersed inside of a sealant (sealed type), a light-emitting body obtained by solidifying particles of a fluorescent body, or a light-emitting body obtained by applying (depositing) particles of a fluorescent body onto a substrate made of a highly thermally conductive material (thin-film type). In the present embodiment, the light-emitting section 113 is formed by applying a fluorescent body in powder form onto an inclined part 301*a* of the heat radiating base 301 with $TiO_2$ as a binder, so as to be in the shape of a 4 mm×2 mm rectangular thin film having a thickness of 0.1 mm.

The light-emitting section 113 is located at the heat radiating base 301 and near one (first focal point) of two focal points that the reflector 114 has. This causes light emitted from the light-emitting section 113 to be reflected by a reflection curved surface of the reflector 114 so that its optical path is controlled.

It is preferable that as shown in FIG. 29, the light-emitting section 113 be smaller than (e.g., about 1/10 the size of) the reflector 114. In this case, light emitted by the light-emitting section 113 can be efficiently cast on the area in front of the reflector 114.

Further, it is desirable that the light-emitting section 113 be larger than an illuminated region (range of laser-light illumination) that is formed by laser beams emitted from all of the laser elements 111.

(Putting the Light-Emitting Section 113 at a Slant)

The light-emitting section 113 is so provided at a slant on an inclined part 301*a* of the heat radiating base 301 that fluorescence emitted from the light-emitting section 113 can be efficiently reflected by the reflector 114 and then cast from the reflector 114. The inclined part 301*a* is, with respect to the plane perpendicular to a direction in which a laser beam is incident, inclined at an angle of approximately 15° toward the incidence direction. The light-emitting section 113 emits light having a substantially Lambertian light distribution. Thus, if the inclined part 301*a* has a laser-light illumination surface that is perpendicular to the laser-beam incidence direction, the light-emitting section 113 will emit light having its highest luminous intensity in a region corresponding to a window section 114*a* of the reflector 114. This will decrease floodlighting efficiency.

The laser-light illumination surface is desirably inclined at an angle of approximately 15° for high floodlighting efficiency. If, however, no consideration of floodlighting efficiency is needed, the inclined part 301*a* may be so formed as to have a laser-light illumination surface that is perpendicular to the laser-beam incidence direction.

Further, in the case where the headlamp 110 is so structured that the window section 114*a* of the reflector 114 transmits a laser beam but reflects light emitted from the light-emitting section 113, although such a headlamp 110 requires a higher production cost, the floodlighting efficiency is increased even if the inclined part 301*a* is so formed as to have a laser-light illumination surface that is perpendicular to the laser-beam incidence direction.

(Fluorescent Material)

The present embodiment uses BAM ($BaMgAl_{10}O_{17}$: Eu), BSON ($Ba_3Si_6O_{12}N_2$: Eu), or Eu-α (Ca-α-SiAlON: Eu) as the fluorescent body of the light-emitting section 113 so that the fluorescent body emits white fluorescence in response to laser beams which have been generated by the respective laser elements 111 and each have a wavelength of 395 nm. The fluorescent body of the light-emitting section 113 is, however, not limited to the above, and may be so selected as appropriate that the headlamp 110 for an automobile emits white illuminating light having a chromaticity within a predetermined range stipulated in the related law(s).

For example, it is possible to use another oxynitride fluorescent body (e.g., a sialon fluorescent body such as JEM ($LaAl(SiAl)_6N_9O$: Ce) or β-SiAlON), a nitride fluorescent body (e.g., a CASN ($CaAlSiN_3$: Eu) fluorescent body), a SCASN ((Sr, Ca) $AlSiN_3$: Eu) fluorescent body), an Apataite ($(Ca,Sr)_5(PO_4)_3Cl$: Eu), or a III-V group compound semiconductor nanoparticle fluorescent body (e.g., indium phosphide: InP).

Further, white light can also be obtained by causing the light-emitting section 113 to contain a yellow florescent body (or a green and red florescent body) and emitting a laser beam of 450 nm (blue) (or a so-called laser beam having a wavelength in the vicinity of the blue range, the laser beam having a peak wavelength within a wavelength range from 440 nm to 490 nm).

(Sealed Type)

A sealing material of which the light-emitting section 113 of a sealed type is made is, for example, a resin material such as a glass material (e.g., inorganic glass or organic/inorganic hybrid glass) or a silicone resin. Low-melting glass may also be used as the glass material. The sealing material is preferably highly transparent, and is preferably highly heat-resistant in a case where a laser beam is high in output. The light-emitting section 113 may be sealed with, for example, silicon oxide or titanium oxide by a sol-gel process.

The light-emitting section 113 may have, on a top surface thereof, an anti-reflection structure which prevents reflection of a laser beam. In the case of a sealed-type light-emitting body, since it is easy to control a shape of the top surface of the light-emitting section 113, it is particularly desirable to form an anti-reflection film.

(Thin-Film Type)

In a case where the light-emitting section 113 is a thin-film type light-emitting body, Al, Cu, AlN ceramic, SiC ceramic, aluminum oxide, Si, or the like is used as a substrate. Fluorescent body particles are applied to or deposited on the substrate, and then the substrate is divided into substrates each having a desired size. Thereafter, the substrates are fixed to the heat radiating base 301 (light-emitting body supporting section) by use of a highly thermally conductive adhesive.

In a case where Al or Cu, for example, is used as the substrate, it is desirable that a side of the substrate on which side no fluorescent body particles are deposited (a side of the substrate which side faces the heat radiating base 301) be coated with TiN, Ti, TaN, Ta, or the like as a barrier metal. Further, the barrier metal may be coated with Pt or Au, for example.

It is desirable to use, as a highly thermally conductive adhesive, eutectic solder of SnAgCu, AuSn, or the like. However, the highly thermally conductive adhesive is not limited to those.

(Excitation Light Spot Size)

The present embodiment forms, on the light-emitting section 113, an illuminated region (that is, the spot size of an excitation light beam) having a diameter ranging from 100 μm to 1000 μm for the following reasons:

1) Minimum Size

The light-emitting section 113 includes a plurality of fluorescent bodies to emit white light, the fluorescent bodies each having a particle size of approximately 10 μm. Further, in the case where the light-emitting section 113 includes three kinds of fluorescent bodies to emit uniform white light, the illuminated region needs to have a diameter of 20 μm even with the three kinds of fluorescent bodies blended at a ratio of 1:1:1. In actuality, however, the fluorescent bodies are blended according to a necessary color temperature. The illuminated region thus needs to have a diameter of approximately 50 μm to emit white light. In addition, in the case where the fluorescent bodies are unprocessed for use, there unfortunately occurs, depending on a range of floodlighting, a color distribution corresponding to the distribution of particles of the individual fluorescent bodies. In view of this, the light-emitting section 113 is desirably so illuminated with laser beams that the illuminated region has a diameter of 100 μm or larger.

2) Maximum Size

This is a value that is determined in accordance with the range of floodlighting to be performed by a single laser element 111.

(Size of an Illuminated Region that is Formed in a Case Where a Blue Laser is Used)

In the case where the headlamp 110 includes a laser element 111 (blue laser element) that emits a laser beam having a wavelength in the vicinity of the blue range, such a laser beam is cast as floodlighting. The laser beam thus needs to be set to have an output under class 1 of IEC60825-1.

In the case where the laser elements 111 emit a mixture of a blue laser beam and a blue-violet laser beam (that is, in the case where the laser elements 111 include a blue laser element and a blue-violet laser element), the light-emitting section 113 desirably has, for higher luminous efficiency, different regions for respective fluorescent bodies in accordance with regions to be illuminated with the respective laser beams. For instance, the light-emitting section 113 desirably includes (i) a YAG-based fluorescent body in accordance with a region to be illuminated with a blue laser beam and (ii) BAM, BSON, or Eu-α in accordance with a region to be illuminated with a blue-violet laser beam (in other words, these fluorescent bodies are so applied as to be separated from each other).

The laser elements 111 are, in the above case, desirably set for improved safety such that a single blue laser element emits a blue laser beam that forms an illuminated region having a size that is equal to or larger than that of an illuminated region formed by a blue-violet laser beam emitted by a single blue-violet laser element.

The individual fluorescent bodies may, if no consideration is needed of luminous efficiency, be mixed with each other and applied to the entire light-receiving surface of the light-emitting section 113 without being separated from each other (for example, a YAG-based fluorescent body may be mixed with BAM, BSON, or Eu-α).

(As to Emission of Light Other than White Light)

The light to be emitted by the light-emitting section 113 is not limited to white light. The light-emitting section 113 simply needs to emit light having a chromaticity defined for the light-emitting device.

In the case where the laser elements 111 include an infrared laser element to serve as a light source for an infrared camera, the light-emitting section 113 functions also as a scatterer for casting an infrared laser beam on a desired region.

<LED 201>

The LED 201 is a light source having a luminance lower than that of the laser light source unit 101, and serves to increase the light-emitting area for increased luminous flux. The LED 201 thus emits illuminating light having a great range of floodlighting.

The LED 201 is a light source that emits white light without the use of the laser elements 111. The LED 201 is, in other words, a light source that emits light on a principle of light emission which principle differs from that of the laser light source unit 101. The LED 201 emits white light that can be used as illuminating light, as with the fluorescence emitted from the light-emitting section 113.

The LED 201, under control of an output control section 660 described later, emits illuminating light in such a manner as to satisfy a minimum illuminance defined for the headlamp 110. This configuration makes it possible to, even when the laser light source unit 101 is off, secure the minimum illuminance with use of only the LED 201.

(Specifications of LED 201)

The LED 201 of the present embodiment is in the shape of a cuboid having a size of 5 mm×5 mm and a thickness of 3 mm. The LED 201 has a light-emitting region of approximately 4 mm×1 mm.

The LED 201 of the present embodiment has light-distribution characteristics that increase directivity for improved coupling efficiency (floodlighting efficiency) for the convex lens 116. The LED 201 thus has a (half) directional angle of 40°.

Figure 30:
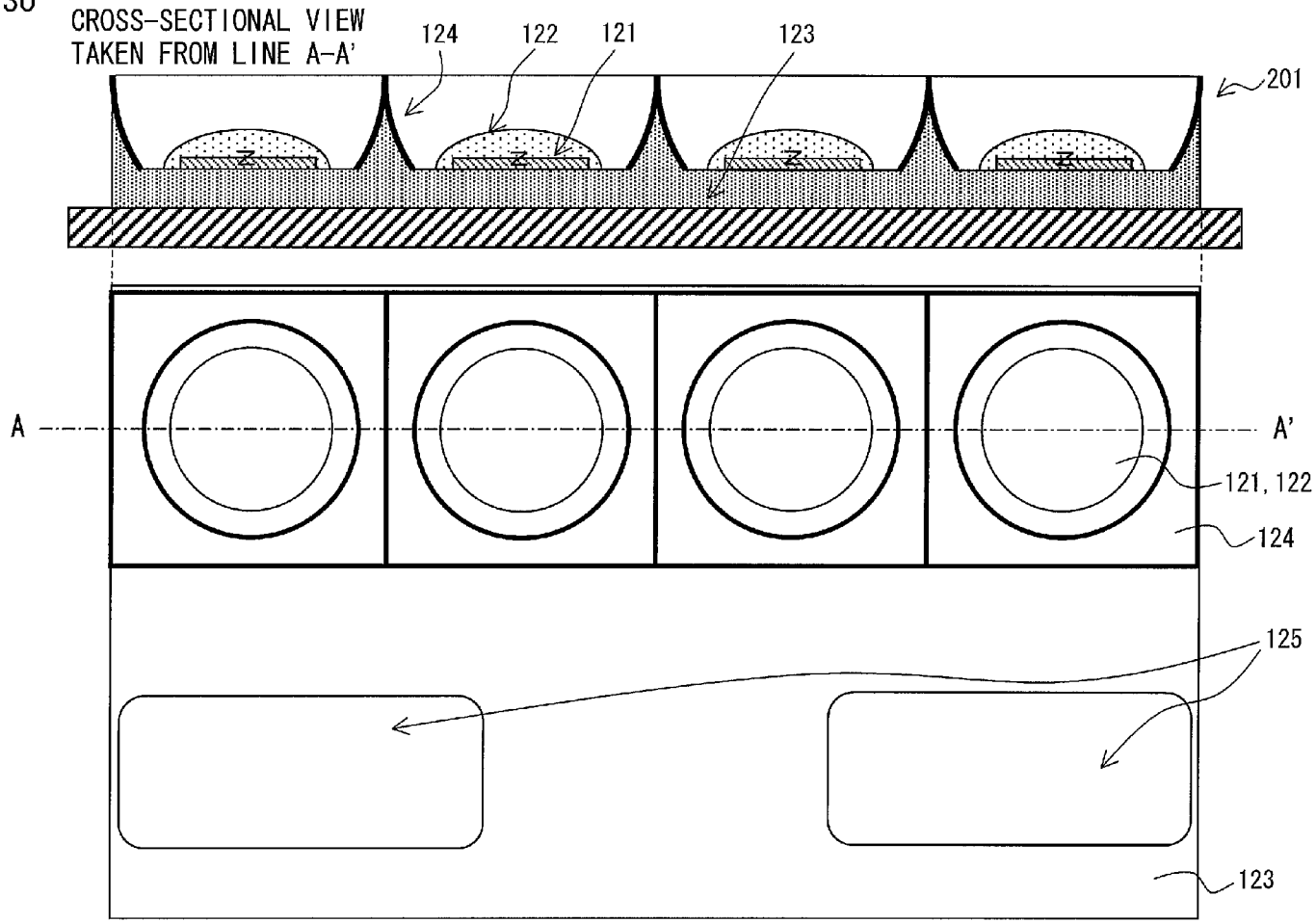
FIG. 30 shows a top view and a cross-sectional view schematically showing an example configuration of an LED of the headlamp.

The LED 201 of the present embodiment, as illustrated in FIG. 30, includes (i) a highly thermally conductive mount member 123 (made of AlN ceramic in the present embodiment), (ii) four LED chips 121 (blue LED chips) each having a size of 750 μm×750 μm and bonded to a surface of the mount member 123 by flip-chip bonding, and (iii) a fluorescent body 122 deposited in the vicinity of each LED chip 121, the fluorescent body 122 being excited by light from the LED chips 121.

The fluorescent body 122 of the present embodiment is a YAG fluorescent body. The fluorescent body 122 is, however, not limited to a YAG fluorescent body. The fluorescent body 122 may be so selected as appropriate that the LED chips 121 each emit white light having a chromaticity within a predetermined range stipulated in the related law(s).

The LED 201 is provided substantially at a focal position of a reflector cup 124 to control the distribution of light emitted by (i) the LED chips 121 and (ii) the fluorescent body 122 deposited in the vicinity of each LED chip 121.

The LED 201 further includes, on the mount member 123, electrodes 125 for driving the individual LED chips 121.

The present embodiment is configured such that the reflector cups 124 control the distribution of light to be emitted by the LED 201. Such light distribution may alternatively be controlled with use of a molded lens or the like. These light-distribution characteristics do not need controlling if no consideration is needed of coupling efficiency for the convex lens 116.

(Where to Provide LED 201)

The LED 201 is provided on the heat radiating base 301 and in the vicinity of the other (second focal point) of the two focal points of the reflector 114. The LED 201 is so provided on the heat radiating base 301 as to (i) cause a light-emitting point thereof to face an opening of the reflector 114 and thus (ii) cause light emitted thereby to directly exit to the outside of the reflector 114. The position of the LED 201 is, however, not limited to the above. The LED 201 simply needs to be provided at such a position that (i) light emitted by the LED 201 efficiently exits the headlamp 110, (ii) light-distribution characteristics defined for the headlamp 110 are achievable, and (iii) the LED 201 does not block light emitted from the light-emitting section 113 and reflected by the reflector 114.

The light emitted by the LED 201 forms a second range of floodlighting a2 (see, for example, FIG. 32) in front of the reflector 114. In other words, the second range of floodlighting a2 is formed by illuminating light emitted by the LED 201.

(Matrix LED)

The LED chips 121 included in the LED 201 may have respective outputs that are controlled individually. In such a case, the output control section 660 described later can individually control the respective outputs of (that is, the respective amounts of light to be emitted by) the LED chips 121 to control the light-distribution characteristics of light emitted by the LED 201 as a whole.

The plurality of LED chips 121 included in the LED 201 may be arranged in a matrix.

The LED 201 is connected to a wire (not illustrated), through which the LED 201 is supplied with electric power and the like.

(Light Source Other than LED 201)

The present embodiment, which includes a combination of the laser light source unit 101 and a floodlighting optical system (convex lens 116) to downsize the unit as a whole, includes an LED 201 to serve as a second light source that emits light on a principle of light emission which principle differs from that of the laser light source unit 101.

In the case where the present embodiment includes, for example, a halogen lamp or HID lamp (high discharge lamp) as a light source, light emitted from the laser light source unit 101 is blocked by glass of which the bulb is made. Thus, the present embodiment, in the above case, needs to include a floodlighting optical system for the above light source separately from the floodlighting optical system for the laser light source unit 101 so as to perform floodlighting with a predetermined floodlighting efficiency. If, however, no consideration is needed of this point, the second light source is not limited to an LED 201, and may be a halogen lamp or HID lamp, for example. In other words, the second light source may be any light source that emits light on a principle of light emission which principle differs from that of the laser light source unit 101.

The light to be emitted by the LED 201 is not limited to white light. The light-emitting section 113 simply needs to emit light having a chromaticity defined for the lighting device.

The specifications of the LED 201 may be set such that a plurality of LEDs 201 emitting light beams of different chromaticities (for example, R, G, and B) cast white illuminating light. This configuration facilitates changing the color temperature (chromaticity) of luminous flux of floodlighting.

<Heat Radiating Base 301>

The heat radiating base 301 is a supporting member for supporting the light-emitting section 113 and the LED 201. The heat radiating base 301 of the present embodiment is made of Al. The heat radiating base 301 may, however, be made of another material that is highly thermally conductive, such as Cu, AlN, and SiC. The heat radiating base 301 allows efficient radiation of heat generated by the light-emitting section 113 and the LED 201.

The heat radiating base 301, as illustrated in FIG. 29, has a shape that allows (i) the light-emitting section 113 and the LED 201 to be provided in this order at the first and second focal points respectively, (ii) the light-emitting section 113 to emit light that falls upon the reflector 114 efficiently, and (iii) the LED 201 to emit light that exits to the outside of the reflector 114 efficiently.

The heat radiating base 301 is preferably shaped such that light emitted by the light-emitting section 113, after being reflected by the reflector 114, does not fall upon the heat radiating base 301 and that the light thus does not exit to the outside of the reflector 114 with decreased efficiency. Thus, the heat radiating base 301 preferably has a width as viewed from the opening of the reflector 114 which width is a minimum width (for example, 4 mm) that allows the light-emitting section 113 and the LED 201 to be provided on the heat radiating base 301.

In the case where the light-emitting section 113 is configured such that a laser beam incident upon the light-receiving surface of the light-emitting section 113 is transmitted through to the inclined part 301*a*, the inclined part 301*a*, to which the light-emitting section 113 is applied, preferably has a surface that functions as a reflecting surface. This configuration allows an incident laser beam to be reflected by that reflecting surface to travel toward the inside of the light-emitting section 113 again for conversion into fluorescence.

The present embodiment uses an identical member to support the light-emitting section 113 and the LED 201. The present embodiment may, however, use respective different members to support them separately. In the case where the present embodiment includes respective different heat radiating bases to support the light-emitting section 113 and the LED 201 separately, the supporting member for the LED 201 is desirably larger than that for the light-emitting section 113.

<Fin 401>

The fin 401 functions as a cooling section (heat radiating mechanism) which cools the laser elements 111, and is made of for example, aluminum. The fin 401, which has a plurality of heat radiating plates, enhances heat radiation efficiency by increasing an area of a contact part with atmosphere.

Note that the fin 401 does not necessarily need to be in contact with the laser elements 111 and that a heat pipe, a water-cooled pipe, a Peltier device, or the like may be provided between the laser elements 111 and the fin 401.

It is only necessary that the cooling section which cools the laser elements 111 have a cooling function (radiating function). The cooling section which cools the laser elements 111 in a water-cooling mode may perform cooling by use of a radiator. Alternatively, the cooling section may perform forced cooling by use of, for example, a fan.

<Light Control Section 112>

The light control section 112 controls in which direction the laser beam travels, and controls overlapping, spot sizes, spot shapes, etc. of illuminated regions on the light-emitting section 113.

The light control section 112, placed between the light-emitting section 113 and the laser elements 111, is achieved by a plurality of reflection mirrors or a plurality of lenses provided so as to respectively correspond to the laser elements 111 constituting the laser light source unit 101. It should be noted that the light control section 112 need only be capable of controlling overlapping, spot sizes, spot shapes, etc. of illuminated regions on the light-emitting sections 113, and as such, may be achieved by an integrally formed array lens or multi-facet mirror, as well as by the reflection mirrors or lenses. Alternatively, there may be a light control section 112 structured such that the plurality of laser elements 111 share a single reflection mirror or lens.

<Reflection Mirror 112*a*>

The present embodiment includes reflection mirrors 112*a* as the light control section 112.

The reflection mirrors 112*a* are each provided between one of the plurality of laser elements 111 and the light-emitting section 113. The reflection mirrors 112*a* control how laser beams emitted by the plurality of laser elements 111 are guided to the light-emitting section 113. In other words, the reflection mirrors 112*a* each (i) reflect a laser beam emitted by a corresponding one of the plurality of laser elements 111 and thus (ii) control how such a laser beam is guided.

Specifically, the plurality of laser elements 111 emit respective laser beams, which are reflected by the respective reflection mirrors 112*a* to be substantially collimated light and to have a beam width compressed in the longitudinal direction. This collimated light is then guided through the window section 114*a* of the reflector 114 to arrive at the light-emitting section 113.

The above configuration allows a plurality of laser elements 111 to be provided freely relative to the light-emitting section 113.

(Structure)

The reflection mirrors 112*a* (initial mirrors) of the present embodiment are each an off-axis parabolic mirror of which a focal position substantially coincides with a light-emitting point of a corresponding laser element 111. The reflection mirrors 112*a* convert the laser beams, emitted by the respective laser elements 111, into collimated light and control its optical path. The reflection mirrors 112*a* are each more desirably aspheric mirrors each for correcting astigmatic difference of a corresponding laser element 111 (laser chip) to convert the laser beams into collimated light. This configuration makes it possible to generate more collimated light.

The plurality of reflection mirrors 112*a* are so provided in a one-to-one correspondence with the plurality of laser elements 111 on the fin 401 as to face respective light-emitting points of the laser elements 111.

(Function)

As described above, the initial mirrors serving as the reflection mirrors 112*a* of the present embodiment change emitted light (that is, the laser beams emitted by the laser elements 111) into collimated light. The use of the initial mirrors allows the reflector 114 to have a small window section 114*a*.

The description below studies in detail an optical path of laser beams illustrated in FIG. 29 which optical path extends from the laser elements 111 to the light-emitting section 113. A distance between respective laser beams emitted from the three laser elements 111 (in the lateral direction of the drawing) depends on the interval at which the individual laser elements 111 are provided. However, the three laser beams after being reflected by the respective initial mirrors serving as the reflection mirrors 112*a* have a compressed distance therebetween (in the longitudinal direction of the drawing). This configuration allows the reflector 114 to have a small window section 114*a*, and thus makes it possible to effectively use light emitted from the light-emitting section 113.

Figure 39:
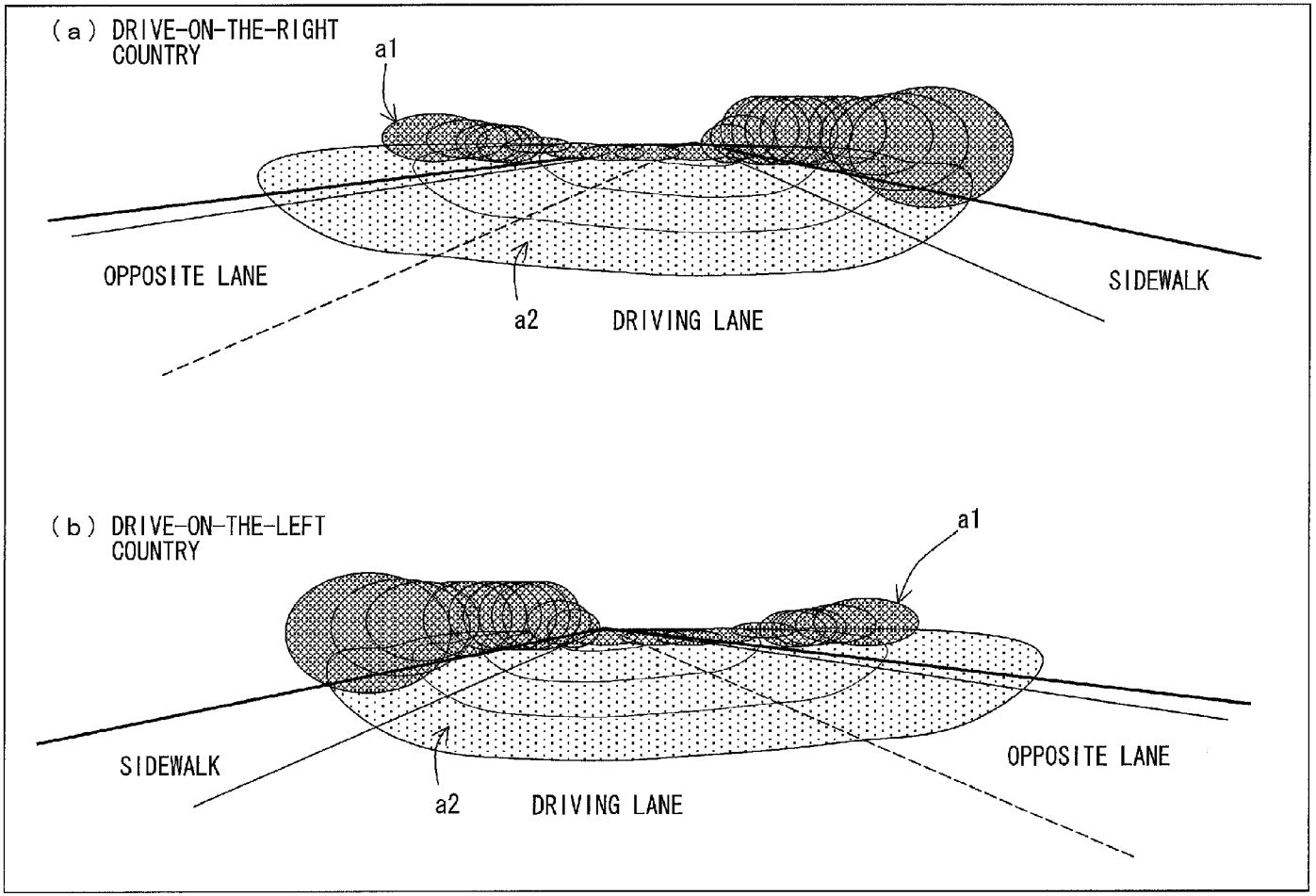
FIG. 39 is a set of diagrams (*a*) and (*b*), (*a*) being a diagram showing how the headlamp achieves a light-distribution pattern stipulated in a drive-on-the-right country, (*b*) being a diagram showing how the headlamp achieves a light-distribution pattern stipulated in a drive-on-the-left country.

The headlamp 110, which is a light source serving as a vehicle headlamp, needs to have a light distribution that ultimately forms a horizontally long floodlighting pattern as illustrated in, for example, (*a*) of FIG. 39. That is why the reflection mirrors 112*a* compress the light, emitted by the laser elements 111, in the longitudinal direction to illuminate the light-emitting section 113 with light having a horizontally long pattern.

The reflection mirrors 112*a* of the present embodiment, as described above, have the two functions of collimating dispersed light and compressing beams in the longitudinal direction.

FIG. 29 illustrates a configuration including reflection mirrors 112*a*. The headlamp 110 is, however, not limited to this in configuration. Using collimating lenses and plane mirrors instead makes it possible to also achieve functions similar to the functions of the initial mirrors serving as the reflection mirrors 112*a*. Further, in the case where the laser elements 111 each contain a collimating lens or collimating mirror to be capable of emitting collimated light, the reflection mirrors 112*a* can be replaced with plane mirrors to achieve functions similar to the functions of the initial mirrors serving as the reflection mirrors 112*a*.

Using the reflection mirrors 112*a* to control how laser beams are guided can reduce deterioration of coating films as compared to the case of using collimating lenses. The use of reflection mirrors 112*a* is thus desirable to secure long-term reliability as well.

(Materials)

The reflection mirrors 112*a* are each made of AlN ceramic (base) coated with Al (reflection coating) and aluminum oxide (antioxidant film). The materials are, however, not limited to those.

The base is desirably made of a material having a small thermal expansion coefficient, for example, BK7, a glass such as silica glass, polycarbonate, acryl, FRP, SiC, or $Al_2O_3$. The base may alternatively be made of a metal such as Al in the case where ultimate collimation accuracy is not so needed.

The reflection coating is desirably made of a metal such as Ag or Pt. The reflection coating may alternatively have a multilayer film structure including, for example, a $SiO_2$/$TiO_2$ multilayer film.

The antioxidant film may be made of, for example, silicon oxide. The antioxidant film is not an essential member.

The reflection mirrors 112*a* may each have a surface provided with a reflection-increasing film (reflection-increasing structure; for example, an HR coating film). This configuration can reduce reflection loss (mirror loss) of a laser beam by the reflection mirrors 112*a*.

<Reflector 114>

The reflector 114 reflects light emitted by the light-emitting section 113 and thus controls the light. This indicates that the first range of floodlighting a1 (see, for example, (*a*) of FIG. 32) is formed by illuminating light emitted by the laser light source unit 101.

The present embodiment is configured such that the laser light source unit 101 emits illuminating light, which is cast with use of the reflector 114 and the convex lens 116.

The reflector 114 includes an ellipse mirror having a reflecting surface at least a portion of which is in the shape of an ellipse. The reflector 114 has, on the side on which laser beams are incident, a first focal point, in the vicinity of which the light-emitting section 113 is provided. The reflector 114 also has a second focal point, in the vicinity of which the focal position of the convex lens 116 is located.

The reflector 114 has an exit pupil that coincides with an entrance pupil of the convex lens 116 for increased floodlighting efficiency. This configuration allows light from the light-emitting section 113 to be cast efficiently within a solid angle to form the first range of floodlighting a1, and consequently allows light to be used with higher efficiency.

The light emitted by the light-emitting section 113 is reflected by the reflector 114, collected in the vicinity of the second focal point of the reflector 114, and changed by the convex lens 116 into substantially parallel light for floodlighting.

(Materials)

The reflector 114 of the present embodiment is made of FRP (base) coated with Al (reflection coating), which is further coated with silicon oxide for antioxidation of Al.

The materials of the reflector 114 are, however, not limited to the above. The reflector 114 simply needs to have a function of controlling reflection. The reflector 114 may alternatively include, as the base, (i) another resin such as acryl or polycarbonate or (ii) a metallic member made of Al or the like. The reflector 114 may also include a reflection coating made of Ag, Pt or the like. Further, the reflector 114 may include, for example, an aluminum oxide-based antioxidant film, or may include, as the antioxidant film, a film additionally having a reflection-increasing function, such as a multilayer film made of silicon oxide and titanium oxide.

The headlamp 110 is configured such that the laser elements 111 are provided on the fin 401 outside the reflector 114 and that the reflector 114 includes a window section 114*a* for transmitting or passing a laser beam. The window section 114*a* may be a through hole, or may include a transparent member capable of transmitting a laser beam. For example, the reflector 114 may include, as the window section 114*a*, a transparent plate that transmits a laser beam and that is provided with a filter which reflects white light (that is, fluorescence from the light-emitting section 113). This configuration can prevent light emitted from the light-emitting section 113 from escaping through the window section 114*a*.

The reflector 114 of the present embodiment is made of a resin ellipse mirror having an inner surface coated with aluminum. The reflector 114 has an opening with a radius of 38 mm, and has a distance of 32.5 mm between its first and second focal points.

The above configuration makes it possible to provide a laser light source unit 101 having high luminance and superior light-distribution characteristics.

The present embodiment is configured such that a single reflector 114 contains the light-emitting section 113 and the LED 201. The present embodiment is, however, not limited to such a configuration, and may include one reflector for the light-emitting section 113 and another reflector for the LED 201. However, a vehicle includes, mounted at the position at which a headlamp is provided, various members other than a headlamp. The headlamp as a whole is thus preferably as small as possible in size. Further, a headlamp including a plurality of reflectors requires a complicated operation for aligning respective optical axes of the plurality of reflectors with each other. The present embodiment, in view of this, preferably includes a single reflector.

<Convex Lens 116>

The convex lens 116 changes light, having been emitted from the light-emitting section 113 or LED 201 and transmitted through the wavelength cut coating 115, into substantially parallel light and casts that substantially parallel light on an area in front of the headlamp 110. The convex lens 116 is held by abutment of the wavelength cut coating 115 or reflector 114, the abutment occurring on a surface that is substantially equal in size to the wavelength cut coating 115 (or the opening of the reflector 114). Further, a straight line passing through the principal point of the convex lens 116 and perpendicular to the principal plane thereof is present on a plane through the first and second focal points of the reflector 114.

(Substantially Parallel Light)

Substantially parallel light does not need to be completely parallel and may have an angle of floodlighting (a vertex angle at which a luminous intensity is halved) of 20° or less.

The present embodiment sets angles of floodlighting for respective elements constituting the laser elements 111. From the viewpoint of light-distribution control, the plurality of laser elements 111 are set to have respective angles of floodlighting each falling within a range of 0.5° to 20°. In particular, the present embodiment is, in the case where it is used as a vehicle headlamp, desirably configured such that a plurality of laser elements 111 for casting light in the direction in which the vehicle moves (that is, for casting light within a range of ±8° with respect to an axis of the vehicle) are each set to have an angle of floodlighting of 3° or less. This configuration allows for a finer light distribution.

<Wavelength Cut Coating 115>

The wavelength cut coating 115 blocks light within a particular wavelength range. The wavelength cut coating 115 of the present embodiment cuts light having wavelengths of 400 nm or less, and blocks a laser beam having a wavelength of 395 nm.

The above configuration helps provide the user with a device that casts no laser beam and that is thus friendly on the human eye. What wavelengths to block may be selected as appropriate by selecting a desired kind of the wavelength cut coating 115. Further, the wavelength cut coating 115 may be replaced with a wavelength cut filter.

[Configuration of the Headlamp 110]

Next, an example of a general configuration of the headlamp 110 according to the present embodiment is described with reference to FIG. 28.

Figure 28:
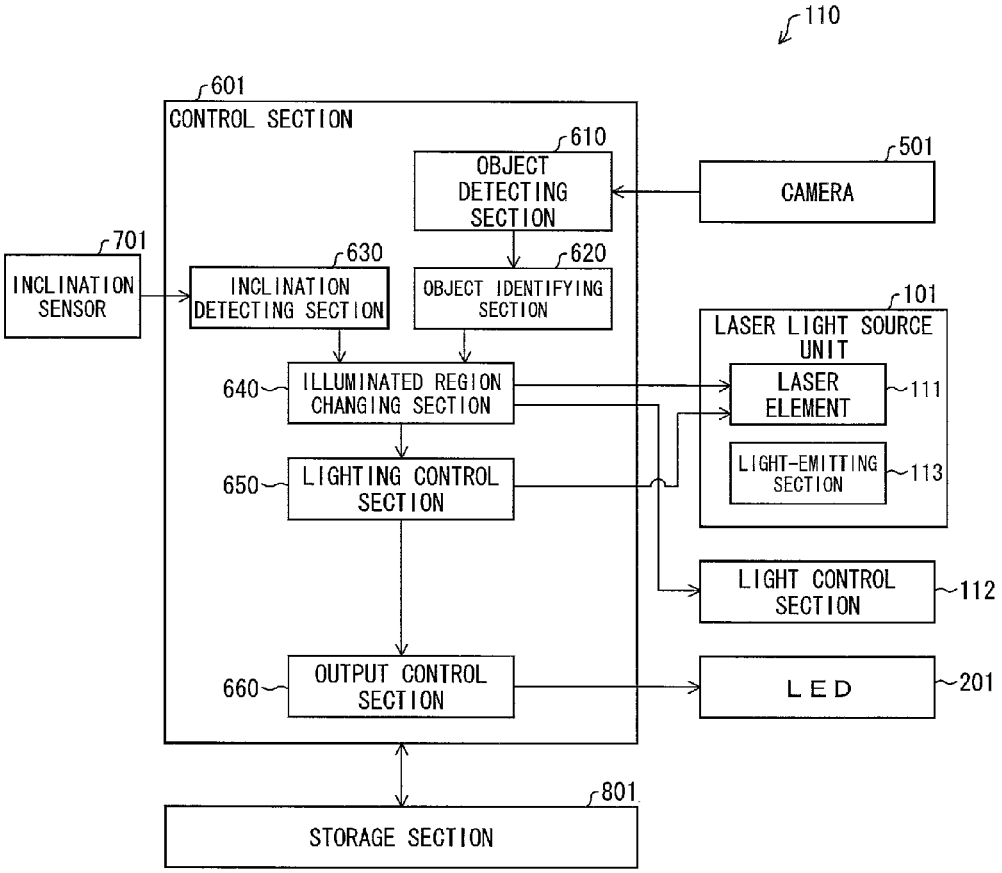
FIG. 28 is a block diagram schematically showing an example of a configuration of a headlamp according to an embodiment of the present invention.

FIG. 28 is a block diagram showing an example of a general configuration of the headlamp 110 according to the present embodiment. As shown in FIG. 28, the headlamp 110 includes a camera 501, a control section 601, a inclination sensor 701, and a storage section 801, as well as the aforementioned laser light source unit 101, LED 201, and reflection mirror 112*a* serving as the light control section 112.

<Camera 501>

The camera 501 continuously captures images of an area including a light-distribution area (the first range of floodlighting a1 or the second range of floodlighting a2), ahead of the vehicle. The camera 501 is installed, for example, in a vicinity of a rearview mirror provided forward of a room of the vehicle or in a vicinity of the headlamp 110 (headlight). As the camera 501, a moving image capturing device can be used to capture a moving image at a television frame rate.

The camera 501 starts capturing a moving image, for example, at a time when one of the laser element 111 and the LED 201 is turned on, and the camera 501 outputs the moving image thus captured to the control section 601. The control section 601 can analyze the moving image thus captured to detect and identify a predetermined object in the moving image, and the control section 601 can further control, in accordance with a result of the identification, a position of the first range of floodlighting a1.

Note that the camera 501 may be replaced by an infrared radar (radar) which illuminates an object existing in front of the vehicle with infrared light to detect reflected waves from the object. As in the case of the camera 501, the infrared radar can detect the object existing in front of the vehicle by employing a versatile technique.

Further, the camera 501 may be a visible camera or an infrared camera. Alternatively, the camera 501 may have both functions of the visible camera and the infrared camera. With the camera 501 serving as the infrared camera, homoiothermal animals including a human can be easily detected.

The camera 501 is not necessarily a single camera. Alternatively, the camera 501 may be a plurality of cameras.

Note that a technique of identifying the type of an object in a moving image captured by the camera 501 is not limited to the above-described technique. Instead, a publicly known technique may be employed.

<Control Section 601>

The control section 601 executes a control program, for example, and thereby controls the members constituting the headlamp 110. The control section 601 mainly includes an object detecting section 610 (sensing means), an object identifying section 620 (identifying means), an inclination detecting section 630 (inclination detecting means), the illuminated region changing section 640 (changing means), a lighting control section 650, and an output control section 660 (output control means). The control section 601 carries out various processes by reading out a program from the storage section 801 of the headlamp 110, as needed, into a primary storage section (not illustrated) constituted by a RAM (Random Access Memory) or the like and executing the program. It should be noted that the various members will be described later.

<Inclination Sensor 701>

The inclination sensor 701 is a sensor that measures information to be referenced so that the inclination detecting section 630 detects an inclination of the vehicle. A sensing technique of the inclination sensor 701 may be any technique as long as the technique realizes a quick response by following changes in attitude of the vehicle.

<Storage Section 801>

The storage section 801 has stored therein (1) a control program that is executed by the control section 601 to control each of the sections, (2) an OS program that is executed by the control section 601, (3) an application program that is executed by the control section 601, and (4) various pieces of data that the control section 601 reads out in executing these programs. The storage section 801 is constituted by a storage device such as an HDD (Hard Disk Drive) or a semiconductor memory, and a nonvolatile storage device such as a ROM (Read Only Memory) or a flash memory is provided as needed. It should be noted that although the aforementioned primary storage section is constituted by a volatile storage device such as a RAM, the present embodiment may be described on the assumption that the storage device 801 performs the function of the primary storage section.

<Configuration of the Control Section 601 as Shown in Details>

Next, the various members of the control section 601 are described.

(Object Detecting Section 610)

The object detecting section 610 analyzes a moving image captured by the camera 501 to detect an object in the moving image. Specifically, upon obtaining a moving image from the camera 501, the object detecting section 610 detects an object contained in a possible light-distribution area of the moving image.

The object detecting section 610, upon detecting any object existing in the possible light-distribution area from the moving image, outputs, to the object identifying section 620, a detection signal indicative of a coordinate value representing where the object has been detected.

(Object Identifying Section 620)

The object identifying section 620 identifies, by image recognition, the kind of the object corresponding to the coordinate value indicated by the detection signal, which is outputted from the object detecting section 610. Specifically, the object identifying section 620, upon obtaining a detection signal from the object detecting section 610, extracts features (for example, moving speed, shape, and position) of the object indicated by the detection signal, and thus calculates a feature value, which is a numerical representation of the features.

The object identifying section 620 further refers to a reference value table that is stored in the storage section 801 and that manages reference values each of which is a numerical representation of the features of a kind of object, and retrieves, from the reference value table, a reference value having a difference from the calculated feature value which difference is within a predetermined threshold.

The reference value table has, for example, respective reference values corresponding to a vehicle, a road sign, a pedestrian, an animal, an expected obstacle, and the like registered in advance therein and manages them. The object identifying section 620, in the case where it has identified a reference value having a difference from the calculated feature value which difference is within the predetermined threshold, determines that the object represented by that reference value is the object detected by the object detecting section 610.

The object identifying section 620, when it identifies that the object having been detected by the object detecting section 610 is an object as registered in advance in the reference value table, outputs to the illuminated region changing section 640 an identification signal indicative of (i) the object and (ii) the coordinate value representing where the object has been detected.

(Inclination Detecting Section 630)

The inclination detecting section 630 (i) detects, on a basis of a signal outputted from the inclination sensor 701, an inclination of a whole of the vehicle, particularly an inclination of the vehicle with respect to a horizontal plane, and thus (ii) outputs to the illuminated region changing section 640 an angle signal indicative of a value of an inclination angle of the vehicle. The inclination detecting section 630 can be implemented by any technique as long as the technique realizes a quick response by following changes in attitude of the vehicle.

(Illuminated Region Changing Section 640)

The illuminated region changing section 640 changes an illuminated region (i.e., changes the area, position, and/or the like of the illuminated region) that a laser beam emitted from the laser element 111 forms on the light-emitting section 113. For such a change, the illuminated region changing section 640 determines respective values of output from the laser elements 111 and then outputs to the lighting control section 650 an output signal indicative of the values of output thus determined. It can also be said that the illuminated region changing section 640 determines a laser element(s) 111 to be driven and a laser element(s) 111 not to be driven.

(Lighting Control Section 650)

The lighting control section 650 controls, on a basis of the output signal outputted from the illuminated region changing section 640, the laser elements 111 so that the laser elements 111 are separately turned on and off (i.e., drives the laser element 111). That is, the lighting control section 650 controls (varies) the output of each of the laser elements 111.

The lighting control section 650 outputs, to the output control section 660, a lighting status signal indicative of the lighting status of each of the laser elements 111.

(Output Control Section 660)

The output control section 660 controls the output of illuminating light that is outputted from the LED 201 (i.e., controls the amount of light that is emitted by the LED 201). This makes it possible to control the intensity of illuminating light that is emitted from the LED 201. The LED 201 has an arrangement of LEDs in a matrix manner, and in a case where the output of each of the LEDs is controlled, rough light-distribution control (e.g., rough control of the standard of light-distribution characteristics of a passing headlight, a light-distribution pattern that is stipulated in a drive-on-the-left country, etc.) can be carried out.

Further, the output control section 660 can also analyze a lighting status signal outputted from the lighting control section 650 and determine, if determining at least one of the laser elements 111 is being on, that illuminating light is emitted from the laser light source unit 101. In this case, the output control section 660 controls output of the illuminating light emitted from the LED 201.

For example, the output control section 660 changes the output, chromaticity, etc. of the LED 201 according to the driver (differences in spectral luminous efficacy due to differences in age, race, etc. among drivers) and the driving environment (weather, whether the vehicle is traveling in an urban district or a mountainous region, whether the vehicle is traveling in an evening or in a nighttime, etc.).

It should be noted that in the storage section 801, (i) drivers (differences in spectral luminous efficacy due to differences in age, race, etc. among drivers) and/or driving environments (weather, whether the vehicle is traveling in an urban district or a mountainous region, whether the vehicle is traveling in the evening or at night, etc.) and (ii) the values of output (chromaticity, in the case of a chromaticity-changing type) from the LED 201 are stored in association with each other. The output control section 660 gradually controls the output of the LED 201 by reading out the values of output.

Further, even in a case where, for example, all of the laser elements 111 fail and suddenly stop being on, and the output control section 660 controls the emission of illuminating light from the LED 201, thereby ensuring at least minimum requirements stipulated for the light-distribution characteristics and illuminance of the headlamp 110.

Further, the output control section 661 can also control the output of the LED 201 in accordance with the lighting status of the laser light source unit 101 (i.e., the state of output of illuminating light from the laser light source unit 101). This makes it possible to switch to an electric power consumption reduction mode, and to utilize the LED 201 to backup the laser light source unit 101.

(Details of the Illuminated Region Changing Section 640)

The illuminated region changing section 640 determines, according to a desired first range of floodlighting a1 to be formed, respective values of output of the laser elements 111, as described previously, and then outputs to the lighting control section 650 a result of the determination as an output signal. That is, the illuminated region changing section 640 changes the illuminated region to be formed by laser beams on the light-emitting section 113, by changing respective outputs of the plurality of laser elements 111 while including no moving member that is movable to change the illuminated region. This makes it possible to change the illuminated region in quick response to a change in output of each of the laser elements 111. Therefore, it is possible to perform control of the light-distribution characteristics of illuminating light that is highly responsive to such a change in output of the laser light source unit 101.

Here, the moving member refers to a member capable of mechanical movement, and also refers to a member that can be provided separately from the members provided in the headlamp 110, such as the laser element 111, the light control section 112 and the like light collection system, and the reflector 114, so that such movement can be made. That is, the headlamp 110 according to the present embodiment is configured to include the lighting device capable of changing the illuminated region, without including the moving member as described above.

Examples of the desired first range of floodlighting a1 include:

(1) a range based on an object and its corresponding coordinate value both of which have been outputted from the object identifying section 620;

(2) a range that meets the standard of light-distribution characteristics of the driving headlight (high beam);

(3) a range that meets the standard of light-distribution characteristics of the passing headlight (low beam);

(4) a range that meets a light-distribution pattern of a illuminating light stipulated in a drive-on-the-right country;

(5) a range that meets a light-distribution pattern of a illuminating light stipulated in a drive-on-the-left country;

(6) a range based on an angle signal outputted from the inclination detecting section 630;

(7) a range that meets a light-distribution pattern for use in an evening;

(8) a range that meets a light-distribution pattern for use in a nighttime;

(9) a range that meets a light-distribution pattern for use in a rainy condition;

(10) a range that meets a light-distribution pattern for use on a snowy road;

(11) a range that meets a light-distribution pattern for use on an icy road;

(12) a range that meets a light-distribution pattern for use on a paved road;

(13) a range that meets a light-distribution pattern for use on an unpaved road;

(14) a range that meets a light-distribution pattern for use in an urban district; and

(15) a range that meets a light-distribution pattern for use in a mountainous region.

Further, examples of the object in the range (1) include:

(a) a person jumping in front of a vehicle;

(b) a car jumping in front of a vehicle;

(c) a two-wheeled vehicle, such as a motorcycle, jumping in front of a vehicle;

(d) an animal jumping in front of a vehicle (e) a standing vehicle;

(f) a falling object;

(g) an oncoming vehicle; and (h) a vehicle driving in front (preceding vehicle).

(Storage Section 801)

In order to achieve a change of first ranges of floodlighting a1 such as the first ranges of floodlighting (1) to (15), the storage section 801 has stored therein, e.g., (A) identification related data by which the object and the coordinate value as indicated by an identifying signal, the laser element 111 to be driven, power required to drive each of the laser elements 111 are associated with one another, (B) standard-of-characteristics related data by which the standard of light-distribution characteristics of a driving headlight or a passing headlight, the laser element 111 to be driven, and power required to drive each of the laser element 111 are associated with one another, (C) light-distribution-pattern related data by which the light-distribution pattern of a drive-on-the-right country or a drive-on-the-left country, the laser element 111 to be driven, and power required to drive each of the laser elements 111 are associated with one another, and (D) angle related data by which the angle of inclination of the vehicle, the laser element 111 to be driven, and power required to drive each of the laser elements 111 are associated with one another. Furthermore, the storage section 801 has stored therein data related to driving of the laser light source unit 101 according to various ambient surroundings, data related to control of light by the laser light source unit 101 according to various ambient surroundings, data related to driving of the LED 201, etc.

The illuminated region changing section 640 reads out any one of the identification related data, the standard-of-characteristics related data, the light-distribution-pattern related data, the angle related data, etc. from the storage section 801 and determines which one(s) is/are to be driven or not to be driven among the plurality of laser elements 111 (i.e. determines respective values of outputs of the laser elements 111).

(Laser Element 111 and Ranges of Floodlighting)

Figure 31:
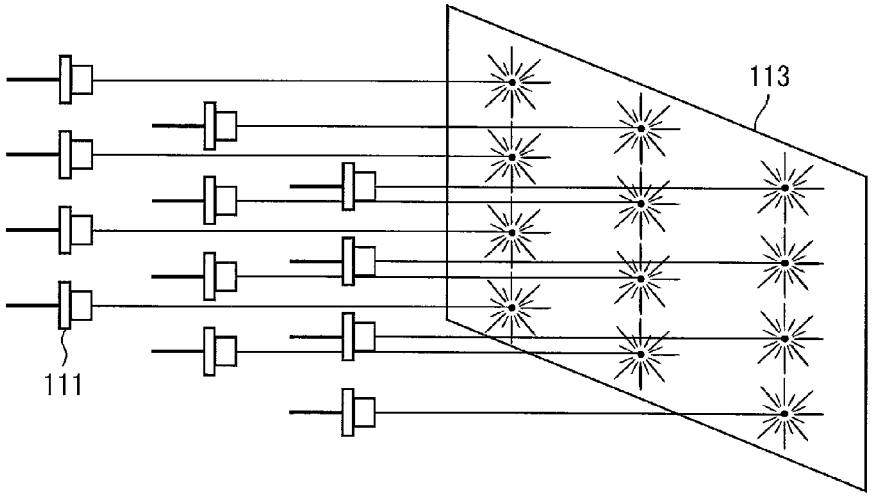
FIG. 31 is a diagram schematically showing a relationship between a plurality of laser elements of the headlamp and a light-emitting section of the headlamp.
Figure 32:
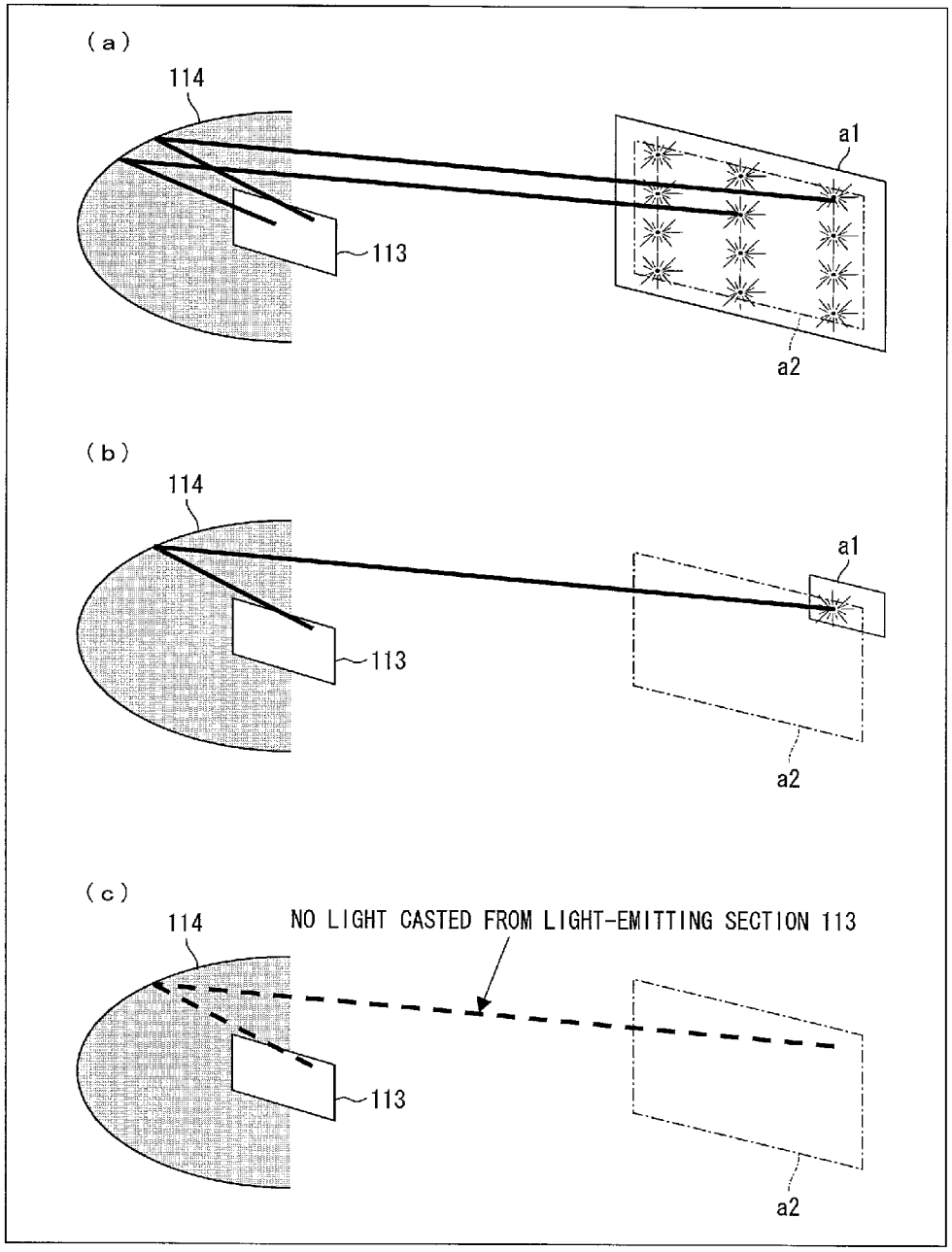
FIG. 32 is a set of diagrams (*a*) through (*c*) schematically showing a relationship between a pattern of formation of an illuminated region on the light-emitting section and the size of a first range of floodlighting, (*a*) being a diagram showing the relationship as established when all of the laser elements are on, (*b*) being a diagram showing the relationship as established when some of the laser elements are on, (*c*) being a diagram showing the relationship as established when all of the laser elements are off.

Here, referring to FIGS. 31 and 32, the following describes (i) the illuminated region to be formed by the laser beams emitted from the plurality of laser elements 111 on the light-emitting section 113 and (ii) a relationship between a pattern of formation of the illuminated region and the size of the first range of floodlighting a1.

FIG. 31 schematically shows a relationship between the plurality of laser elements 111 and the light-emitting section 113. Note that in FIG. 31, a reflection mirror 112*a* or a lens 112*b* (described later), which functions as the light control section 112, is omitted. For the sake of simplification, twelve (12) laser elements 111 are depicted in FIG. 31.

As shown in FIG. 31, the laser elements 111 are provided in a matrix manner with respect to the light-emitting section 113. With this arrangement, laser beams emitted from the respective laser elements 111 are shone on a whole light-receiving surface of the light-emitting section 113 in a matrix manner so that there is no overlap between illuminated regions that are formed on the light-receiving surface. This makes it possible (i) to allow the fluorescent body of the light-emitting section 113 to efficiently emit light and (ii) to change, by control of lighting-up of the laser elements 111, the first range of floodlighting a1 according to various light-distribution characteristics.

Further, FIG. 32 shows a relationship between a pattern of formation of the illuminated regions on the light-emitting section 113 and the size of the first range of floodlighting a1. Note that for the sake of simplification, FIG. 32 depicts an arrangement such that a parabolic mirror is used to serve as the reflector 114 and that the light-emitting section 113 is provided nearly at a focal point of the parabolic mirror.

In a case shown in (*a*) of FIG. 32, in a situation where the LED 201 stays on, the use of the illuminating light emitted from the laser light source unit 101 allows at least the second range of floodlighting a2 to be more brightly illuminated. Further, for example, even in a case where, due to a breakdown or the like of the LED 201, the second range of floodlighting a2 fail to meet requirements stipulated for the range of floodlighting and light intensity of the headlamp 110, the illuminating light emitted from the laser light source unit 101 ensures illumination of the second range of floodlighting a2.

Further, in a case where the illuminated region changing section 640 outputs, to the lighting control section 650, an output signal indicative of driving one (1) laser element 111, as shown in (*b*) of FIG. 32 (*b*), the illuminated region is formed on the light-receiving surface of the light-emitting section 113 so as to include only a position corresponding to the laser element 111 (only one (1) segment of the light-receiving surface). In this case, the first range of floodlighting a1 becomes only a range formed by light cast of the illuminating light emitted from the illuminated region.

In this case, it is possible to make the first range of floodlighting a1 smaller than the second range of floodlighting a2. For example, as described later, it is possible to brightly light only a predetermined object in front of the headlamp 110. Further, it is possible to light a necessary portion and eliminate lighting of an unnecessary portion. This makes it possible to reduce electric power consumption of the entire headlamp 110.

Further, in a case where the illuminated region changing section 640 outputs to the lighting control section 650 an output signal indicative of not driving any of the laser elements 111, no illuminated region is formed on the light-receiving surface of the light-emitting section 113, as shown in (*c*) of FIG. 32. In this case, no first range of floodlighting a1 is formed, but only the second range of floodlighting a2 is formed.

In this manner, the illuminated region changing section 640 determines which one(s) to be driven among the plurality of laser elements 111 (i.e. determines respective values of outputs of the laser element 111), thereby changing the illuminated regions to be formed by laser beams on the light-emitting section 113. This makes it possible to change a desired area of the first range of floodlighting a1 to be formed by the illuminating light emitted from the light-emitting section 113. It is therefore possible (i) to utilize, as the illuminating light, light beams emitted from the laser light source unit 101 and the LED 201 and (ii) to control the light-distribution characteristics and light intensity distribution of the illuminating light. That is, it is possible to freely change the light-distribution pattern to be formed by light emitted from the headlamp 110.

Further, by the determination of the illuminated region changing section 640 as to which one(s) is/are to be driven among the laser elements 111 (i.e. determination of the respective values of output of the laser elements 111), it is possible to control the position(s) of the illuminated region(s) to be formed on the light-receiving surface of the light-emitting section 113. That is, it can be said that the illuminated region changing section 640 changes the position(s) of the illuminated region(s) with respect to the light-emitting section 113. This makes it possible to change the position and size of the first range of floodlighting a1, thus not only freely changing the light-distribution pattern to be formed by the first range of floodlighting a1, but also freely controlling the intensity of light emitted from the first range of floodlighting a1. Thus, it is possible to realize a wide variety of light-distribution patterns.

Still further, as shown in FIG. 32, cast light by the laser light source unit 101 can more finely control the range of floodlighting and light-distribution pattern than cast light by the LED 201. An example of fine control of the range of floodlighting and light-distribution pattern will be described later with reference to, for example, FIGS. 33 and 34.

Yet further, the headlamp 110 includes the laser light source unit 101 and the LED 201. With this configuration, it is possible to utilize, as the illuminating light, light beams emitted from light sources that emit light on different principles, by use of one lighting device.

Further, a lamp which scans and emits light to be emitted from a light source, as disclosed in the conventional technique, had the following risk. That is, in the event of a breakdown of the light source would lead the lamp to not only a failure to control light distribution but also a failure to emit illuminating light. This would result in failure to implement the function of the lamp. On the contrary, the headlamp 110 according to the present embodiment, which includes the laser light source unit 101 and the LED 201 as described above, can avoid the failure to implement the function of the lamp.

It should be noted here that in order to achieve a particular light-distribution pattern (e.g., light-distribution characteristics of a passing headlight) with an LED, a conventional lamp has blocked part of illuminating light with a mask (light-blocking plate), a lens cut, or a mirror cut. However, this configuration causes a loss of the illuminating light.

Meanwhile, in the present embodiment, the LED 201 is mainly utilized to backup the rays of light emitted from the laser light source unit 101. Further, under control of the illuminated region changing section 640, it is possible to freely change the shape, size, etc. of a first range of floodlighting a1. This makes it unnecessary to create an advanced optical design (e.g., a lens cut or a mirror cut) so as to form a particular light-distribution pattern. Further, switching between the light-distribution characteristics of a driving headlight and the light-distribution characteristics of a passing headlight, for example, can be achieved by a reflector of a simple shape. It should be noted that in the present embodiment, free formation of a range of floodlighting a1 may be inhibited all the more because of the mirror cut or the like.

Further, in a case where the configuration of the headlamp 110 of the present embodiment is achieved by a lighting device (e.g., an interior lamp) other than the headlamp 110, it is possible, for example, to illuminate the whole room with illuminating light emitted from the LED 201 and illuminate the top surface of a desk with illuminating light emitted from the laser light source unit 101.

The following describes examples of operation 1 to 6 of the headlamp 110 where the first ranges of floodlighting (1) to (15) can be achieved. It should be noted that the examples of operation 1 to 6 are intended for illustrative purposes only, and are not intended to limit examples of operation of the headlamp 110. In the following examples of operation, the first ranges of floodlighting a1, which are formed so as to include objects (such as a pedestrian, an animal, a road sign, and a centerline) located in front of the vehicle, are ranges that are formed by light cast by the laser light source unit 101, and need only be higher in luminous intensity than the second range of floodlighting a2, which are formed by light cast by the LED 201 alone.

<Specific Example of Operation 1>

Figure 33:
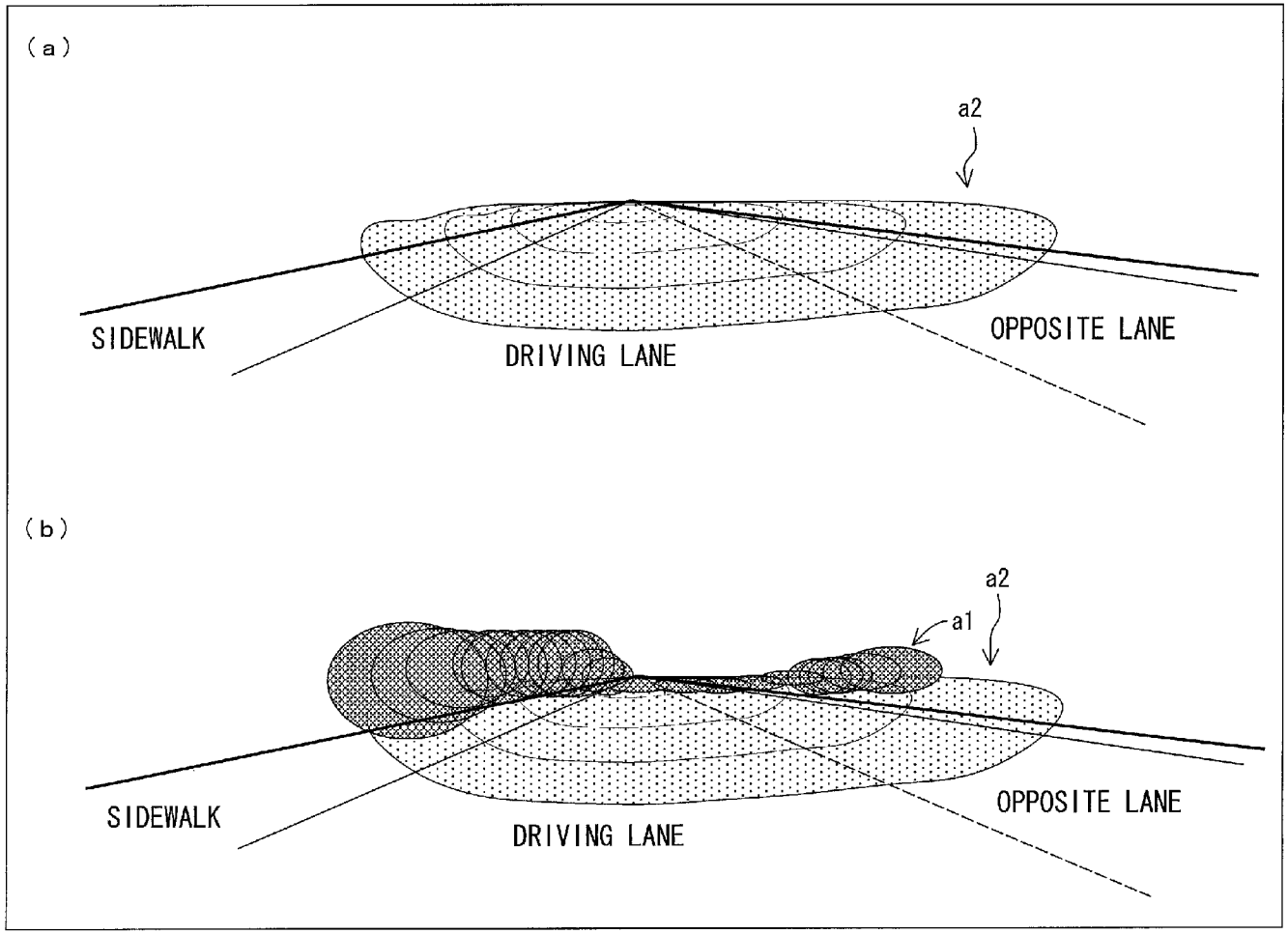
Figure 34:
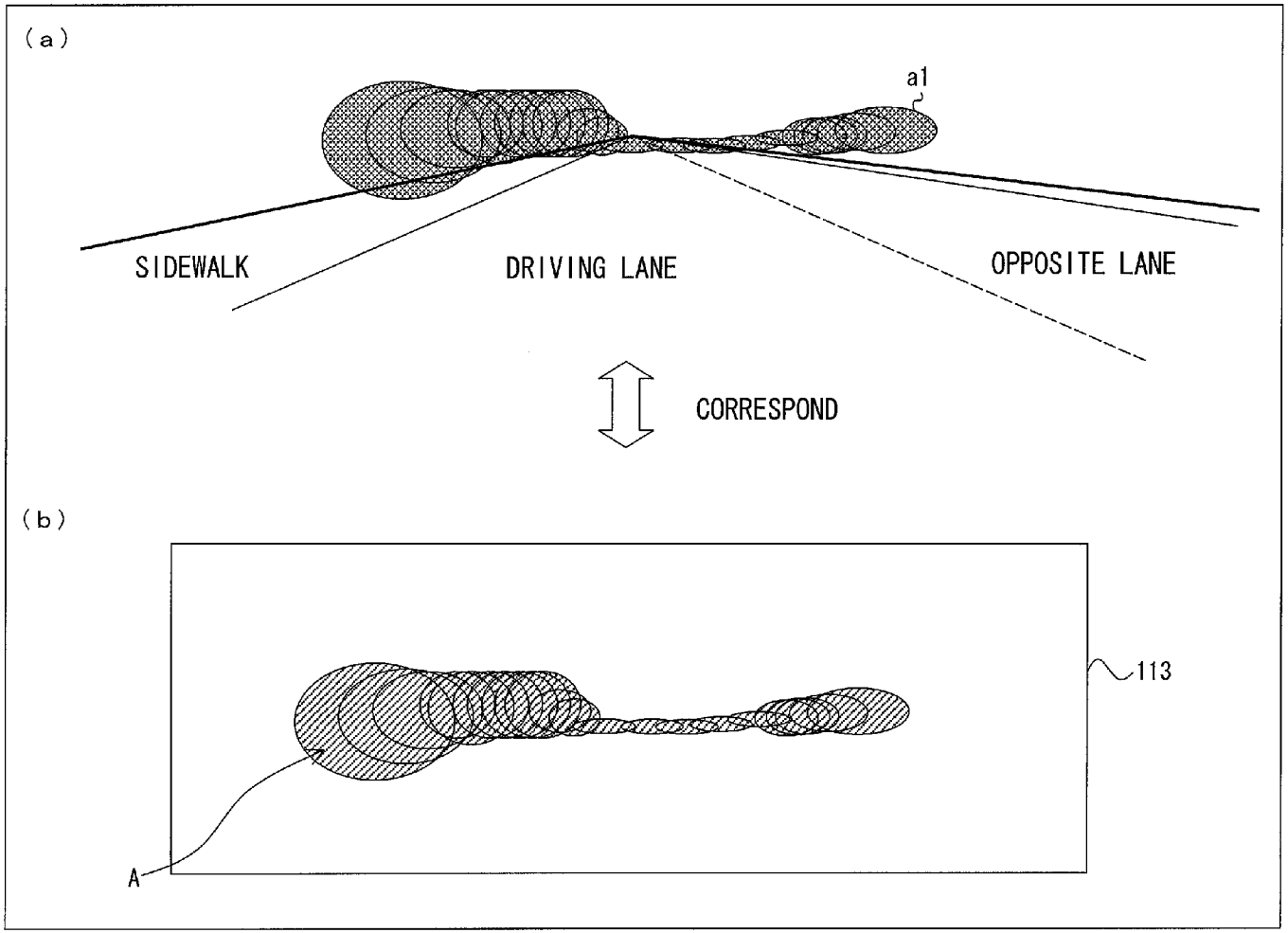
FIG. 34 is a set of diagrams (*a*) and (*b*), (*a*) being a diagram showing first ranges of floodlighting formed by illuminating light emitted by the laser light source unit exhibiting the light-distribution characteristics shown in (*b*) of FIG. 33, (*b*) being a diagram showing an example of appearance of an illuminated region formed on the light-emitting section when the first ranges of floodlighting of (*a*) of FIG. 33 are achieved.

First, an example of light distribution in an urban district is described with reference to FIGS. 33 and 34. FIG. 33 is a diagram showing an example of light-distribution characteristics of the headlamp 110 as exhibited when the headlamp 110 is used in an urban district. In FIG. 34, (*a*) is a diagram showing first ranges of floodlighting a1 formed by illuminating light emitted by the laser light source unit 101 exhibiting the light-distribution characteristics shown in FIG. 33, (*b*) is a diagram showing an illuminated region formed when the first ranges of floodlighting a1 of (*a*) of FIG. 33 are achieved.

(*a*) of FIG. 33 shows light-distribution characteristics as exhibited when only the LED 201 is on, i.e. an appearance of second ranges of floodlighting a2 formed. As shown in (*a*) of FIG. 33, the whole areas of the sidewalk, the driving lane, and the opposite lane and the area in front of the vehicle other than those roads are illuminated. However, it is difficult to finely control the light-distribution characteristics even by using light-blocking plate or the like.

The present embodiment allows illuminating light emitted from the laser light source unit 101 to be emitted together with illuminating light emitted from the LED 201. As shown in (*b*) of FIG. 33, the laser light source unit 101 forms first ranges of floodlighting a1.

The first ranges of floodlighting a1 thus formed are shown in (*a*) of FIG. 34. In order to form the first ranges of floodlighting a1 shown in (*a*) of FIG. 34, the illuminated region changing section 640 determines respective output values of the laser elements 111 so that illuminated regions A such as those shown in (*b*) of FIG. 34 are formed. That is, the illuminated region changing section 640 determines the respective output values of the laser elements 111 so that a first range of floodlighting a1 is formed in a peripheral part or outside a second range of floodlighting a2. The illuminated region changing section 640 then transmits to the lighting control 650 an output signal indicative of the output values thus determined. The lighting control 650 controls lighting-up of the laser elements 111 in accordance with such an output signal so that the illuminated regions A such as those shown in (*b*) of FIG. 34 are formed.

With this, as shown in (*b*) of FIG. 33, those ranges which are hard to make visible with illuminating light emitted from the LED 201 (i.e., those ranges which cannot be illuminated by the LED 201) can be supplementarily illuminated by illuminating light emitted from the laser light source unit 101.

Furthermore, as shown in (*b*) of FIG. 34, illuminated regions which are formed by respective laser beams emitted from the plurality of laser elements 111 are changed by the illuminated region changing section 640 so as to partially overlap with each other. This allows first ranges of floodlighting a1 which are formed in accordance with the respective illuminated regions to overlap with each other. This makes it possible to smoothly form the first ranges of floodlighting a1.

It should be noted that in order to achieve such a smooth overlap of ranges of floodlighting with a light source such as the LED 201, it is necessary to provide a reflector or a multi-facet mirror for each of the plurality of LED chips 21 to lap the ranges of floodlighting over one another during floodlighting. Moreover, whereas the luminance of the laser light source unit 101 in the present embodiment is 1000 Mcm/m$^2$, the luminance of a typical LED or HID amp is 100 Mcd/m$^2$. An attempt to use an LED or Hip lamp to form the same ranges of floodlighting as those which are formed by the laser light source unit 101 makes it necessary to increase the size of each reflector by one digit, and therefore is not realistic. Since the headlamp 110 of the present embodiment uses the laser element 111, smooth change of ranges of floodlighting can be achieved without providing a reflector or a multi-facet mirror.

Further, as shown in (*b*) of FIG. 34, by being simultaneously formed on the light-emitting section 113, the plurality of illuminated regions which are formed by the respective laser beams emitted from the plurality of laser elements 111 can simultaneously form the plural ranges of floodlighting (indicated by circles in the drawing) which are formed by the illuminating light emitted from the laser light source unit 101. This makes it possible to simultaneously floodlight a plurality of areas in front of the headlamp 110.

<Specific Example of Operation 2>

Figure 35:
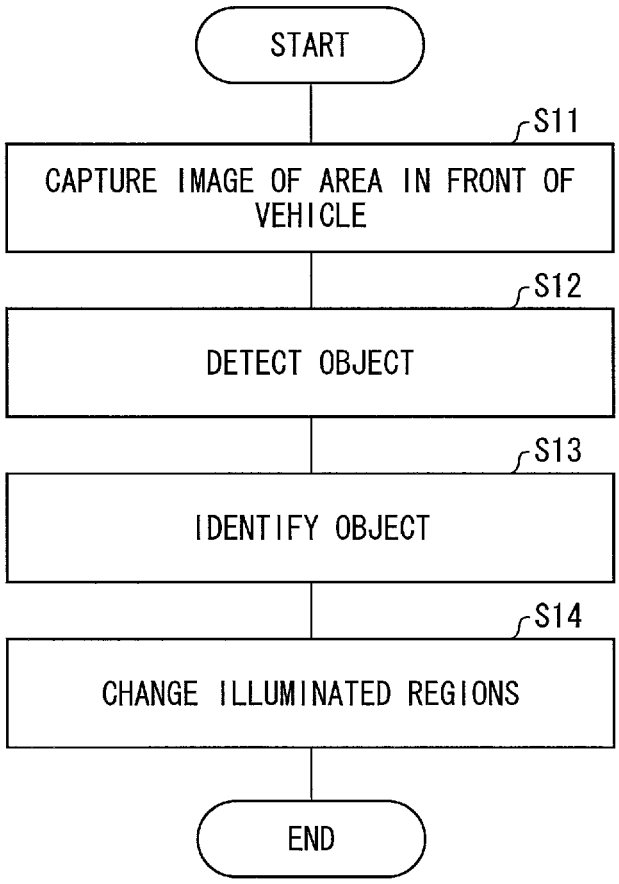
FIG. 35 shows an example of the flow of a process that is carried out by the headlamp.
Figure 36:
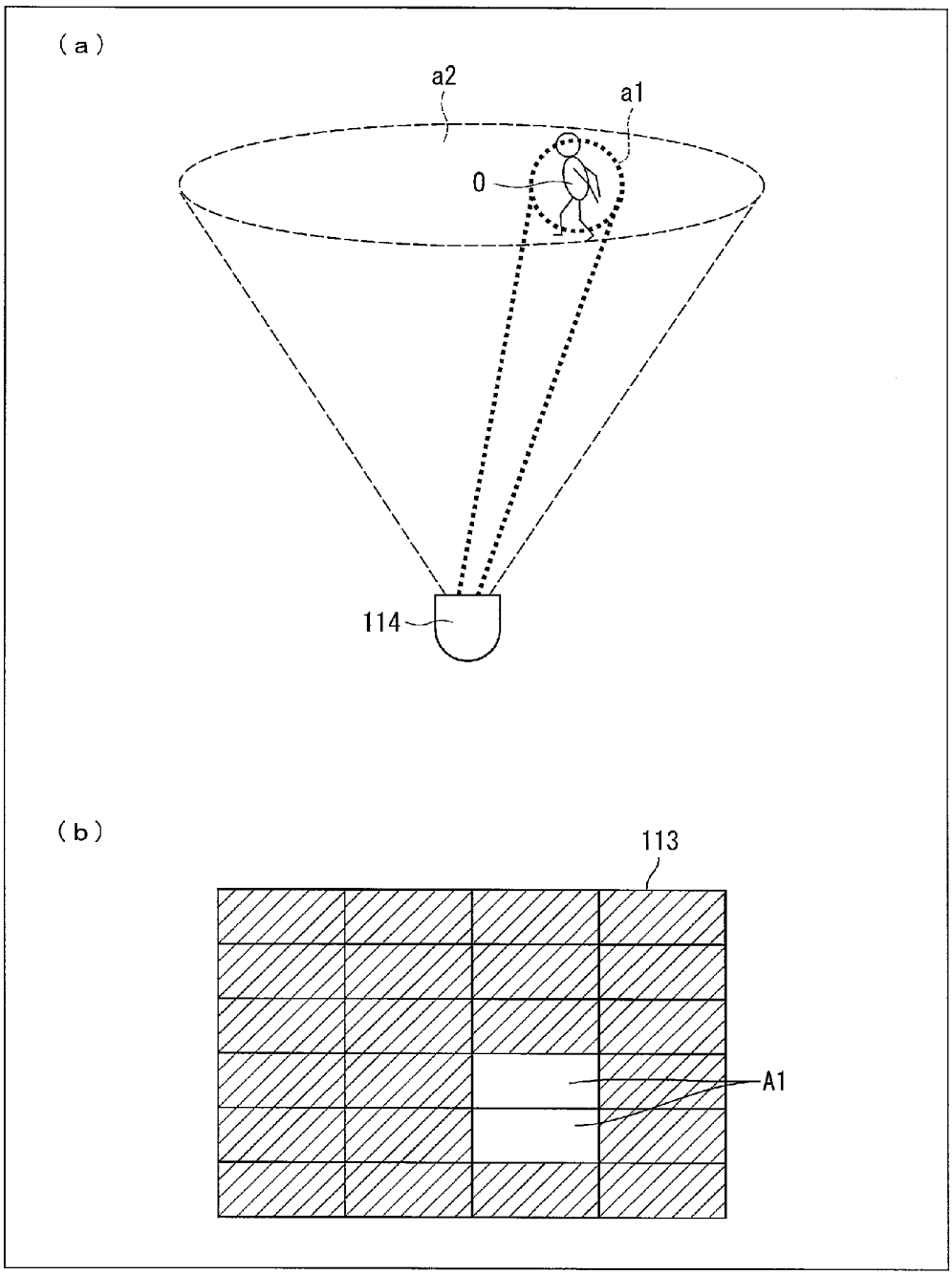
FIG. 36 is a set of schematic views (*a*) and (*b*), (*a*) being a schematic view showing an example of ranges of floodlighting formed by the process that is carried out by the headlamp, (*b*) being a schematic view showing an example of an illuminated region formed on the light-emitting section.

Next, an example of operation where an object sensed by the object detection section 610 is illuminated with illuminating light emitted from the laser light source unit 101 is described with reference to FIGS. 35 and 36. FIG. 35 is a diagram showing an example of a flow of a process that is carried out by the headlamp 110 in the example of operation 2. In FIG. 36, (*a*) is a schematic view showing an example of ranges of floodlighting formed by the process carried out by the headlamp 110, and (*b*) is a schematic view showing an example of an illuminated region formed on the light-emitting section 113.

As shown in FIG. 35, when the laser light source unit 101 and/or the LED 201 is turned on, the camera 501 starts capturing images of an area in front of the vehicle (S11). In S11, the camera 501 captures a moving image of an area in front of the vehicle, at an angle of view such that an image of at least the whole light-distribution area can be captured, and the camera 501 then outputs the moving image to the object detecting section 610 of the control section 601.

Next, the object detecting section 610 analyzes the moving image thus captured by the camera 501 to detect an object existing in a possible light-distribution area from the moving image (S12). The object detecting section 610, upon detecting any object existing in the possible light-distribution area from the moving image, outputs, to the object identifying section 620, a detection signal indicative of a coordinate value representing where the object has been detected.

Subsequently, the object identifying section 620 identifies the kind of the object corresponding to the coordinate value indicated by the detection signal, which has been outputted from the object detecting section 610 (S13). Specifically, the object identifying section 620, upon obtaining the detection signal from the object detecting section 610, extracts features (for example, moving speed, shape, and position) of the object corresponding to the coordinate value indicated by the detection signal, and thus calculates a feature value, which is a numerical representation of the features.

The object identifying section 620 further refers to the reference value table and retrieves from the reference value table a reference value having a difference from the calculated feature value which difference is within a predetermined threshold. In a case where the object identifying section 620 has identified the reference value having a difference from the calculated feature value which difference is within the predetermined threshold, the object identifying section 620 identifies that the object represented by that reference value is the object having been detected by the object detecting section 610.

The object identifying section 620, when it identifies that the object having been detected by the object detecting section 610 is an object as registered in advance in the reference value table, outputs to the illuminated region changing section 640 an identification signal indicative of the coordinate value representing where the object has been detected.

In the case of (*a*) of FIG. 36, the object identifying section 620 identifies the kind of the object as a pedestrian O and also outputs, to the illuminated region changing section 640, the identification signal indicative of the coordinate value representing where the pedestrian O has been detected in the moving image. Note that the pedestrian O is depicted as an example of a factor of an accident.

Next, the illuminated region changing section 640 determines, in accordance with the coordinate value represented by the identification signal, which has been outputted from the object identifying section 620, such output values of the laser elements 111 that light from the light-emitting section 113 is distributed toward the object. Then, the illuminated region changing section 640 outputs, to the lighting control section 650, an output signal indicative of the outputs values thus determined.

In accordance with the output signal, the lighting control section 650 performs control of respective outputs of the laser elements 111 (including control of the turning off of the laser elements 111). That is, the illuminated region changing section 640 changes illuminated regions (its area, position, and/or luminance distribution) formed by the laser beams on the light-emitting section 113 (S14).

In the case shown in FIG. 36, the illuminated region changing section 640 reads out the identification related data from the storage section 801 to determine (i) that a laser element(s) 111 provided at the position(s) corresponding to the coordinate value of, for example, the pedestrian O which has been detected from the moving image is/are to be driven, and (ii) that the other laser element(s) 111 are not to be driven. The lighting control section 650 then controls lighting-up of the laser element(s) 111 in accordance with the output signal indicative of a result of the determination.

In this case, as shown in (*b*) of FIG. 36, the laser beams emitted from the driven laser elements 111 are shone on only regions Al on the light-receiving surface of the light-emitting section 113 (as indicated by bright portions in the drawing), but not the other regions (indicated by dark portions in the drawing). This allows the first range of floodlighting a1 to be formed so that light from the light-emitting section 113 is distributed toward the pedestrian O, thus making it possible to more brightly illuminate the pedestrian O.

Thus, in the headlamp 110, the illuminated region changing section 640 changes illuminated regions on the light-emitting section 113 so that an object (i.e., a road sign, a pedestrian, an animal, an obstacle a centerline, or the like) sensed by the object detecting section 611 is included; therefore, the light from the light-emitting section 113 can be distributed solely to the object. That is, the road sign, the pedestrian, the obstacle, or the like can be illuminated brightly. This makes it possible to visually read the road sign correctly and visually recognize the pedestrian, the obstacle, or the like correctly, thus making possible to achieve a safe traffic environment.

Further, the reference value table has managed therein reference values corresponding to vehicles such as a bicycle and a motorcycle as well as reference values corresponding to a road sign, a pedestrian, an obstacle, etc. This makes it possible to form a first range of floodlighting a1 in an appropriate position according to the kind of an object identified by the object identifying section 620.

The present embodiment uses the laser elements 111 as an excitation light source that is an optically small light source (high-luminance light source) with respect to the floodlighting system (the reflector 114 and the convex lens 116), thus making it possible to achieve such high floodlighting efficiency that 90% of the light emitted by the light-emitting section 113 is cast on the target object. This makes it possible to achieve floodlighting with low electric power consumption and with high illuminance on the target object.

(Modification of Specific Example of Operation 2>

Figure 37:
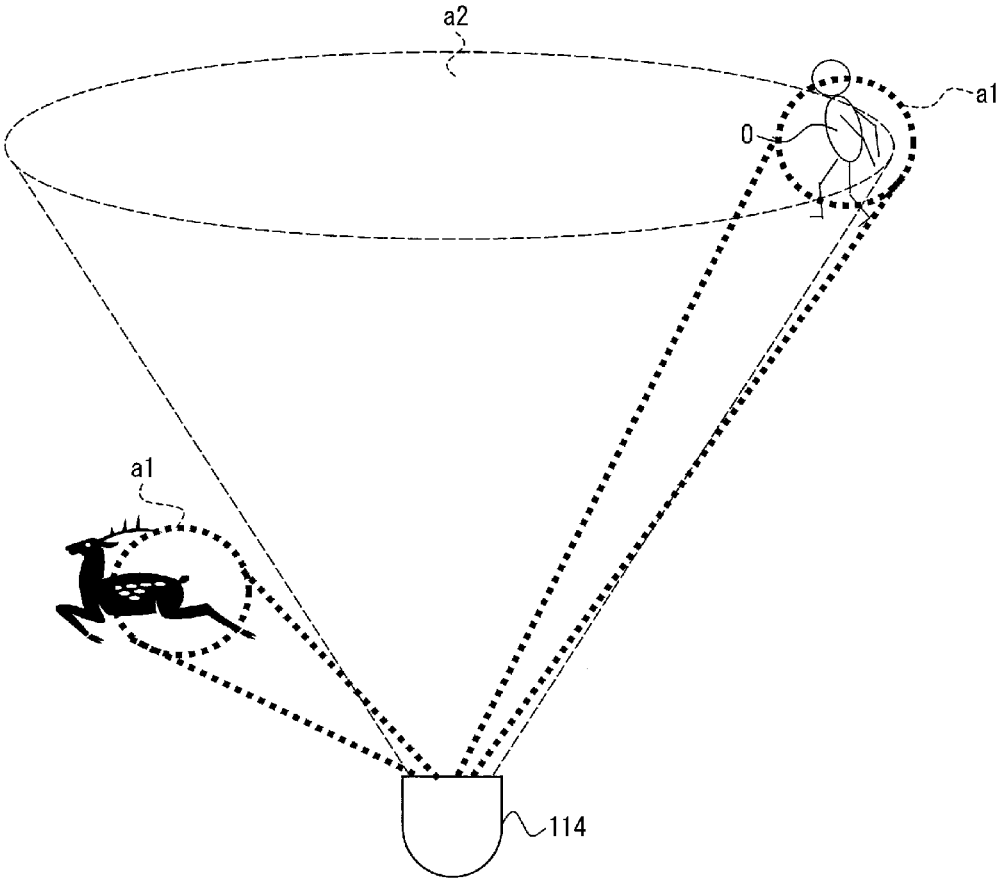
FIG. 37 is a schematic view showing an example of ranges of floodlighting formed by a modification of the process of FIG. 36.

FIG. 37 is a view showing a modification of the specific example of operation 2. In the present modification, the pedestrian O and the animal are target objects. With the second range of floodlighting a2 alone, it is difficult for the driver to recognize the target objects, as the illuminance on the target objects (i.e., the pedestrian O and the animal) is low.

In the case shown in FIG. 37, as in the case shown in FIG. 36, the present modification can direct spotlight (light emitted from the light-emitting section 113) regardless of the second range of floodlighting a2, thus making it possible to alert the driver.

Further, in the present modification, the light distribution of each spotlight (the position of formation of a first range of floodlighting a1) is controlled by the illumination of each laser beam to the light-emitting section 113. This makes it possible to floodlight a plurality of places with a single headlamp 110 (floodlighting device), thus making it possible to reduce the size of the headlamp 110. That is, first ranges of floodlighting a1 can be simultaneously formed on a plurality of places so as to include a plurality of target objects, respectively. It should be noted that the process in the present modification is similar to that of the example of operation 2, and as such, is not described below.

Even if the target objects are moving objects as in the case of the example of operation 2 and its modification, the illuminated region changing section 640 needs only change the illuminated region of laser beams on the light-emitting section 113. This makes it possible to change first ranges of floodlighting a1 in quick response to the movement of the target objects, thus making it possible to follow the target objects.

<Specific Example of Operation 3>

Figure 38:
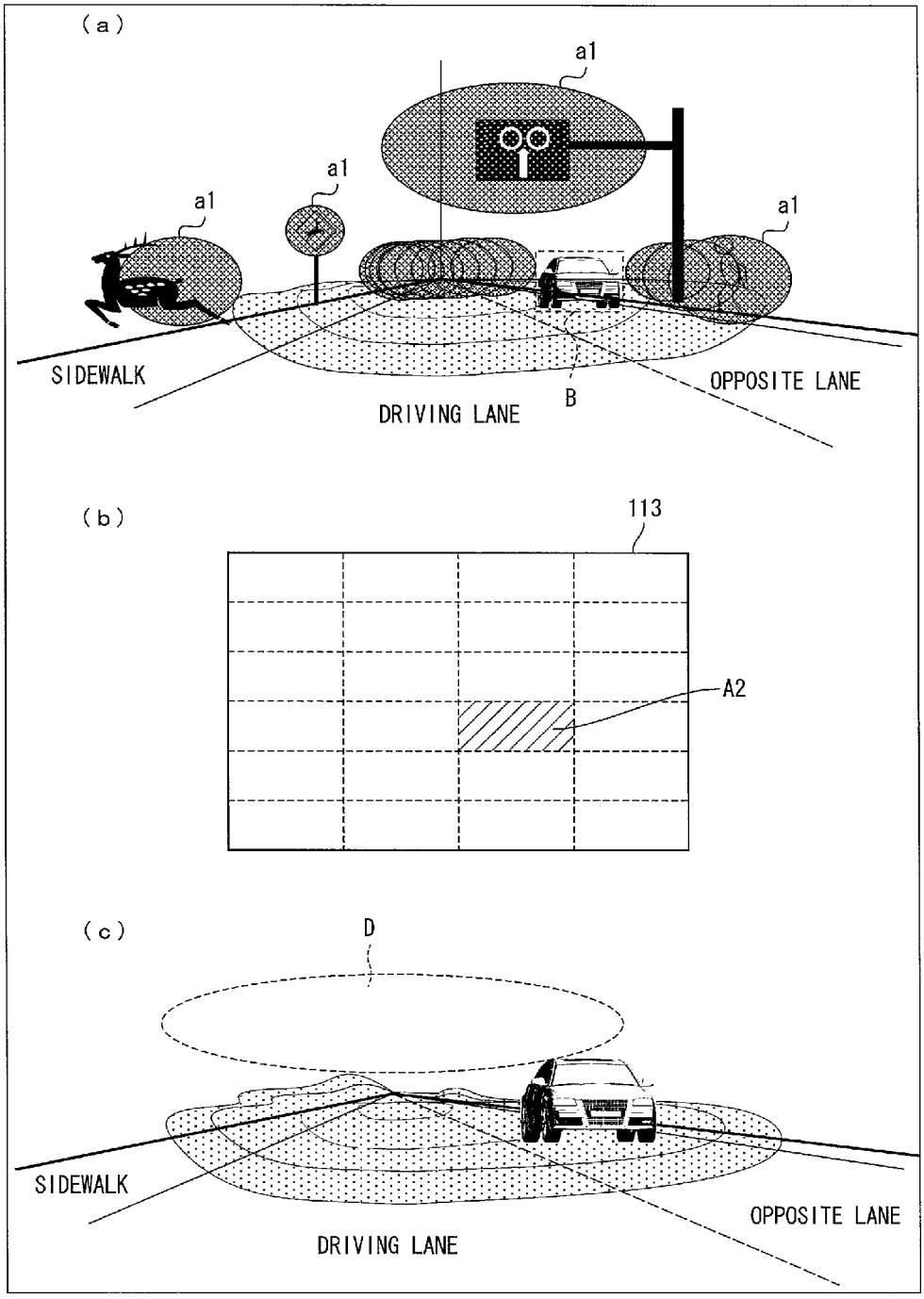

Next, referring to FIG. 38, the following describes an example of operation where an object sensed by the object detecting section 610 is not illuminated by illuminating light emitted from the laser light source unit 101. In FIG. 38, (*a*) is a schematic view showing another example of ranges of floodlighting formed by the process that is carried out by the headlamp 110, and (*b*) is a schematic view showing an example of an illuminated region formed on the light-emitting section 113. Further, (*c*) of FIG. 38 is a diagram showing an example of light-distribution characteristics as formed when only the LED is on. For simplification of explanation, any illuminated regions corresponding to the first ranges of floodlighting a1 in (*a*) of FIG. 38 are not depicted in (*b*) of FIG. 38.

The example of operation 3 shows an example of a case where those objects sensed by the object detecting section 610 include an oncoming vehicle and light is cast in a light-distribution pattern corresponding to a high beam (a first range of floodlighting a1 corresponding to a high beam is formed).

As in the example of operation 2, the kinds of objects are identified by the object detecting section 610 and the object identifying section 620 carrying out a process, and an identifying signal indicative of a coordinate value in a moving image in which the objects have been detected is outputted to the illuminated region changing section 640. In the case shown in (*a*) of FIG. 38, the object identifying section 620 identifies the kinds of the objects as an oncoming vehicle (such as an automobile or a motorcycle), a pedestrian, a road sign, and an animal, and outputs, to the illuminated region changing section 640, an identifying signal indicative of a coordinate value in a moving image in which the oncoming vehicle has been detected.

The illuminated region changing section 640 determines, in accordance with the coordinate value represented by the identifying signal, which has been outputted from the object identifying section 620, such output values of the laser elements 111 that light from the light-emitting section 113 is not distributed toward the oncoming vehicle. Then, the illuminated region changing section 640 outputs, to the lighting control section 650, an output signal indicative of the outputs values thus determined. In accordance with such an output signal, the lighting control section 650 performs control of respective outputs of the laser elements 111. Here, as in the case of the example of operation 2, the illuminated region changing section 640 determines, in accordance with the coordinate value, such output values of the laser elements 111 that light from the light-emitting section 113 is distributed toward each of the objects, i.e. the pedestrian, the road sign, and the animal.

In the case shown in FIG. 38, the illuminated region changing section 640 reads out the identification related data from the storage section 801 to determine (i) that a laser element(s) 111 provided at the position(s) corresponding to the coordinate value of, for example, the oncoming vehicle which has been detected from the moving image is/are not to be driven, and (ii) that the other laser element(s) 111 are to be driven. The lighting control section 650 then controls lighting-up of the laser element(s) 111 in accordance with the output signal indicative of a result of the determination.

In this case, as shown in (*b*) of FIG. 38, the laser beams emitted from the laser elements 111 driven are shone on any of the regions (indicated by bright portions in the drawing) other than the region A2 (indicated by a dark portion in the drawing) on the light-receiving surface of the light-emitting section 113. With this, as shown in (*a*) of FIG. 38, the first ranges of floodlighting a1 are formed so that the light from the light-emitting section 113 is not distributed toward the oncoming vehicle. That is, the headlamp 110 can control the ranges of floodlighting so as not to floodlight the region (region B) where otherwise the oncoming vehicle is illuminated.

Thus, the headlamp 110 is configured such that in a case where the object is an oncoming vehicle or the like, the illuminated region changing section 640 changes the illuminated regions on the light-emitting section 113 so that the object sensed by the object detecting section 610 is not included; therefore, the light from the light-emitting section 113 can be distributed so that the object is not included. This makes it possible to reduce unpleasant glare and dazzle that, for example, the driver of an oncoming vehicle, a preceding vehicle, or the like experiences, thus making it possible to achieve a safe and comfortable traffic environment.

Further, in the examples of operation 1 and 2, when the kind of an object identified by the object identifying section 620 matches the kind of an object as registered in advance in the reference value table, the illuminated region changing section 640 changes illuminated regions that laser beams form on the light-emitting section 113.

As described above, in the example of operation 2, when the kind of an object identified by the object identifying section 620 matches the kind of an object as registered in advance, the illuminated region changing section 640 changes the positions of the illuminated regions so that the light from the light-emitting section 113 is cast toward the object. This allows only an object (such as a road sign, a pedestrian, or an animal) sensed by the object detecting section 610 to be included in a first range of floodlighting a1, thus making it possible to more brightly illuminate the object.

Meanwhile, in the example of operation 3, when the kind (which is an oncoming vehicle in this case) of an object identified by the object identifying section 620 matches the kind of an object as registered in advance, the illuminated region changing section 640 may change the positions of the illuminated regions so that the light from the light-emitting section 113 is not cast toward the object. This allows only an object (such as an automobile) sensed by the object detecting section 610 not to be included in a first range of floodlighting a1, thus making it possible not to cause the driver of an oncoming vehicle or the like to experience unpleasant glare or the like.

It should be noted here that in the case of a lamp including only an LED as shown in (*c*) of FIG. 38, the possibility of causing the driver of an oncoming vehicle or the like to experience unpleasant glare is low. However, all the more because of that, there appears a wide range (range D in the drawing) of low illuminance in the area in front of the vehicle. Meanwhile, in the case of such a lamp, an attempt to increase illuminance in the area in front of the vehicle is highly likely to end up causing the driver of an oncoming vehicle or the like to experience unpleasant glare. Therefore, it is difficult for such a lamp to increase illuminance in the area in front of the vehicle without causing the driver of an oncoming vehicle or the like to experience unpleasant glare.

Meanwhile, in the headlamp 110 of the present embodiment, as described above, the identification of the kind of an object by the object identifying section 620 makes it possible to change optimum illuminated regions and therefore first ranges of floodlighting a1 according the kind. This makes it possible to increase illuminance in the area in front of the vehicle without causing the driver of an oncoming vehicle or the like to experience unpleasant glare.

<Specific Example of Operation 4>

Next, an example of operation where light-distribution patterns are changed according to the traffic regulations of the country in which the vehicle travels is described with reference to FIG. 39. In FIG. 39, (*a*) is a diagram showing how the headlamp 110 achieves a passing headlight's light-distribution pattern stipulated in a drive-on-the-right country, (*b*) being a diagram showing how the headlamp 110 achieves a passing headlight's light-distribution pattern stipulated in a drive-on-the-left country.

For example, in France, which is a drive-on-the-right country, and the United Kingdom, which is a drive-on-the-left country, light-distribution patterns need to be changed according to the traffic regulations of the respective countries. The illuminated region changing section 640 changes the positions of the illuminated regions to be formed by laser beams on the light-emitting section 113 so that either one of an illuminating light-distribution pattern stipulated in the drive-on-the-right country and an illuminating light-distribution pattern stipulated in the drive-on-the-left country is satisfied.

Specifically, in a case where, for example, the vehicle travels from the United Kingdom to France or vice versa, the illuminated region changing section 640 can work with a GPS, for example, to read out, from the storage section 801, light-distribution pattern related data based on the traffic regulations of the respective countries. Thus, the illuminated region changing section 640 determines respective output values of the laser elements 111 so that first ranges of floodlighting a1 based on the traffic regulations are formed. In accordance with an output signal indicative of a result of the determination, the lighting control section 650 controls lighting-up of the laser elements 111. This allows the headlamps 110 of the present application to be mounted and utilized on a vehicle in any country.

Further, a conventional lamp has achieved light distribution by using a lens cut or a multi-facet mirror, and as such, has been unable to finely control light distribution. On the other hand, the present embodiment casts light with high floodlighting efficiency by using the laser elements 111 (high-luminance light source), and therefore can ideally control light distribution.

Further, whereas the DMD method yields low illuminance on a target object and requires a measurable amount of electric power, the present embodiment can achieve such fine light-distribution control with low electric power consumption that the target object becomes high in illuminance.

It should be noted the LED 201, too, is controlled by the output control section 660 so that the second range of floodlighting a2 is in a light-distribution pattern based on the traffic regulations of the country in which the vehicle is traveling.

<Specific Example of Operation 5>

Figure 40:
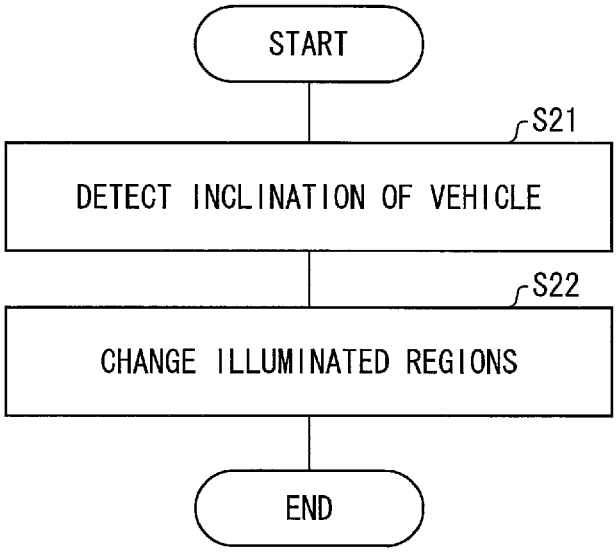
FIG. 40 is an example of a process that is carried out by the headlamp.
Figure 41:
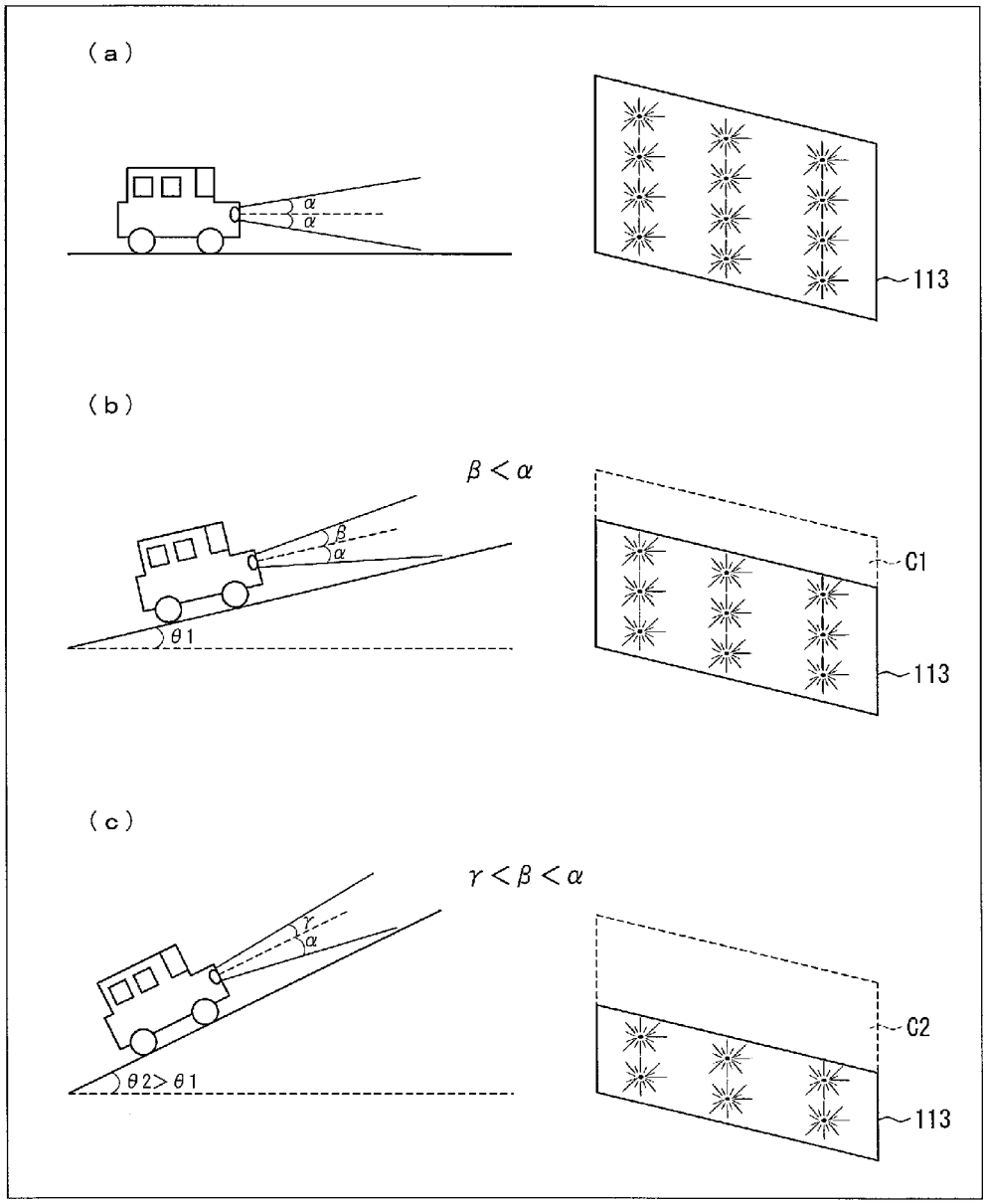
FIG. 41 is a set of diagrams (*a*) through (*c*) showing an example of a relationship between the angle of inclination of a vehicle and a change of illuminated regions.
Figure 42:
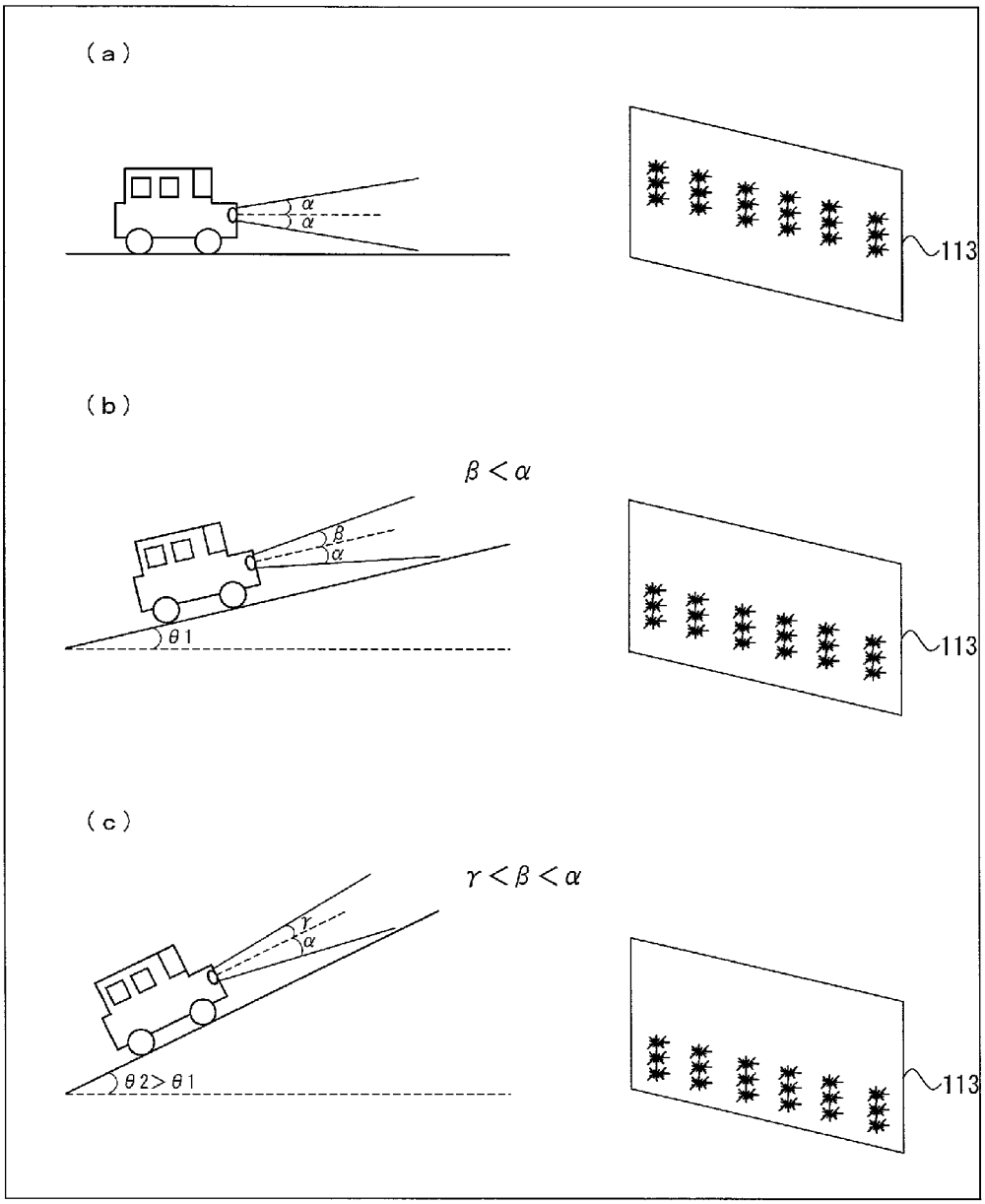
FIG. 42 is a set of diagrams (*a*) through (*c*) showing another example of the relationship shown in FIG. 41.
Figure 43:
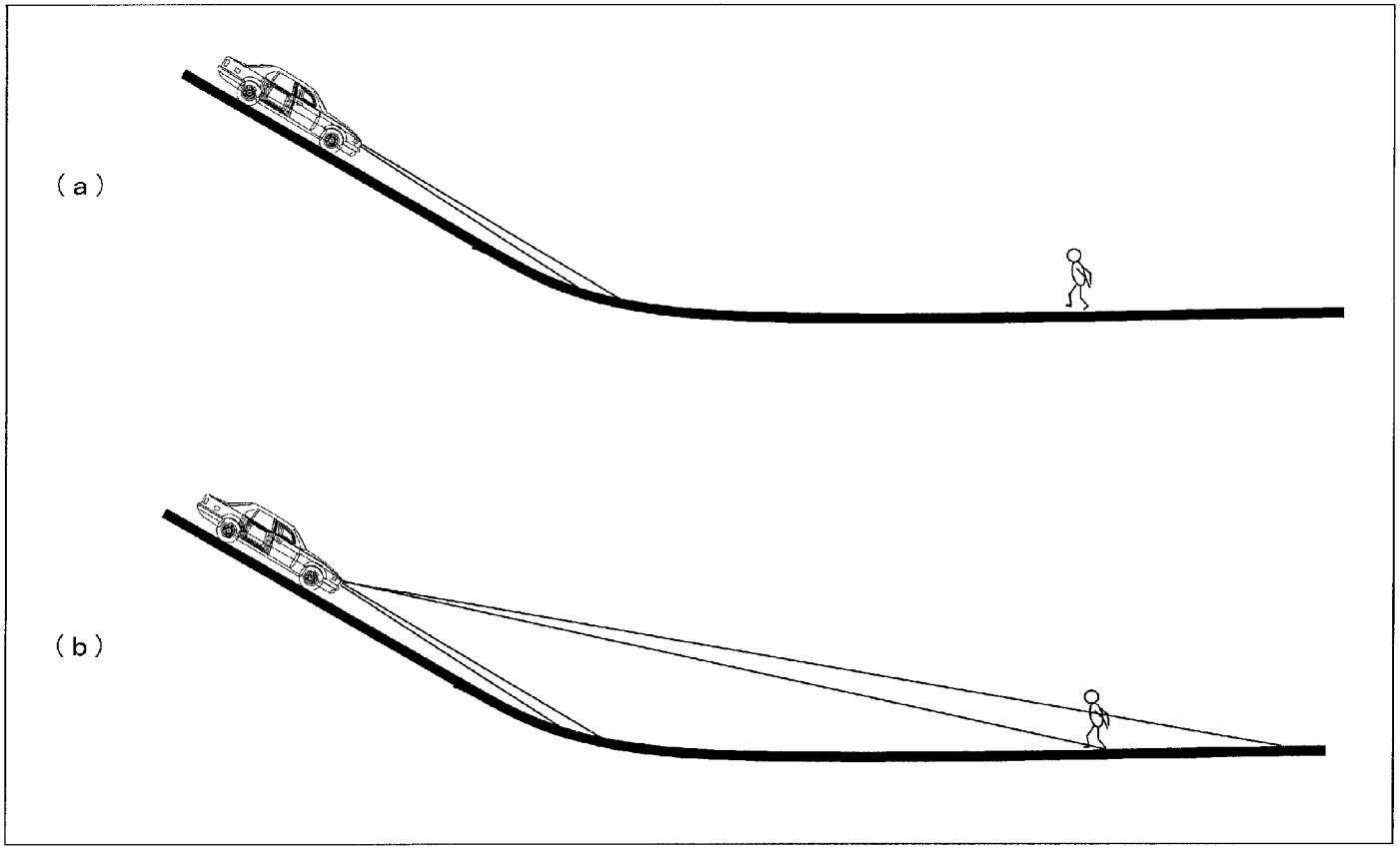
FIG. 43 is a set of diagrams (*a*) and (*b*), (*a*) being a diagram showing an example of the light-distribution characteristics of a conventional headlamp, (*b*) being a diagram showing an example of the light-distribution characteristics of a headlamp according to the present embodiment.
Figure 44:
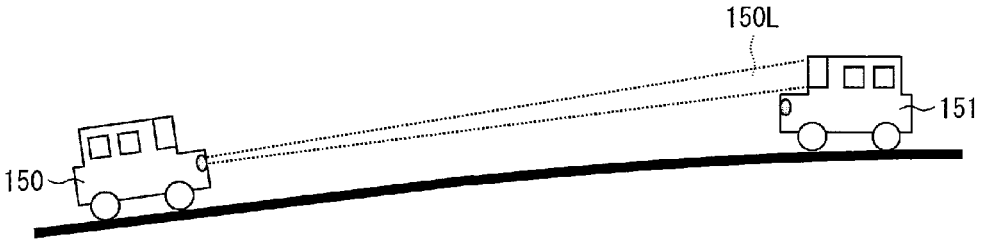
FIG. 44 is a diagram schematically showing how illuminating light emitted by a vehicle about to go up a slope affects an oncoming vehicle.

Next, an example of operation where the illuminated region changing section 640 changes illuminated regions according to the angle of inclination of the vehicle as detected by the inclination detecting section 630 is described with reference to FIGS. 40 through 44. FIG. 40 is a diagram showing a process that is carried out by the headlamp 110 in the example of operation 5. FIG. 41 is a set of diagrams (*a*) through (*c*) showing an example of a relationship between the angle of inclination of a vehicle and a change of illuminated regions. FIG. 42 is a set of diagrams (*a*) through (*c*) showing another example of the relationship shown in FIG. 41. FIG. 43 is a set of diagrams showing an example of the light-distribution characteristics exhibited when a vehicle comes near a downward slope. FIG. 44 is a diagram schematically showing how illuminating light emitted by a vehicle about to go up a slope affects an oncoming vehicle.

As shown in FIG. 44, it is general that when a vehicle 150 goes by an oncoming vehicle 151, for example, in a place where the vehicle 150 is about to go up a slope, illuminating light 150L emitted by the vehicle 150 causes a driver of the oncoming vehicle 151 to experience unpleasant glare or the like. Further, a conventional vehicle had the following problem. Change of a range of floodlighting of illuminating light according to an inclination of the vehicle required an operation of a reflector itself of a headlamp provided in the vehicle. Therefore, the change required a large mechanism for the operation of the reflector, which operation was carried out at a slow speed accordingly. On this account, the use of the operation mechanism for changing a range of floodlighting in a vertical direction (longitudinal direction) increased the possibility of causing the driver of the oncoming vehicle to experience unpleasant glare or the like, thus making it difficult to ensure safety. In view of this, the operation mechanism was mainly used for changing a range of floodlighting in a horizontal direction (sideways) that is not particularly affected by such a slow operation speed.

On the contrary, in the headlamp 110, the illuminated region changing section 640 changes the positions of the illuminated regions in accordance with a result (inclination of the vehicle with respect to a horizontal plane) of sensing made by the inclination detecting section 630. This makes it possible to change the position of the first range of floodlighting a1 in accordance with the inclination of the vehicle with respect to the horizontal plane, thus making it possible to reduce unpleasant glare or the like that, for example, the driver of the oncoming vehicle experiences. Further, the change of the position of the first range of floodlighting a1 can be made simply by changing the illuminated regions to be formed on the light-emitting section 113. This also makes it possible to quickly change the position of the first range of floodlighting a1 in the vertical direction. That is, it can be said that the headlamp 110 is suitable as a headlamp for reducing unpleasant glare and dazzle that, for example, a driver of an oncoming vehicle experiences.

Specifically, as shown in FIG. 40, the inclination detecting section 630 detects an inclination of the vehicle, obtains the angle of inclination of the vehicle in a front-to-rear direction of the vehicle (S21), and outputs, to the illuminated region changing section 640, an angle signal indicative of the value of the angle of inclination. The illuminated region changing section 640 reads out the angle related data from the storage section 801, thereby determining the respective output values of the laser elements 111. In accordance with an output signal indicative of a result of the determination, the lighting control section 650 controls lighting-up of the laser elements 111. That is, the illuminated region changing section 640 changes, in accordance with the angle signal, illuminated regions that the laser beams form on the light-emitting section 113 (S22).

It should be noted that the change of the illuminated regions may be carried out on the basis of information from a car navigator, a highway traffic system (ITS), and/or the camera 501.

For example, (*a*) of FIG. 41 is a conceptual diagram showing how laser beams emitted from all of the laser elements 111 are shone on the whole light-emitting section 113 by the illuminated region changing section 640 driving all of the laser elements 111 to satisfy the desired light distribution in a flat road. In this case, for example, the vehicle forms a first range of floodlighting a1 in the range of angles of $-\alpha$ to $\alpha$ with respect to an imaginary line perpendicular to the front face of the headlamp 110. It should be noted here that for simplification of explanation, this example shows how twelve (12) laser elements 111 forms a matrix of 4×3 illuminated regions on the light-receiving surface of the light-emitting section 113.

(*b*) of FIG. 41, which is premised on (*a*) of FIG. 41, shows how, for example, the vehicle goes up a slope having an angle of $\theta$1 with respect to the horizontal plane. In this case, for example, the respective output values of the laser elements 111 (representing which ones are to be driven or not to be driven among the laser elements 111) are determined by the illuminated region changing section 640 so that no illuminated region is formed in an upper portion C 1 of the light-emitting section 113 along the vertical direction. As a result, the headlamp 110 forms a range of floodlighting a1 in the range of angles of $-\alpha$ to $\beta$ ($\beta<\alpha$) with respect to an imaginary line perpendicular to the front face of the headlamp 110.

At this point in time, the LED 201 outputs less light than it does when the vehicle is traveling on a flat road (see (*a*) of FIG. 41). The lighting control section 650 adjusts the intensity of output from the laser elements 111 to the light-emitting section 113 so as to supplement the decrease in amount of light that the LED 201 emits.

Further, in a case where the vehicle goes up a slope having an angle of $\theta 2$ ($>\theta 1$) with respect to the horizontal plane, as shown in (*c*) of FIG. 41, the respective output values of the laser elements 111 (representing which ones are to be driven or not to be driven among the laser elements 111) are determined by the illuminated region changing section 640 so that no illuminated region is formed in an upper portion C2 of the light-emitting section 113 along the vertical direction. As a result, the headlamp 110 forms a range of floodlighting a1 in the range of angles of $-\alpha$ to $\gamma$ ($\gamma<\beta$) with respect to an imaginary line perpendicular to the front face of the headlamp 110.

At this point in time, the LED 201 outputs less light than it does when the vehicle is traveling on a slope having an angle of $\theta 1$ (see (*b*) of FIG. 41). The lighting control section 650 adjusts the intensity of output from the laser elements 111 to the light-emitting section 113 so as to supplement the decrease in amount of light that the LED 201 emits. That is, the LED 201 outputs more light in (*a*) of FIG. 41 than it does in (*b*) of FIG. 41, and outputs more light in (*b*) of FIG. 41 than it does in (*c*) of FIG. 41.

Further, for example, in the case of an arrangement of 8×6 laser elements 111 in a matrix manner, i.e., in a case where a larger number of laser elements 111 are arranged than in the case shown in FIG. 41, it is not necessary to drive all of the laser elements 111 even when the vehicle is traveling on a flat road. That is, as shown in (*a*) through (*c*) of FIG. 42, the control of light distribution (position control of a first range of floodlighting a1) according to the inclination of the vehicle as shown in FIG. 41 can be carried out simply by changing the position of illuminated regions which are formed by the laser beams emitted from the respective laser elements 111, without changing the area of the illuminate regions, regardless of whether the vehicle is traveling on a flat road or a slope.

Thus, the aforementioned control of the illuminated region changing section 640 allows the headlamp 110 to change first ranges of floodlighting a1 according to the inclination of a road so as not to affect the driver of an oncoming vehicle or the like. This makes it possible to reduce unpleasant glare and dazzle that the driver of an oncoming vehicle or the like experiences.

It should be noted that the example of operation 5 is an example of a case where the vehicle comes across an oncoming vehicle when the vehicle is about to go up a slope, and it is only necessary that a light distribution that does not cause the driver of the oncoming vehicle to experience glare be achieved by shining lasers provided in a matrix manner on the light-emitting section 113.

Further, although the example of operation 5 deals with a case where the vehicle goes up a slope, similar control is carried out also in a case where the vehicle goes down a slope. This makes it possible, also in a case where the vehicle goes down a slope, to reduce unpleasant glare and dazzle that the driver of an oncoming vehicle or the like experiences in a place from which the slope starts goes up.

Further, in the case where the vehicle goes down a slope, as shown in (*a*) of FIG. 43, a conventional headlamp has not been capable of, even by emitting a high beam, illuminating an object in a distant area to which the vehicle is traveling. However, in the headlamp 110 of the present embodiment, the laser beams having been emitted from the laser elements 111 excite the light-emitting section 113 in a matrix manner. This makes it possible to design the headlamp 110 to illuminate even a distant area as shown in (*b*) of FIG. 43.

Although it is possible to achieve the same function with a conventional headlamp by providing a reflector adequate for each purpose, an automobile, a motorcycle, or the like only has a limited amount of space in which such a reflection can be provided, which has made it possible to provide such a reflector. In the present embodiment, by providing the plurality of laser elements 111 (high luminance light source) in a matrix manner, such a light distribution can be achieved in a space-saving manner without providing such a reflector.

<Specific Example of Operation 6>

Figure 45:
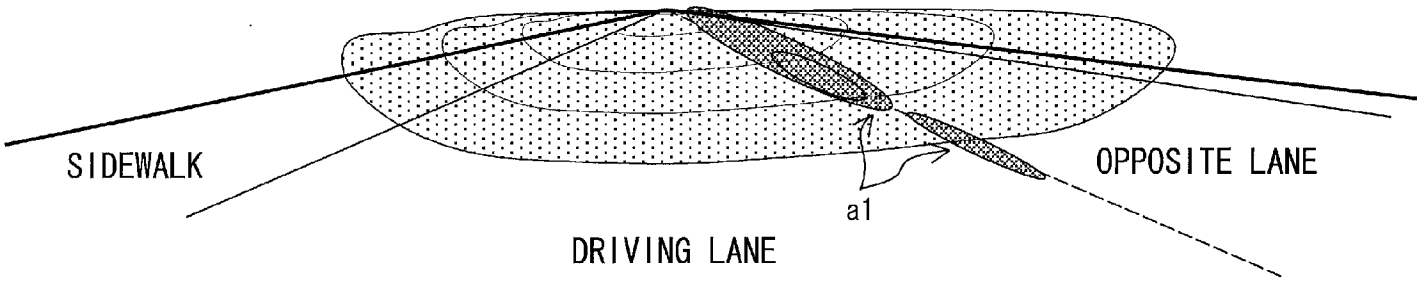
FIG. 45 is a schematic view showing an example of ranges of floodlighting formed by the process that is carried out by the headlamp.

Next, an example of a range of floodlighting that is formed in case of rain is described with reference to FIG. 45.

Conventionally, there was the problem that a centerline, in particular, was less visible in a rainy evening. Such a problem can lead to the incidence of accidents which are caused by vehicles going over centerlines, for example, in roadways like a single-lane road and a road having two lanes each way. However, illuminating a whole road surface with bright headlight may cause a driver of an oncoming vehicle to recognize light reflected from the road surface as glare. Because of this, it was difficult, for a conventional headlamp having only the function of brightly illuminating the whole road surface, to improve visibility of a centerline during traveling in a rainy condition.

In the headlamp 110 of the present embodiment, the illuminated region changing section 640 changes illuminated regions which are formed on the light-emitting section 113, in order that first ranges of floodlighting a1 are formed in part of a second range of floodlighting a2. Specifically, as in the example of operation 2, for example, the illuminated region changing section 640 controls respective output values of the laser elements 111 so that the first ranges of floodlighting a1 are formed to include those parts of a centerline which falls within the second range of floodlighting a2 as sensed by the object detecting section 610. With this, even if there is a hardly visible range in the second range of floodlighting a2, that part can be supplementarily illuminated by illuminating light emitted from the laser light source unit 101. This makes it possible to improve visibility of a centerline in a rainy condition, thus making it possible to reduce the incidence of such accidents.

[Modification 1]

Figure 46:
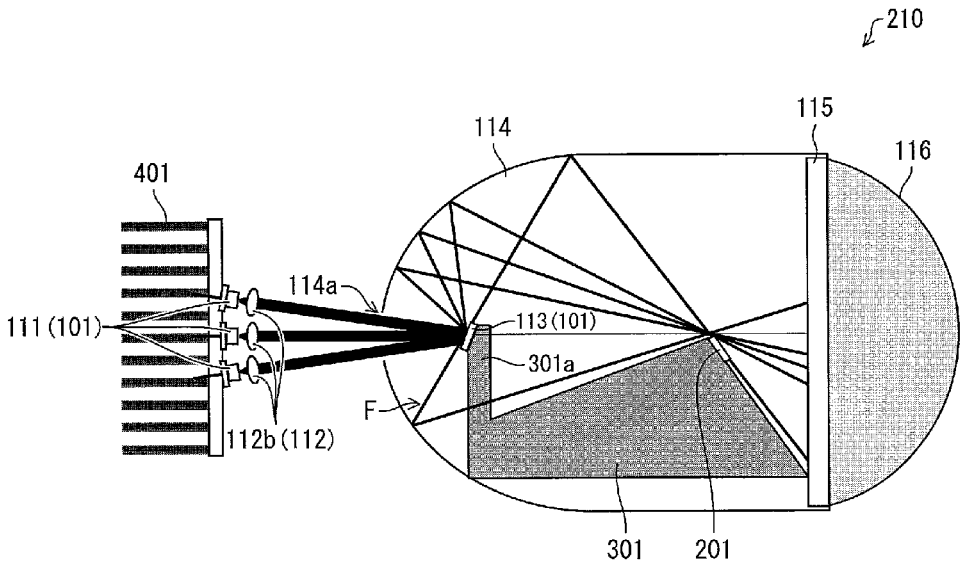
FIG. 46 is a diagram showing a modification of the headlamp.

Next, a headlamp 210 (lighting device, vehicle headlight) is described which is a modification 1 of the headlamp 110. FIG. 46 is a diagram showing a modification of the headlamp 110. As shown in FIG. 46, the headlamp 210 according to the modification 1 includes lenses 112*b* (light control sections) as the light control sections 112 instead of including the reflection mirrors 112*a*.

(Lens 112*b*)

The lenses 112*b*, which are a plurality of lenses, control a direction of travel of laser beams generated by the laser elements 111 so that these laser beams are appropriately shone on the light-emitting section 113. The plurality of lenses 112*b* are so provided in a one-to-one correspondence with the plurality of laser elements 111 as to face respective light-emitting points of the laser elements 111. The laser beams passing through the respective lenses 112*b* pass through the window section 114*a* of the reflector 114 to arrive at the light-emitting section 113.

Here, assume that the reflection mirrors 112*a* are used as the light control sections 112. In this case, a direction of travel of the laser beams before arriving at the reflection mirrors 112*a* are different from a direction of travel of the laser beams reflected by the reflection mirrors 112*a*. That is, the reflection mirrors 112*a* can change the direction of travel of the laser beams into a direction which is different from an optical axis of the light-emitting points of the laser elements 111.

This allows the laser elements 111 to be provided in such a manner that the light-emitting points of the laser elements 111 are pointed in a direction (e.g. a vertically upward direction) which is different from a direction in which an opening of the reflector 114 is provided, for example, as shown in FIG. 29. Consequently, in FIG. 29, the fin 401 is placed with its base's surface vertically upwards, and the laser elements 111 are provided on the surface of the base.

On the contrary, the lenses 112*b* make substantially parallel laser beams which otherwise travel while spreading, and control the guidance of the laser beams to the light-emitting section 113. That is, unlike in the case of the reflection mirrors 112*a*, the optical axis of the light-emitting points of the laser elements 111 is substantially identical to the direction in which the laser beams travel after having passed through the lenses 112*b*.

This requires that the laser elements 111 be provided so that the light-emitting points of the laser elements 111 are arranged in a direction which is substantially identical to the direction in which the opening of the reflector 114 is provided, for example, as shown in FIG. 46. Consequently, in FIG. 46, the fin 401 is placed with its base's surface pointed in a direction which is substantially identical to the direction in which the opening of the reflector 114 is provided, and the laser elements 111 are provided on the surface of the base.

Note that a method which uses only the lenses 112*b* instead of using the reflection mirrors 112*a* (initial mirrors) cannot compress beams and therefore requires the window section 114*a* of the reflector 114 to be larger than the window section 114*a* of the reflector 114 used in the method which uses the reflection mirrors 112*a*. Thus, from the viewpoint of the floodlighting efficiency of the reflector 114, the headlamp 110 shown in FIG. 29 takes a more preferable form than the headlamp 210 of the present modification.

The lenses 112*b* are aspheric lenses in the present modification. Alternatively, the lenses 112*b* may be convex lenses.

[Modification 2]

Figure 47:
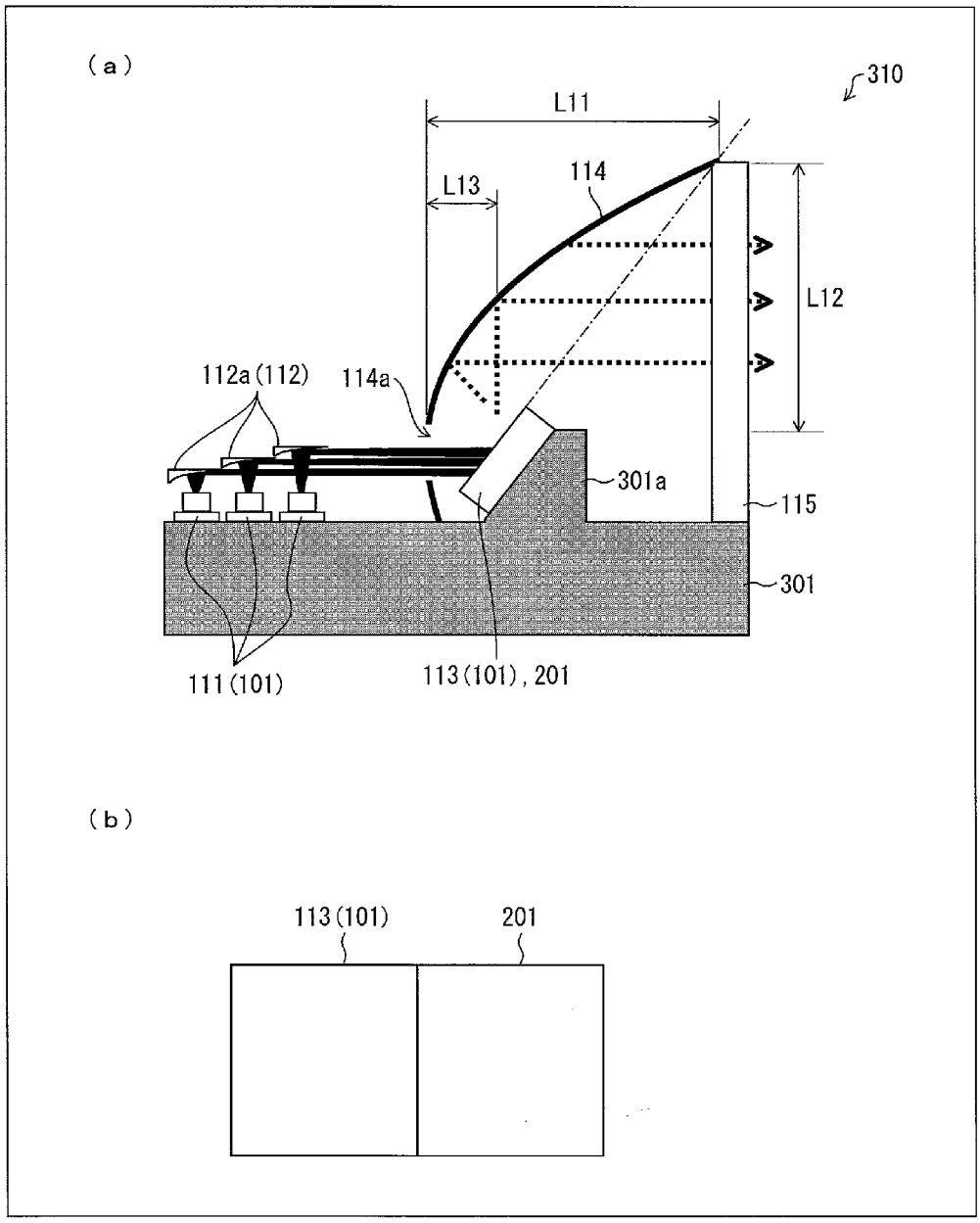
FIG. 47 is a set of diagrams (*a*) and (*b*) showing another modification of the headlamp, (*a*) being a plan view showing an example of the modification, (*b*) being a diagram showing a positional relationship between the light-emitting section and the LED in the modification.

Next, a headlamp 310 (lighting device, vehicle headlight) is described which is a modification 2 of the headlamp 110. FIG. 47 is a diagram showing a further modification of the headlamp 110.

The headlamp 310 of the present modification differ in structure of the above-described headlamp 110 in that the headlamp 310 uses a parabolic mirror as the reflector 114 and the light-emitting section 113 functions as part of the LED 201.

(Light-Emitting Section 113)

As shown in (*a*) of FIG. 47 (*a*), the light-emitting section 113 is so disposed at a slant on an inclined part 301*a* of the heat radiating base 301 that an imaginary surface extended from the light-receiving surface of the light-emitting section 113 contacts the end of the reflector 114 having the opening. This allows the light emitted from the light-emitting section 113 to be efficiently reflected by the reflector 114 and then distributed, without directly exiting outside.

Further, as shown in (*b*) of FIG. 47, the light-emitting section 113 may be integral with the LED 201. Still further, the fluorescent body of the LED 201 functions as a fluorescent body included in the light-emitting section 113. In either of these two cases, it can be said that the light-emitting section 113 functions as part of the LED 201. This makes it possible to reduce a parts count of the headlamp 310, thus making it possible to simplify the configuration of the headlamp 310.

In an example shown in (*a*) of FIG. 47, the light-emitting section 113 and the LED 201 are disposed nearly at a focal point of the reflector 114.

Note that in the present modification, the laser elements 111 share the same light-emitting section 113 with the LED 201. Consequently, the LED 201 has a luminescent center wavelength of 395 nm. Further, as the fluorescent body, a fluorescent body suitable for excitation of laser light having a luminescent center wavelength of 395 nm is used.

(Reflector 114)

The reflector 114 includes, in a reflection plane thereof, at least a part of a partial curved surface that is obtained by cutting, along a plane being in parallel to a rotation axis which is a symmetry axis of a parabola, a curved surface (parabolic curved surface) formed by causing the parabola to rotate. Further, the reflector 114 has a semicircular opening in such a direction that light emitted from the light-emitting section 113 and the LED 201 is distributed.

Light having been emitted from the light-emitting section 113 and the LED 201, which are disposed nearly at the focal point of the reflector 114, is distributed, in a form of a bundle of rays that are nearly parallel to each other, ahead of the opening by the reflector 114 having the reflection plane of the parabolic curved surface. That is, the reflector 114 according to the modification 2 casts illuminating light emitted from both the light-emitting section 113 and the LED 201. This makes it possible to efficiently cast, in a narrow solid angle, light emitted from the light-emitting section 113 to form a first range of floodlighting a1 and a second range of floodlighting a2. This, in turn, makes it possible to increase a use efficiency of light.

The reflector 114 as used in the present modification is a semicircular reflector having a resin half parabolic mirror with an aluminum coating formed on an inner surface of the half parabolic mirror. The reflector 114 has a depth L11 of 40 mm and has the opening having a radius L12 of 40 mm. Further, the reflector 114 has a focal point at a position 10 mm (i.e. L13=10 mm) away from an upper end of the window section 114*a* of the reflector 114.

Alternatively, the reflector 114 may be a projection mirror. In particular, the reflector 114 may include a parabolic mirror having a closed circular opening or a part of the parabolic mirror. Apart from the parabolic mirror, the reflector 114 may be an ellipse-shaped mirror, a free-form surface mirror, or a multi-facet type parabolic mirror. Further, the reflector 114 may include, in part, a non-parabolic curved surface.

Alternatively, as the reflector 114, a projection lens may be used. However, the use of a mirror as the reflector 114 generally leads to design simplification.

Note that the reflector 114 may be a half parabolic mirror or the like provided that the parabolic mirror has a parabolic shape. The parabolic mirror may also be an off-axis parabolic mirror or a multi-facet type parabolic mirror.

[Modification 3]

Figure 48:
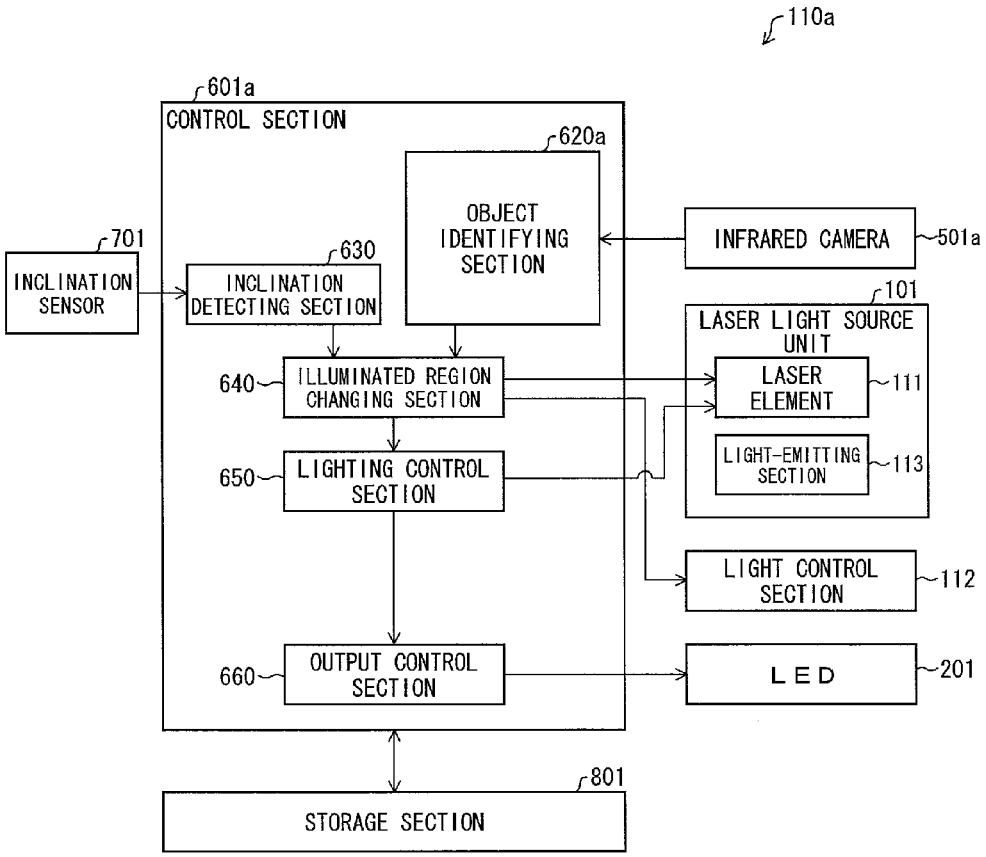
FIG. 48 is a block diagram schematically showing an example of a configuration of a headlamp according to still another modification of the headlamp.

Next, a headlamp 110*a* is described which is a modification 3 of the headlamp 110. FIG. 48 is a block diagram schematically showing an example of a configuration of the headlamp 110*a*, which is a modification of the headlamp 110. As shown in FIG. 48, the headlamp 110*a* (lighting device, vehicle headlight) includes an infrared camera 501*a* (sensing means) instead of the camera 501, and includes a control section 601*a* instead of the control section 601. It should be noted that the number of infrared cameras 502*a* to be provided may be 1.

(Infrared Camera 501*a*)

The infrared camera 501*a* senses infrared radiation energy radiated from an object existing in the possible light-distribution area, and then outputs, to an object identifying section 620*a*, a distribution signal indicative of distribution of the infrared radiation energy.

(Object Identifying Section 620*a*)

The object identifying section 620*a* (identifying means) generates, on a basis of infrared radiation energy sensed by the infrared camera 501*a*, a temperature distribution image, thereby identifying the kind of the above object. That is, the infrared camera 501*a* and the object identifying section 620*a* implement the function of an infrared thermography.

As with the case of the object identifying section 620, the object identifying section 620*a* extracts features (for example, moving speed, shape, and position) of an object within a high-temperature region in a temperature distribution image, and thus calculates a feature value, which is a numerical representation of the features. Subsequently, the object identifying section 620*a* refers to a reference value table that is stored in the storage section 801 and then outputs, to the illuminated region changing section 640, an identifying signal indicative of the object and a coordinate value of the object thus sensed.

With such a configuration, the headlamp 110*a*, as with the headlamp 110, allows a first range of floodlighting a1 of a desired size to be formed in a desired position by the illuminated region changing section 640 determining respective output values of the laser elements 111 (which one(s) is/are to be driven or not to be driven among the laser elements 111) in order that the object is included or not included.

[Modification 4]

Figure 49:
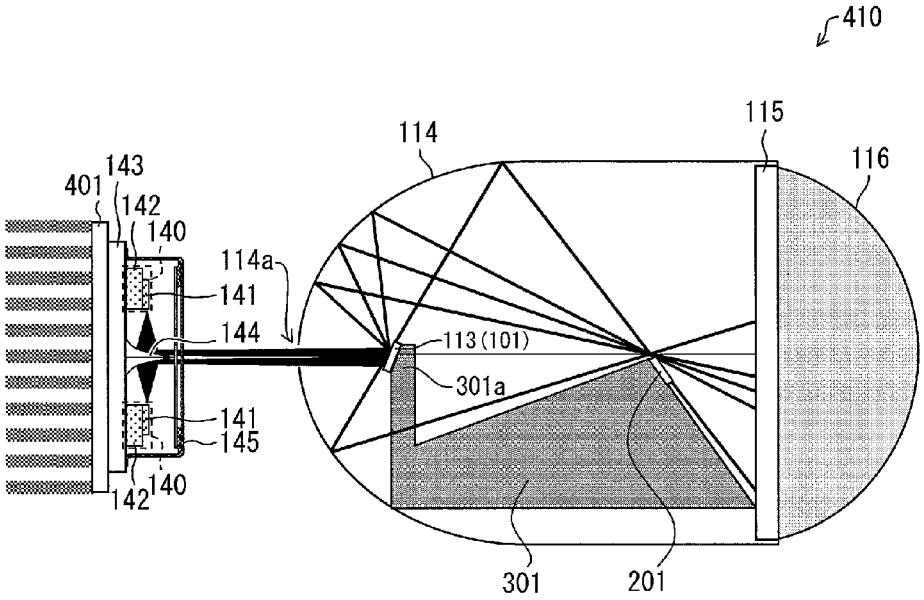
FIG. 49 is a plan view schematically showing an example of a configuration of a headlamp according to still another modification of the headlamp.
Figure 50:
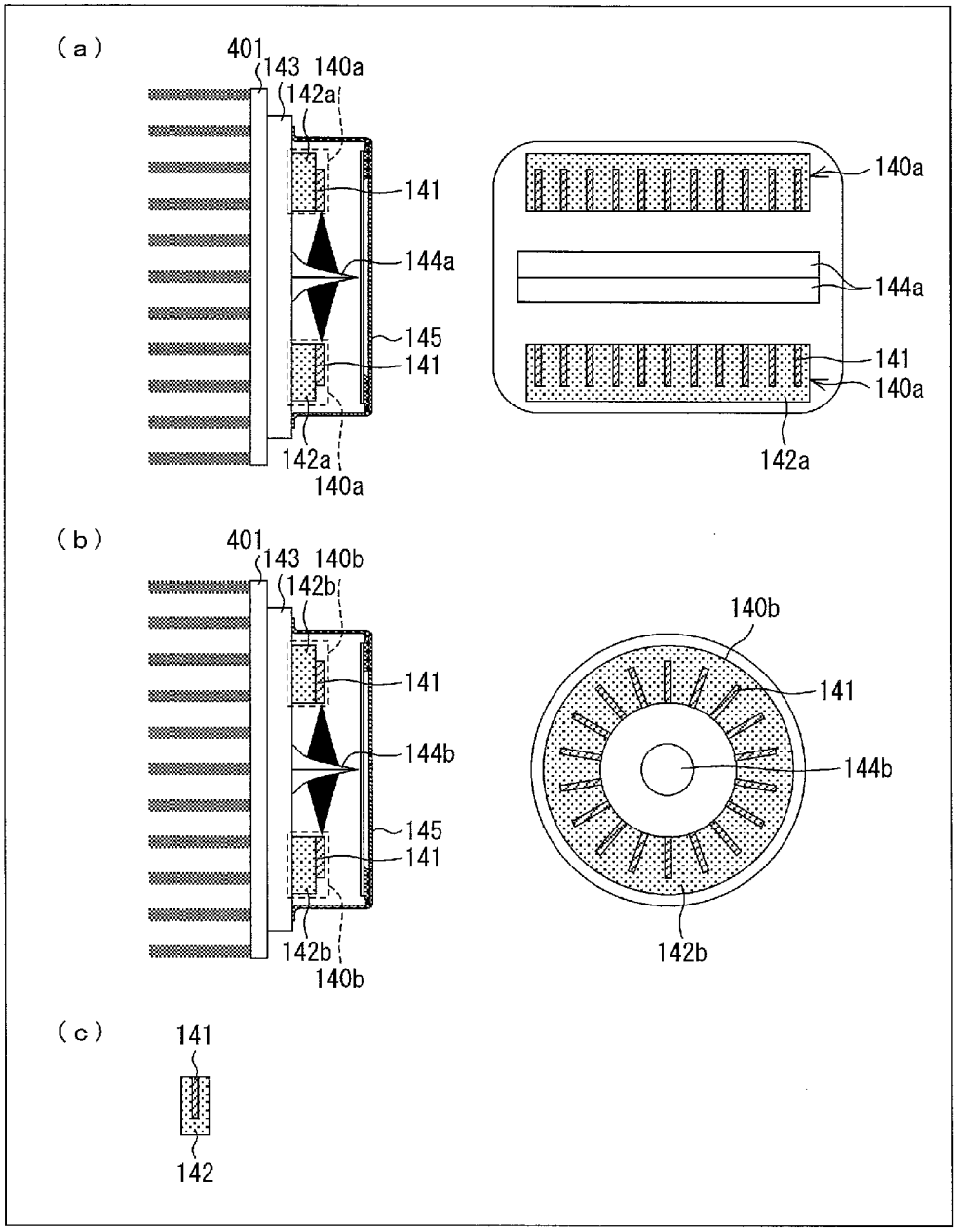
FIG. 50 is a set of schematic views (*a*) through (*c*) showing an example of a peripheral configuration of an array laser element of the headlamp.

Next, a headlamp 410 (lighting device, vehicle headlight) is described which is a modification 4 of the headlamp 110. FIGS. 49 and 50 are views showing still another modifications of the headlamp 110. FIG. 49 is a view schematically showing an example of the headlamp 310. Further, FIG. 50 is a view schematically showing an example of a peripheral configuration of an array laser element 140.

The headlamp 410 of the present modification is configured in much the same manner as the aforementioned headlamp 110, except that the array laser element 140 is used as the laser elements 111. That is, in the present modification, the array laser element 140 and the light-emitting section 113 form the laser light source unit 101.

The headlamp 410 includes: the array laser element 140 having a plurality of laser elements 111 provided in an array manner, a reflection mirror 144 (initial mirror, light control section) having the same function as the reflection mirror 112*a*; a stem 143 (base, casing); and a cap 145 (casing) (see FIG. 49).

Note that the array laser element 140 has a basic structure such that a laser light source group is formed having a plurality of laser light sources each of which includes a laser chip 141 and a sub-mount 142.

Further, the stem 143 and the cap 145 forms one (1) casing which includes the array laser element 140 and the reflection mirror 144. With such a structure, it is possible to decrease thermal resistance between the laser chip 141 and the stem 143.

On this account, the use of the fin 401, which is the same as that used in the headlamp 110, allows the headlamp 410 to increase its system reliability, as compared to the headlamp 110. From another viewpoint, in a case where the headlamp 410 is configured so as to have the same reliability as that of the headlamp 110, it is possible to reduce the size of the whole headlamp 410. That is, it is possible to reduce the size of the headlamp 410.

Further, there is a merit that strict control of a relative arrangement of the laser chip 141 and the reflection mirror 144 can be easily made, and a manufacturing yield, in turn, increases.

(Array Laser Element 140)

The array laser element 140 contacts the one (1) stem 143, which is mounted on the fin 401, and includes a plurality of laser chips 141 and a plurality of sub-mounts 142. As shown in (*c*) of FIG. 50, the laser chip 141 is disposed on the sub-mount 142.

The laser chip 141 has the same function as the chip provided in the laser element 111. Further, the sub-mount 142 is a die-bonded part with respect to the laser chip 141. For example, as shown in (*a*) and (*b*) of FIG. 50, stacking of the laser chips 141 and the sub-mounts 142 forms the array laser element 140. That is, using the array laser element 140 having such a configuration as the laser light source group enables reduction of the size of the headlamp 410. (*a*) and (*b*) of FIG. 50 will be further described below.

(Stem 143)

The stem 143 having thermal conductivity has (i) a surface facing the fin 401 (second surface, one of surfaces which has the largest area, the surfaces forming an outer surface of the stem 143) and (ii) a surface being substantially parallel to the second surface (first surface, a surface a large part of which is sealed with the cap 145) (see FIG. 50).

The first surface of the stem 143 contacts the array laser element 140 and the reflection mirror 144. This allows heat emitted from the array laser element 140 to be guided directly to the first surface of the stem 143 and thus guided to the fin 401 without being trapped inside the stem 143. This makes it possible to efficiently cool the array laser element 140. Further, the arrangement in which the array laser element 140 contacts the first surface enables reduction of the size of the headlamp 410, as compared to a configuration in which the array laser element 140 contacts a part other than the first surface of the stem 143.

Note that as shown in FIG. 49, in the present modification, the stem 143 and the light-emitting section 113 are so disposed that a center of the first surface of the stem 143 is positioned to substantially face the light-emitting section 113. Alternatively, by providing a mirror between the light-emitting section 113 and the array laser element 140, the fin 401 may be installed, as in the headlamp 110, in the lateral direction of the drawing (in such a manner that the surface of the fin 401 faces vertically upwards). In this case, the fin 401 may be shared with the stem 143 and the heat dissipation base 301.

(Reflection Mirror 144)

The reflection mirror 144 has the same function as the reflection mirror 112*a* and is provided so as to face the array laser element 140. The reflection mirror 144 is provided substantially at a center position of the first surface of the stem 143. With this configuration, laser beams emitted from the respective laser chips 141 of the array laser element 140 are appropriately shone on the reflection mirror 144, and laser beams reflected by the reflection mirror 144 are guided toward the light-emitting section 113. Further, for example, heat generated by loss of reflection of the laser beams by the reflection mirror 144, due to a phenomenon such as absorption of part of laser beams which part has not been reflected by the reflection mirror 144, can be efficiently dissipated.

Further, it is preferable that the reflection mirror 144 be brought into contact with the first surface of the stem 143, after which the laser chip 141 is brought into contact with the first surface of the stem 143. This makes it possible to easily adjust where the array laser elements 140 are positioned, in consideration of light guide control of the laser beams, a shape of emitted light formed on the light-emitting section 113, positions of the light-emitting points, and other factor(s), thus making it possible to easily manufacture the headlamp 410.

Still further, the reflection mirror 144 may be one (1) reflection mirror which is provided so as to face one (1) array laser element 140. Alternatively, the reflection mirror 144 may be a plurality of reflection mirrors which are provided so as to respectively face the plurality of laser chips 141 of the array laser element 140.

In a case where the reflection mirror 144 is a plurality of reflection mirrors, the reflection mirror 144 is preferably an array mirror. The array mirror is formed, by batch, from different kinds of reflection mirrors (initial mirrors) varying in reflection surface curve according to a shape of emitted light to be formed on the light-emitting section 113. This makes it possible to simplify a manufacturing process. Further, the laser chip 141 and one (1) reflection mirror 144 constituting the array mirror are provided in a one-to-one-correspondence. This allows the laser beams emitted from the laser chips 141 to be accurately guided to the light-emitting section 113.

(Cap 145)

The cap 145 seals the first surface of the stem 143 to protect the array laser element 140 and the reflection mirror 144 (see FIG. 50). The inside of the sealing cap 145 is filled with dry air. A sealing method as used herein is resistance welding. However, other method may be employed.

This makes it possible to prevent dust collection caused by the laser beams and to prevent dust and/or dirt from settling on the array laser element 140 and the reflection mirror 144. A part of the cap 145 (at least a part which positions an optical path formed by the laser beams) is constituted by a transparent plate (which is made from, for example, kovar glass) to transmit the laser beams reflected by the reflection mirror 144.

(Variations of the Array Laser Element 140)

Next, variations of the array laser element 140 are described with reference to (*a*) and (*b*) of FIG. 50. Note that array laser elements 140*a* and 140*b* and reflection mirrors 144*a* and 144*b* have the same functions as the array laser element 140 and the reflection mirror 144, respectively. The sub-mount groups 142*a* and 142*b* are each formed by a plurality of sub-mounts 142.

In the case of (*a*) of FIG. 50, two reflection mirrors 144*a* are provided substantially at a center position of the stem 143, and two array laser elements 140*a* (first and second groups of laser light source) are provided so as to respectively face the reflection mirrors 144*a*.

The array laser element 140*a* and the sub-mount group 142*a* are formed in rectangular shape when viewed from the first surface of the stem 143. In this case, even when there are a plurality of laser light sources which are each constituted by the laser chips 141 and the sub-mount 142, the plurality of laser light sources can be collectively provided as a group of laser light sources. This makes it possible to decrease the area of a region where the plurality of laser light sources are provided. Further, the reflection mirror 144*a* is an array mirror.

Although in (*a*) of FIG. 50, the case where the number of the array laser elements 140*a* is two has been described, this is not the only possibility. Alternatively, the number of the array laser elements 140*a* may be three or more. For example, any one of the array laser elements 140*a* in (*a*) of FIG. 50 may be divided into two array laser elements 140*a*.

Further, in the case of (*b*) of FIG. 50, one (1) array laser element 140*b* is provided so as to face the reflection mirror 144*b*, which is provided substantially in a center of the stem 143. The array laser element 140*b* and the sub-mount group 142*b* are formed in circular shape when viewed from the first surface of the stem 143. That is, the array laser element 140*b* is provided around the reflection mirror 144*b*. This makes it possible to reduce the size of the headlamp 410, as compared to the configuration, as in (*a*) of FIG. 50, in which the array laser element 140*b* is formed in rectangular shape.

The present invention is not limited to the aforementioned embodiments and is susceptible of various changes within the scope of the accompanying claims. That is, embodiments obtained by suitable combinations of technical means modified within the scope of the accompanying claims are also included within the technical scope of the present invention.

[Summary of Embodiment 2]

A lighting device in accordance with a second embodiment of the present invention includes: a first light source including: at least one laser light source; and a light-emitting section which emits light in response to a laser beam(s) emitted from the at least one laser light source; a second light source which emits light and differs from the first light source in principle of light emission; and changing means for changing an illuminated region which is formed in the light-emitting section by the laser beam(s) emitted from the at least one laser light source.

According to the above configuration, since the lighting device includes the first light source and the second light source, light emitted from respective light sources which differ in principle of light emission can be used as illuminating light in one lighting device.

Further, according to the above configuration, since the changing means changes an illuminated region which is formed in the light-emitting section by the laser beam(s) emitted from the at least one laser light source, it is possible to change a range of casting of illuminating light that is emitted from the light-emitting section.

This makes it possible to (i) use, as illuminating light, light emitted from the respective first and second light sources, (ii) emit illuminating light in a range of floodlighting having a desired area, and (iii) control light-distribution characteristics and a light intensity distribution of the illuminating light.

The lighting device in accordance with the second embodiment of the present invention is preferably configured such that: the at least one laser light source of the first light source includes a plurality of laser light sources; and the changing means changes the illuminated region by changing respective outputs of the plurality of laser light sources while including no moving member that is movable to change the illuminated region.

According to the above configuration, the changing means changes the illuminated region by changing respective outputs of the plurality of laser light sources while including no moving member. This makes it possible to change the illuminated region in immediate response to the change in output. Therefore, it is possible to control light-distribution characteristics of illuminating light which is highly responsive to the change in output of the first light source.

Further, since the laser light sources can control the light-distribution characteristics, it is unnecessary to create an advanced optical design (e.g., a lens cut or a mirror cut) so as to satisfy light distribution in a stipulated range of floodlighting.

The lighting device in accordance with the second embodiment of the present invention is preferably configured such that the changing means changes a position of the illuminated region with respect to the light-emitting section.

According to the configuration, it is possible to freely control a position of a range of floodlighting which is formed by illuminating light emitted from the light-emitting section.

The lighting device in accordance with the second embodiment of the present invention is preferably configured such that: the at least one laser light source of the first light source includes a plurality of laser light sources; and illuminated regions which are formed by respective laser beams emitted from the plurality of laser light sources are changed by the changing means so as to partially overlap with each other.

According to the above configuration, the illuminated regions are changed by the changing means so as to partially overlap with each other. This allows ranges of floodlighting which are formed to correspond to the respective illuminated regions to overlap with each other. Therefore, it is possible to smooth the illuminated regions which are formed by illuminating light emitted from the light-emitting section.

The lighting device in accordance with the second embodiment of the present invention is preferably configured such that the second light source emits illuminating light so as to satisfy a minimum illuminance stipulated in the lighting device.

According to the above configuration, since the second light source emits illuminating light so as to satisfy a minimum illuminance stipulated in the lighting device, the minimum illuminance can be secured by only the second light source even in a case where the first light source is off. Namely, it can be assumed that illuminating light which is emitted from the second light source is a basic light distribution of the lighting device in accordance with the second embodiment of the present invention.

The lighting device in accordance with the second embodiment of the present invention is preferably configured such that the changing means changes the illuminated region so that a first range of floodlighting that is formed by illuminating light emitted from the first light source is formed in a peripheral part of or outside a second range of floodlighting that is formed by illuminating light emitted from the second light source.

According to the above configuration, since a first range of floodlighting can be formed in a peripheral part of or outside a second range of floodlighting, a range which is hard to make visible with illuminating light emitted from the second light source can be supplementarily illuminated by illuminating light emitted from the light-emitting section.

The lighting device in accordance with the second embodiment of the present invention is preferably configured such that the changing means changes the illuminated region so that a first range of floodlighting that is formed by illuminating light emitted from the first light source is formed in a part of a second range of floodlighting that is formed by illuminating light emitted from the second light source.

According to the above configuration, since a first range of floodlighting can be formed in a part of a second range of floodlighting, a hardly visible range in the second range of floodlighting can be supplementarily illuminated by illuminating light emitted from the light-emitting section.

The lighting device in accordance with the second embodiment of the present invention is preferably configured such that: the at least one laser light source of the first light source includes a plurality of laser light sources; and a plurality of illuminated regions are simultaneously formed in the light-emitting section by respective laser beams emitted from the plurality of laser light sources.

According to the above configuration, a plurality of ranges of floodlighting can be simultaneously formed by the illuminating light emitted from the light-emitting section. This makes it possible to simultaneously floodlight a plurality of areas in front of the lighting device.

The lighting device in accordance with the second embodiment of the present invention is preferably configured to further include a light control section(s), provided between the at least one laser light source and the light-emitting section, for controlling a direction in which the laser beam(s) travel(s).

According to the above configuration, since the light control section(s) is(are) provided in the above position, it is possible to change the illuminated regions which are formed in the light-emitting section by the respective laser beams. Further, the light control section(s) make(s) it possible to control overlapping, a spot size(s), a spot shape(s), etc. of the illuminated regions on the light-emitting section(s).

The lighting device in accordance with the second embodiment of the present invention is preferably configured to further include: output control means for controlling an output of illuminating light from the second light source, the output control means controlling the output of the illuminating light from the second light source in accordance with a state of an output of illuminating light from the first light source.

According to the above configuration, since the lighting device includes the output control means, it is possible to perform output control on the second light source in accordance with the state of the output of illuminating light from the first light source. This makes it possible to (i) reduce electric power consumption and (ii) utilize the second light source to backup the ray of light emitted from the first light source.

The lighting device in accordance with the second embodiment of the present invention is preferably configured to further include: a floodlighting section which performs floodlighting with illuminating light emitted from at least one of the first light source and the second light source, the floodlighting section being an ellipse mirror, the light-emitting section being provided at a first focal point of the floodlighting section, and the second light source being provided at a second focal point of the floodlighting section.

According to the above configuration, the light-emitting section is provided at the first focal point of the floodlighting section which is an ellipse mirror, and the second light source is provided at the second focal point of the floodlighting section. Therefore, one floodlighting section can individually cast rays of illuminating light which have been emitted from the light-emitting section and the second light source, respectively. This allows the lighting device to be smaller.

Note that light emitted from the light-emitting section provided at the first focal point forms a bundle of rays which are substantially parallel, so as to be cast in front of the floodlighting section by the floodlighting section. This makes it possible to efficiently cast the light from the light-emitting section in a solid angle. This allows light to be used with higher efficiency.

The lighting device in accordance with the second embodiment of the present invention is preferably configured such that: the second light source is a light-emitting diode which emits white light as the illuminating light; and the light-emitting section functions as a part of the second light source.

According to the above configuration, it is possible to integrally configure the light-emitting section and the second light source. This allows a reduction in number of parts of the lighting device, so that the lighting device can be more simply configured.

A vehicle headlight in accordance with the second embodiment of the present invention includes a lighting device mentioned above.

According to the above configuration, as in the case of the lighting device, it is possible to (i) use, as illuminating light, light emitted from the respective first and second light sources, (ii) emit illuminating light in a range of floodlighting having a desired area, and (iii) control light-distribution characteristics and a light intensity distribution of the illuminating light.

The vehicle headlight in accordance with the second embodiment of the present invention is preferably configured to further include: sensing means for sensing an object, when the sensing means senses the object, the changing means changing the illuminated region with respect to the light-emitting section so that the object is included.

The above configuration allows a range of floodlighting that is formed by illuminating light emitted from the light-emitting section to include the object sensed by the sensing means. This securely allows, for example, a driver of a vehicle provided with a vehicle headlight to visually recognize the object.

The vehicle headlight in accordance with the second embodiment of the present invention is preferably configured to further include: sensing means for sensing an object, when the sensing means senses the object, the changing means changing the illuminated region with respect to the light-emitting section so that the object is not included.

The above configuration can prevent a range of floodlighting that is formed by illuminating light emitted from the light-emitting section from including the object sensed by the sensing means. In particular, in a case where the object is an oncoming vehicle, a preceding vehicle, or the like and a driver of that vehicle receives light emitted from the vehicle headlight of the present invention, the driver may have a problem with driving. According to the above configuration, it is possible to reduce unpleasant glare and dazzle that, for example, the driver experiences, thus making it possible to achieve a safe and comfortable traffic environment.

The vehicle headlight in accordance with the second embodiment of the present invention is preferably configured to further include: identifying means for identifying, by image recognition, a kind of the object which has been sensed by the sensing means, the changing means changing the illuminated region when the kind of the object which kind has been identified by the identifying means matches a preregistered kind of the object.

According to the above configuration, since the vehicle headlight includes the identifying means for identifying, by image recognition, a kind of the object which has been sensed by the sensing means, it is possible to change optimum illuminated regions in accordance with the kind of the object which kind has been identified by the identifying means. Therefore, it is possible to change a range of floodlighting that is formed by light emitted from the light-emitting section.

The vehicle headlight in accordance with the second embodiment of the present invention is preferably configured such that: the sensing means senses infrared radiation energy which is radiated from the object; the vehicle headlight further includes identifying means for identifying a kind of the object by generating a temperature distribution image in accordance with the infrared radiation energy which has been sensed by the sensing means; and the changing means changes the illuminated region when the kind of the object which kind has been identified by the identifying means matches a preregistered kind of the object.

According to the above configuration, the vehicle headlight includes the identifying means for identifying a kind of the object by a temperature distribution image in accordance with the infrared radiation energy which has been sensed by the sensing means. Therefore, as in the case of the identifying means for identifying, by image recognition, a kind of the object, it is possible to change optimum illuminated regions in accordance with the kind of the object.

The vehicle headlight in accordance with the second embodiment of the present invention is preferably configured such that the sensing means is a radar which radiates an infrared ray to the object and senses a reflected wave from the object.

According to the above configuration, since the sensing means is the radar, it is possible to realize highly versatile sensing means.

The vehicle headlight in accordance with the second embodiment of the present invention is preferably configured such that the changing means changes the illuminated region with respect to the light-emitting section so that either one of an illuminating light-distribution pattern stipulated in a drive-on-the-right country and an illuminating light-distribution pattern stipulated in a drive-on-the-left country is satisfied.

The above configuration allows (i) realization of light-distribution characteristics in both a drive-on-the-right country and a drive-on-the-left country, the light-distribution characteristics satisfying regulations stipulated in those countries and (ii) mounting and utilization of the vehicle headlight of the present invention on a vehicle in any country.

The vehicle headlight in accordance with the second embodiment of the present invention is preferably configured to further include: inclination detecting means for detecting an inclination of a vehicle with respect to a horizontal plane, the changing means changing the illuminated region in accordance with a result of the detection by the inclination detecting means.

According to the above configuration, the changing means changes a position of the illuminated region in accordance with a result of the detection, it is possible to change a position of a range of floodlighting that is formed by illuminating light emitted from the light-emitting section.

For example, when a vehicle passes an oncoming vehicle at, for example, a place from which an upward slope starts, it is possible to prevent the oncoming vehicle from being included in the range of floodlighting. This makes it possible to reduce unpleasant glare and dazzle that, for example, a driver of the oncoming vehicle experiences.

[Embodiment 3]

An embodiment of a lighting device according to the present embodiment is described below with reference to FIGS. 51 through 69. The present embodiment is described by taking, as an example, a case where a lighting device according to the present invention is applied to a headlamp of an automobile. It should be noted, however, that a lighting device according to the present invention can be applied to a headlight for a vehicle other than an automobile or to any other lighting device.

[Structure of a Headlamp 155 as Schematically Shown]

Figure 52:
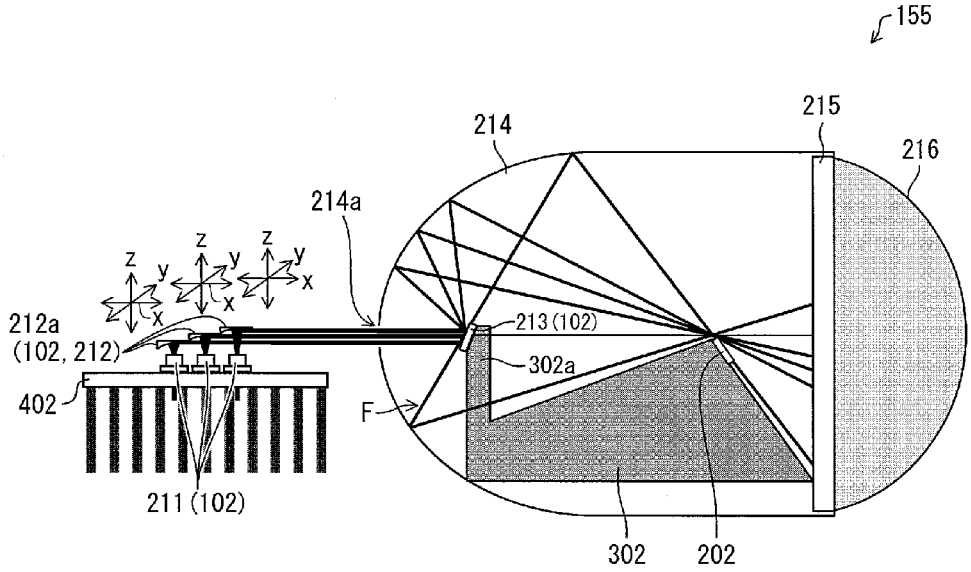
FIG. 52 is a plan view schematically showing an example of the headlamp.

First, an example of a structure of a headlamp 155 (lighting device, vehicle headlight) according to the present embodiment is schematically described with reference to FIG. 52. FIG. 52 is a plan view schematically showing an example of the headlamp 155 according to the present embodiment.

As shown in FIG. 52, the headlamp 155 includes a laser light source unit 102 (first light source), an LED 202 (second light source, light-emitting diode), a heat radiating base 302, a fin 402, a reflector 214 (floodlighting section), a wavelength cut coating 215, and a convex lens 216.

The headlamp 155, which includes the laser light source unit 102 and the LED 202, is configured to be capable of simultaneously casting rays of light emitted from the laser light source unit 102 and the LED 202, respectively. This makes it possible to utilize, as illuminating light, rays of light emitted from light sources that emit light on the basis of the respective different principles of light emission, namely the laser light source unit 102 and the LED 202, and to control the light-distribution characteristics and light intensity distribution of the illuminating light.

It should be noted here that in order to achieve a particular light-distribution pattern (e.g., light-distribution characteristics of a passing headlight) with an LED, a conventional lamp has blocked part of illuminating light with a mask (light-blocking plate), a lens cut, or a mirror cut. However, this configuration causes a loss of the illuminating light.

Meanwhile, in the present embodiment, the LED 202 is utilized to backup the rays of light emitted from the laser light source unit 102. Further, the headlamp 155 includes an illuminated region changing section 641 (to be described later) that makes it possible to freely change the shape, size, etc. of a first range of floodlighting a1. This makes it unnecessary to create an advanced optical design (e.g., a lens cut or a mirror cut) so as to form a particular light-distribution pattern. Further, switching between the light-distribution characteristics of a driving headlight and the light-distribution characteristics of a passing headlight, for example, can be achieved by a reflector of a simple shape. It should be noted that in the present embodiment, free formation of a range of floodlighting may be inhibited all the more because of the mirror cut or the like.

Further, in a case where the configuration of the headlamp 155 of the present embodiment is achieved by a lighting device (e.g., an interior lamp) other than the headlamp 155, it is possible, for example, to illuminate the whole room with illuminating light emitted from the LED 202 and illuminate the top surface of a desk with illuminating light emitted from the laser light source unit 102.

It should be noted that in general, a comparison between the laser light source unit 102 and the LED 202 under the same conditions of electric power consumption shows that whereas the laser light source unit 102 emits illuminating light at high luminance with low luminous flux, the LED 202 emits illuminating light at a low luminance with high luminous flux.

Further, in actuality, these headlamps 155 are provided one at each anterior end of an automobile on which they are mounted. However, for convenience of explanation, the following description assumes that light is shone by a single headlamp 155.

<Laser Light Source Unit 102>

As shown in FIG. 52, the laser light source unit 102 includes laser elements 211 (laser light sources), light control sections 212, and a light-emitting section 213.

(Laser Element 211)

The laser elements 211 have a function that is similar to that of the laser elements 111 described in Embodiment 2, and as such, are not described in detail below. It should be noted that the number of laser elements 211 may be 1, for example, provided that illumination of the whole light-receiving surface of the light-emitting section 213 with a laser beam can be achieved.

(Light-Emitting Section 213)

The light-emitting section 213 emits fluorescence upon receiving, via reflection mirrors 212*a*, laser beams generated from the laser elements 211. That is, the laser-emitting section 213 emits light upon receiving a laser beam emitted from at least one of the plurality of laser elements 211 and guided under the control of the corresponding reflection mirror 212*a*.

Further, the light-emitting section 213 contains a fluorescent body (fluorescent substance) that absorbs a laser beam and emits fluorescence.

For example, the light-emitting section 213 is a light-emitting body containing a fluorescent body, such as a light-emitting body having particles of a fluorescent body dispersed inside of a sealant (sealed type), a light-emitting body obtained by solidifying particles of a fluorescent body, or a light-emitting body obtained by applying (depositing) particles of a fluorescent body onto a substrate made of a highly thermally conductive material (thin-film type). In the present embodiment, the light-emitting section 213 is formed by applying a fluorescent body in powder form onto an inclined part 302*a* of the heat radiating base 302 with $TiO_2$ as a binder, so as to be in the shape of a 4 mm×2 mm rectangular thin film having a thickness of 0.1 mm.

The light-emitting section 213 is located at the heat radiating base 302 and near one (first focal point) of two focal points that the reflector 214 has. This causes light emitted from the light-emitting section 213 to be reflected by a reflection curved surface of the reflector 214 so that its optical path is controlled.

It is preferable that as shown in FIG. 52, the light-emitting section 213 be smaller than (e.g., about 1/10 the size of) the reflector 214. In this case, light emitted by the light-emitting section 213 can be efficiently cast on the area in front of the reflector 214.

Further, it is desirable that the light-emitting section 213 be larger than an illuminated region (range of laser-light illumination) that is formed by laser beams emitted from all of the laser elements 211 and reflected by the reflection mirrors 212*a*, respectively, provided in one-to-one correspondence with the laser elements 211 (guided under the control of the corresponding reflection mirrors 212*a*).

It should be noted that as for descriptions similar to those given in the sections (Putting the Light-emitting Section 113 at a Slant), (Fluorescent Material), (Sealed Type), (Thin-film Type), (Excitation Light Spot Size), (Size of an Illuminated Region That Is Formed in a Case Where a Blue Laser Is Used), and (As to Emission of Light Other Than White Light) of Embodiment 2 is applicable to the light-emitting section 213 and the laser elements 211 of the present embodiment. Therefore, a detailed description thereof is omitted here.

(Light Control Section 212)

The light control sections 212 each control how a laser beam emitted from the corresponding laser element 211 is guided toward the light-emitting section 213 (controls in which direction the laser beam travels), and control overlapping, spot sizes, spot shapes, etc. of illuminated regions on the light-emitting sections 213.

The light control sections 212, each placed between the light-emitting section 213 and the corresponding laser element 211, are achieved by a plurality of reflection mirrors or a plurality of lenses provided so as to respectively correspond to the laser elements 211 constituting the laser light source unit 102.

With the light control sections 212 and the laser elements 211 provided in one-to-one correspondence with each other, it is possible to control how laser beams emitted from the plurality of laser elements 211, respectively, are guided. This makes it possible to more finely control how an illuminated region is formed, thus making it possible to more finely control how a first range of floodlighting a1 is formed by illuminating light emitted from the light-emitting section 213.

It should be noted that the light control sections 212 need only be capable of controlling overlapping, spot sizes, spot shapes, etc. of illuminated regions on the light-emitting sections 213, and as such, may be achieved by an integrally formed array lens or multi-facet mirror, as well as by the reflection mirrors or lenses. Alternatively, there may be a light control section 212 structured such that the plurality of laser elements 211 share a single reflection mirror or lens.

Further, the movement of the light control sections 212 is controlled by the illuminated region changing section 641. This causes the position or angle of each of the light control sections 212 to be changed.

For example, in order to cause the light control sections 212 to mechanically move, a plurality of wires are attached to each of the light control sections 212 per se or to a frame body supporting that light control section 212, with a motor connected to each of the plurality of wires. The motors are driven under the control of the after-mentioned illuminated region changing section 641 to generate driving force that is utilized to cause the wires to independently move substantially along the optical axis. This allows that light control section 212 to move in a direction along any of the three axes (x, y, z).

When the light control sections 212 are reflection mirrors 212*a*, for example, four of these wires are provided at four corners of a surface of each reflection mirror 212 that is opposite that surface of that reflection mirror 212 on which a reflection coating is provided (i.e., which is illuminated by a laser beam). Alternatively, when the light control section 212 are lenses 212*b* (to be described later), for example, four of these wires are provided at four corners of a frame body of each lens 212*b*.

This structure is not the only structure for causing the light control sections 212 to mechanically move. Any structure may be employed, provided that the light control sections 212 are allowed to move in a direction along any one of the three axes under the control of the illuminated region changing section 641.

The term "motor" here means that which imparts movement to an object or puts the object in motion.

(Reflection Mirror 212*a*)

In the present embodiment, the reflection mirrors 212*a* are used as the light control sections 212. The reflection mirrors 212*a* have a function that is similar to that of the reflection mirrors 112*a* described in Embodiment 2, and as such, are not described in detail in the present embodiment.

<LED 202, Heat Radiating Base 302, Fin 402, Reflector 214, Convex Lens 216, and Wavelength Cut Coating 215>

The LED 202, the heat radiating base 302, the fin 402, the reflector 214, the convex lens 216, and the wavelength cut coating 215 have functions that are similar to those of the LED 201, the heat radiating base 301, the fin 401, the reflector 114, the convex lens 116, and the wavelength cut coating 115 described in Embodiment 2, and as such, are not described in detail in the present embodiment.

[Configuration of the Headlamp 155]

Next, an example of a configuration of the headlamp 155 according to the present embodiment is schematically described with reference to FIG. 51.

Figure 51:
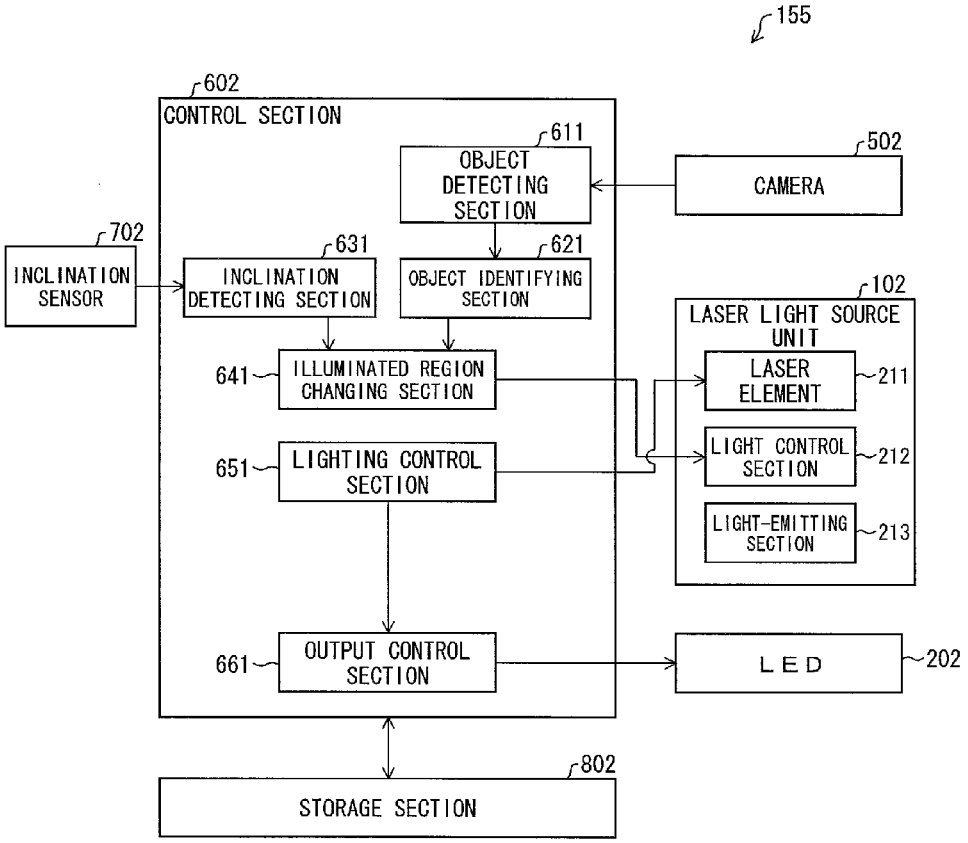
FIG. 51 is a block diagram schematically showing an example of a headlamp according to an embodiment of the present invention.

FIG. 51 is a block diagram schematically showing an example of a configuration of the headlamp 155 according to the present embodiment. The headlamp 155 includes a camera 502, a control section 602, an inclination sensor 702, and a storage section 802 in addition to the aforementioned laser light source unit 102 and the aforementioned LED 202.

<Camera 502>

The camera 502 has a function that is similar to that of the camera 501 described in Embodiment 2, and as such, is not described in detail in the present embodiment.

<Control Section 602>

The control section 602 executes a control program, for example, and thereby controls the members constituting the headlamp 155. The control section 602 mainly includes an object detecting section 611 (sensing means), an object identifying section 621 (identifying means), an inclination detecting section 631 (inclination detecting means), the illuminated region changing section 641 (changing means), a lighting control section 651 (first output control means), and an output control section 661 (second output control means). The control section 602 carries out various processes by reading out a program from the storage section 802 of the headlamp 155, as needed, into a primary storage section (not illustrated) constituted by a RAM (Random Access Memory) or the like and executing the program. It should be noted that the various members will be described later.

<Inclination Sensor 702>

The inclination sensor 702 has a function that is similar to that of the inclination sensor 701 described in Embodiment 2, and as such, is not described in detail in the present embodiment.

<Storage Section 802>

The storage section 802 has stored therein (1) a control program that is executed by the control section 602 to control each of the sections, (2) an OS program that is executed by the control section 602, (3) an application program that is executed by the control section 602, and (4) various pieces of data that the control section 602 reads out in executing these programs. The storage section 802 is constituted by a storage device such as an HDD (Hard Disk Drive) or a semiconductor memory, and a nonvolatile storage device such as a ROM (Read Only Memory) or a flash memory is provided as needed. It should be noted that although the aforementioned primary storage section is constituted by a volatile storage device such as a RAM, the present embodiment may be described on the assumption that the storage device 802 performs the function of the primary storage section.

<Configuration of the Control Section 602 as Shown in Detail>

Next, the various members of the control section 602 are described.

(Object Detecting Section 611, Object Identifying Section 621, and Inclination Detecting Section 631)

The object detecting section 611, the object identifying section 621, and the inclination detecting section 631 have functions that are similar to those of the object detecting section 610, the object identifying section 620, and the inclination detecting section 630 described in Embodiment 2, and as such, are not described in detail in the present embodiment.

(Illuminated Region Changing Section 641)

The illuminated region changing section 641 changes the position or angle of each reflection mirror 212*a* to cause a laser beam emitted from the corresponding laser element 211 to change its optical path, thereby changing an illuminated region (i.e., changing the area, position, and/or the like of the illuminated region) that the laser beam forms on the light-emitting section 213. In actuality, the illuminated region changing section 641 changes the illuminated region by controlling the movement of each of the plurality of reflection mirrors 212*a* provided in accordance with each separate laser element 211 and thereby causing each of the reflection mirrors 212*a* to move in a direction along any one of the three axes (x, y, z).

This control makes it possible to change the illuminated region in quick response to a change in the position or angle of the reflection mirror 212*a*, thus making it possible to achieve control of the light-distribution characteristics of illuminating light that is highly responsive to such a change in the position or angle. Further, this configuration makes it possible to achieve control of the light-distribution characteristics of illuminating light that is highly responsive to an instruction to change first ranges of floodlighting a1, as compared with the configuration in which first ranges of floodlighting a1 are changed by causing a floodlighting section such as a reflector 214 to move.

(Lighting Control Section 651)

The lighting control section 651 controls the laser elements 211 so that the laser elements 211 are separately turned on and off (i.e., drives the laser element 211). That is, the lighting control section 651 controls (varies) the output of each of the laser elements 211.

The lighting control section 651 outputs, to the output control section 661, a lighting status signal indicative of the lighting status of each of the laser elements 211.

By the lighting control section 651 thus controlling the output of each of the laser elements 211, the intensity of a laser beam that is shone on the light-emitting section 213 is controlled, so that the intensity of light that is emitted by the light-emitting section 213 can be controlled, too. Therefore, the control of movement of the reflection mirrors 212*a* by the illuminated region changing section 641 makes it possible not only to freely change how a first range of floodlighting a1 is formed by illuminating light emitted from the light-emitting section 213, but also to more freely change first ranges of floodlighting a1 as the intensity of the light can be freely controlled.

(Output Control Section 661)

The output control section 661 controls the output of illuminating light that is outputted from the LED 202 (i.e., controls the amount of light that is emitted by the LED 202). This makes it possible to control the intensity of illuminating light that is emitted from the LED 202. The LED 202 has an arrangement of LEDs in a matrix manner, and in a case where the output of each of the LEDs is controlled, rough light-distribution control (e.g., rough control of the standard of light-distribution characteristics of a passing headlight, a light-distribution pattern that is stipulated in a drive-on-the-left country, etc.) can be carried out.

For example, the output control section 661 changes the output, chromaticity, etc. of the LED 202 according to the driver (differences in spectral luminous efficacy due to differences in age, race, etc. among drivers) and the driving environment (weather, whether the vehicle is traveling in an urban district or a mountainous region, whether the vehicle is traveling in the evening or at night, etc.).

It should be noted that in the storage section 802, (i) drivers (differences in spectral luminous efficacy due to differences in age, race, etc. among drivers) and/or driving environments (weather, whether the vehicle is traveling in an urban district or a mountainous region, whether the vehicle is traveling in the evening or at night, etc.) and (ii) the values of output (chromaticity, in the case of a chromaticity-changing type) from the LED 202 are stored in association with each other. The output control section 661 gradually controls the output of the LED 202 by reading out the values of output.

Further, the output control section 661 can also analyze a lighting status signal outputted from the lighting control section 651 and control the output of the LED 202 in accordance with the lighting status of the laser light source unit 102 (i.e., the state of output of illuminating light from the laser light source unit 102). This makes it possible to switch to an electric power consumption reduction mode, and to utilize the LED 202 to backup the laser light source unit 102.

Further, even in a case where, for example, all of the laser elements 211 fail and suddenly stop being on, and the output control section 661 controls the emission of illuminating light from the LED 202, thereby ensuring at least minimum requirements stipulated for the light-distribution characteristics and illuminance of the headlamp 155.

(Details of the Illuminated Region Changing Section 641)

The illuminated region changing section 641 controls the movement of the reflection mirrors 212*a* to change how the laser beams form illuminated regions on the light-emitting section 213, so that a desired first range of floodlighting a1 can be formed.

Examples of the desired first range of floodlighting a1 include the first ranges of floodlighting (1) to (15) named in Embodiment 2.

(Storage Section 802)

In order to achieve a change of first ranges of floodlighting a1 such as the first ranges of floodlighting (1) to (15), the storage section 802 has stored therein, e.g., (A) identification related data by which the object and the coordinate value as indicated by an identifying signal, the reflection mirror 212*a* to be driven, the position or angle of the reflection mirror 212*a* are associated with one another, (B) standard-of-characteristics related data by which the standard of light-distribution characteristics of a driving headlight or a passing headlight, the reflection mirror 212*a* to be driven, the position or angle of the reflection mirror 212*a* are associated with one another, (C) light-distribution-pattern related data by which the light-distribution pattern of a drive-on-the-right country or a drive-on-the-left country, the reflection mirror 212*a* to be driven, the position or angle of the reflection mirror 212*a* are associated with one another, and (D) angle related data by which the angle of inclination of the vehicle, the reflection mirror 212*a* to be driven, the position or angle of the reflection mirror 212*a* are associated with one another. Furthermore, the storage section 802 has stored therein data related to driving of the laser light source unit 102 according to various ambient surroundings, data related to control of light by the laser light source unit 102 according to various ambient surroundings, data related to driving of the LED 202, etc.

The illuminated region changing section 641 reads out any one of the identification related data, the standard-of-characteristics related data, the light-distribution-pattern related data, the angle related data, etc. from the storage section 802 and determines the angle or position of each reflection mirror 212*a*.

(Illuminated Regions that are Formed by the Plurality of Laser Elements 211)

As shown in FIG. 31, which was used in Embodiment 2, the plurality of laser elements 211 are arranged in a matrix manner with respect to the light-emitting section 213. Therefore, in a case where at least the reflection mirrors 212*a* have not been controlled (i.e., in a case where the reflection mirrors 212*a* are in their respective default positions), the laser beams emitted from the respective laser elements 211 are shone on the whole light-receiving surface in a matrix manner so that there is no overlap between illuminated regions that are formed on the light-receiving surface. This allows the fluorescent body of the light-emitting section 213 to efficiently emit light.

Further, the control of the reflection mirrors 212*a* by the illuminated region changing section 641 makes it possible to freely change the position of an illuminated region that is formed by each of the laser beams emitted from the respective laser elements 211.

Therefore, the headlamp 155 can form a first range of floodlighting a1 outside a second range of floodlight a2, for example. This makes it possible to highly control the light-distribution characteristics of illuminating light that is emitted from the headlamp 115. Further, the headlamp 155 can form a first range of floodlighting a1 in part of a second range of floodlight a2, for example. This makes it possible to more highly control the light intensity distribution of illuminating light that is emitted from the headlamp 115. That is, this makes it possible to freely change how a light-distribution pattern is formed light emitted by the headlamp 155, thus making it possible to achieve a wide variety of light-distribution patterns.

The following describes examples of operation 11 to 16 of the headlamp 155 where the first ranges of floodlighting (1) to (15) can be achieved. It should be noted that the examples of operation 11 to 16 are intended for illustrative purposes only, and are not intended to limit examples of operation of the headlamp 155. In the following examples of operation, the first ranges of floodlighting a1, which are formed so as to include objects (such as a pedestrian, an animal, a road sign, and a centerline) located in front of the vehicle, are ranges that are formed by light cast by the laser light source unit 102, and need only be higher in luminous intensity than the second range of floodlighting a2, which are formed by light cast by the LED 202 alone.

[Specific Examples of Operation]

<Specific Example of Operation 11>

First, an example of light distribution in an urban district is described with reference to FIGS. 33 and 34, which were used in Embodiment 2. The following description assumes that the reference sign 113 of (*b*) of FIG. 34 corresponds to the light-emitting section 213 of the present embodiment.

As shown in (*a*) of FIG. 33, the whole areas of the sidewalk, the driving lane, and the opposite lane and the area in front of the vehicle other than those roads are illuminated. However, it is difficult to finely control the light-distribution characteristics even by using a light-blocking plate or the like.

The present embodiment allows illuminating light emitted from the laser light source unit 102 to be emitted together with illuminating light emitted from the LED 202. As shown in (*b*) of FIG. 33, the laser light source unit 102 forms first ranges of floodlighting a1.

The first ranges of floodlighting a1 thus formed are shown in (*a*) of FIG. 34. In order to form the first ranges of floodlighting a1 shown in (*a*) of FIG. 34, the illuminated region changing section 641 controls the position or angle of each reflection mirror 212*a* so that illuminated regions A such as those shown in (*b*) of FIG. 34 are formed. That is, the illuminated region changing section 641 controls the position or angle so that a first range of floodlighting a1 is formed in a peripheral part or outside a second range of floodlighting a2.

With this, as shown in (*b*) of FIG. 33, those ranges which are hard to make visible with illuminating light emitted from the LED 202 (i.e., those ranges which cannot be illuminated by the LED 202) can be supplementarily illuminated by illuminating light emitted from the laser light source unit 102.

Furthermore, as shown in (*b*) of FIG. 34, illuminated regions which are formed by respective laser beams emitted from the plurality of laser elements 211 are changed by the illuminated region changing section 641 so as to partially overlap with each other. This allows first ranges of floodlighting a1 which are formed in accordance with the respective illuminated regions to overlap with each other. This makes it possible to smoothly form the first ranges of floodlighting a1.

It should be noted that in order to achieve such a smooth overlap of ranges of floodlighting with a light source such as the LED 202, it is necessary to provide a reflector or a multi-facet mirror for each of the plurality of LED chips 21 to lap the ranges of floodlighting over one another during floodlighting. Moreover, whereas the luminance of the laser light source unit 102 in the present embodiment 1000 $Mcd/m^2$, the luminance of a typical LED or HID lamp is 100 $Mcd/m^2$. An attempt to use an LED or HIP lamp to form the same ranges of floodlighting as those which are formed by the laser light source unit 102 makes it necessary to increase the size of each reflector by one digit, and therefore is not realistic. Since the headlamp 155 of the present embodiment uses the laser elements 211, the smooth ranges of floodlighting can be achieved without providing a reflector or a multi-facet mirror.

Further, as shown in (*b*) of FIG. 34, by being simultaneously formed on the light-emitting section 213, the plurality of illuminated regions which are formed by the respective laser beams emitted from the plurality of laser elements 211 can simultaneously form the plural ranges of floodlighting (indicated by circles in the drawing) which are formed by the illuminating light emitted from the laser light source unit 102. This makes it possible to simultaneously floodlight a plurality of areas in front of the headlamp 155.

<Specific Example of Operation 12>

Next, an example of operation where an object sensed by the object detecting section 611 is illuminated by illuminating light emitted from the laser light source unit 102 is described with reference to FIGS. 35 and 36. The steps S11 to S13 shown in FIG. 35 are executed in a similar manner in the present embodiment, too, and as such, are not described below. Further, the following description assumes that the reference signs 113 and 114 of FIG. 36 correspond to the light-emitting section 213 and the reflector 214 of the present embodiment, respectively.

As shown in FIG. 35, the illuminated region changing section 641 changes, in accordance with the coordinate value indicated by an identifying signal outputted from the object identifying section 621, the position or angle of each reflection mirror 212*a* so that light from the light-emitting section 213 distributed toward the object, thereby changing an illuminated region (i.e., changing the area, position, and/or luminance distribution of the illuminated region) that the laser beam forms on the light-emitting section 213 (S14).

It should be noted that the lighting control section 651 can alert the driver or the like by changing lighting patterns according to the kind of the object identified (e.g., illuminating the object with blinking light) or changing lighting intensity (intensity of laser beam illumination) according to the brightness of the surrounding area (driving environment).

In the case shown in FIG. 36, the illuminated region changing section 641 reads out the identification related data from the storage section 802 to change the position or angle, for example, so that a first range of floodlighting a1 is formed in a position on an moving image where the pedestrian O has been detected, which position corresponds to the coordinate value.

In this case, as shown in (*b*) of FIG. 36, the laser beams emitted from the laser elements 211 and guided under the control of the reflection mirrors 212*a* are shone only on regions Al on the light-receiving surface of the light-emitting section 213 (as indicated by bright portions in the drawing), but not on the other regions (indicated by dark portions in the drawing). This allows the first range of floodlighting a1 to be formed so that light from the light-emitting section 213 is distributed toward the pedestrian O, thus making it possible to more brightly illuminate the pedestrian O.

Thus, in the headlamp 155, the illuminated region changing section 641 controls the movement of each reflection mirror 212*a* to change illuminated regions on the light-emitting section 213 so that an object (i.e., a road sign, a pedestrian, the animal, an obstacle, a centerline, or the like) sensed by the object detecting section 611 is included; therefore, the light from the light-emitting section 213 can be distributed solely to the object. That is, the pedestrian, the obstacle, or the like can be illuminated brightly. This makes it possible to visually read the road sign correctly and visually recognize the pedestrian, the obstacle, or the like correctly, thus making it possible to achieve a safe traffic environment.

Further, the reference value table has managed therein reference values corresponding to vehicles such as an automobile and a motorcycle as well as reference values corresponding to a road sign, a pedestrian, an obstacle, etc. This makes it possible to form a first range of floodlighting a1 in an appropriate position according to the kind of an object identified by the object identifying section 621.

The present embodiment uses the laser elements 211 as an excitation light source that is an optically small light source (high-luminance light source) with respect to the floodlighting system (the reflector 214 and the convex lens 216), thus making it possible to achieve such high floodlighting efficiency that 90% of the light emitted by the light-emitting section 213 is cast on the target object. This makes it possible to achieve floodlighting with low electric power consumption and with high illuminance on the target object.

As will be mentioned in <Modification of Specific Example of Operation 12> below, it is assumed that in a driving environment, there are many cases where the driver or the like must be alerted to a plurality of target objects simultaneously. However, if the reflection mirrors 212*a* (light control sections 212) are slow in response speed, this may make it impossible to follow a plurality of target objects simultaneously to floodlight them. With this point in consideration, it is preferable that light from the light-emitting section 213 which has followed the movement of the objects be distributed by using some of the laser elements 211 (e.g., one of the laser elements 211) and the reflection mirrors 212*a* provided in accordance with these laser elements 211, with the other reflection mirrors 212*a* held on standby (idle).

In this case, such first ranges of floodlighting a1 as those shown in FIG. 34 may be formed by the other laser elements 211 and the reflection mirrors 212*a* provided in accordance with these laser elements 211. Alternatively, these laser elements 211 may be turned off.

It should be noted that the target objects may be followed by turning on all of the laser elements 211 at low output and controlling the reflection mirrors 212*a* provided in accordance with the laser elements 211. In this case, the output from each laser element 211 that is necessary for giving the same luminous intensity is low. This makes it possible to extend the life of each laser element 211.

<Modification of Specific Example of Operation 12>

A modification of the specific example of operation 12 is described with reference to FIG. 37, which was used in Embodiment 2. The following description assumes that the reference signs 114 of FIG. 37 corresponds to the reflector 214 of the present embodiment.

In the present modification, the pedestrian O and the animal are target objects. With the second range of floodlighting a2 alone, it is difficult for the driver to recognize the target objects, as the illuminance on the target objects (i.e., the pedestrian O and the animal) is low.

In the case shown in FIG. 37, as in the case shown in FIG. 36, the present modification can direct spotlight (light emitted from the light-emitting section 213) regardless of the second range of floodlighting a2, thus making it possible to alert the driver.

Further, in the present modification, the position of formation of a first range of floodlighting a1 is controlled by the control of guidance of each laser beam by the corresponding reflection mirror 212*a*. This makes it possible to floodlight a plurality of places with a single headlamp 155 (floodlighting device), thus making it possible to reduce the size of the headlamp 155. That is, first ranges of floodlighting a1 can be simultaneously formed on a plurality of places so as to include a plurality of target objects, respectively. It should be noted that the process in the present modification is similar to that of the example of operation 12, and as such, is not described below.

Even if the target objects are moving objects as in the case of the example of operation 12 and its modification, the illuminated region changing section 641 needs only change the position or angle of each reflection mirrors 212*a*. This makes it possible to change first ranges of floodlighting a1 in quick response to the movement of the target objects, thus making it possible to follow the target objects. Further, since it is possible to follow the target objects simply by changing the position or angle of each reflection mirror 212*a*, the positions of formation of first ranges of floodlighting a1 can be smoothly changed in accordance with the movement of the target objects.

Further, the illuminated region changing section 641 can also change the area of an illuminated region on the light-emitting section 213 simply by changing the position or angle of the corresponding reflection mirror 212*a* and thereby change the size of the corresponding first range of floodlighting a1. For example, in a case where a vehicle including a headlamp 155 is moving forward, a still object such as a road sign (see (*a*) of FIG. 38), as well as moving objects such as the pedestrian O and the animal, moves (approaches) relative to the vehicle. Even in the case of such a relative movement, not only the positions but also the areas of the first ranges of floodlighting a1 can be changed by changing the position or angle of each reflection mirror 212*a*. Therefore, the positions of formation of the first ranges of floodlighting a1 can be smoothly changed even in accordance with the relative movement of the target objects to the vehicle.

<Specific Example of Operation 13>

Next, an example of operation where an object sensed by the object detecting section 611 is not illuminated by illuminating light emitted from the laser light source unit 102. The following description assumes that the reference sign 113 of (*b*) of FIG. 38 corresponds to the light-emitting section 213 of the present embodiment.

The example of operation 13 shows an example of a case where those objects sensed by the object detecting section 611 include an oncoming vehicle and light is cast in a light-distribution pattern corresponding to a high beam (a first range of floodlighting a1 corresponding to a high beam is formed).

As in the example of operation 12, the kinds of objects are identified by the object detecting section 611 and the object identifying section 621 carrying out a process, and an identifying signal indicative of a coordinate value in a moving image in which the objects have been detected is outputted to the illuminated region changing section 641. In the case shown in (*a*) of FIG. 38, the object identifying section 621 identifies the kinds of the objects as an oncoming vehicle (such as an automobile or a motorcycle), a pedestrian, a road sign, and an animal, and outputs, to the illuminated region changing section 641, an identifying signal indicative of a coordinate value in a moving image in which the oncoming vehicle has been detected.

As shown in (*a*) of FIG. 38, the illuminated region changing section 641 controls, in accordance with the coordinate value indicated by the identifying signal outputted from the object identifying section 621, the positions of formation of first ranges of floodlighting a1 by controlling guidance of each laser beam by the corresponding reflection mirror 212*a* so that light from the light-emitting section 213 is not distributed toward the oncoming vehicle and is distributed toward the pedestrian, the road sign, and the animal.

In this case, as shown in (*b*) of FIG. 38, the laser beams emitted from the laser elements 211 and guided under the control of the reflection mirrors 212*a* are shone on any of the regions (indicated by bright portions in the drawing) other than the region A2 (indicated by a dark portion in the drawing) on the light-receiving surface of the light-emitting section 213. With this, as shown in (*a*) of FIG. 38, the first ranges of floodlighting a1 are formed so that the light from the light-emitting section 13 is not distributed toward the oncoming vehicle. That is, the headlamp 155 can control the ranges of floodlighting so as not to floodlight the region (region B) where otherwise the oncoming vehicle is illuminated.

Thus, the headlamp 155 is configured such that in a case where the object is an oncoming vehicle or the like, the illuminated region changing section 641 controls the movement of each reflection mirror 212*a* to change illuminated regions on the light-emitting section 213 so that the object sensed by the object detecting section 611 is not included; therefore, the light from the light-emitting section 213 can be distributed so that the object is not included. This makes it possible to reduce unpleasant glare and dazzle that, for example, the driver of an oncoming vehicle, a preceding vehicle, or the like experiences, thus making it possible to achieve a safe and comfortable traffic environment.

Further, in the examples of operation 11 and 12, when the kind of an object identified by the object identifying section 621 matches the kind of an object as registered in advance in the reference value table, the illuminated region changing section 641 changes illuminated regions that laser beams form on the light-emitting section 213.

As described above, in the example of operation 12, when the kind of an object identified by the object identifying section 621 matches the kind of an object as registered in advance, the illuminated region changing section 641 changes the positions of the illuminated regions so that the light from the light-emitting section 213 is cast toward the object. This allows only an object (such as a road sign, a pedestrian, or an animal) sensed by the object detecting section 611 to be included in a first range of floodlighting a1, thus making it possible to more brightly illuminate the object.

Meanwhile, in the example of operation 13, when the kind (which is an oncoming vehicle in this case) of an object identified by the object identifying section 621 matches the kind of an object as registered in advance, the illuminated region changing section 641 may change the positions of the illuminated regions so that the light from the light-emitting section 213 is not cast toward the object. This allows only an object (such as an automobile) sensed by the object detecting section 611 not to be included in a first range of floodlighting a1, thus making it possible not to cause the driver of an oncoming vehicle or the like to experience unpleasant glare or the like.

It should be noted here that in the case of a lamp including only an LED as shown in (*c*) of FIG. 38, the possibility of causing the driver of an oncoming vehicle or the like to experience unpleasant glare is low. However, all the more because of that, there appears a wide range (range D in the drawing) of low illuminance in the area in front of the vehicle. Meanwhile, in the case of such a lamp, an attempt to increase illuminance in the area in front of the vehicle is highly likely to end up causing the driver of an oncoming vehicle or the like to experience unpleasant glare. Therefore, it is difficult for such a lamp to increase illuminance in the area in front of the vehicle without causing the driver of an oncoming vehicle or the like to experience unpleasant glare.

Meanwhile, in the headlamp 155 of the present embodiment, as described above, the identification of the kind of an object by the object identifying section 621 makes it possible to change optimum illuminated regions and therefore first ranges of floodlighting a1 according the kind. This makes it possible to increase illuminance in the area in front of the vehicle without causing the driver of an oncoming vehicle or the like to experience unpleasant glare.

<Specific Example of Operation 14>

Next, an example of operation where light-distribution patterns are changed according to the traffic regulations of the country in which the vehicle travels is described with reference to FIG. 39, which was used in Embodiment 2.

In a case where, for example, the vehicle travels from the United Kingdom to France or vice versa, the illuminated region changing section 641 can work with a GPS, for example, to read out, from the storage section 802, light-distribution pattern related data based on the traffic regulations of the respective countries, thereby changing the position or angle of each reflection mirror 212*a* to change the illuminated regions so that first ranges of floodlighting a1 based on the traffic regulations are formed. This allows the headlamps 155 of the present application to be mounted and utilized on a vehicle in any country.

Further, a conventional lamp has achieved light distribution by using a lens cut or a multi-facet mirror, and as such, has been unable to finely control light distribution. On the other hand, the present embodiment casts light with high floodlighting efficiency by using the laser elements 211 (high-luminance light source), and therefore can ideally control light distribution.

Further, whereas the DMD method yields low illuminance on a target object and requires a measurable amount of electric power, the present embodiment can achieve such fine light-distribution control with low electric power consumption that the target object becomes high in illuminance.

It should be noted the LED 202, too, is controlled by the output control section 661 so that the second range of floodlighting a2 is in a light-distribution pattern based on the traffic regulations of the country in which the vehicle is traveling.

<Specific Example of Operation 15>

Next, an example of operation where the illuminated region changing section 641 changes illuminated regions according to the angle of inclination of a vehicle as detected by the inclination detecting section 631 is described with reference to FIGS. 40 through 44, which were used in Embodiment 2. The following description assumes that the reference sign 113 of FIGS. 41 and 42 corresponds to the light-emitting section 213 of the present embodiment. The description of FIG. 44 is identical to that given in Embodiment 2, and as such, is omitted here.

As shown in FIG. 40, the inclination detecting section 631 detects an inclination of the vehicle, obtains the angle of inclination of the vehicle in a front-to-rear direction of the vehicle (S21), and outputs, to the illuminated region changing section 641, an angle signal indicative of the value of the angle of inclination. The illuminated region changing section 641 reads out the angle related data from the storage section 802 or changes the position or angle of each reflection mirror 212*a*, thereby changing illuminated regions that the laser beams form on the light-emitting section 213 (S22).

It should be noted that the change of the illuminated regions may be carried out on the basis of information from a car navigator, a highway traffic system (ITS), and/or the camera 502.

For example, (*a*) of FIG. 41 is a conceptual diagram showing how the laser beams emitted from all of the laser elements 211 are shone on the whole light-emitting section 213 by the illuminated region changing section 641 controlling the movement of each reflection mirror 212*a* to satisfy the desired light distribution in a flat road. In this case, for example, the vehicle forms a first range of floodlighting a1 in the range of angles of $-\alpha$ to $\alpha$ with respect to an imaginary line perpendicular to the front face of the headlamp 155. It should be noted here that for simplification of explanation, this example shows how twelve laser elements 211 forms a matrix of 4×3 illuminated regions on the light-receiving surface of the light-emitting section 213.

(*b*) of FIG. 41, which is premised on (*a*) of FIG. 41, shows how the vehicle, for example, goes up a slope having an angle of $\theta 1$ with respect to the horizontal plane. In this case, for example, the position or angle of each reflection mirror 212*a* is controlled by the illuminated region changing section 641 so that no illuminated region is formed in an upper portion C1 of the light-emitting section 213 along the vertical direction, and the position and area of illuminated regions which are formed by the laser beams emitted from the respective laser elements 211 are changed. As a result, the headlamp 155 forms a range of floodlighting a1 in the range of angles of $-\alpha$ to $\beta$ ($\beta<\alpha$) with respect to an imaginary line perpendicular to the front face of the headlamp 155.

At this point in time, the LED 202 outputs less light than it does when the vehicle is traveling on a flat road (see (*a*) of FIG. 41). The lighting control section 651 adjusts the intensity of output from the laser elements 211 to the light-emitting section 213 so as to supplement the decrease in amount of light that the LED 202 emits.

Further, in a case where the vehicle goes up a slope having an angle of $\theta 2$ ($>\theta 1$) with respect to the horizontal plane, as shown in (*c*) of FIG. 41, the position or angle of each reflection mirror 212*a* is controlled by the illuminated region changing section 641 so that no illuminated region is formed in an upper portion C2 of the light-emitting section 213 along the vertical direction, and the position and area of illuminated regions which are formed by the laser beams emitted from the respective laser elements 211 are changed. As a result, the headlamp 155 forms a range of floodlighting a1 in the range of angles of $-\alpha$ to $\gamma$ ($\gamma<\beta$) with respect to an imaginary line perpendicular to the front face of the headlamp 155.

At this point in time, the LED 202 outputs less light than it does when the vehicle is traveling on a slope having an angle of $\theta 1$ (see (*b*) of FIG. 41). The lighting control section 651 adjusts the intensity of output from the laser elements 211 to the light-emitting section 213 so as to supplement the decrease in amount of light that the LED 202 emits. That is, the LED 202 outputs more light in (*a*) of FIG. 41 than it does in (*b*) of FIG. 41, and outputs more light in (*b*) of FIG. 41 than it does in (*c*) of FIG. 41.

Further, for example, in the case of an arrangement of 8×6 laser elements 211 in a matrix manner, i.e., in a case where a larger number of laser elements 211 are arranged than in the case shown in FIG. 41, it is not necessary to drive all of the laser elements 211 even when the vehicle is traveling on a flat road. That is, as shown in (*a*) through (*c*) of FIG. 42, the control of light distribution (position control of a first range of floodlighting a1) according to the inclination of the vehicle as shown in FIG. 41 can be carried out simply by changing the position of illuminated regions which are formed by the laser beams emitted from the respective laser elements 211, without changing the area of the illuminate regions, regardless of whether the vehicle is traveling on a flat road or a slope.

In (*a*) through (*c*) of FIG. 42, it is desirable that a range of floodlighting (floodlighting pattern) be changed by changing the position or angle of each light control sections 212 while turning on laser elements 211 of the same positions (without changing from turning on laser elements 211 in one position to turning on laser elements 211 in another position, as doing so makes a smooth change in the floodlighting pattern. However, it is of course possible to change the floodlighting pattern by changing from turning on laser elements 211 in one position to turning on laser elements 211 in another position.

Thus, the aforementioned control of the illuminated region changing section 641 allows the headlamp 155 to change first ranges of floodlighting a1 according to the inclination of a road so as not to affect the driver of an oncoming vehicle or the like. This makes it possible to reduce unpleasant glare and dazzle that the driver of an oncoming vehicle or the like experiences.

It should be noted that the example of operation 15 is an example of a case where the vehicle comes across an oncoming vehicle when the vehicle is about to go up a slope, and it is only necessary that a light distribution that does not cause the driver of the oncoming vehicle to experience glare be achieved by shining lasers on the light-emitting section 213. It should also be noted that it is possible to achieve the floodlighting pattern by using some of the laser elements 211 (e.g., one of the laser elements 211) and the reflection mirrors 212*a* provided in accordance with these laser elements 211.

Further, although the example of operation 15 deals with a case where the vehicle goes up a slope, similar control is carried out also in a case where the vehicle goes down a slope. This makes it possible, also in a case where the vehicle goes down a slope, to reduce unpleasant glare and dazzle that the driver of an oncoming vehicle or the like about to go up the slope experiences.

Further, in the case where the vehicle goes down a slope, as shown in (*a*) of FIG. 43, a conventional headlamp has not been capable of, even by emitting a high beam, illuminating an object in a distant area to which the vehicle is traveling. However, in the headlamp 155 of the present embodiment, the illuminated region changing section 641 changes the position or angle of each reflection mirror 212*a*, thereby controlling the guidance of laser beams emitted from the respective laser elements 211. This makes it possible to design the headlamp 155 to illuminate even a distant area as shown in (*b*) of FIG. 43.

Although it is possible to achieve the same function with a conventional headlamp by providing a reflector adequate for each purpose, an automobile, a motorcycle, or the like only has a limited amount of space in which such a reflection can be provided, which has made it possible to provide such a reflector. In the present embodiment. by changing the position or angle of each reflection mirror 212*a*, such a light distribution can be achieved in a space-saving manner without providing such a reflector.

<Specific Example of Operation 16>

Next, an example of a range of floodlighting that is formed in case of rain is described with reference to FIG. 45, which was used in Embodiment 2.

In the headlamp 155 of the present embodiment, the illuminated region changing section 641 changes illuminated regions which are formed on the light-emitting section 213, in order that first ranges of floodlighting a1 are formed in part of a second range of floodlighting a2. Specifically, as in the example of operation 12, for example, the illuminated region changing section 641 changes the illuminated regions by changing the position or angle of each reflection mirror 212*a* so that the first ranges of floodlighting a1 are formed to include those parts of a centerline which falls within the second range of floodlighting a2 as sensed by the object detecting section 611. With this, even if there is a hardly visible range in the second range of floodlighting a2, that part can be supplementarily illuminated by illuminating light emitted from the laser light source unit 102. This makes it possible to improve the visibility of a centerline in case of rain, thus making it possible to reduce the incidence of such accidents.

[Modification 11]

Figure 53:
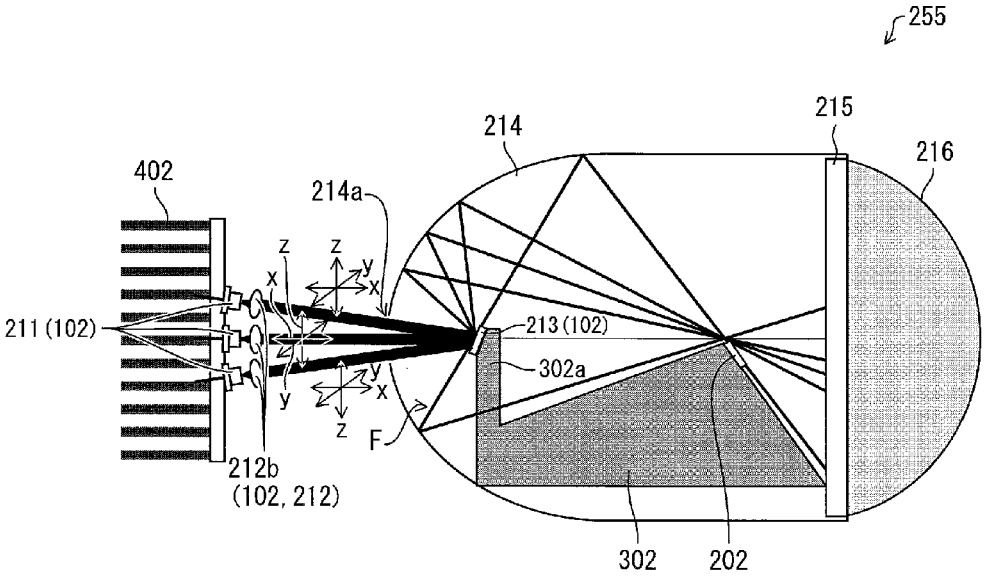
FIG. 53 is a diagram showing a modification of the headlamp.

Next, a headlamp 255 (lighting device, vehicle headlight) is described which is a modification 11 of the headlamp 155. FIG. 53 is a diagram showing a modification of the headlamp 155. As shown in FIG. 53, the headlamp 255 according to the modification 11 includes lenses 212*b* (light control sections) as the light control sections 212 instead of including the reflection mirrors 212*a*.

In the headlamp 255, the illuminated region changing section 641 changes the position or angle of each lens 212*b* to change illuminated regions which are formed on the light-emitting section 213, thereby achieving control of the light-distribution characteristics and light intensity distribution of illuminating light that the headlamp 255 emits, as in the case of the headlamp 155.

<Lens 212*b*>

The lenses 212*b* have a function that is similar to that of the lenses 112*b* described in Embodiment 2, and as such, are not described in detail below. The lenses 212*b* convert, into substantially parallel laser beams, laser beams which otherwise travel while spreading, and control the guidance of the laser beams to the light-emitting section 213. That is, unlike in the case of the reflection mirrors 212*a*, the optical axis of the light-emitting points of the laser elements 211 and the direction in which the laser beams travel after having passed through the lenses 212*b* are slightly varied by the illuminated region changing section 641 controlling the movement of each lens 212*b*. The lenses 212*b* can be said to be substantially identical to the reflection mirrors 212*a* in that the laser beams travel toward the light-emitting section 213.

[Modification 12]

Figure 54:
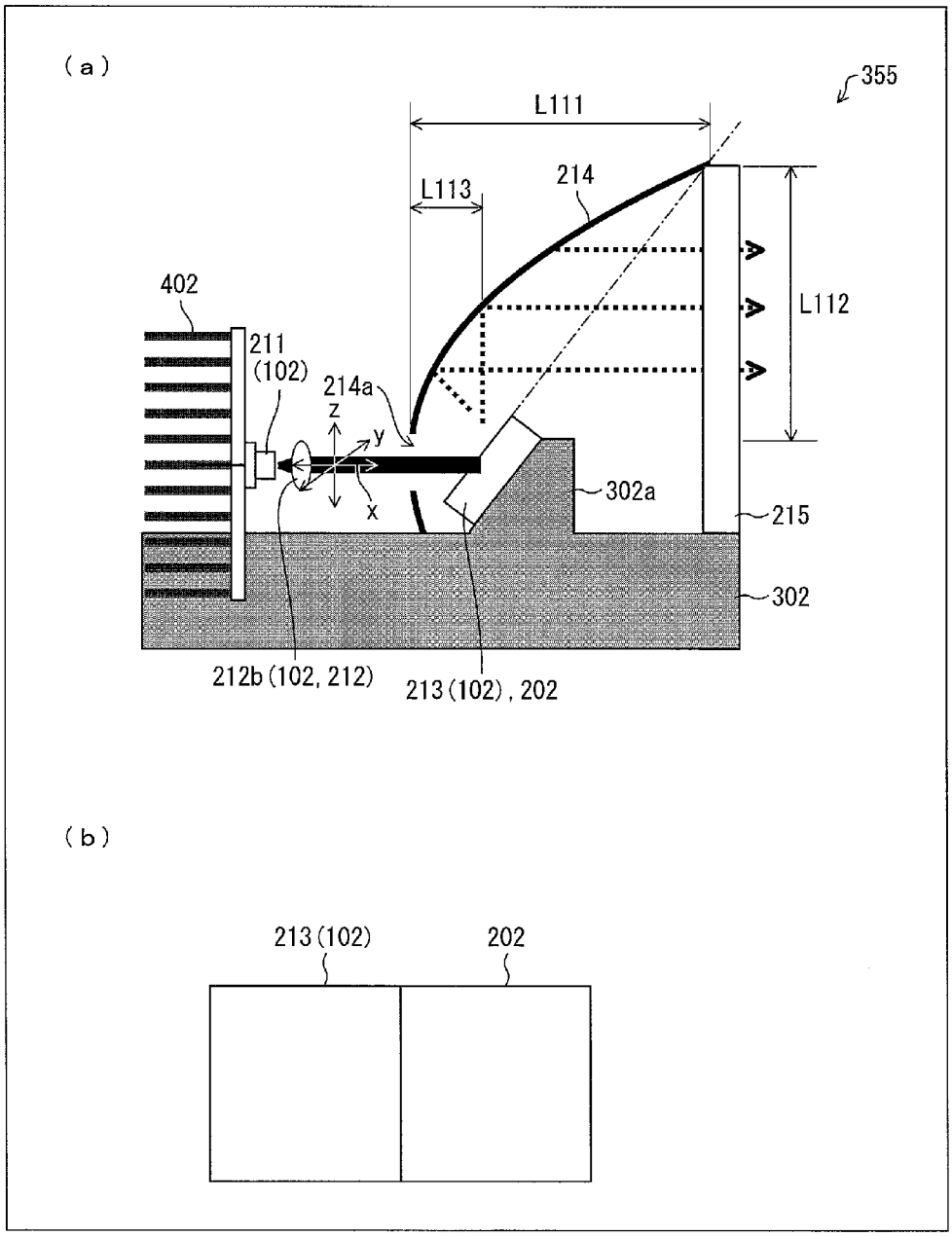
FIG. 54 is a set of diagrams (*a*) and (*b*) showing another modification of the headlamp, (*a*) being a plan view showing an example of the modification, (*b*) being a diagram showing a positional relationship between the light-emitting section and the LED in the modification.

Next, a headlamp 355 (lighting device, vehicle headlight) is described which is a modification 12 of the headlamp 155. FIG. 54 is a diagram showing a further modification of the headlamp 155.

The headlamp 355 of the present modification differ in structure of the above-described headlamp 155 in that the headlamp 355 uses a parabolic mirror as the reflector 214 and the light-emitting section 213 functions as part of the LED 202. Further, the headlamp 355 differs in structure from the above-described headlamp 255 in that the headlamp 355 includes only a single laser element 211 and a single lens 212*b*.

<Laser Element 211 and Lens 212*b*>

As described above, the headlamp 355 includes only a single laser element 211 and a single lens 212*b*. Moreover, in the headlamp 355, the illuminated region changing section 641 changes the position or angle of the lens 212*b* to change illuminated regions which are formed on the light-emitting section 213, thereby achieving control of the light-distribution characteristics and light intensity distribution of illuminating light that the headlamp 255 emits, as in the case of the headlamp 255.

In the present modification, it is the lens 212*b* whose position or angle is changed. However, it may not be the lens 212*b* but the laser element 211 whose position or angle is changed.

<Light-emitting Section 213 and Reflector 214>

The light-emitting section 213 and the reflector 214 as shown in FIG. 54 have functions that are similar to those of the light-emitting section 213 and the reflector 214 described in Embodiment 2 with reference to FIG. 47, and as such, are not described in detail in the present embodiment. It should be noted that L11, L12, and L13 of FIG. 47 correspond to L111, L112, and L113 of FIG. 54, respectively.

<Example of Operation>

Next, an example of operation of the headlamp 355 is described with reference to FIGS. 55 through 58.

Figure 55:
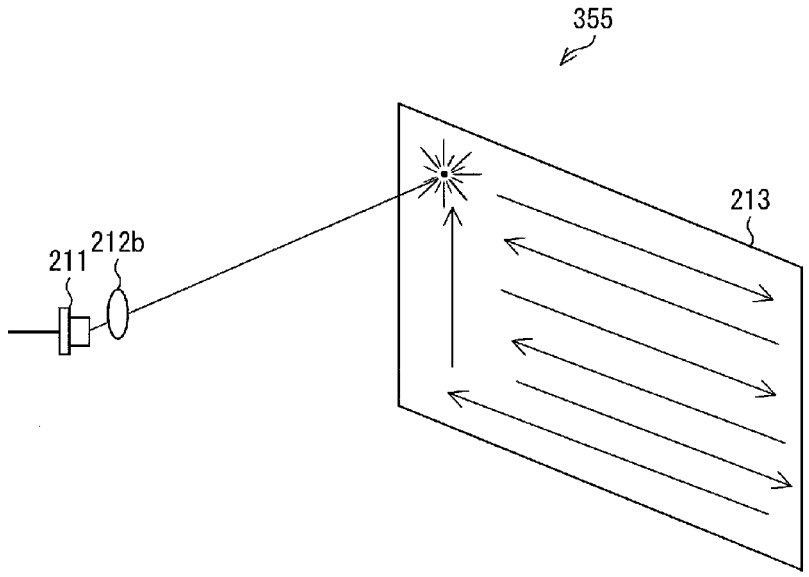
FIG. 55 is a diagram for explaining an overview of the formation of an illuminated region as observed when the position or angle of a lens of the headlamp is changed.

FIG. 55 explains the foregoing operation. The lens 212*b* moves in response to the control by the illuminated region changing section 641. According to this, scanning with the laser beam is performed on any region of an illuminated surface (light-receiving surface) of the light-emitting section 213 to which surface the laser beam is emitted. Further, by causing the lens 212*b* to move, the illuminated region changing section 641 can also arbitrarily change the area of an illuminated region of the light-emitting section 213 to which illuminated region the laser beam is emitted.

It should be noted that the laser element 211 has its scan rate set at 60 Hz, for example. Although FIG. 55 shows how scanning is performed with a laser beam passed over the whole light-emitting section 213, the range of scanning is changed according to the first range of floodlighting a1 to be formed, as shown in FIGS. 56 through 58.

Figure 56:
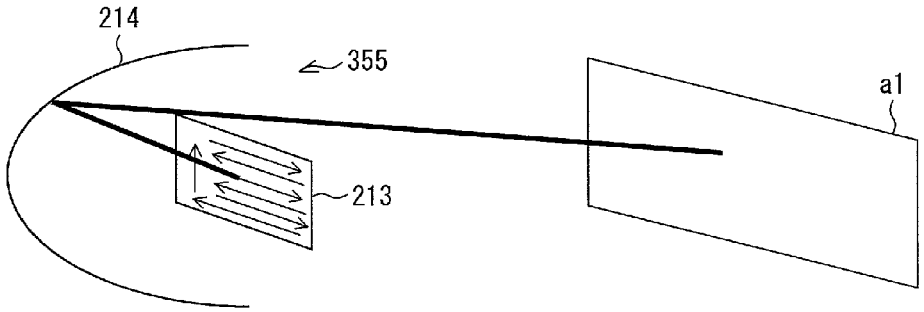
FIG. 56 is a diagram explaining how the headlamp casts light.

FIG. 56 is a diagram explaining how the headlamp 355 casts light. As shown in FIG. 56, light emitted from the light-emitting section 213 form a first range of floodlighting a1 under the control of the illuminated region changing section 641. In this case, for example, such a first range of floodlighting a1 as that shown in (*a*) of FIG. 34 can be formed by the illuminated region changing section 641 controlling the single lens 212*b* provided in accordance with the single laser element 211.

Further, an amount of scanning with the laser light can also be controlled by increasing the area of the illuminated region on the light-emitting section 213. Same applies to examples of FIG. 57 etc. described later.

Figure 57:
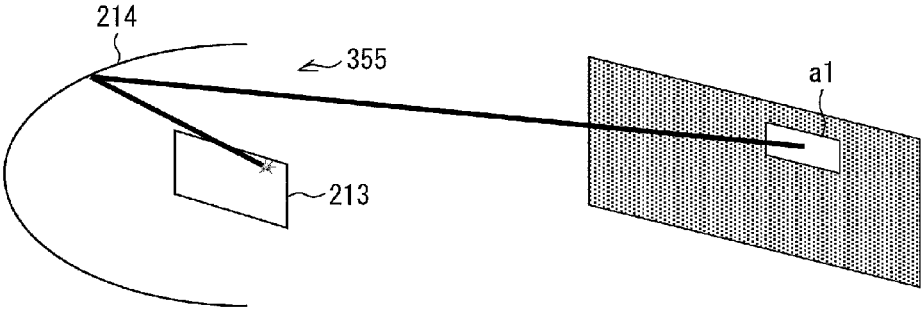
FIG. 57 is a diagram for explaining an example of floodlighting by the headlamp.
Figure 58:
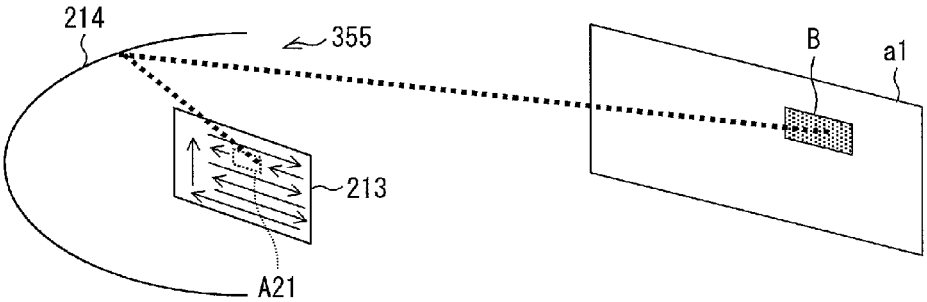
FIG. 58 is a diagram for explaining another example of floodlighting by the headlamp.

FIG. 57 is a diagram for explaining an example of floodlight by the headlamp 355. According to this example, a laser beam is emitted to only a part of a region of the light-emitting section 213 by thus controlling the illuminated region changing section 641, so that a first range of floodlighting a1 can be limited (reduced).

FIG. 58 is a diagram for explaining another example of floodlighting by the headlamp 355. According to this example, the headlamp 355 can form a first range of floodlight a1 in a position on the light-emitting section 213 except a region B by controlling the illuminated region changing section 641. In this case, the illuminated region changing section 641 can be achieved by controlling the lighting control section 651 so that the laser element 211 is turned off at a point of time when the laser beam is shone on a region A2 of the light-receiving surface of the light-emitting section 213.

Thus, as with the headlamps 155 and 255, the headlamp 355 can freely change the position or area of an illuminated region on the light-emitting section 213 to which illuminated section the laser beam is emitted, and thereby can freely change first ranges of floodlight a1. Further, the headlamp 355, which, by thus controlling the illuminated region changing section 641, changes the position or area of an illuminated region on the light-emitting section 213 to which illuminated section the laser beam is emitted, is high in response speed and can be greatly reduced in electric power consumption.

Further, such scanning makes it possible to achieve a lamp having various functions such as a driving headlight, a passing headline, a daylight lamp, and blinkers.

It is also of course possible to form a floodlighting pattern by performing scanning with the same spot size over the same range of scanning on the light-emitting section 213 and synchronizing the scanning with the light control section 651.

[Modification 14]

Figure 59:
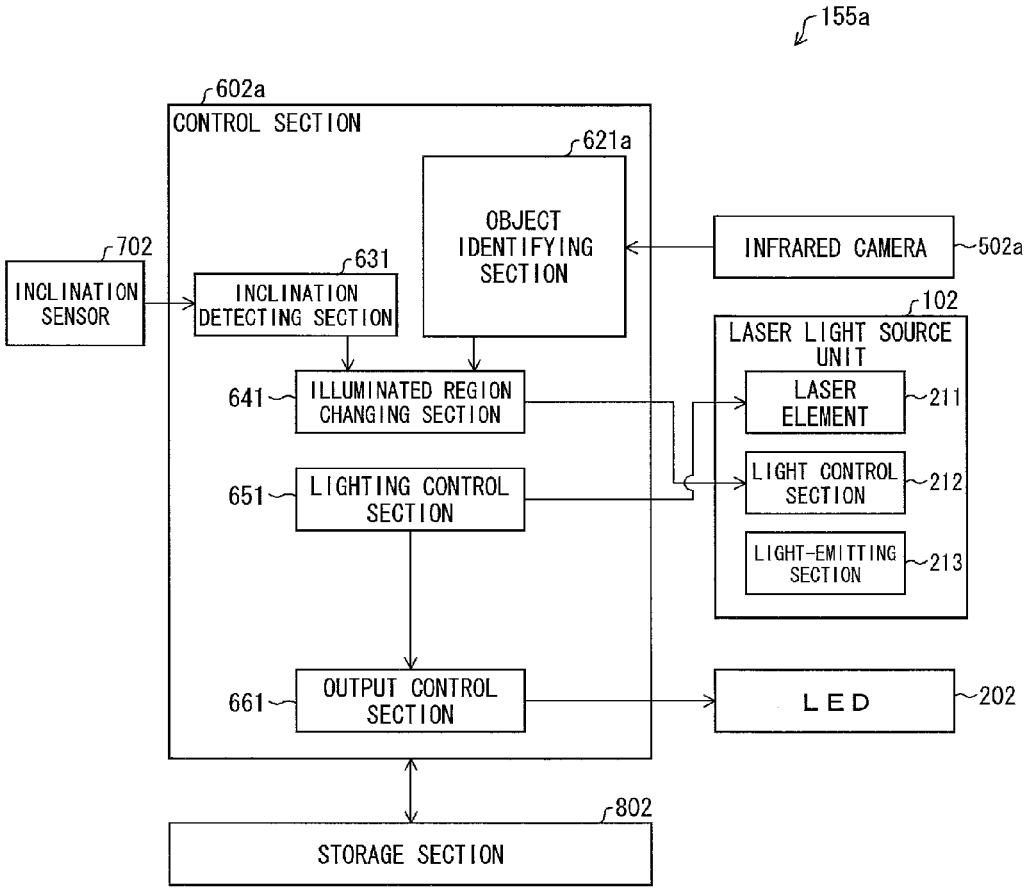
FIG. 59 is a block diagram schematically showing an example of a configuration of a headlamp according to still another modification of the headlamp.

Next, a headlamp 155*a* is described which is a modification 14 of the headlamp 155. FIG. 59 is a block diagram schematically showing an example of a configuration of the headlamp 155*a*, which is a modification of the headlamp 155. As shown in FIG. 59, the headlamp 155*a* (lighting device, vehicle headlight) includes an infrared camera 502 (sensing means) instead of the camera 502, and includes a control section 602*a* instead of the control section 602.

<Infrared Camera 502*a* and Object Identifying Section 621*a*>

The infrared camera 502*a* and the object identifying section 621*a* have functions that are similar to those of the infrared camera 501*a* and the object identifying section 620*a* described in Embodiment 2, and as such, are not described in detail in the present embodiment.

By including the object identifying section 621*a*, the headlamp 155*a*, as with the headlamp 155, allows a first range of floodlighting a1 of a desired size to be formed in a desired position by the illuminated region changing section 641 changing the position or angle of each reflection mirror 212*a* to change illuminated regions which are formed on the light-emitting section 213, in order that the object is included or not included.

[Modification 15]

Figure 60:
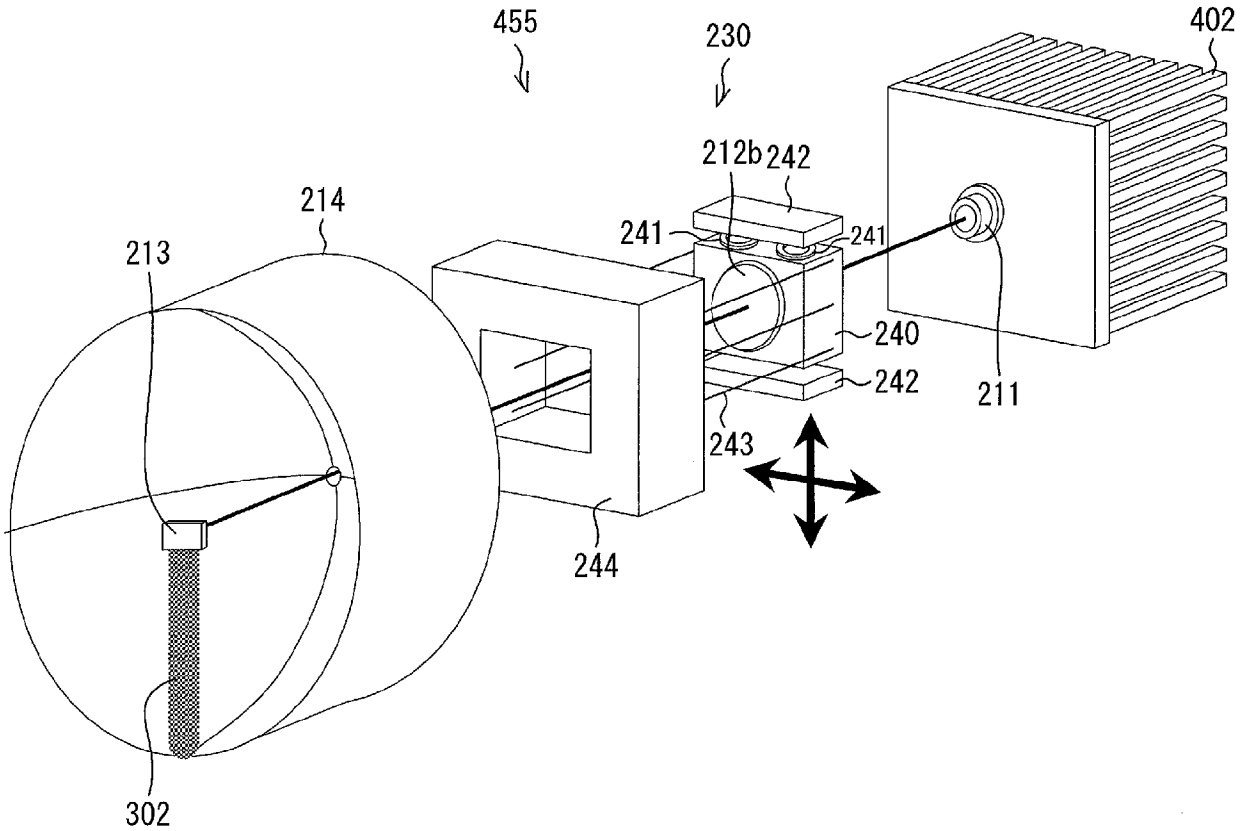
FIG. 60 is a diagram showing still another modification of the headlamp.

Next, a headlamp 455 (lighting device, vehicle headlight) is described which is a modification 15 of the headlamp 155. FIG. 60 is a diagram showing a further modification of the headlamp 155.

It should be noted that although FIG. 60 omits to illustrate the LED 202 of the headlamp 455, the LED 202 is located in a position that is similar to that in which the LED 202 of the headlamp 155 is located (i.e., near the second focal point of the reflector 214). As for the position in which the LED 202 is located, the same applies to the subsequent modifications. Further, although the following description is given by taking, as an example, a case where the number of laser elements 211 is 1, a plurality of laser elements 211 may be attached to the fin 402. Furthermore, the following description omits to illustrate the heat radiating base 302 or, even if it illustrates the head radiating base 302, illustrates it in a simplified manner. In actuality, the heat radiating base 302 is identical in shape to the heat radiating base 302 shown in FIG. 52.

As illustrated in the drawing, the headlamp 455 includes a movement control section 230. The movement control section 230, which functions as an actuator, includes a lens frame body 240, a coil(s) 241, a magnet(s) 242, a suspension wire 243, and a wire supporting housing 244. The lens frame body 240, the coil(s) 241, the magnet(s) 242, the suspension wire 243, and the wire supporting housing 244 have functions that are similar to those of the lens frame body 40, the coil(s) 41, the magnet(s) 42, the suspension wire 43, and the wire supporting housing 44 described in Embodiment 1, and as such, are not described in detail in the present embodiment.

In the present embodiment, the illuminated region changing section 641 changes the position or angle of the lens 212*b* by controlling the operation of the movement control section 230 by controlling the level and direction of an electric current flowing through the coil(s) 241.

[Modification 16]

Figure 61:
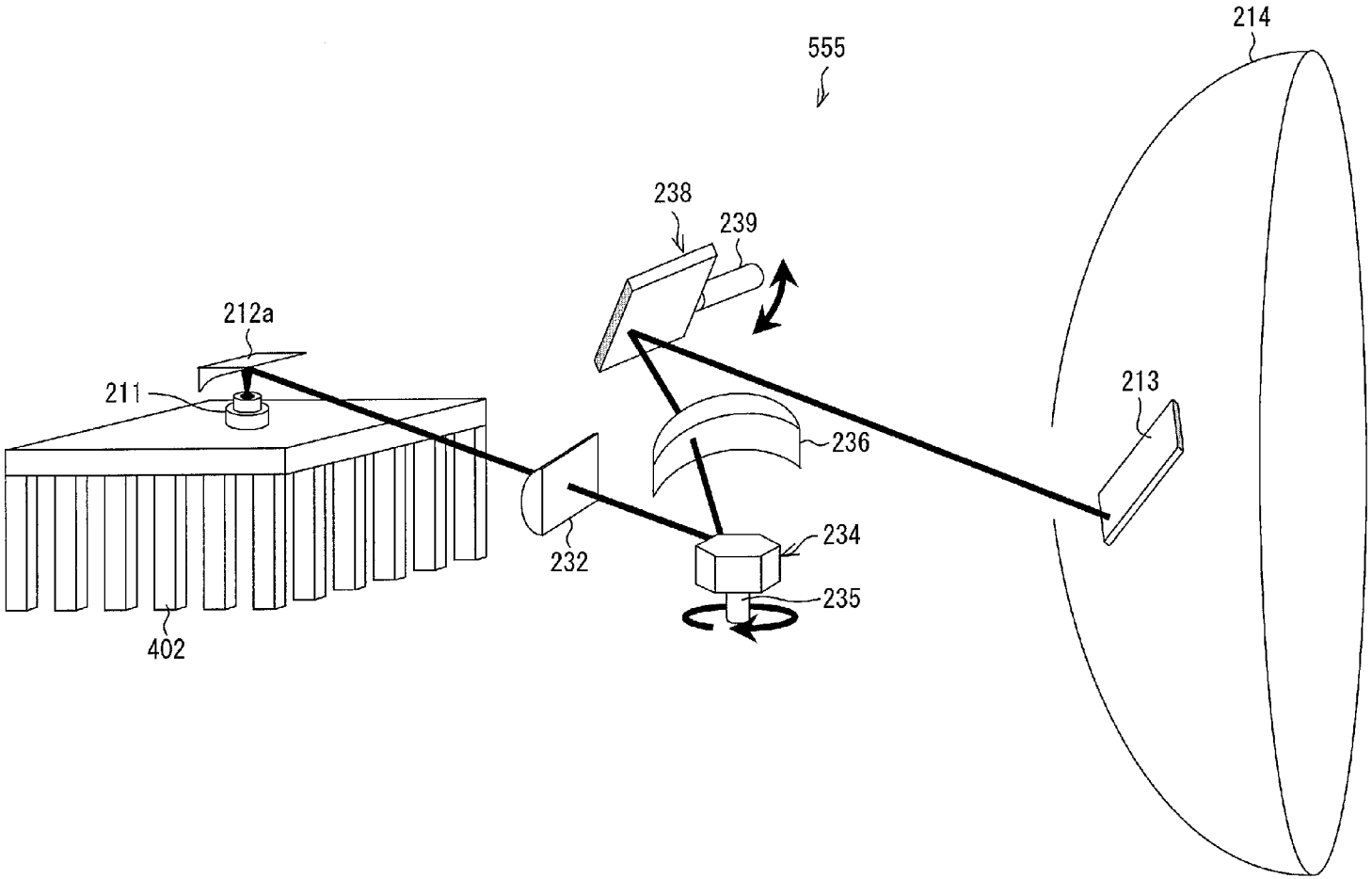
FIG. 61 is a diagram showing still another modification of the headlamp.

Next, a headlamp 555 (lighting device, vehicle headlight) is described which is a modification 16 of the headlamp 155. FIG. 61 is a diagram showing a further modification of the headlamp 155.

As illustrated in the drawing, the headlamp 555 includes a laser element 211, a light-emitting section 213, a reflector 214, and a fin 402. Furthermore, the headlamp 555 includes a cylindrical lens 232, a polygon mirror (light control section) 234, a polygon mirror driving section (movement control section) 235, a scanning lens 236, a galvanometer mirror (light control section) 238, a galvanometer mirror driving section (movement control section) 239. The illuminated region changing section 641 changes the position or angle of the polygon mirror 234 and the position or angle of the galvanometer mirror 238 by controlling how the polygon mirror driving section 235 and the galvanometer mirror driving section 239 perform the after-mentioned driving.

The reflection mirror 212*a* collimates a laser beam emitted from a laser beam emission end of the laser element 211, and redirects that collimated light toward the cylindrical lens 232 by reflection. The movement of the reflection mirror 212*a* may be controlled by an actuator or the like (not illustrated) under the control of the illuminated region changing section 641.

The cylindrical lens 232 changes, in only a single direction, magnification of a laser beam reflected by the reflection mirror 212*a*, and directs that laser beam toward the polygon mirror 234. The polygon mirror 234, the polygon mirror driving section 235, the scanning lens 236, the galvanometer mirror 238, and the galvanometer mirror driving section 239 have functions that are similar to those of the polygon mirror 34, the polygon mirror driving section 35, the scanning lens 36, the galvanometer mirror 38, and the galvanometer mirror driving section 39 described in Embodiment 1, and as such, are not described in detail in the present embodiment.

In the present embodiment, the headlamp 555 uses the polygon mirror driving section 235 and the galvanometer mirror driving section 239 to cause the polygon mirror 234 and the galvanometer mirror 238, respectively, to move to change in any manner an illumination position and a spot size of a laser beam in the light-emitting section 213.

The reflection mirror 212*a*, the polygon mirror 234, and the galvanometer mirror 238 are each provided with an HR coating made from a dielectric multilayer film. Further, the cylindrical lens 232 and the scanning lens 236 are each provided with an AR (anti-reflective) coating made from a dielectric multilayer film. The AR coating and HR coating are each tuned to the wavelength of light that is emitted by the laser element 211.

The reason for providing the AR coating and the HR coating was explained in Embodiment 1, and therefore omitted here.

[Modification 17]

Figure 62:
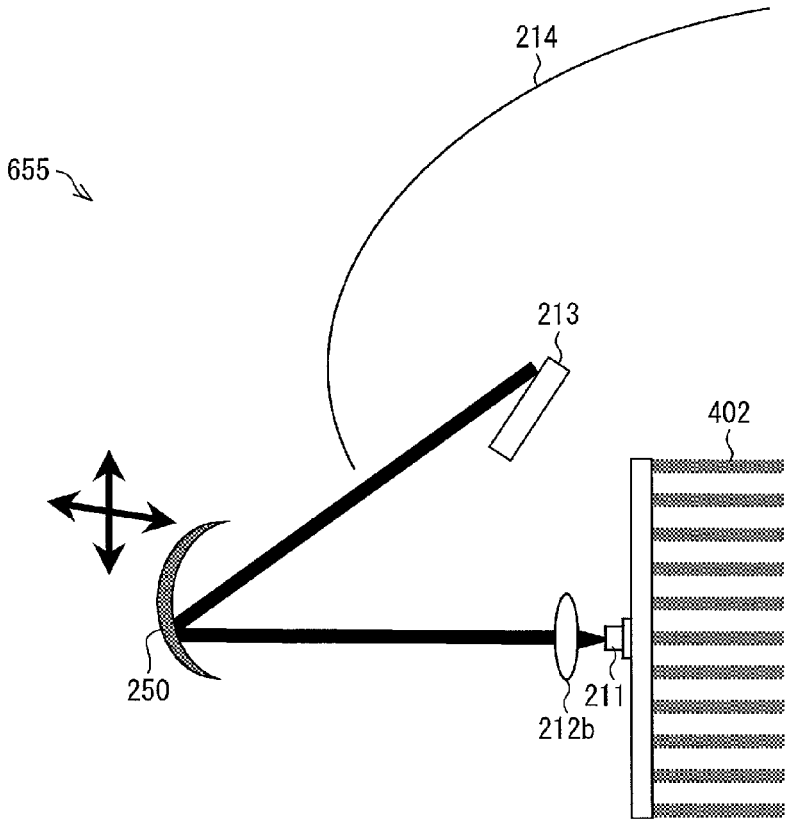
FIG. 62 is a diagram showing still another modification of the headlamp.

Next, a headlamp 655 (lighting device, vehicle headlight) is described which is a modification 17 of the headlamp 155. FIG. 62 is a diagram showing a further modification of the headlamp 155.

The headlamp 655 includes a laser element 211, a light-emitting section 213, a reflector 214, a fin 402, and a lens 212*b*. Furthermore, the headlamp 655 includes an actuator (movement control section, not illustrated) and a concave mirror (light control section) 250 that is driven by the actuator. The illuminated region changing section 641 changes the position or angle of the concave mirror 250 by controlling the operation of the actuator.

The headlamp 655 is configured to operate as follows: The laser element 211 emits a laser beam, which travels through the lens 212*b* to fall upon the concave mirror 250. The concave mirror 250 then reflects the laser beam, which has fallen thereon, toward the light-emitting section 213. The concave mirror 250 is moved as such under control of the actuator. In other words, the actuator changes the position of the concave mirror 250 relative to the light-emitting section 213 to change (i) a position in the light-emitting section 213 at which position it is illuminated with a laser beam and (ii) the spot size of such a laser beam.

The headlamp 655 according to the present embodiment may alternatively differ in configuration from the headlamp 555 and the like as described above.

A vehicle floodlight such as headlamp 655 is frequently provided in front of an engine compartment. Since such an engine compartment contains various pieces of equipment and piping, a floodlight desirably has a small depth. Further, the fin 402 is desirably provided not on the engine compartment side, but in the outermost shell of the vehicle for efficient heat radiation. The headlamp 655, which includes the concave mirror 250, attains the above two desires.

Further, the headlamp 655 changes the position of a light-emitting spot of the light-emitting section 213 by using the actuator to cause the concave mirror 250 to move in a direction parallel to the principal plane of the concave mirror 250.

The concave mirror 250 may, depending on the size of the light-emitting spot of the light-emitting section 213, alternatively be replaced with a convex mirror.

The concave mirror 250 may further alternatively be replaced with a plane mirror. This configuration will, however, not allow functions similar to the above to be performed with mere use of a mechanism for causing the plane mirror to move in a direction parallel to the mirror plane. In view of this, the headlamp 655 can, in the case where it includes a plane mirror, employ a mechanism that, for instance, (i) sets a rectangular coordinate system defined by a z axis (direction normal to the mirror plane), an x axis (on the mirror plane), and a y axis (perpendicular to the x axis and z axis) and (ii) inclines the mirror plane in the x axis direction and y axis direction. Causing the plane mirror to move as such can change the position of a light-emitting spot of the light-emitting section 213.

[Modification 18]

Figure 63:
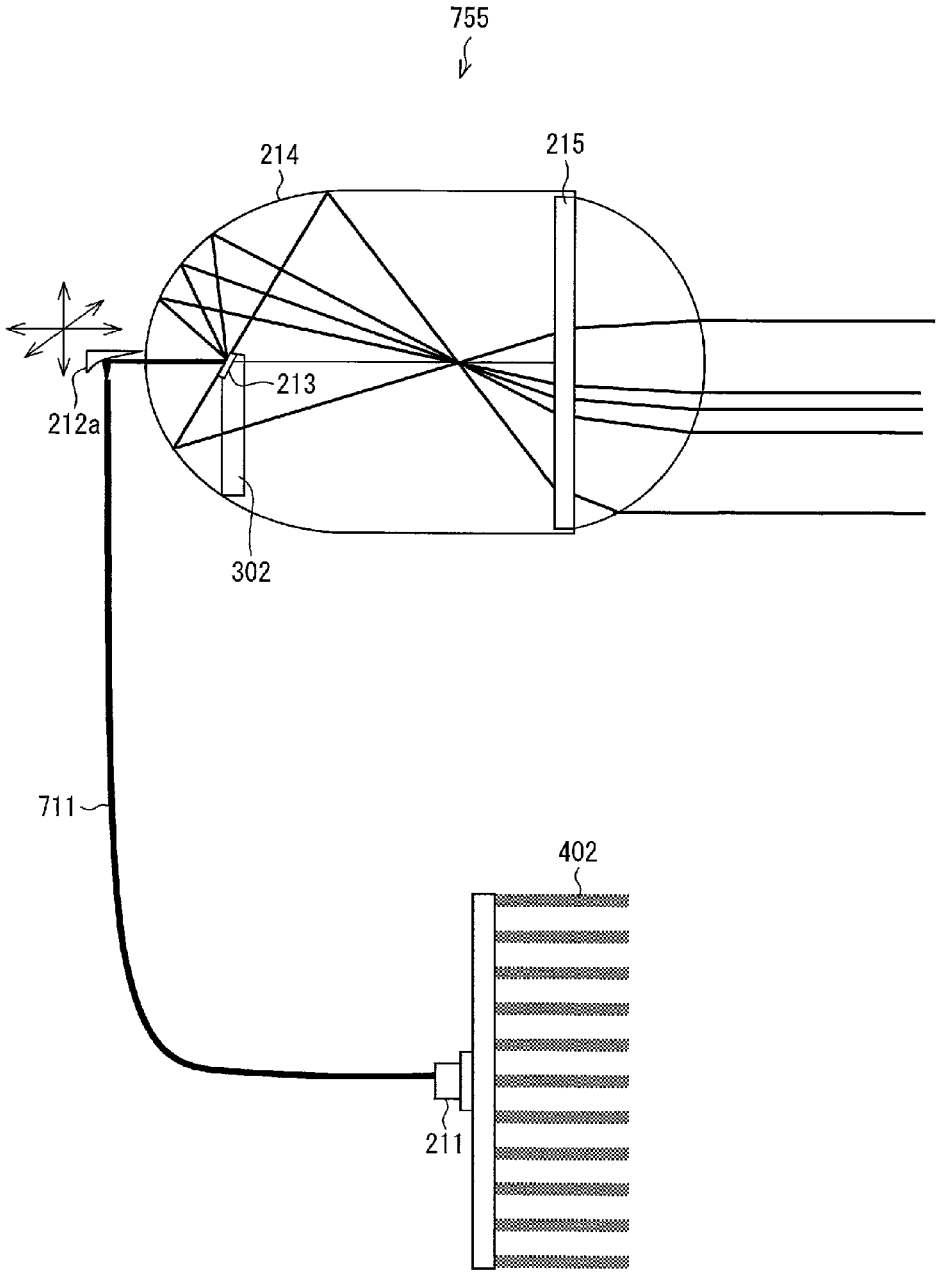
FIG. 63 is a diagram showing still another modification of the headlamp.

Next, a headlamp 755 (lighting device, vehicle headlight) is described which is a modification 18 of the headlamp 155. FIG. 63 is a diagram showing a further modification of the headlamp 155.

The headlamp 755 is identical to the headlamp 155 shown in FIG. 52 except that it causes a laser beam of the laser element 211 to enter a fiber 711, through which the laser beam is guided to a substantial focal position of the reflection mirror 212*a* (note, however, that the number of laser elements 211 in the headlamp 755 is 1). Thus, similarly to the headlamp 155, the headlamp 755 can change in any manner an illumination position and a spot size of a laser beam in the light-emitting section 213.

The headlamp 755, which includes the fiber 711, can reduce space necessary behind the headlamp 755.

The headlamp 755, which includes the fiber 711, allows the fin 402 to be provided as appropriate at such a position as to facilitate heat radiation. This configuration improves long-term reliability of the system.

The headlamp 755 causes a laser beam to enter the fiber 711 through a butt join. The present example is, however, not limited to such a configuration. The headlamp 755 may as appropriate use a lens or a mirror so as to cause a laser beam to enter the fiber 711.

The fiber 711 has a numerical aperture (NA) of 0.18 at both an entry end and an emission end. The NA of the light-emitting section 213 may be different from that of the entry end to maintain efficiency in coupling laser beams and reduce an excitation area of a light source section. In such a case, the NA of the light-emitting section 213 is greater than that of the entry end.

The reflection mirror 212*a* may alternatively be replaced with a lens. This configuration, however, requires the fiber 711 to extend behind the headlamp 755 considerably, and thus occupies space behind the headlamp 755.

[Modification 19]

Figure 64:
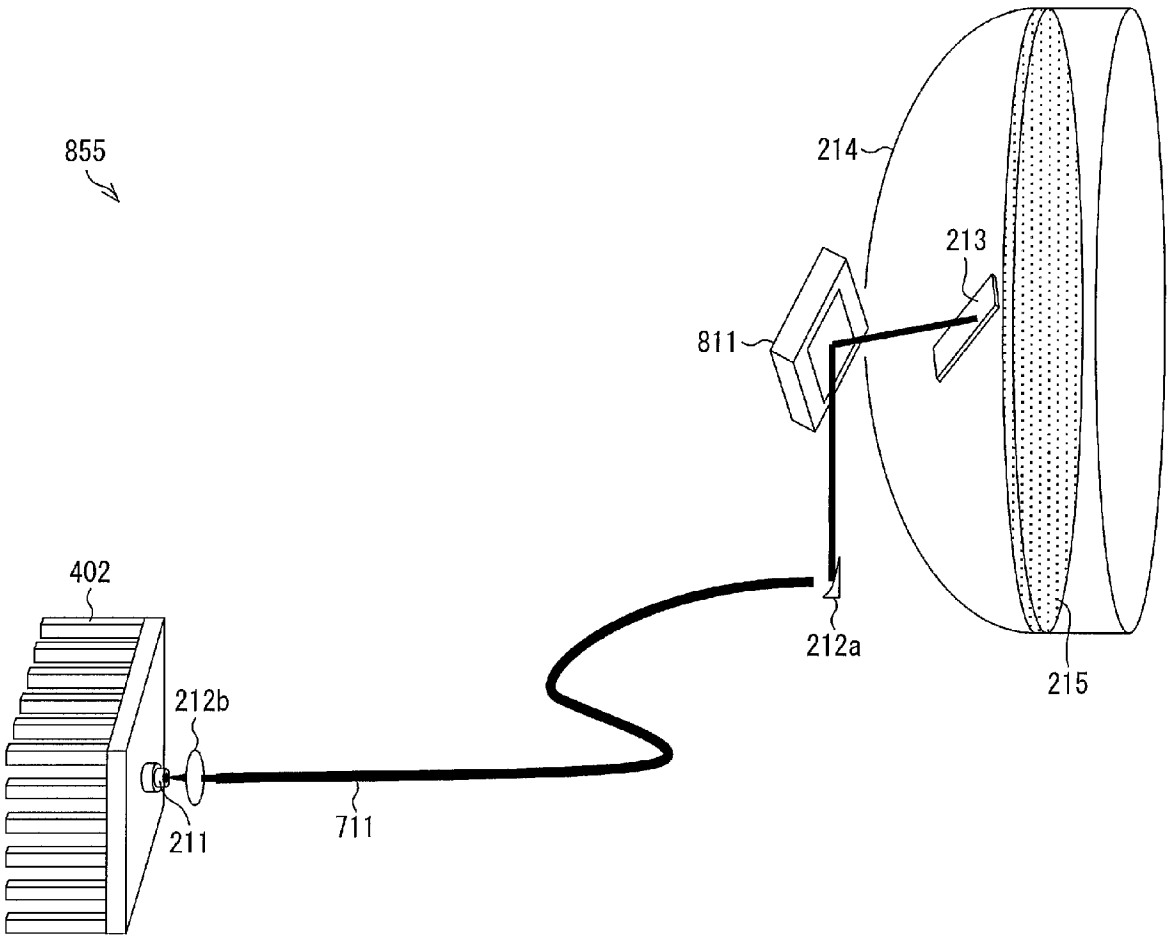
FIG. 64 is a diagram showing still another modification of the headlamp.

Next, a headlamp 855 (lighting device, vehicle headlight) is described which is a modification 19 of the headlamp 155. FIG. 64 is a diagram showing a further modification of the headlamp 155.

As illustrated in the drawing, the headlamp 855 includes a MEMS (Micro Electro Mechanical System) mirror 811. In the headlamp 855, a laser beam emitted from the fiber 711 via the entry end is reflected by the reflection mirror 212*a* to be guided to the MEMS mirror 811. Then, the MEMS mirror 811 controls the guidance of the laser beam to the light-emitting section 213. In this respect, the headlamp 855 differs from the headlamp 755 shown in FIG. 63.

The fiber 711 may be (i) a single-mode fiber or (ii) a multimode fiber, of which the core for transmitting light is thick. The fiber 711 may be made of not only quartz but also plastic. The fiber 711, in such a case, is inexpensive and high in bend strength. The fiber 711 may be connected to the lens 212*b* by a butt joint.

Figure 65:
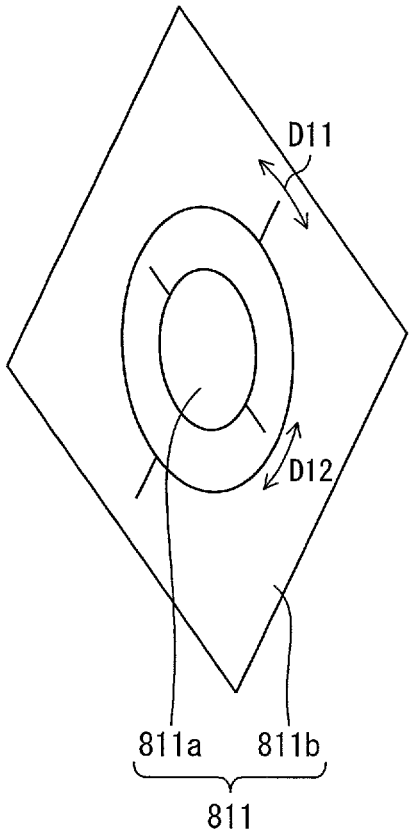
FIG. 65 is a schematic view explaining a MEMS mirror.

The laser element 211 emits a laser beam, which travels through the lens 212*b* and the fiber 711 and is reflected by the reflection mirror 212*a* to fall upon the MEMS mirror 811. The MEMS mirror 811 is a minute electron mirror including fine parts formed by integrating machine parts with electron circuits. The MEMS mirror 811 is provided between (i) the laser element 211 and (ii) a region outside the reflector 214 which region is located on the side opposite from the opening of the reflector 214. The description below deals with the MEMS mirror 811 with reference to FIG. 65. FIG. 65 is a schematic view explaining the MEMS mirror 811.

The MEMS mirror 811(light control section, movement control section) includes a mirror section (light control section) 811*a* and a mirror driving section (movement control section) 811*b*. The mirror section 811*a* is provided as surrounded by the mirror driving section 811*b*. The mirror section 811*a* is exemplified by, but is not limited to, a circular biaxial mirror having a diameter of 1 mm Φ. The mirror section 811*a* may have a mirror plane provided with a coating such as an Al coating.

The mirror driving section 811*b* is, for example, configured as follows, but is not limited to such a configuration: The mirror driving section 811*b* is substantially square with a side of 5 mm, and surrounds the mirror section 811*a*. The mirror driving section 811*b* changes its angle in response to a voltage change along a direction D11 (that is, an X axis direction perpendicular to the gravitational direction) and/or a direction D12 (that is, a Y axis direction defined as the gravitational direction). The mirror driving section 811*b*, by means of the angle change, moves the mirror section 811*a* provided on the mirror driving section 811*b*. Moving the mirror section 811*a* as such consequently changes the illumination position and spot size of a laser beam that is emitted by the light-emitting section 213 after being reflected by the mirror section 811*a*. This configuration allows the headlamp 855 to emit light to any position and change the light-distribution pattern. That is, according to the headlamp 855, the illuminated region changing section 641 changes a position or an angle of the mirror section 811*a* by controlling the above movement of the mirror driving section 811*b*.

The MEMS mirror 811 is preferably set to have a drive range along the Y axis direction which range is longer than a drive range along the X axis direction. This configuration is particularly effective in the case where the headlamp 855 has a horizontally long range of floodlighting. The drive ranges of the MEMS mirror 811 may, however, be changed as appropriate in accordance with its range of floodlighting. For example, in the case where the headlamp 855 has a longitudinally long range of floodlighting, the MEMS mirror 811 is set to have a drive range along the X axis direction which range is longer than a drive range along the Y axis direction.

In the case where the headlamp 855 forms a floodlighting pattern by continuously performing scanning with use of a laser beam and synchronizing the intensity of the laser beam with the scanning rate (scanning speed), the MEMS mirror 811 is desirably a resonance-type MEMS mirror, which can increase its scanning rate. The MEMS mirror 811 is desirably of a resonance type in the case where, for instance, the headlamp 855 performs scanning at a vertical scanning rate of 60 Hz and synchronizes the intensity of a laser beam with the scanning rate to form, in the light-emitting section 213, a light-emitting pattern that can serve as a floodlighting pattern for a passing lamp.

In the case where the present system is used to change the floodlighting position of spot light or continuously light a target object (for example, a deer as a risk factor), the MEMS mirror 811 is desirably a MEMS of a non-resonance type because continuously lighting a target object increases illuminance for such a target object (at a given laser output).

In the present modification, a laser beam emitted from the fiber 711 via the entry end is reflected by the reflection mirror 212*a* to be guided to the MEMS mirror 811. The reflection mirror 212*a* may be eliminated so that the light beam is guided directly to the MEMS mirror 811, or may be replaced by a lens so that the light beam is guided by using the lens.

[Modification 20]

Figure 66:
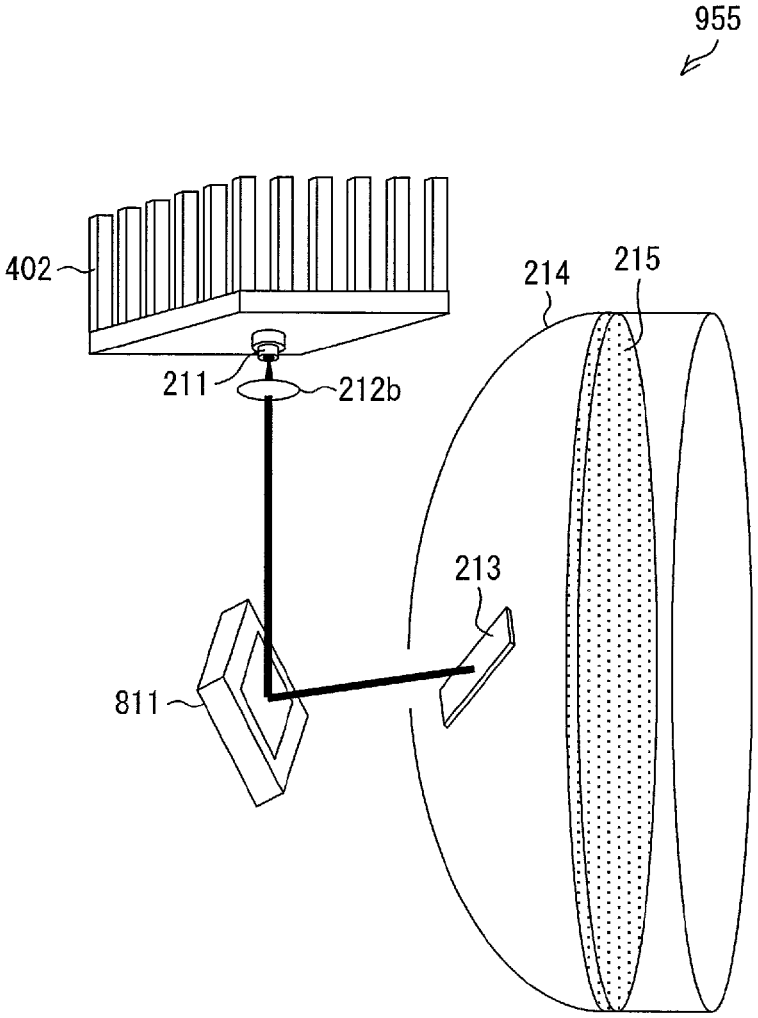
FIG. 66 is a diagram showing still another modification of the headlamp.

Next, a headlamp 955 (lighting device, vehicle headlight) is described which is a modification 20 of the headlamp 155. FIG. 66 is a diagram showing a further modification of the headlamp 155.

As illustrated in the drawing, the headlamp 955 includes a laser element 211, a light-emitting section 213, a reflector 214 having a cut coating 215, a fin 402, a lens 212*b*, and a MEMS mirror 811.

The headlamp 955 differs from the headlamp 855 shown FIG. 64 in that it includes neither the fiber 711 nor the reflection mirror 212*a*, both of which included in the headlamp 855. With this configuration, the laser element 211 emits a laser beam, which travels through the lens 212*b*, falls upon the MEMS mirror 811 to be reflected thereby, and then arrives at the light-emitting section 213. The headlamp 955, during this operation, moves the above-described MEMS mirror 811 to emit light to any position and change the light-distribution pattern.

As described above, the headlamp 955 can, without using the fiber 711 or the reflection mirror 212*a*, bring about effects similar to those brought about by the headlamp 855. The headlamp 955 includes fewer parts than the headlamp 855, which in turn increases the degree of freedom in designing the layout inside the headlamp 955.

[Modification 21]

Figure 67:
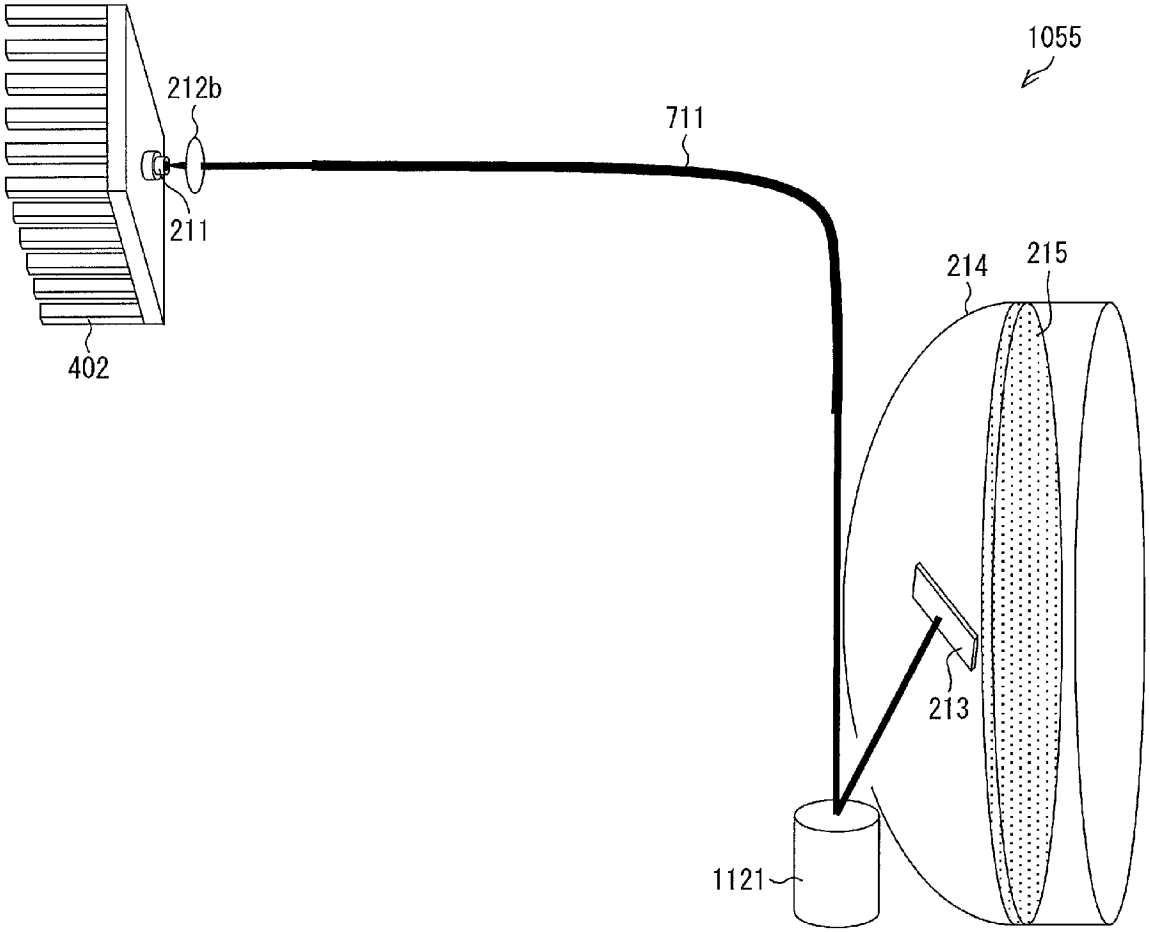
FIG. 67 is a diagram showing still another modification of the headlamp.

Next, a headlamp 1055 (lighting device, vehicle headlight) is described which is a modification 21 of the headlamp 155. FIG. 67 is a diagram showing a further modification of the headlamp 155.

As illustrated in the drawing, the headlamp 1055 differs from the headlamp 855 in that the headlamp 1055 includes a piezo mirror element (light control section) 1121 instead of including the reflection mirror 212*a* and the MEMS (Micro Electro Mechanical System) mirror 811 as shown in FIG. 64.

The headlamp 1055 is configured as follows: The laser element 211 emits a laser beam, which travels through the lens 212*b* and the fiber 711 to fall upon the piezo mirror element 1121. The laser beam is then reflected by the piezo mirror element 1121 to arrive at the light-emitting section 213.

The piezo mirror element 1121 has a function that is similar to that of the piezo mirror element 1021 described with reference to FIG. 27 in Embodiment 1, and as such, are not described in detail below.

In the headlamp 1055, the illuminated region changing section 641 changes the position or angle of the mirror plane of a mirror 1022 of the piezo mirror element 1211 by controlling the operation of the piezo mirror driving section.

[Modification 22]

Figure 68:
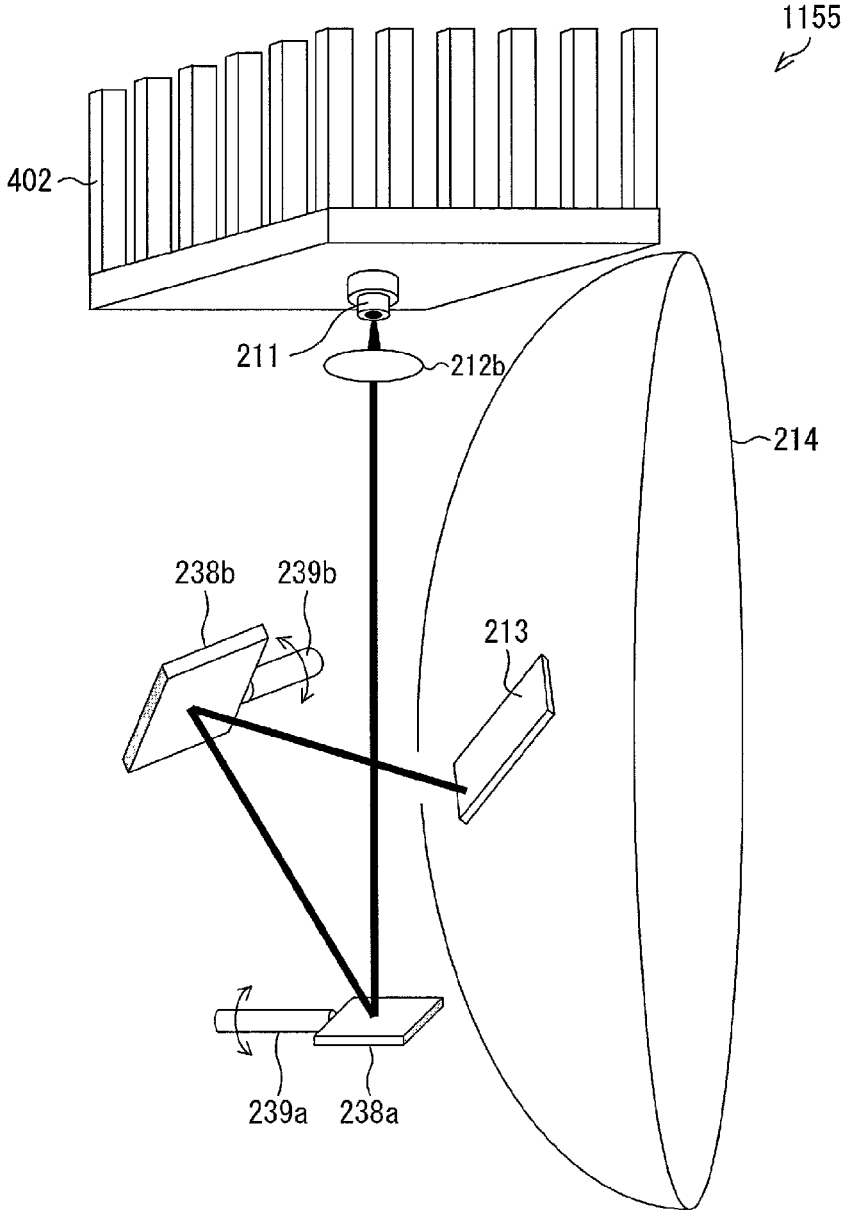
FIG. 68 is a diagram showing still another modification of the headlamp.

Next, a headlamp 1155 (lighting device, vehicle headlight) is described which is a modification 22 of the headlamp 155. FIG. 68 is a diagram showing a further modification of the headlamp 155.

As illustrated in the drawing, the headlamp 155 includes a laser element 211, a light-emitting section 213, a reflector 214, a fin 402, and a lens 212*b*. Furthermore, the headlamp 1155 includes a galvanometer mirror 238*a* for an X axis, a galvanometer mirror driving section 239*a*, a galvanometer mirror 238*b* for a Y axis, and a galvanometer mirror driving section 239*b*. The illuminated region changing section 641 changes the position or angle of each of the polygon mirrors 238*a* and 238*b* by controlling how the galvanometer mirror driving sections 239*a* and 239*b* perform the after-mentioned driving.

The galvanometer mirror 238*a*, the galvanometer mirror driving section 239*a*, the galvanometer mirror 238*b*, and the galvanometer mirror driving section 239*b* have functions that are similar to those of the galvanometer mirror 38*a*, the galvanometer mirror driving section 39*a*, the galvanometer mirror 38*b*, the galvanometer mirror driving section 39*b* described in Embodiment 1, and as such, are not described in detail in present embodiment.

[Modification 23]

Figure 69:
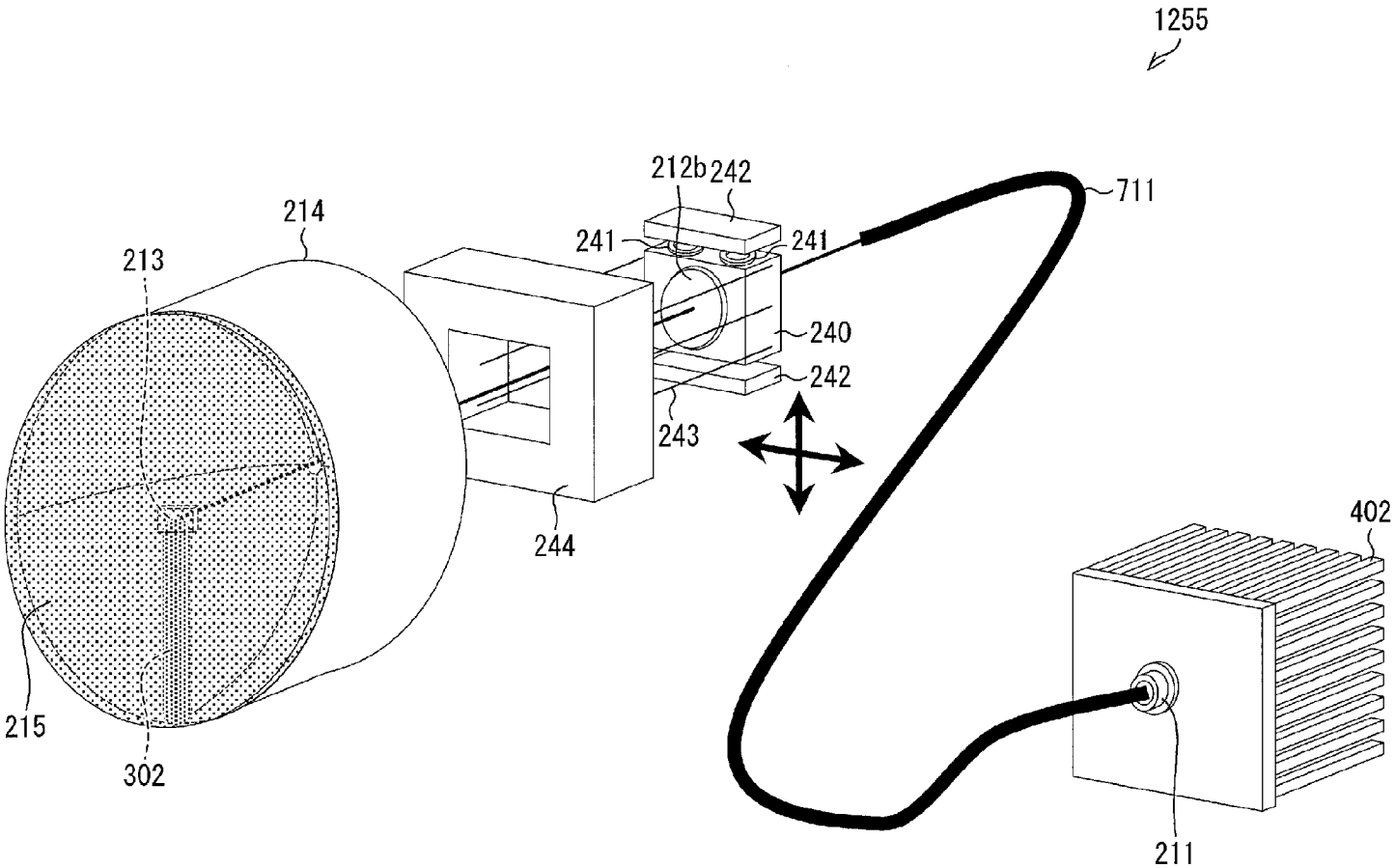
FIG. 69 is a diagram showing still another modification of the headlamp.

Next, a headlamp 1255 (lighting device, vehicle headlight) is described which is a modification 22 of the headlamp 155. FIG. 69 is a diagram showing a further modification of the headlamp 155.

The headlamp 1255 is identical in configuration to the headlamp 455 shown FIG. 60 except that the laser element 211 of the headlamp 1255 emits a laser beam, which is guided through a fiber 711 to a lens 212*b* fitted in a lens frame body 240. The fiber 711 may be connected to the laser element 211 by a butt joint. The reflector 214 of the headlamp 1255 is provided with a wavelength cut coating 215. The headlamp 1255 thus blocks light within a particular wavelength range, and helps provide a user with a device that is easy on the human eye.

The description above has dealt with how the headlamp 1255 differs from the headlamp 455 shown in FIG. 1. The headlamp 1255, which has the above configuration, can bring about effects similar to those brought about by the headlamp 455. The headlamp 1255 can thus as appropriate change the route through which light is guided from the laser element 211 to the lens 212*b*. This in turn makes it possible to design the headlamp 1255 while taking its overall layout into consideration. In this respect, the headlamp 1255 brings about an effect different from those brought about by the headlamp 455.

[Summary of Embodiment 3]

A lighting device in accordance with a third embodiment of the present invention includes: a first light source including: at least one laser light source; at least one light control section; and a light-emitting section, the at least one light control section controlling a laser beam(s) emitted from the at least one laser light source to be guided to the light-emitting section, the light-emitting section emitting light in response to the laser beam(s) controlled by the at least one light control section; a second light source which emits light and differs from the first light source in principle of light emission; and changing means for changing an illuminated region by changing a position or an angle of the at least one light control section, the illuminated region being formed in the light-emitting section by the laser beam(s) emitted from the at least one laser light source, the lighting device being capable of simultaneously casting the light emitted from the first light source and the light emitted from the second light source.

According to the above configuration, since the lighting device includes the first light source and the second light source and is capable of simultaneously casting the light emitted from the first light source and the light emitted from the second light source, light emitted from respective light sources which differ in principle of light emission can be used as illuminating light in one lighting device.

Further, according to the above configuration, since the changing means changes an illuminated region which is formed in the light-emitting section by the laser beam(s) emitted from the at least one laser light source, it is possible to change a range of casting of illuminating light that is emitted from the light-emitting section.

This makes it possible to (i) use, as illuminating light, light emitted from the respective first and second light sources, (ii) emit illuminating light in a range of floodlighting having a desired area, and (iii) control light-distribution characteristics and a light intensity distribution of the illuminating light.

Further, according to the above configuration, the first light source includes the at least one light control section that controls the laser beam(s) emitted from the at least one laser light source to be guided to the light-emitting section, and the changing means changes the illuminated region by changing the position or the angle of the at least one light control section, the illuminated region being formed in the light-emitting section by the laser beam(s). This makes it possible to change the illuminated region in immediate response to the change in position or angle of the at least one light control section. Therefore, it is possible to control light-distribution characteristics of illuminating light which is highly responsive to the change in position or angle of the at least one light control section.

Further, since the laser light sources can control the light-distribution characteristics, it is unnecessary to create an advanced optical design (e.g., a lens cut or a mirror cut) so as to satisfy light distribution in a stipulated range of floodlighting.

The lighting device in accordance with the third embodiment of the present invention is preferably configured such that: the at least one laser light source of the first light source includes a plurality of laser light sources; and the at least one light control section includes light control sections which are provided so as to correspond to the respective plurality of laser light sources.

According to the above configuration, the light control sections which are provided so as to correspond to the respective plurality of laser light sources control laser beams that are emitted from the respective plurality of laser light sources. This makes it possible to more finely control how the illuminated region is formed, thus making it possible to more finely control how the range of floodlighting is formed by illuminating light emitted from the light-emitting section.

The lighting device in accordance with the third embodiment of the present invention is preferably configured to further include first output control means for controlling an output(s) of the at least one laser light source.

According to the above configuration, in a case where the first output control means controls the output(s) of the at least one laser light source, an intensity of a laser beam that is shone on the light-emitting section is controlled, so that an intensity of light that is emitted by the light-emitting section can be controlled, too. This makes it possible not only to freely change how the range of floodlighting is formed by illuminating light emitted from the light-emitting section, but also to more freely change the range of floodlighting since the intensity of the light can also be freely controlled.

The lighting device in accordance with the third embodiment of the present invention is preferably configured such that the changing means changes a position of the illuminated region with respect to the light-emitting section.

According to the configuration, it is possible to freely control a position of a range of floodlighting which is formed by illuminating light emitted from the light-emitting section.

The lighting device in accordance with the third embodiment of the present invention is preferably configured such that: the at least one laser light source of the first light source includes a plurality of laser light sources; and illuminated regions which are formed by respective laser beams emitted from the plurality of laser light sources are changed by the changing means so as to partially overlap with each other.

According to the above configuration, the illuminated regions are changed by the changing means so as to partially overlap with each other. This allows ranges of floodlighting which are formed to correspond to the respective illuminated regions to overlap with each other. Therefore, it is possible to smooth the illuminated regions which are formed by illuminating light emitted from the light-emitting section.

The lighting device in accordance with the third embodiment of the present invention is preferably configured such that the second light source emits illuminating light so as to satisfy a minimum illuminance stipulated in the lighting device.

According to the above configuration, since the second light source emits illuminating light so as to satisfy a minimum illuminance stipulated in the lighting device, the minimum illuminance can be secured by only the second light source even in a case where the first light source is off. Namely, it can be assumed that illuminating light which is emitted from the second light source is a basic light distribution of the lighting device in accordance with the second embodiment of the present invention.

The lighting device in accordance with the third embodiment of the present invention is preferably configured such that the changing means changes the illuminated region so that a first range of floodlighting that is formed by illuminating light emitted from the first light source is formed in a peripheral part of or outside a second range of floodlighting that is formed by illuminating light emitted from the second light source.

According to the above configuration, since a first range of floodlighting can be formed in a peripheral part of or outside a second range of floodlighting, a range which is hard to make visible with illuminating light emitted from the second light source can be supplementarily illuminated by illuminating light emitted from the light-emitting section.

The lighting device in accordance with the third embodiment of the present invention is preferably configured such that the changing means changes the illuminated region so that a first range of floodlighting that is formed by illuminating light emitted from the first light source is formed in a part of a second range of floodlighting that is formed by illuminating light emitted from the second light source.

According to the above configuration, since a first range of floodlighting can be formed in a part of a second range of floodlighting, a hardly visible range in the second range of floodlighting can be supplementarily illuminated by illuminating light emitted from the light-emitting section.

The lighting device in accordance with the third embodiment of the present invention is preferably configured such that: the at least one laser light source of the first light source includes a plurality of laser light sources; and a plurality of illuminated regions are simultaneously formed in the light-emitting section by respective laser beams emitted from the plurality of laser light sources.

According to the above configuration, a plurality of ranges of floodlighting can be simultaneously formed by the illuminating light emitted from the light-emitting section. This makes it possible to simultaneously floodlight a plurality of areas in front of the lighting device.

The lighting device in accordance with the third embodiment of the present invention is preferably configured to further include: second output control means for controlling an output of illuminating light from the second light source, the second output control means controlling the output of the illuminating light from the second light source in accordance with a state of an output of illuminating light from the first light source.

According to the above configuration, since the lighting device includes the second output control means, it is possible to perform output control on the second light source in accordance with the state of the output of illuminating light from the first light source. This makes it possible to (i) reduce electric power consumption and (ii) utilize the second light source to backup the ray of light emitted from the first light source.

The lighting device in accordance with the third embodiment of the present invention is preferably configured to further include: a floodlighting section which performs floodlighting with illuminating light emitted from at least one of the first light source and the second light source, the floodlighting section being an ellipse mirror, the light-emitting section being provided at a first focal point of the floodlighting section, and the second light source being provided at a second focal point of the floodlighting section.

According to the above configuration, the light-emitting section is provided at the first focal point of the floodlighting section which is an ellipse mirror, and the second light source is provided at the second focal point of the floodlighting section. Therefore, one floodlighting section can individually cast rays of illuminating light which have been emitted from the light-emitting section and the second light source, respectively. This allows the lighting device to be smaller.

Note that light emitted from the light-emitting section provided at the first focal point forms a bundle of rays which are substantially parallel, so as to be cast in front of the floodlighting section by the floodlighting section. This makes it possible to efficiently cast the light from the light-emitting section in a solid angle. This allows light to be used with higher efficiency.

The lighting device in accordance with the third embodiment of the present invention is preferably configured such that: the second light source is a light-emitting diode which emits white light as the illuminating light; and the light-emitting section functions as a part of the second light source.

According to the above configuration, it is possible to integrally configure the light-emitting section and the second light source. This allows a reduction in number of parts of the lighting device, so that the lighting device can be more simply configured.

A vehicle headlight in accordance with the third embodiment of the present invention includes a lighting device mentioned above.

According to the above configuration, as in the case of the lighting device, it is possible to (i) use, as illuminating light, light emitted from the respective first and second light sources, (ii) emit illuminating light in a range of floodlighting having a desired area, and (iii) control light-distribution characteristics and a light intensity distribution of the illuminating light. It is also possible to control light-distribution characteristics of illuminating light which is highly responsive to the change in position or angle of the at least one light control section.

The vehicle headlight in accordance with the third embodiment of the present invention is preferably configured to further include: sensing means for sensing an object, when the sensing means senses the object, the changing means changing the illuminated region with respect to the light-emitting section so that the object is included.

The above configuration allows a range of floodlighting that is formed by illuminating light emitted from the light-emitting section to include the object sensed by the sensing means. This securely allows, for example, a driver of a vehicle provided with a vehicle headlight to visually recognize the object.

The vehicle headlight in accordance with the third embodiment of the present invention is preferably configured to further include: sensing means for sensing an object, when the sensing means senses the object, the changing means changing the illuminated region with respect to the light-emitting section so that the object is not included.

The above configuration can prevent a range of floodlighting that is formed by illuminating light emitted from the light-emitting section from including the object sensed by the sensing means. In particular, in a case where the object is an oncoming vehicle, a preceding vehicle, or the like and a driver of that vehicle receives light emitted from the vehicle headlight of the present invention, the driver may have a problem with driving. According to the above configuration, it is possible to reduce unpleasant glare and dazzle that, for example, the driver experiences, thus making it possible to achieve a safe and comfortable traffic environment.

The vehicle headlight in accordance with the present invention is preferably configured to further include: identifying means for identifying, by image recognition, a kind of the object which has been sensed by the sensing means, the changing means changing the illuminated region when the kind of the object which kind has been identified by the identifying means matches a preregistered kind of the object.

According to the above configuration, since the vehicle headlight includes the identifying means for identifying, by image recognition, a kind of the object which has been sensed by the sensing means, it is possible to change optimum illuminated regions in accordance with the kind of the object which kind has been identified by the identifying means. Therefore, it is possible to change a range of floodlighting that is formed by light emitted from the light-emitting section.

The vehicle headlight in accordance with the third embodiment of the present invention is preferably configured such that: the sensing means senses infrared radiation energy which is radiated from the object; the vehicle headlight further includes identifying means for identifying a kind of the object by generating a temperature distribution image in accordance with the infrared radiation energy which has been sensed by the sensing means; and the changing means changes the illuminated region when the kind of the object which kind has been identified by the identifying means matches a preregistered kind of the object.

According to the above configuration, the vehicle headlight includes the identifying means for identifying a kind of the object by a temperature distribution image in accordance with the infrared radiation energy which has been sensed by the sensing means. Therefore, as in the case of the identifying means for identifying, by image recognition, a kind of the object, it is possible to change optimum illuminated regions in accordance with the kind of the object.

The vehicle headlight in accordance with the third embodiment of the present invention is preferably configured such that the sensing means is a radar which radiates an infrared ray to the object and senses a reflected wave from the object.

According to the above configuration, since the sensing means is the radar, it is possible to realize highly versatile sensing means.

The vehicle headlight in accordance with the third embodiment of the present invention is preferably configured such that the changing means changes the illuminated region with respect to the light-emitting section so that either one of an illuminating light-distribution pattern stipulated in a drive-on-the-right country and an illuminating light-distribution pattern stipulated in a drive-on-the-left country is satisfied.

The above configuration allows (i) realization of light-distribution characteristics in both a drive-on-the-right country and a drive-on-the-left country, the light-distribution characteristics satisfying regulations stipulated in those countries and (ii) mounting and utilization of the vehicle headlight of the present invention on a vehicle in any country.

The vehicle headlight in accordance with the third embodiment of the present invention is preferably configured to further include: inclination detecting means for detecting an inclination of a vehicle with respect to a horizontal plane, the changing means changing the illuminated region in accordance with a result of the detection by the inclination detecting means.

According to the above configuration, the changing means changes a position of the illuminated region in accordance with a result of the detection, it is possible to change a position of a range of floodlighting that is formed by illuminating light emitted from the light-emitting section.

For example, when a vehicle passes an oncoming vehicle at, for example, a place from which an upward slope starts, it is possible to prevent the oncoming vehicle from being included in the range of floodlighting. This makes it possible to reduce unpleasant glare and dazzle that, for example, a driver of the oncoming vehicle experiences.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

The present invention, which (i) has a high color rendering property and (ii) achieves any light-distribution pattern, is applicable to a light-emitting device and a floodlight, and particularly to a headlight for a vehicle, for example.

The present invention, which can (i) use, as illuminating light, light emitted from the respective first and second light sources and (ii) control light-distribution characteristics and a light intensity distribution of the illuminating light, is applicable to a light-emitting device and a lighting device, and particularly to a headlight for a vehicle, for example.

REFERENCE SIGNS LIST

1 Light-emitting device
2 Laser element (Laser light source)
4 Light-emitting section
5 Parabolic mirror (Floodlighting section)
6 Ellipse mirror (Floodlighting section)
7 Heat radiating base
8 Fin
9 Light-emitting body supporting section
10, 12, 21 Lens (Light control section)
11 Movement control section
15 Fiber
20 Wavelength cut coating
30 Initial mirror (Light control section)
32 Cylindrical lens (Light control section)
34 Polygon mirror (Light control section)
35 Polygon mirror driving section (Movement control section)
36 Scanning lens (Light control section)
38 Galvanometer mirror (Light control section)
39 Galvanometer mirror driving section (Movement control section)
40 Lens frame body (Movement control section)
41 Coil (Movement control section)
42 Magnet (Movement control section)
43 Suspension wire (Movement control section)
44 Wire supporting housing
50 Concave mirror (Light control section)
55 Vehicle
60 Light amount adjusting section
61 Sensing section
62 Identifying section
63 Light amount control section
65 Wire
70 Camera
100, 200, 300, 400, 500, 600, 700, 800, 900, 1000, 1010, 1020, 1030, 1040 Floodlight
1001 MEMS mirror
1021 Piezo mirror element
101 Laser light source unit (First light source)
111 Laser element (Laser light source)
112 Light control section
112*a* Reflection mirror (Light control section)
112*b* Lens (Light control section)
113 Light-emitting section (First light source)
114 Reflector (Floodlighting section)
201 LED (Second light source)
501*a* Infrared camera (Sensing means)
610 Object detecting section (Sensing means)
620 Object identifying section (Identifying means)
620*a* Object identifying section (Identifying means)
630 Slope detecting section (Slope detecting means)
640 Illuminated region changing section (Changing means)
660 Output control section (Output control means)
110 Headlamp (Lighting device, Vehicle headlight)
110*a* Headlamp (Lighting device, Vehicle headlight)
210 Headlamp (Lighting device, Vehicle headlight)
310 Headlamp (Lighting device, Vehicle headlight)
410 Headlamp (Lighting device, Vehicle headlight)
102 Laser light source unit (First light source)
202 LED (Second light source)
211 Laser element (Laser light source)
212 Light control section (First light source)
212*a* Reflection mirror (Light control section, First light source)
212*b* Lens (Light control section, First light source)
213 Light-emitting section (First light source)
214 Reflector (Floodlighting section)
234 Polygon mirror (Light control section)
238 Galvanometer mirror (Light control section)
238*a* Galvanometer mirror (Light control section)
238*b* Galvanometer mirror (Light control section)
250 Concave mirror (Light control section)
502*a* Infrared camera (Sensing means)
611 Object detecting section (Sensing means)
621 Object identifying section (Identifying means)
621*a* Object identifying section (Identifying means)
631 Slope detecting section (Slope detecting means)
641 Illuminated region changing section (Changing means)
651 Lighting control section (First output control means)
661 Output control section (Second output control means)
811 MEMS mirror (Light control section)
811*a* Mirror section (Light control section)
1121 Piezo mirror element (Light control section)
155 Headlamp (lighting device, Vehicle headlight)
155*a* Headlamp (Lighting device, Vehicle headlight)
255 Headlamp (Lighting device, Vehicle headlight)
355 Headlamp (Lighting device, Vehicle headlight)
455 Headlamp (Lighting device, Vehicle headlight)
555 Headlamp (Lighting device, Vehicle headlight)
655 Headlamp (Lighting device, Vehicle headlight)
755 Headlamp (Lighting device, Vehicle headlight)
855 Headlamp (Lighting device, Vehicle headlight)
955 Headlamp (Lighting device, Vehicle headlight)
1055 Headlamp (Lighting device, Vehicle headlight)
1155 Headlamp (Lighting device, Vehicle headlight)
1255 Headlamp (Lighting device, Vehicle headlight)
a1 First range of floodlighting
a2 Second range of floodlighting

The invention claimed is:

1. A light-emitting device comprising:

a light-emitting section which emits light in response to a laser beam emitted from a laser light source;

a light control section which controls the laser beam to be guided from the laser light source to the light-emitting section; and a movement control section which causes the light control section to move, the movement control section changing an illumination position and a spot size of the laser beam in the light-emitting section by changing a relative position of the light control section with respect to the light-emitting section, wherein the light control section comprises at least two movable mirrors which have rotation axis directions different from each other so that the laser beam emitted from the laser light source is sequentially reflected by the at least two movable mirrors so as to be incident on the light-emitting section.

2. The light-emitting device as set forth in claim 1, further comprising a light amount control section which is capable of controlling an amount of the laser beam that is emitted by the laser light source.

3. The light-emitting device as set forth in claim 1, wherein the light-emitting section at least contains a fluorescent body which emits fluorescence in response to the laser beam.

4. The light-emitting device as set forth in claim 1, further comprising:

a second light source assuming that the light-emitting section is a first light source, the second light source emitting light and differing from the first light source in principle of light emission.

5. The light-emitting device as set forth in claim 1, wherein:

the light control section is at least one of a polygon mirror and a galvanometer mirror; and the movement control section is an actuator which causes at least one of the polygon mirror and the galvanometer mirror to move.

6. A light-emitting device compromising:

a light-emitting section which emits light in response to a laser beam emitted from a laser light source;

a light control section which controls the laser beam to be guided from the laser light source to the light-emitting section; and a movement control section which causes the light control section to move, the movement control section changing an illumination position and a spot size of the laser beam in the light-emitting section by changing a relative position of the light control section with respect to the light-emitting section, the light control section being a convex lens or a concave mirror, and the movement control section being an actuator which causes the convex lens or the concave mirror to move in two directions different from each other.

7. The light-emitting device as set forth in claim 1, further comprising:

a sensing section which senses an object in a floodlit region on which the light-emitting device performs floodlighting, when the sensing section senses the object, the movement control section causing the light control section to move.

8. The light-emitting device as set forth in claim 1, further comprising:

a sensing section which senses an object in a floodlit region on which the light-emitting device performs floodlighting; and an identifying section which identifies, by image recognition, a kind of the object which has been sensed by the sensing section, in accordance with the kind of the object which kind has been identified by the identifying section, the movement control section causing the light control section to move.

9. The light-emitting device as set forth in claim 1, further comprising:

a light amount control section which is capable of controlling an amount of the laser beam that is emitted by the laser light source; and a sensing section which senses an object in a floodlit region on which the light-emitting device performs floodlighting, when the sensing section senses the object, the light amount control section controlling the amount of the laser beam that is emitted by the laser light source that performs floodlighting on the floodlit region in which the object has been sensed.

10. The light-emitting device as set forth in claim 1, further comprising:

a light amount control section which is capable of controlling an amount of the laser beam that is emitted by the laser light source;

a sensing section which senses an object in a floodlit region on which the light-emitting device performs floodlighting; and an identifying section which identifies, by image recognition, a kind of the object which has been sensed by the sensing section, in accordance with the kind of the object which kind has been identified by the identifying section, the light control section controlling the amount of the laser beam that is emitted by the laser light source that performs floodlighting on the floodlit region in which the object has been sensed.

11. A floodlight comprising:

a light-emitting device recited in claim 1; and a floodlighting section which performs floodlighting with light emitted from the light-emitting section, the floodlighting section changing a range of floodlighting by movement of the light control section by the movement control section.

12. A vehicle headlight comprising:

a light-emitting section which emits light in response to a laser beam emitted from a laser light source;

a light control section which controls the laser beam to be guided from the laser light source to the light-emitting section; and a movement control section which causes the light control section to move, the movement control section changing an illumination position and a spot size of the laser beam in the light-emitting section by changing a relative position of the light control section with respect to the light-emitting section, wherein the light control section comprises at least two movable mirrors which have rotation axis directions different from each other so that the laser beam emitted from the laser light source is sequentially reflected by the at least two movable mirrors so as to be incident on the light-emitting section.

13. The vehicle headlight as set forth in claim 12, further comprising:

a light amount control section which is capable of controlling an amount of the laser beam that is emitted by the laser light source;

a sensing section which senses an object in a floodlit region on which the vehicle headlight performs floodlighting; and an identifying section which identifies, by image recognition, a kind of the object which has been sensed by the sensing section, when the identifying section identifies the object as an oncoming vehicle or a preceding vehicle, the light amount control section reducing the amount of the laser beam that is emitted by the laser light source that performs floodlighting on the floodlit region in which the oncoming vehicle or the preceding vehicle has been sensed.

14. The vehicle headlight as set forth in claim 12, further comprising:

a light amount control section which is capable of controlling an amount of the laser beam that is emitted by the laser light source;

a sensing section which senses an object in a floodlit region on which the vehicle headlight performs floodlighting; and an identifying section which identifies, by image recognition, a kind of the object which has been sensed by the sensing section, when the identifying section identifies the object as a road sign or an obstacle, the light amount control section increasing the amount of the laser beam that is emitted by the laser light source that performs floodlighting on the floodlit region in which the road sign or the obstacle has been sensed.

15. The vehicle headlight as set forth in claim 12, further comprising:

a light amount control section which is capable of controlling an amount of the laser beam that is emitted by the laser light source, in order to satisfy either one of an illuminating light-distribution pattern stipulated in a drive-on-the-right country and an illuminating light-distribution pattern stipulated in a drive-on-the-left country, the movement control section changing the illumination position with respect to the light-emitting section, and the light amount control section controlling the amount of the laser beam that is emitted by the laser light source.

16. The vehicle headlight as set forth in claim 12, further comprising:

a sensing section which senses an object in a floodlit region on which the vehicle headlight performs floodlighting; and an identifying section which identifies, by image recognition, a kind of the object which has been sensed by the sensing section, the movement control section changing the illumination position in the light-emitting section by changing the relative position of the light control section with respect to the light-emitting section when the identifying section identifies an ascending slope, thereby changing, from a forward direction to a ground direction, a range in which illuminating light is emitted from a vehicle, and the movement control section changing the illumination position in the light-emitting section by changing the relative position of the light control section with respect to the light-emitting section when the identifying section identifies a descending slope, thereby changing, from the forward direction to the direction opposite from the ground direction, the range in which the illuminating light is emitted from the vehicle.

17. The vehicle headlight as set forth in claim 12, further comprising:

a first sensing section which senses an object by sensing infrared radiation energy which is radiated from the object; and a first identifying section which identifies a kind of the object by generating a temperature distribution image in accordance with the infrared radiation energy which has been sensed by the first sensing section, or a second sensing section as a radar which radiates an infrared ray to the object and senses a reflected wave from the object; and a second identifying section which identifies, by image recognition, a kind of the object which has been sensed by the second sensing section, the movement control section changing the illumination position and the spot size of the laser beam in the light-emitting section when the kind of the object which kind has been identified by the first or second identifying section matches a preregistered kind of the object.

* * * * *